US007823513B2

(12) United States Patent
Forbes et al.

(10) Patent No.: US 7,823,513 B2
(45) Date of Patent: Nov. 2, 2010

(54) RAIL ROAD CAR TRUCK

(75) Inventors: James W. Forbes, Campbellville (CA); Jamal Hematian, Burlington (CA)

(73) Assignee: National Steel Car Limited (CA)

( * ) Notice: Subject to any disclaimer, the term of this patent is extended or adjusted under 35 U.S.C. 154(b) by 0 days.

(21) Appl. No.: 10/745,926

(22) Filed: Dec. 24, 2003

(65) Prior Publication Data

US 2005/0005815 A1 Jan. 13, 2005

Related U.S. Application Data

(63) Continuation-in-part of application No. 10/615,331, filed on Jul. 8, 2003, now abandoned.

(51) Int. Cl.
*B61F 3/00* (2006.01)

(52) U.S. Cl. ..... 105/193; 105/197.05

(58) Field of Classification Search ..... 105/157.1, 105/193, 197.05, 226, 218.1
See application file for complete search history.

(56) References Cited

U.S. PATENT DOCUMENTS

| | | | |
|---|---|---|---|
| 2,071 | A | 5/1841 | Davenport et al. |
| 26,502 | A | 12/1859 | Kipple et al. |
| 90,795 | A | 6/1869 | Thielsen |
| 378,926 | A | 3/1888 | Fish |
| 477,767 | A | 6/1892 | Miller |
| 692,086 | A | 1/1902 | Stephenson |
| 740,617 | A | 10/1903 | Bettendorf |
| 792,943 | A | 6/1905 | Stephenson |
| 895,157 | A | 8/1908 | Bush |

(Continued)

FOREIGN PATENT DOCUMENTS

| | | |
|---|---|---|
| AT | 245611 | 3/1966 |

(Continued)

OTHER PUBLICATIONS

1980 Car and Locomotive Cyclopedia, pp. 669-750. Section 13 Truck and Journal Bearings. pp. 669-682, 699-703, 706-709, 712-719, 722-726, 734-735.

(Continued)

*Primary Examiner*—S. Joseph Morano
*Assistant Examiner*—Robert J McCarry, Jr.
(74) *Attorney, Agent, or Firm*—Hahn Loeser & Parks LLP; Michael H. Minns

(57) ABSTRACT

A rail road freight car truck has a truck bolster and a pair of side frames, the truck bolster being mounted transversely relative to the side frames. The mounting interface between the ends of the axles and the sideframe pedestals allows lateral rocking motion of the sideframes in the manner of a swing motion truck. The lateral swinging motion is combined with a longitudinal self steering capability. The self steering capability may be obtained by use of a longitudinally oriented rocker that may tend to permit resistance to self steering that is proportional to the weight carried across the interface. The trucks may have auxiliary centering elements mounted in the pedestal seats, and those auxiliary centering elements may be made of resilient elastomeric material. The truck may also have friction dampers that have a disinclination to stick-slip behavior. The friction dampers may be provided with brake linings, or similar features, on the face engaging the side-frame columns, on the slope face, or both.

66 Claims, 63 Drawing Sheets

U.S. PATENT DOCUMENTS

| | | | |
|---|---|---|---|
| 931,658 | A | 8/1909 | Stephenson |
| 1,060,370 | A | 4/1913 | Shallenberger et al. |
| 1,316,553 | A | 9/1919 | Barber |
| 1,695,085 | A | 12/1928 | Cardwell |
| 1,727,715 | A | 9/1929 | Kassler |
| 1,744,277 | A | 1/1930 | Melcher |
| 1,745,321 | A | 1/1930 | Brittain, Jr. |
| 1,745,322 | A | 1/1930 | Brittain, Jr. |
| 1,823,884 | A | 9/1931 | Brittain, Jr. |
| 1,855,903 | A | 4/1932 | Brittain, Jr. |
| 1,859,265 | A | 5/1932 | Brittain, Jr. et al. |
| 1,865,220 | A | 6/1932 | Starbuck |
| 1,891,674 | A | 12/1932 | Glascodine |
| 1,902,823 | A | 3/1933 | Bender |
| 1,953,103 | A | 4/1934 | Buckwalter |
| 1,967,808 | A | 7/1934 | Buckwalter |
| 2,009,771 | A | 7/1935 | Goodwin |
| 2,053,990 | A | 9/1936 | Goodwin |
| 2,106,345 | A | 1/1938 | Frede |
| 2,129,408 | A | 9/1938 | Davidson |
| 2,132,001 | A | 10/1938 | Dean |
| 2,155,615 | A | 4/1939 | De Los Rice |
| 2,257,109 | A | 9/1941 | Davidson |
| 2,301,726 | A | 11/1942 | Kirsten |
| 2,324,267 | A | 7/1943 | Oelkers |
| 2,333,921 | A | 11/1943 | Flesch |
| 2,352,693 | A | 7/1944 | Davidson |
| 2,367,510 | A | 1/1945 | Light |
| 2,389,840 | A | 11/1945 | Bruce |
| 2,404,278 | A | 7/1946 | Dath |
| 2,408,866 | A | 10/1946 | Marquardt |
| 2,424,936 | A | 7/1947 | Light |
| 2,432,228 | A | 12/1947 | DeLano |
| 2,434,583 | A | 1/1948 | Pierce |
| 2,434,838 | A | 1/1948 | Cottrell |
| 2,446,506 | A | 8/1948 | Barrett et al. |
| 2,456,635 | A | 12/1948 | Heater |
| 2,458,210 | A | 1/1949 | Schlegel, Jr. |
| 2,573,159 | A | 3/1949 | Noe |
| 2,483,858 | A | 10/1949 | Van Der Sluys |
| 2,497,460 | A | 2/1950 | Leese |
| 2,528,473 | A | 10/1950 | Kowalik |
| 2,551,064 | A | 5/1951 | Spenner |
| 2,570,159 | A | 10/1951 | Schlegel, Jr. |
| 2,613,075 | A | 10/1952 | Barrett |
| 2,650,550 | A | 9/1953 | Pierce |
| 2,661,702 | A | 12/1953 | Kowalik |
| 2,668,505 | A | 2/1954 | Janeway |
| 2,669,943 | A | 2/1954 | Spenner |
| 2,687,100 | A | 8/1954 | Dath |
| 2,688,938 | A | 9/1954 | Kowalik |
| 2,693,152 | A | 11/1954 | Bachman |
| 2,697,989 | A | 12/1954 | Shafer |
| 2,717,558 | A | 9/1955 | Shafer |
| 2,727,472 | A | 12/1955 | Forssell |
| 2,737,907 | A | 3/1956 | Janeway |
| 2,751,856 | A | 6/1956 | Maatman |
| 2,762,317 | A | 9/1956 | Palmgren |
| 2,777,400 | A | 1/1957 | Forssell |
| 2,827,987 | A | 3/1958 | Williams |
| 2,853,958 | A | 9/1958 | Neumann |
| 2,883,944 | A | 4/1959 | Couch |
| 2,911,923 | A | 11/1959 | Bachman et al. |
| 2,913,998 | A | 11/1959 | Lich |
| 2,931,318 | A | 4/1960 | Travilla |
| 2,968,259 | A | 1/1961 | Lich |
| 3,024,743 | A | 3/1962 | Williams et al. |
| 3,026,819 | A | 3/1962 | Cope |
| 3,120,381 | A | 2/1964 | Sweeney et al. |
| 3,218,990 | A | 11/1965 | Weber |
| 3,274,955 | A | 9/1966 | Thomas |
| 3,285,197 | A | 11/1966 | Tack |
| 3,302,589 | A | 2/1967 | Williams |
| 3,352,255 | A | 11/1967 | Sheppard |
| 3,358,614 | A | 12/1967 | Barber |
| 3,381,629 | A | 5/1968 | Jones |
| 3,461,814 | A | 8/1969 | Weber et al. |
| 3,461,815 | A | 8/1969 | Gedris et al. |
| 3,517,620 | A | 6/1970 | Weber |
| 3,559,589 | A | 2/1971 | Williams |
| 3,575,117 | A | 4/1971 | Tack |
| 3,670,660 | A | 6/1972 | Weber et al. |
| 3,687,086 | A | 8/1972 | Barber |
| 3,699,897 | A | 10/1972 | Sherrick |
| 3,713,710 | A | 1/1973 | Wallace |
| 3,714,905 | A | 2/1973 | Barber |
| 3,785,298 | A | 1/1974 | Reynolds |
| 3,802,353 | A | 4/1974 | Korpics |
| 3,834,320 | A | 9/1974 | Tack |
| 3,844,226 | A | 10/1974 | Brodeur et al. |
| 3,855,942 | A | 12/1974 | Mulcahy |
| 3,857,341 | A | 12/1974 | Neumann |
| 3,880,089 | A | 4/1975 | Wallace |
| 3,897,736 | A | 8/1975 | Tack |
| 3,901,163 | A | 8/1975 | Neumann |
| 3,905,305 | A | 9/1975 | Cope |
| 3,920,231 | A | 11/1975 | Harrison et al. |
| 3,937,153 | A | 2/1976 | Durocher |
| 3,965,825 | A | 6/1976 | Sherrick |
| 3,977,332 | A | 8/1976 | Bullock |
| 3,995,720 | A | 12/1976 | Wiebe |
| 4,003,318 | A | 1/1977 | Bullock et al. |
| 4,034,681 | A | 7/1977 | Neumann et al. |
| 4,067,262 | A | 1/1978 | Scheffel |
| 4,072,112 | A | 2/1978 | Wiebe |
| 4,078,501 | A | 3/1978 | Neumann |
| 4,084,514 | A | 4/1978 | Bullock |
| 4,103,623 | A | 8/1978 | Radwill |
| 4,109,585 | A | 8/1978 | Brose |
| 4,109,586 | A | 8/1978 | Briggs et al. |
| 4,109,934 | A | 8/1978 | Paton et al. |
| 4,111,131 | A | 9/1978 | Bullock |
| 4,136,620 | A | 1/1979 | Scheffel et al. |
| 4,148,469 | A | 4/1979 | Geyer |
| 4,151,801 | A | 5/1979 | Scheffel et al. |
| 4,167,907 | A | 9/1979 | Mulcahy et al. |
| 4,179,995 | A | 12/1979 | Day |
| 4,186,914 | A | 2/1980 | Radwill et al. |
| 4,192,240 | A | 3/1980 | Korpics |
| 4,196,672 | A | 4/1980 | Bullock |
| 4,230,047 | A | 10/1980 | Wiebe |
| 4,236,457 | A | 12/1980 | Cope |
| 4,237,793 | A | 12/1980 | Holden et al. |
| 4,239,007 | A | 12/1980 | Kleykamp et al. |
| 4,242,966 | A | 1/1981 | Holt et al. |
| 4,244,297 | A | 1/1981 | Monselle |
| 4,244,298 | A * | 1/1981 | Hawthorne et al. ..... 105/198.4 |
| 4,254,712 | A | 3/1981 | O'Neil |
| 4,254,713 | A | 3/1981 | Clafford |
| 4,256,041 | A | 3/1981 | Kemper et al. |
| 4,265,182 | A | 5/1981 | Neff et al. |
| 4,274,339 | A | 6/1981 | Cope |
| 4,274,340 | A | 6/1981 | Neumann et al. |
| 4,276,833 | A | 7/1981 | Bullock |
| 4,295,429 | A | 10/1981 | Wiebe |
| 4,311,098 | A | 1/1982 | Irwin |
| 4,316,417 | A | 2/1982 | Martin |
| 4,332,201 | A | 6/1982 | Pollard et al. |
| 4,333,403 | A | 6/1982 | Tack et al. |
| RE31,008 | E | 8/1982 | Barber |
| 4,342,266 | A | 8/1982 | Cooley |
| 4,351,242 | A | 9/1982 | Irwin |
| 4,356,775 | A | 11/1982 | Paton et al. |
| 4,357,880 | A | 11/1982 | Weber |

| | | | | |
|---|---|---|---|---|
| 4,363,276 | A | | 12/1982 | Neumann |
| 4,363,278 | A | * | 12/1982 | Mulcahy ..... 105/218.1 |
| 4,370,933 | A | | 2/1983 | Mulcahy |
| 4,373,446 | A | | 2/1983 | Cope |
| 4,413,569 | A | * | 11/1983 | Mulcahy ..... 105/168 |
| 4,416,203 | A | | 11/1983 | Sherrick |
| 4,426,934 | A | | 1/1984 | Geyer |
| 4,434,720 | A | | 3/1984 | Mulcahy et al. |
| 4,483,253 | A | * | 11/1984 | List ..... 105/167 |
| RE31,784 | E | | 1/1985 | Wiebe |
| 4,491,075 | A | | 1/1985 | Neumann |
| 4,512,261 | A | * | 4/1985 | Horger ..... 105/167 |
| 4,526,109 | A | | 7/1985 | Dickhart et al. |
| 4,537,138 | A | | 8/1985 | Bullock |
| RE31,988 | E | | 9/1985 | Wiebe |
| 4,552,074 | A | | 11/1985 | Mulcahy et al. |
| 4,554,875 | A | | 11/1985 | Schmitt et al. |
| 4,574,708 | A | | 3/1986 | Solomon |
| 4,590,864 | A | | 5/1986 | Przybylinski |
| 4,637,319 | A | | 1/1987 | Moehling et al. |
| 4,660,476 | A | | 4/1987 | Franz |
| 4,674,411 | A | | 6/1987 | Schindehutte |
| 4,674,412 | A | | 6/1987 | Mulcahy et al. |
| 4,676,172 | A | | 6/1987 | Bullock |
| 4,765,251 | A | | 8/1988 | Guins |
| 4,785,740 | A | | 11/1988 | Grandy |
| 4,813,359 | A | | 3/1989 | Marulic et al. |
| 4,825,775 | A | | 5/1989 | Stein et al. |
| 4,825,776 | A | | 5/1989 | Spencer |
| 4,870,914 | A | | 10/1989 | Radwill |
| 4,915,031 | A | | 4/1990 | Wiebe |
| 4,936,226 | A | | 6/1990 | Wiebe |
| 4,938,152 | A | | 7/1990 | List |
| 4,953,471 | A | | 9/1990 | Wronkiewicz et al. |
| 4,974,521 | A | | 12/1990 | Eungard |
| 4,986,192 | A | | 1/1991 | Wiebe |
| 5,000,097 | A | | 3/1991 | List |
| 5,001,989 | A | | 3/1991 | Mulcahy et al. |
| 5,009,521 | A | | 4/1991 | Wiebe |
| 5,027,716 | A | | 7/1991 | Weber |
| 5,046,431 | A | * | 9/1991 | Wagner ..... 105/198.4 |
| 5,072,673 | A | | 12/1991 | Lienard |
| 5,081,935 | A | | 1/1992 | Pavlick |
| 5,086,708 | A | | 2/1992 | McKeown, Jr. et al. |
| 5,095,823 | A | | 3/1992 | McKeown, Jr. |
| 5,107,773 | A | | 4/1992 | Daley et al. |
| 5,111,753 | A | | 5/1992 | Zigler et al. |
| 5,138,954 | A | | 8/1992 | Mulcahy |
| 5,174,218 | A | | 12/1992 | List |
| 5,176,083 | A | | 1/1993 | Bullock |
| 5,226,369 | A | | 7/1993 | Weber |
| 5,235,918 | A | | 8/1993 | Durand et al. |
| 5,237,933 | A | | 8/1993 | Bucksbee |
| 5,239,932 | A | | 8/1993 | Weber |
| 5,241,913 | A | | 9/1993 | Weber |
| 5,327,837 | A | | 7/1994 | Weber |
| 5,331,902 | A | | 7/1994 | Hawthorne et al. |
| 5,404,826 | A | * | 4/1995 | Rudibaugh et al. ..... 105/222 |
| 5,410,968 | A | | 5/1995 | Hawthorne et al. |
| 5,417,163 | A | | 5/1995 | Lienard |
| RE34,963 | E | | 6/1995 | Eungard |
| 5,450,799 | A | | 9/1995 | Goding |
| 5,452,665 | A | | 9/1995 | Wronkiewicz et al. |
| 5,463,964 | A | | 11/1995 | Long et al. |
| 5,481,986 | A | | 1/1996 | Spencer et al. |
| 5,503,084 | A | * | 4/1996 | Goding et al. ..... 105/218.1 |
| 5,509,358 | A | * | 4/1996 | Hawthorne et al. ..... 105/218.1 |
| 5,511,489 | A | | 4/1996 | Bullock |
| 5,511,491 | A | | 4/1996 | Hesch et al. |
| 5,524,551 | A | | 6/1996 | Hawthorne et al. |
| 5,544,591 | A | | 8/1996 | Taillon |
| 5,555,817 | A | | 9/1996 | Taillon |
| 5,555,818 | A | | 9/1996 | Bullock |
| 5,562,045 | A | | 10/1996 | Rudibaugh et al. |
| 5,572,931 | A | | 11/1996 | Lazar |
| 5,613,445 | A | | 3/1997 | Rismiller |
| 5,632,208 | A | | 5/1997 | Weber |
| 5,647,283 | A | | 7/1997 | McKisic |
| 5,666,885 | A | | 9/1997 | Wike |
| 5,722,327 | A | | 3/1998 | Hawthorne et al. |
| 5,735,216 | A | | 4/1998 | Bullock et al. |
| 5,746,137 | A | | 5/1998 | Hawthorne |
| 5,749,301 | A | | 5/1998 | Wronkiewicz et al. |
| 5,794,538 | A | | 8/1998 | Pitchford |
| 5,799,582 | A | | 9/1998 | Rudibaugh et al. |
| 5,802,982 | A | | 9/1998 | Weber |
| 5,850,795 | A | | 12/1998 | Taillon |
| 5,875,721 | A | | 3/1999 | Wright et al. |
| 5,918,547 | A | | 7/1999 | Bullock |
| 5,921,186 | A | | 7/1999 | Hawthorne et al. |
| 5,924,366 | A | | 7/1999 | Trainer et al. |
| 5,943,961 | A | | 8/1999 | Rudibaugh et al. |
| 5,967,053 | A | | 10/1999 | Toussaint et al. |
| 5,992,330 | A | | 11/1999 | Gilbert et al. |
| 6,125,767 | A | | 10/2000 | Hawthorne et al. |
| 6,142,081 | A | | 11/2000 | Long |
| 6,173,655 | B1 | | 1/2001 | Hawthorne |
| 6,178,894 | B1 | | 1/2001 | Leingang |
| 6,186,075 | B1 | | 2/2001 | Spencer |
| 6,196,134 | B1 | | 3/2001 | Stecker |
| 6,227,122 | B1 | | 5/2001 | Spencer |
| 6,269,752 | B1 | | 8/2001 | Taillon |
| 6,276,283 | B1 | | 8/2001 | Weber |
| 6,338,300 | B1 | | 1/2002 | Landrot |
| 6,347,588 | B1 | | 2/2002 | Leingang |
| 6,371,033 | B1 | | 4/2002 | Smith |
| 6,374,749 | B1 | | 4/2002 | Duncan et al. |
| 6,422,155 | B1 | | 7/2002 | Heyden |
| 6,425,334 | B1 | | 7/2002 | Wronkiewicz et al. |
| 6,591,759 | B2 | | 7/2003 | Bullock |
| 6,631,685 | B2 | | 10/2003 | Hewitt |
| 6,659,016 | B2 | | 12/2003 | Forbes |
| 6,672,224 | B2 | | 1/2004 | Weber et al. |
| 6,688,236 | B2 | | 2/2004 | Taillon |
| 6,691,625 | B2 | | 2/2004 | Duncan |
| 6,701,850 | B2 | | 3/2004 | McCabe et al. |
| 6,895,866 | B2 | * | 5/2005 | Forbes ..... 105/197.05 |
| 7,255,048 | B2 | | 8/2007 | Forbes |
| 7,267,059 | B2 | | 9/2007 | Forbes |
| 7,328,659 | B2 | | 2/2008 | Forbes |
| 2003/0024429 | A1 | | 2/2003 | Forbes |
| 2003/0037696 | A1 | * | 2/2003 | Forbes ..... 105/404 |
| 2003/0041772 | A1 | | 3/2003 | Forbes |
| 2003/0097955 | A1 | | 5/2003 | Bullock |
| 2003/0129037 | A1 | | 7/2003 | Forbes |

FOREIGN PATENT DOCUMENTS

| | | |
|---|---|---|
| CA | 714822 | 8/1965 |
| CA | 2090031 | 6/1991 |
| CA | 2153137 | 6/1995 |
| CA | 2191673 | 11/1996 |
| CA | 2034125 | 7/2000 |
| CA | 2100004 | 1/2004 |
| CH | 329987 | 5/1958 |
| CH | 371475 | 10/1963 |
| DE | 473036 | 2/1929 |
| DE | 664933 | 8/1938 |
| DE | 688777 | 2/1940 |
| DE | 1180392 | 10/1964 |
| DE | 2318369 | 10/1974 |
| EP | 0 264 731 | 4/1988 |
| EP | 0 347 334 | 12/1989 |
| EP | 0 444 362 | 9/1991 |
| EP | 0494323 | 7/1992 |
| EP | 1053925 A1 | 11/2000 |

| | | |
|---|---|---|
| FR | 1095600 | 6/1955 |
| GB | 2 045 188 | 10/1980 |
| JP | 58-39558 | 3/1983 |
| JP | 63-279966 | 11/1988 |
| JP | 4-143161 | 5/1992 |
| WO | 00/13954 | 3/2000 |

OTHER PUBLICATIONS

1984 Car and Locomotive Cyclopedia, 5th ed. (Omaha: Simmons-Boardman Books, Inc. 1984) at pp. 512-513.
1997 Car and Locomotive Cyclopedia, 6th ed. (Omaha: Simmons-Boardman Books, Inc. 1997) at pp. 705-770. Section 7: Trucks, Wheels, Axles & Bearings. pp. 705-720, 724, 726, 735-736, 739-751.
1997 Car and Locomotive Cyclopedia, 6th ed. (Omaha: Simmons-Boardman Books, Inc. 1997) at pp. 811-822. Section 7 Bearings, pp. 819-822.
1997 Car and Locomotive Cyclopedia, 6th ed. (Omaha: Simmons-Boardman Books, Inc. 1997) at p. 834.
1966 Car and Locomotive Cyclopedia, 1st ed. (New York: Simmons-Boardman Publishing Corporation, 1966) at p. 827.
1970 Car and Locomotive Cyclopedia, 2nd ed. ((New York: Simmons-Boardman Publishing Corporation, 1970) at p. 816.
1984 Car and Locomotive Cyclopedia, 5th ed. (Omaha: Simmons-Boardman Books, Inc. 1984) at pp. 488, 489, 496, 500 and 526.
Nov. 1998 Railway Age, pp. 47, 51, 53, 62.
Sep. 1996, Rownd, K. et al., "Improved Ride Quality for Transportation of Finished Automobiles by Rail", Technology Digest TD 96-021, Association of American Railroads.
Jun. 1999, Rownd, K. et al., Evaluation of End-of-Car Cushioning Designs Using the TOES Model:, Technology Digest 99-019, Association of American Railroads.
Aug. 1999, Rownd, K. et al., "Improving the Economy of Bulk-Commodity Service Through Improved Suspensions", Technology Digest 99-027, Association of American Railroads.
Association of American Railroads Mechanical Division Manual of Standards and Recommended Practices Journal "Roller Bearing Adapters for Freight Cars", date Unknown, pp. H-35-H-42. Revised 1998.
Narrow Pedestal Side Frame Trucks, Timken Roller Bearing Company, date unknown.
Timken "AP" Bearing Assembly, Timken Roller Bearing Company, date unknown.
Buckeye XC-R VII, Buckeye Steel Castings, date unknown.
*Standard Car Truck Company, Truck Information Package 2000*: • Iron Friction Wedge Replacement Guide, Standard Car Truck Company, 2000. • Lifeguard Friction Wedge Replacement Guide, Standard Car Truck Company, 2000. • TwinGuard Friction Wedge Replacement Guide, Standard Car Truck Company, 2000. • Product Bulletin, Barber TwinGuard, Standard Car Truck Company, date unknown. • Barber Split Wedge, Standard Car Truck Company, date unknown. • Barber Split Wedge Replacement Guide, Standard Car Truck Company, 2000. • Barber 905-SW Split Wedge Friction Casting, Standard Car Truck Company, 2000. • Barber 905-SW Split Wedge Pocket Insert, Standard Car Truck Company, 2000. Barber 905-SW Split Wedge Insert Application Guide, Standard Car Truck Company, 2000.
*American Steel Foundries information*: • Super Service Ridemaster, American Steel Foundries, date unknown. • Motion Control M976 Upgrade Kit, source unknown, date unknown. • ASF Motion Control Truck System with Super Service Ridemaster & D5 Springs, drawing No. AR-3421, ASF-Keystone, Inc., Jul. 14, 2003. Assembly ASF/Pennsy Adapter Plus Pad & Adapter, drawing No. 43317, ASF-Keystone, Inc., Jul. 10, 2003.
1937 *Car and Locomotive Cyclopedia*, (New York: Simmons-Boardman Publishing Corporation) pp. 892 & 893 "Self-Aligning Spring Plankless Double Truss Trucks".
1961 *Car Builders Cyclopedia*, 21st ed. (New York: Simmons-Boardman Publishing Corporation, 1961) at pp. 846, 847 "Car Trucks: Freight, Modified Conventional".
1966 *Car and Locomotive Cyclopedia*, (New York: Simmons-Boardman Publishing Corporation pp. 818 & 819 "ASF Freight Car Trucks".
1974 *Car and Locomotive Cyclopedia*, 3rd ed. (New York: Simmons-Boardman Publishing Corporation, 1974) pp. S13-36, S13-37 "For new directions in shock and motion protection, keep looking to Lord."
1980 *Car and Locomotive Cyclopedia*, pp. 669-750. Section 13 "Trucks and Journal Bearings".
1984 *Car and Locomotive Cyclopedia*, 5th ed. (Omaha: Simmons-Boardman Books, Inc. 1984) at pp. 512-513.
1997 *Car and Locomotive Cyclopedia*, 6th ed. (Omaha: Simmons-Boardman Books, Inc. 1997) at pp. 705-770. Section 7: "Trucks Wheels Axles & Bearings".
1997 *Car and Locomotive Cyclopedia*, 6th ed. (Omaha: Simmons-Boardman Books, Inc. 1997) at pp. 811-822. Section 7"Bearings".
1966 *Car and Locomotive Cyclopedia*, 1st ed. (New York: Simmons-Boardman Publishing Corporation, 1966) at p. 827. "Barber Stabilized Truck".
1970 *Car and Locomotive Cyclopedia*, 2nd ed. (New York: Simmons-Boardman Publishing Corporation, 1970) at p. 816 "Journal Boxes: Roller Bearing, Pedestal Frames".
1984 *Car and Locomotive Cyclopedia*, 5th ed. (Omaha: Simmons-Boardman Books, Inc. 1984) at pp. 488, 489, 496, 500 and 526 "Barber Stabilized Freight Car Truck Systems".
1997 *Car and Locomotive Cyclopedia*, 6th ed. (Omaha: Simmons-Boardman Books, Inc. 1997) at p. 747.
Nov. 1998 *Railway Age*, pp. 47, 51, 53, 62 "Premium trucks: Real-world test results".
Jul. 2003, "A Dynamic Relationship", *Railway Age*, at pp. 37-38.
*Railway Age*, Comprehensive Railroad Dictionary (Simmons-Boardman Books, Inc.) p. 142.
Sep. 1996, Rownd, K. et al., "Improved Ride Quality of Finished Automobiles by Rail", *Technology Digest* TD 96-021, Association of American Railroads.
Sep. 1996, Rownd, K. et al., "Over-the-Road Tests Demonstrated Improved Ride Quality for Transportation of Finished Automobiles", *Technology Digest* TD 96-022, Association of American Railroads.
Sep. 1997, Burnett, S. et al., "Improved Vehicle Dynamics Model for Tri-Level Auto-Rack Railcars", *Technology Digest* TD 97-038, Association of American Railroads.
Sep. 1997, Rownd, K. et al., "Improved Ride Quality for Rail Transport of Finished Automobiles", *Technology Digest* TD 97-039, Association of American Railroads.
Jun. 1998, Rownd, K. et al., "Use of Modified Suspensions to Improve Ride Quality in Bi-Level Auto-Racks", *Technology Digest* 98-014, Association of American Railroads.
Oct. 1998 , Rownd, K. et al., "Improved Ride-Quality for Transportation of Finished Auto by Tri-Level Autorack", *Technology Digest* 98-025, Association of American Railroads.
Dec. 1998, Rownd, K. et al., "Advanced Suspensions Meet Performance Standards for Bi-Level Auto-Rack Cars", *Technology Digest* 98-032, Association of American Railroads.
Jun. 1999, Rownd, K. et al., "Advanced Suspensions Meet Ride-Quality Performance Standards for Tri-Level Auto-Rack Cars", *Technology Digest* 99-020, Association of American Railroads.
Jun. 1999, Rownd, K. et al., "Evaluation of End-of-Car Cushioning Designs Using the TOES Model", *Technology Digest* 99-019, Association of American Railroads.
Aug. 1999,. Rownd, K. et al., "Improving the Economy of Bulk-Commodity Service Through Improved Suspensions", *Technology Digest* 99-027, Association of American Railroads.
Jul. 2000, Rownd, K. et al., "Improving the Economics of Bulk-Commodity Service: ASF Bulk Truck", *Technology Digest* 00-011, Association of American Railroads.
Jul. 2000, Rownd, K. et al., "Improving the Economics of Bulk-Commodity Service—S2E Standard Car Truck", *Technology Digest* 00-012, Association of American Railroads.
ASF Trucks "Good for the Long Run," American Steel Foundries, date unknown.
ASF User's Guide, "Freight Car Truck Design," American Steel Foundries, ASF652, date unknown.
ADAPTERPlus, Pennsy Corporation, Internet—PENNSY.com, Ver. 9807, date unknown.
*User's Manual for NUCARS*, Version 2.0, SD-o43, at pp. 5-39, 5-40.
Barber S-2-D Product Bulletin , date unknown.

Association of American Railroads Mechanical Division Manual of Standards and Recommended Practices Journal "Roller Bearing Adapters for Freight Cars", date unknown, pp. H-35-H-42.
"Narrow Pedestal Side Frame Trucks,"Timken Roller Bearing Company, date unknown.
"Timken "AP" Bearing Assembly,"Timken Roller Bearing Company, date unknown.
"Buckeye XC-R VII,"Buckeye Steel Castings, date unknown.
"Buckeye XC-R,"Buckeye Steel Castings, date unknown.
Standard Car Truck Company, Truck Information Package 2000: • Iron Friction Wedge Replacement Guide, Standard Car Truck Company, 2000. • Lifeguard Friction Wedge Replacement Guide, Standard Car Truck Company, 2000. • TwinGuard Friction Wedge Replacement Guide, Standard Car Truck Company, 2000. • Product Bulletin, Barber TwinGuard, Standard Car Truck Company, date unknown. • Barber Split Wedge, Standard Car Truck Company, date unknown. • Barber Split Wedge Replacement Guide, Standard Car Truck Company, 2000. • Barber 905-SW Split Wedge Friction Casting, Standard Car Truck Company, 2000. • Barber 905-SW Split Wedge Pocket Insert, Standard Car Truck Company, 2000. • Barber 905-SW Split Wedge Insert Application Guide, Standard Car Truck Company, 2000. Section 2 Friction Wedges Available Wedge Options.
Standard Car Truck Company "Barber Change Brings Choices", date unknown.
Standard Car Truck Company Barber Friction Wedge Matrix, date unknown.
Standard Car Truck Company Barber Stabilized Truck—Suspension Performance Properties, Mar. 14, 2000.
Standard Car Truck Company Barber Stabilized Trucks presentation Oct. 10, 2000.
Section 13 of the *Car and Locomotive Cyclopedia of American Practices*, 4$^{th}$ ed., (Simmons Boardman, Omaha,1980) ("the *1980 Cyclopedia*"), pp. 669-750, entitled Trucks and Journal Bearings.
Section 7 of the *Car and Locomotive Cyclopedia of American Practices*, 6$^{th}$ ed., (Simmons-Boardman, Omaha, 1997) ("the *1997 Cyclopedia*"), pp. 811-833, entitled "Bearings".
International Search Report from European Patent Office (8 pages) PCT/CA2004/000995.
Written Opinion from European Patent Office (6 pages) PCT/CA2004/000995).
Examination Report for EP 04 737 932.6-2422.
John H. White, Jr., Running Gear, The American Railroad Freight Car, Johns Hopkins University Press, Baltimore, 1993, ISBN 0-8018-4404-5, pp. 433-477.
John H. White, Jr., Running Gear, The American Railroad Passenger Car, Johns Hopkins University Press, Baltimore, 1978, ISBN 0-8018-2743-4, pp. 496-522.

* cited by examiner

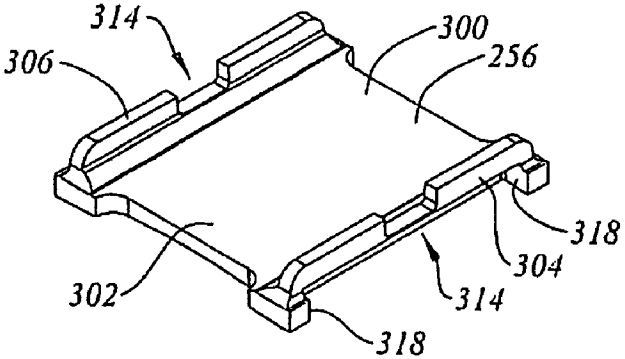
Figure 11a
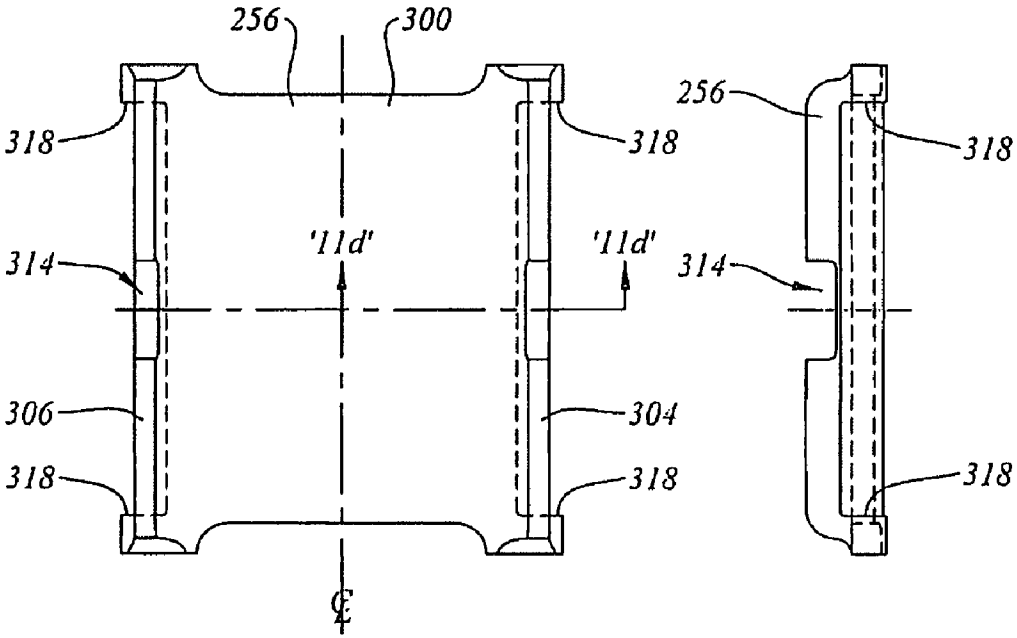
Figure 11b
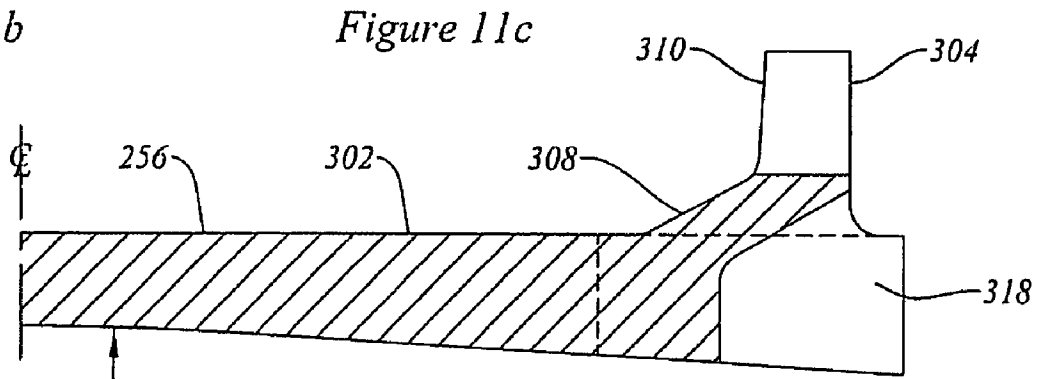
Figure 11c
Figure 11d

RAIL ROAD CAR TRUCK

This application is a continuation-in-part of U.S. patent application Ser. No. 10/615,331, filed Jul. 8, 2003.

FIELD OF THE INVENTION

This invention relates to the field of rail road cars, and, more particularly, to the field of three piece rail road car trucks for rail road cars.

BACKGROUND OF THE INVENTION

Rail road cars in North America commonly employ double axle swivelling trucks known as "three piece trucks" to permit them to roll along a set of rails. The three piece terminology refers to a truck bolster and pair of first and second sideframes. In a three piece truck, the truck bolster extends crosswise relative to the sideframes, with the ends of the truck bolster protruding through the sideframe windows. Forces are transmitted between the truck bolster and the sideframes by spring groups mounted in spring seats in the sideframes. The sideframes carry forces to the sideframe pedestals. The pedestals seat on bearing adapters, whence forces are carried in turn into the bearings, the axle, the wheels, and finally into the tracks. The three piece truck relies upon a suspension in the form of the spring groups trapped in a "basket" between each of the ends of the truck bolster and its associated sideframe. For wheel load equalisation, a three piece truck uses one set of springs, and the side frames pivot about the ends of the truck bolster in a manner like a walking beam. The 1980 *Car & Locomotive Cyclopedia* states at page 669 that the three piece truck offers "interchangeability, structural reliability and low first cost but does so at the price of mediocre ride quality and high cost in terms of car and track maintenance."

Ride quality can be judged on a number of different criteria. There is longitudinal ride quality, where, often, the limiting condition is the maximum expected longitudinal acceleration experienced during humping or flat switching, or slack run-in and run-out. There is vertical ride quality, for which vertical force transmission through the suspension is the key determinant. There is lateral ride quality, which relates to the lateral response of the suspension. There are also other phenomena to be considered, such as truck hunting, the ability of the truck to self steer, and, whatever the input perturbation may be, the ability of the truck to damp out undesirable motion. These phenomena tend to be interrelated, and the optimization of a suspension to deal with one phenomenon may yield a system that may not necessarily provide optimal performance in dealing with other phenomena.

In terms of optimizing truck performance, it may generally be desirable to obtain a measure of self steering in the truck, desirable to avoid truck hunting, and desirable to have a relatively soft lateral and vertical response. It would be advantageous to be able to obtain the desirable relatively soft dynamic response to lateral and vertical perturbations, to obtain a measure of self steering, and yet to maintain resistance to lozenging (or parallelogramming). Lozenging, or parallelogramming, is non-square deformation of the truck bolster relative to the side frames of the truck as seen from above. It may also be desirable to obtain a measure of self-steering. Self steering may tend to be desirable since it may reduce drag and may tend to reduce wear to both the wheels and the track, and may give a smoother overall ride.

In general, the lateral stiffness of the suspension may tend to reflect the combined lateral displacement of (a) the sideframe between (i) the bearing adapter and (ii) the bottom spring seat (that is, the sideframes may swing or rock laterally), and (b) the lateral deflection of the springs between (i) the lower spring seat in the sideframe and (ii) the upper spring mounting against the underside of the truck bolster, and (c) the moment and the associated transverse shear force between the (i) spring seat in the sideframe and (ii) the upper spring mounting against the underside of the truck bolster.

In a conventional rail road car truck, the lateral stiffness of the spring groups may sometimes be estimated as being approximately half of the vertical spring stiffness. Thus the choice of vertical spring stiffness may strongly affect the lateral stiffness of the suspension. There is another component of spring stiffness due to the unequal compression of the inside and outside portions of the spring group as the bottom spring seat rotates relative to the upper spring group mount under the bolster.

It may be desirable to have springs of a given vertical stiffness to give certain vertical ride characteristics, and a different characteristic for lateral perturbations. For example, a softer lateral response through the main spring groups may be desired at high speed (greater than about 50 m.p.h.) and relatively low amplitude to address a truck hunting concern, while a different spring characteristic may be desirable to address a low speed (roughly 10-25 m.p.h.) roll characteristic, particularly since the overall suspension system may have a roll mode resonance lying in the low speed regime.

For the purposes of rapid estimation of truck lateral stiffness, the following formula can be used:

$$k_{truck}=2\times[(k_{sideframe})^{-1}+(k_{spring\ shear})^{-1}]^{-1}$$

where $$k_{sideframe}=[k_{pendulum}+k_{spring\ moment}]$$

$k_{spring\ shear}$=The lateral spring constant for the spring group in shear.

$k_{pendulum}$=The force required to deflect the pendulum per unit of deflection, as measured at the center of the bottom spring seat.

$k_{spring\ moment}$=The force required to deflect the bottom spring seat per unit of sideways deflection against the twisting moment caused by the unequal compression of the inboard and outboard springs.

In a pure pendulum, the relationship between weight and deflection is approximately linear for small angles of deflection, such that, by analogy to a spring in which F=kx, a lateral constant (for small angles) can be defined as $k_{pendulum}=W/L$, where k is the lateral constant, W is the weight, and L is the pendulum length. Further, for the purpose of rapid comparison of the lateral swinging of the sideframes, an approximation for an equivalent pendulum length for small angles of deflection can be defined as $L_{eq}=W/k_{pendulum}$. In this equation W represents the sprung weight borne by that sideframe, typically ¼ of the total sprung weight for a symmetrical car. For a conventional truck, $L_{eq}$ may be of the order of about 3 or 4 inches. For a swing motion truck, $L_{eq}$ may be of the order of about 10". As noted above, one of the features of a swing motion truck is that while it may be quite stiff vertically, and while it may be resistant to parallelogram deformation because of the unsprung lateral connection member, namely the transom, frame brace, or lateral reinforcement rods, it may at the same time tend to be laterally relatively soft.

One way to obtain a measure of passive self steering is to mount elastomeric pads between the pedestal seat and the bearing adapter. That is to say, when a conventional truck enters a curve, the leading outer wheel may tend to want to pull ahead relative to the leading inner wheel, and the inner wheel may then tend to want to slip, or skid, somewhat. The converse may tend to occur on the trailing axle. This tendency to slip or skid may be reduced somewhat if the axles are able to steer a bit, and thereby to conform to some extent to the curve. Elastomeric pads, sometimes manufactured by Lord Corp., have sometimes been used for this purpose, and may provide a resilient means for permitting some self steering to take place.

Considering the interface between the pedestal seat and the wheelsets at the bearing adapters, there are, potentially, six degrees of freedom, namely vertical, longitudinal and transverse translation, and rotation about each of the vertical, longitudinal, and lateral axes. For the purposes of analysis, in the vertical direction the connection can be approximated as being nearly infinitely stiff. In the longitudinal direction, the stiffness with an elastomeric pad is a function of the shear modulus of the elastomer, the area of the elastomer in plan view, and the thickness of the elastomer. If the elastomer is of constant thickness, and is more or less flat, the lateral stiffness may tend to be roughly the same in both longitudinal and lateral shear. The pad may tend to have torsional compliance about the vertical axis to permit the typically relatively small angular deflection of steering.

Longitudinal cylindrical rockers have been employed to increase warp stiffness by compelling the fore and aft bearing adapter interfaces to swing in unison on a common hinge line. Where substantially cylindrical rockers of relatively close radii are used, (that is, where the radius of curvature of the rocker is relatively close to the radius of curvature of the seat) as for example in U.S. Pat. No. 5,544,591 of Armand Taillon, issued Aug. 13, 1996, the torsional stiffness about the vertical, or z, axis of the interface between the bearing adapter crown and the pedestal seat roof may be very high, such that it may tend to provide resistance to unsquaring relative movement between the wheelsets and side frames.

SUMMARY OF THE INVENTION

In an aspect of the present invention, there is a rail road car truck that has a self steering capability and friction dampers in which the coefficients of static and dynamic friction are substantially similar. It may include the added feature of lateral rocking at the sideframe pedestal to wheelset axle end interface. It may include self steering proportional to the weight carried by the truck. It may further have a longitudinal rocker at the sideframe to axle end interface. Further it may provide a swing motion truck with self steering. It may also provide a swing motion truck that has the combination of a swing motion lateral rocker and an elastomeric bearing adapter pad. In another feature, the truck may have dampers lying along the longitudinal centerline of the spring groups of the truck suspensions. In another feature, it may include dampers mounted in a four cornered arrangement. In another feature it may include dampers having modified friction surfaces on both the friction bearing face and on the obliquely angled face of the damper that seats in the bolster pocket.

In another aspect of the invention, a three piece rail road car truck has a truck bolster mounted transversely between a pair of sideframes. The truck bolster has ends, each of the ends being resiliently mounted to a respective one of the sideframes. The truck has a set of dampers mounted in a four cornered damper arrangement between each the bolster end and its respective sideframe. Each damper has a bearing surface mounted to work against a mating surface at a friction interface in a sliding relationship when the bolster moves relative to the sideframes. Each damper has a seat against which to mount a biasing device for urging the bearing face against the mating surface. The bearing surface of the damper has a dynamic co-efficient of friction and a static co-efficient of friction when working against the mating surface. The static and dynamic coefficients of friction are of substantially similar magnitude.

In a further feature of that aspect of the invention, the co-efficients of friction have respective magnitudes within 10% of each other. In another feature, the coefficients of friction are substantially equal. In another feature the coefficients of friction lie in the range of 0.1 to 0.4. In still another feature, the coefficients of friction lie in the range 0.2 to 0.35. In a further feature, the coefficients of friction are about 0.30 (+/−10%). In still another feature, the dampers each include a friction element mounted thereto, and the bearing surface is a surface of the friction element. In yet still another feature, the friction element is a composite surface element that includes a polymeric material.

In another feature of that aspect of the invention, the truck. is a self-steering truck. In another feature, the truck includes a bearing adapter to sideframe pedestal interface that includes a self-steering apparatus. In another feature, the self-steering apparatus includes a rocker. In a further feature, the truck includes a bearing adapter to sideframe pedestal interface that includes a self-steering apparatus having a force-deflection characteristic varying as a function of vertical load. In still another feature, the truck has a bearing adapter to sideframe pedestal interface that includes a bi-directional rocker operable to permit lateral rocking of the sideframes and to permit self-steering of the truck.

In another feature of that aspect of the invention, each damper has an oblique face for seating in a damper pocket of a truck bolster of a rail road car truck, the bearing face is a substantially vertical face for bearing against a mating sideframe column wear surface, and, in use, the seat is oriented to face substantially downwardly. In another feature, the oblique face has a surface treatment for encouraging sliding of the oblique face relative to the damper pocket. In still another feature, the oblique face has a static coefficient of friction and a dynamic co-efficient of friction, and the coefficients of static and dynamic friction of the oblique face are substantially equal. In a further feature, the oblique face and the bearing face both have sliding surface elements, and both of the sliding surface elements are made from materials having a polymeric component. In yet a further feature, the oblique face has a primary angle relative to the bearing surface, and a cross-wise secondary angle.

In another aspect of the invention, there is a three piece railroad car truck having a bolster transversely mounted between a pair of sideframes, and wheelsets mounted to the sideframes at wheelset to sideframe interface assemblies. The wheelset to sideframe interface assemblies are operable to permit self steering, and include apparatus operable to urge the wheelsets in a lengthwise direction relative to the sideframes to a minimum potential energy position relative to the sideframes. The self-steering apparatus has a force deflection characteristic that is a function of vertical load.

In a further aspect of the invention, there is a bearing adapter for a railroad car truck. The bearing adapter has a body for seating upon a bearing of a rail road truck wheelset, and a rocker member for mounting to the body. The rocker member has a rocking surface, the rocking surface facing away from the body when the rocker member is mounted to the body, and the rocker being made of a different material from the body.

In a further feature of that aspect, the rocker member is made from a tool steel. In another feature of that aspect of the invention, the rocker member is made from a metal of a grade used for the fabrication of ball bearings. In another feature, the body is made of cast iron. In another feature, the rocker member is a bi-directional rocker member. In still another feature, the rocking surface of the rocking member defines a portion of a spherical surface.

In another aspect of the invention, there is a three piece railroad car truck having rockers for self steering. In still another aspect, there is a railroad car truck having a sideframe, an axle bearing, and a rocker mounted between the sideframe and the axle bearing. The rocker has a transverse axis to permit rocking of and the bearing lengthwise relative to the sideframe.

In another aspect of the invention there is a three piece railroad car truck having a bolster mounted transversely to a pair of sideframes. The side frames have pedestal fittings and wheelsets mounted in the pedestal fittings. The pedestal fittings include rockers. Each rocker has a transverse axis to permit rocking in a lengthwise direction relative to the sideframes.

In another aspect of the invention there is a three piece railroad car truck having a truck bolster mounted transversely to a pair of side frames, each sideframes has fore and aft pedestal seat interface fittings, and a pair of wheelsets mounted to the pedestal seat interface fittings. The pedestal seat interface fittings include rockers operable to permit the truck to self steer.

In another aspect of the invention there is a railroad car truck having a sideframe, an axle bearing, and a bi-directional rocker mounted between the sideframe and the axle bearing. In still another aspect of the invention, there is a railroad car truck having a truck bolster mounted transversely between a pair of sideframes, and wheelsets mounted to the sideframes to permit rolling operation of the truck along a set of rail road tracks. The truck includes rocker elements mounted between the sideframes and the wheelsets. The rocker elements are operable to permit lateral swinging of the sideframes and to permit self-steering of the truck.

In another aspect of the invention there is a railroad car truck having a pair of sideframes, a pair of wheelsets having ends for mounting to the sideframes, and sideframe to wheelset interface fittings. The sideframe to wheelset interface fittings include rocking members having a first degree of freedom permitting lateral swinging of the sideframes relative to the wheelsets, and a second degree of freedom permitting longitudinal rocking of the wheelset ends relative to the sideframes.

In another aspect of the invention there is a railroad car truck having rockers formed on a compound curvature, the rockers being operable to permit both a lateral swinging motion in the truck and self steering of the truck. In still another aspect of the invention, there is a railroad car truck having a pair of sideframes, a pair of wheelsets having ends for mounting to the sideframes, and sideframe to wheelset interface fittings. The sideframe to wheelset interface fittings include rocking members having a first degree of freedom permitting lateral swinging of the sideframes relative to the wheelsets, a second degree of freedom permitting longitudinal rocking of the wheelset ends relative to the sideframes. The wheelset to sideframe interface fittings being torsionally compliant about a predominantly vertical axis.

In aspect of the invention there is a swing motion rail road car truck modified to include rocking elements mounted to permit self-steering. In yet another aspect there is a swing motion rail road car truck having a transverse bolster sprung between a pair of side frames, and a pair of wheelsets mounted to the sideframes at wheelset to sideframe interface fittings. The wheelset to sideframe interface fittings include swing motion rockers and elastomeric members mounted in series with the swing motion rockers to permit the truck to self-steer.

In another aspect of the invention, there is a rail road car truck having a truck bolster mounted transversely between a pair of sideframes, and wheelsets mounted to the sideframes at wheelset to sideframe interface fittings. The wheelset to sideframe interface fittings include rockers for permitting lateral swinging motion of the sideframes. The rockers have a male element and a mating female element. The male and female rocker elements are engaged for co-operative rocking operation. The female element has a radius of curvature in the lateral swinging direction of less than 25 inches. The wheelset to sideframe interface fittings are also operable to permit self steering.

In still another aspect of the invention there is a rail road car truck having a truck bolster mounted transversely between a pair of sideframes, and wheelsets mounted to the sideframes at wheelset to sideframe interface fittings. The wheelset to sideframe interface fittings include rockers for permitting lateral swinging motion of the sideframes. The rockers have a male element and a mating female element. The male and female rocker elements are engaged for co-operative rocking operation. The sideframe have an equivalent pendulum length, $L_{eq}$, when mounted on the rocker, of greater than 6 inches. The wheelset to sideframe interface fittings include an elastomeric member mounted in series with the rockers to permit self steering.

In yet another aspect of the invention there is a rail road car truck having a truck bolster mounted transversely between a pair of sideframes, and wheelsets mounted to the sideframes at wheelset to sideframe interface fittings. The wheelset to sideframe interface fittings include rockers for permitting self steering of the truck. The rockers have a male element and a mating female element. The male and female rocker elements are engaged for co-operative rocking operation, and the wheelset to sideframe interface fittings include an elastomeric member mounted in series with the rockers.

In still another aspect of the invention there is a rail road car truck having a transverse bolster sprung between twos sideframes, and wheelsets mounted to the sideframes at wheelset to sideframe interface fittings, the truck having a spring groups and dampers seated in the bolster and biased by the spring groups to ride against the sideframes. The spring groups include a first damper biasing spring upon which a first damper of the dampers seats. The first damper biasing spring has a coil diameter. The first damper has a width of more than 150% of the coil diameter.

In another aspect of the invention there is a rail road car truck having a bolster having ends sprung from a pair of sideframes, and wheelsets mounted to the sideframes at wheelset to sideframe interface fittings. The wheelset to sideframe interface fittings include bi-directional rocker fittings for permitting lateral swinging of the sideframes and for permitting self steering of the wheelsets. The truck has a four cornered arrangement of dampers mounted at each end of the bolster. In a further feature of that aspect of the invention the interface fittings are torsionally compliant about a predominantly vertical axis.

In another aspect there is a railroad car truck having a bolster transversely mounted between a pair of sideframes, and wheelsets mounted to the sideframes. The railroad car truck have a bi-directional longitudinal and lateral rocking interface between each sideframe and wheelset, and four cornered damper groups mounted between each sideframe and the truck bolster. In an additional feature of that aspect of the invention the rocking interface is torsionally compliant about a predominantly vertical axis. In another additional feature, the rocking interface is mounted in series with a torsionally compliant member.

In yet another aspect of the invention there is a self-steering rail road car truck having a transversely mounted bolster sprung between two sideframes, and wheelsets mounted to the sideframes. The sideframes are mounted to swing laterally relative to the wheelsets. The truck has friction dampers mounted between the bolster and the sideframes. The friction dampers have coefficients of static friction and dynamic friction. The coefficients of static and dynamic friction being substantially the same.

In still another aspect there is a self-steering rail road car truck having a transversely mounted bolster sprung between two sideframes, and wheelsets mounted to the sideframes. The sideframes are mounted to swing laterally relative to the wheelsets. The truck has friction dampers mounted between the bolster and the sideframes. The friction dampers have coefficients of static friction and dynamic friction. The coefficients of static and dynamic friction differ by less than 10%. Expressed differently, the friction dampers having a co-efficient of static friction, $u_s$, and a co-efficient of dynamic friction, $u_k$, and a ratio of $u_s/u_k$ lies in the range of 1.0 to 1.1. In another aspect of the invention, the truck has friction dampers mounted between the bolster and the sideframes in a sliding friction relationship that is substantially free of stick-slip behaviour. In another feature of that aspect of the invention the friction dampers include friction damper wedges having a first face for engaging one of the sideframes, and a second, sloped, face for engaging a bolster pocket. The sloped face is mounted in the bolster pocket in a sliding friction relationship that is substantially free of stick-slip behaviour.

In another aspect of the invention there is a self-steering rail road car truck having a bolster mounted between a pair of sideframes, and wheelsets mounted to the sideframes for rolling motion along railroad tracks. The wheelsets are mounted to the sideframes at wheelset to sideframe interface fittings. Those fittings are operable to permit lateral rocking of the sideframes. The truck has a set of friction dampers mounted between the bolster and each of the sideframes. The friction dampers have a first face in sliding friction relationship with the sideframes and a second face seated in a bolster pocket of the bolster. The first face, when operated in engagement with the sideframe, has a co-efficient of static friction and a co-efficient of dynamic friction, the coefficients of static and dynamic friction of the first face differing by less than 10%. The second face, when mounted within the bolster pocket, has a co-efficient of static friction, and a co-efficient of dynamic friction, and the co-efficients of static and dynamic friction of the second face differing by less than 10%.

In yet another aspect of the invention there is a self-steering rail road car truck having a bolster mounted between a pair of sideframes, and wheelsets mounted to the sideframes for rolling motion along railroad tracks. The wheelsets are mounted to the sideframes at wheelset to sideframe interface fittings. The interface fittings are operable to permit lateral rocking of the sideframes. The truck has a set of friction dampers mounted between the bolster and each of the sideframes. The friction dampers have a first face in slidable friction relationship with the sideframes and a second face seated in a bolster pocket of the bolster. The first face and the side frame are co-operable and are in a substantially stick-slip free condition. The second face and the bolster pocket are also in a substantially stick-slip free condition.

In another aspect of the invention there is a rocker for a bearing adapter of a rail road car truck. The rocker has a rocking surface for rocking engagement with a mating surface of a pedestal seat of a sideframe of a railroad car truck. The rocking surface has a compound curvature to permit both lengthwise and sideways rocking. In a complementary aspect of the invention, there is a rocker for a pedestal seat of a sideframe of a rail road car truck. The rocker has a rocking surface for rocking engagement with a mating surface of a bearing adapter of a railroad car truck. The rocking surface has a compound curvature to permit both lengthwise and sideways rocking.

In an aspect of the invention there is a sideframe pedestal to axle bearing interface assembly for a three piece rail road car truck, the interface assembly having fittings operable to rock both laterally and longitudinally.

In an additional feature of that aspect of the invention the assembly includes mating surfaces of compound curvature, the compound curvature including curvature in both lateral and horizontal directions. In another feature, the assembly includes at least one rocker element and a mating element, the rocker and mating elements being in point contact with a mating element, the element in point contact being movable in rolling point contact with the mating element. In still another feature, the element in point contact is movable in rolling point contact with the mating element both laterally and longitudinally. In yet another feature, the fittings include rockingly matable saddle surfaces.

In another feature, the fittings include a male surface having a first compound curvature and a mating female surface having a second compound curvature in rocking engagement with each other, and one of the surfaces includes at least a spherical portion. In a further feature, the fittings include a non-rocking central portion in at least one direction. In still another feature, relative to a vertical axis of rotation, rocking motion of the fittings longitudinally is torsionally de-coupled from rocking of the fittings laterally. In a yet further feature the fittings include a force transfer interface that is torsionally compliant relative to torsional moments about a vertical axis. In still another feature, the assembly includes an elastomeric member.

In another aspect of the invention, there is a swing motion three piece rail road car truck having a laterally extending truck bolster, a pair of longitudinally extending sideframes to which the truck bolster is resiliently mounted, and wheelsets to which the side frames are mounted. Damper groups are mounted between the bolster and each of the sideframes. The damper groups each have a four-cornered damper layout, and wheelset to sideframe pedestal interface assemblies operable to permit lateral swinging motion of the sideframes and longitudinal self-steering of the wheelsets.

In a further aspect there is a rail road car truck having a truck bolster mounted between sideframes, and wheelsets to which the sideframes are mounted, and wheelset to sideframe interface assemblies by which to mount the sideframes to the wheelsets. The sideframe to wheelset interface assemblies include rocking apparatus to permit the sideframes to swing laterally. The rocking apparatus includes first and second surfaces in rocking engagement. At least a portion of the first surface has a first radius of curvature of less than 30 inches. The sideframe to wheelset interface includes self steering apparatus.

In a feature of that aspect of the invention, the self steering apparatus has a substantially linear force deflection characteristic. In another feature, the self steering apparatus has a force-deflection characteristic that varies with vertical loading of the sideframe to wheelset interface assembly. In a further feature, the force-deflection characteristic varies linearly with vertical loading of the sideframe to wheelset interface assembly. In another feature, the self steering apparatus includes a rocking element. In still another feature, the rocking element includes a rocking member subject to angular displacement about an axis transverse to one of the sideframes.

In another feature, the self steering apparatus includes male and female rocking elements, and at least a portion of the male rocking element has a radius of curvature of less than 40 inches. In still another feature, the self steering apparatus includes male and female rocking elements, and at least a portion of the female rocking element has a radius of curvature of less than 60 inches. In still another feature the self steering apparatus is self centering. In a further feature, the self steering apparatus is biased toward a central position.

In yet another feature, the self steering apparatus includes a resilient member. In a further feature of that further feature, the resilient member includes an elastomeric element. In another further feature, the resilient member is an elastomeric adapter pad assembly. In another feature, the resilient member is an elastomeric adapter assembly having a lateral force-displacement characteristic and a longitudinal force-displacement characteristic, and the longitudinal force-displacement characteristic is different from the lateral force-displacement characteristic. In another feature, the elastomeric adapter assembly is stiffer in lateral shear then in longitudinal shear. In again another feature, a rocker element is mounted above the elastomeric adapter pad assembly. In another feature, a rocker element is mounted directly upon the elastomeric adapter pad assembly. In a still further feature, the elastomeric adapter pad assembly includes and integral rocker member. In another feature, the three piece truck is a swing motion truck and the self steering apparatus includes an elastomeric bearing adapter pad.

In still another feature, the wheelsets have axles, and the axles have axes of rotation, and ends mounted beneath the sideframes, and, at one end of one of the axles, the self steering apparatus has a force deflection characteristic of at least one of the characteristics chosen from the set of force-deflection characteristic consisting of (a) a linear characteristic between 3000 lbs per inch and 10,000 pounds per inch of longitudinal deflection, measured at the axis of rotation at the end of the axle when the self steering apparatus bears one eighth of a vertical load of between 45,000 and 70,000 lbs.;

(b) a linear characteristic between 16,000 lbs per inch and 60,000 pounds per inch of longitudinal deflection, measured at the axis of rotation at the end of the axle when the self steering apparatus bears one eighth of a vertical load of between 263,000 and 315,000 lbs.; and (c) a linear characteristic between 0.3 and 2.0 lbs per inch of longitudinal deflection, measured at the axis of rotation at the end of the axle per pound of vertical load passed into the one end of the one axle.

In another aspect of the invention there is a three piece rail road freight car truck having self steering apparatus, wherein the passive steering apparatus includes at least one longitudinal rocker.

In yet another aspect of the invention, there is a three piece rail road freight car truck having passive self steering apparatus, the self steering apparatus having a linear force-deflection characteristic, and the force-deflection characteristic varying as a function of vertical loading of the truck.

In an additional feature of that aspect of the invention, the force-displacement characteristic varies linearly with vertical loading of the truck. In another feature, the self steering apparatus includes a rocker mechanism. In another feature, the rocker mechanism is displaceable from a minimum energy state under drag force applied to a wheel of one of the wheelsets. In still another feature, the force-deflection characteristic lies in the range of between about 0.4 lbs and 2.0 lbs per inch of deflection, measured at a center of and end of an axle of a wheelset of the truck per pound of vertical load passed into the end of the axle of the wheelset. In a further feature, the force deflection characteristic lies in the range of 0.5 to 1.8 lbs per inch per pound of vertical load passed into the end of the axle of the wheelset.

In yet another aspect of the invention there is a three piece rail road freight car truck having a transversely extending truck bolster, a pair of side frames mounted at opposite ends of the truck bolster, and resiliently connected thereto, and wheelsets. The sideframes are mounted to the wheelsets at sideframe to wheelset interface assemblies. At least one of the sideframe to wheelset interface assemblies is mounted between a first end of an axle of one of the wheelsets, and a first pedestal of a first of the sideframes. The wheelset to sideframe interface assembly includes a first line contact rocker apparatus operable to permit lateral swinging of the first sideframe and a second line contact rocker apparatus operable to permit longitudinal displacement of the first end of the axle relative to the first sideframe.

In a feature of that aspect of the invention, the first and second rocker apparatus are mounted in series with a torsionally compliant member, the torsionally complaint member being compliant to torsional moments applied about a vertical axis. In another feature, a torsionally compliant member is mounted between the first and second rocker apparatus, the torsionally compliant member being torsionally compliant about a vertical axis.

In a further aspect of the invention, there is a bearing adapter for a three piece rail road freight car truck, the bearing adapter having a rocking contact surface for rocking engagement with a mating surface of a sideframe pedestal fitting, the rocking contact surface of the bearing adapter having a compound curvature.

In another feature of that aspect of the invention, the compound curvature is formed on a first male radius of curvature and a second male radius of curvature oriented cross-wise thereto. In another feature, the compound curvature is saddle shaped. In a further feature, the compound curvature is ellipsoidal. In a further feature, the curvature is spherical.

In a still further aspect there is a railroad car truck having a laterally extending truck bolster. The truck bolster has first and second ends. First and second longitudinally extending sideframes are resiliently mounted at the first and second ends of the bolster respectively. The side frames are mounted on wheelsets at sideframe to wheelset mounting interface assemblies. A four cornered damper group is mounted between each end of the truck bolster and the respective side frame to which that end is mounted. The sideframe to wheelset mounting interface assemblies are torsionally compliant about a vertical axis.

In a feature of that aspect of the invention, the truck is free of unsprung lateral cross-members between the sideframes. In another feature, the sideframes are mounted to swing laterally. In still another feature, the sideframe to wheelset mounting interface assemblies include self steering apparatus.

In another aspect of the invention, there is a railroad freight car truck having wheelsets mounted in a pair of sideframes, the sideframes having sideframe pedestals for receiving the wheelsets. The sideframe pedestals have sideframe pedestal jaws. The sideframe pedestal jaws include sideframe pedestal jaw thrust blocks. The wheelsets have bearing adapters mounted thereto for installation between the jaws. The sideframe pedestals have respective pedestal seat members rockingly co-operable with the bearing adapter. The truck has members mounted intermediate the jaws and the bearing adapters for urging the bearing adapter to a centered position relative to the pedestal seat. In another aspect, there is a member for placement between the thrust lug of a railroad car sideframe pedestal jaw and the end wall and corner abutments of a bearing adapter, the member being operable to urge the bearing adapter to an at rest position relative to the sideframe.

These and other aspects and features of the invention may be understood with reference to the detailed descriptions of the invention and the accompanying illustrations as set forth below.

BRIEF DESCRIPTION OF THE FIGURES

The principles of the invention may better be understood with reference to the accompanying figures provided by way of illustration of an exemplary embodiment, or embodiments, incorporating principles and aspects of the present invention, and in which:

FIG. 11*a* shows an isometric view of a pad adapter for the assembly of FIG. 9*a;*

FIG. 11*b* shows a top view of the pad adapter of FIG. 11*a;*

FIG. 11*c* shows a side view of the pad adapter of FIG. 11*a;*

FIG. 11*d* shows a half cross-section of the pad adapter of FIG. 11*a;*

DETAILED DESCRIPTION OF THE INVENTION

Figure 1A:
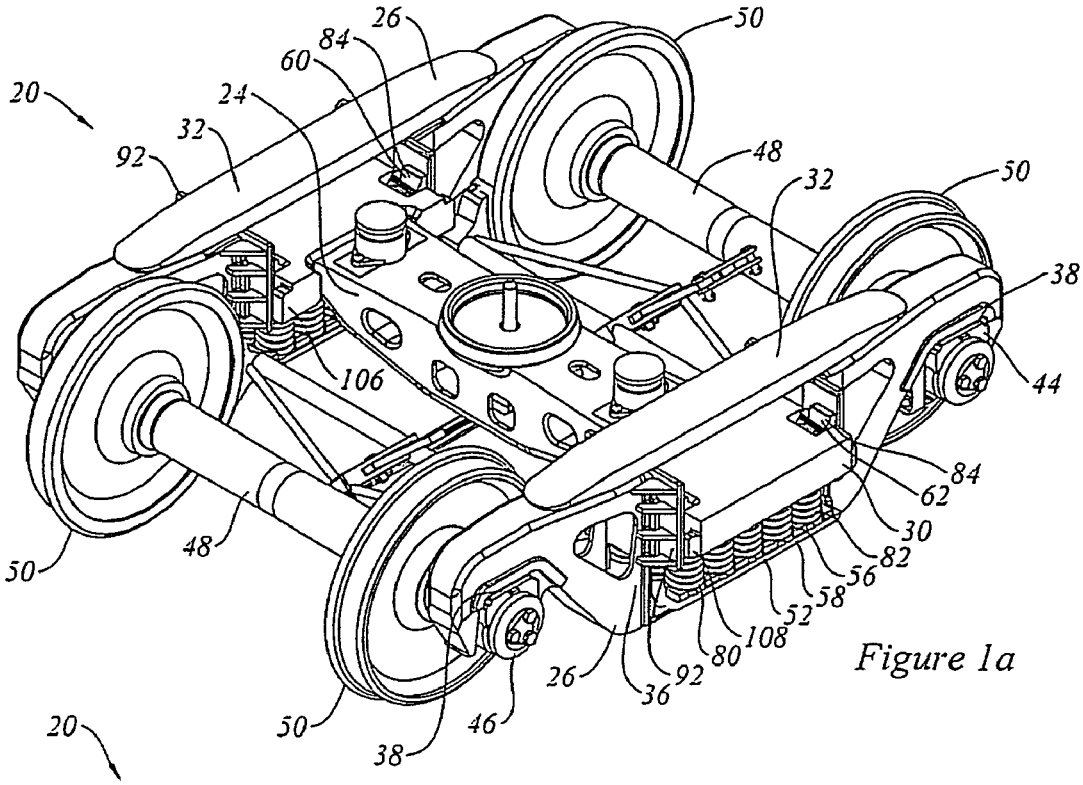
FIG. 1*a* shows an isometric view of an example of an embodiment of a railroad car truck according to an aspect of the present invention.
Figure 1D:
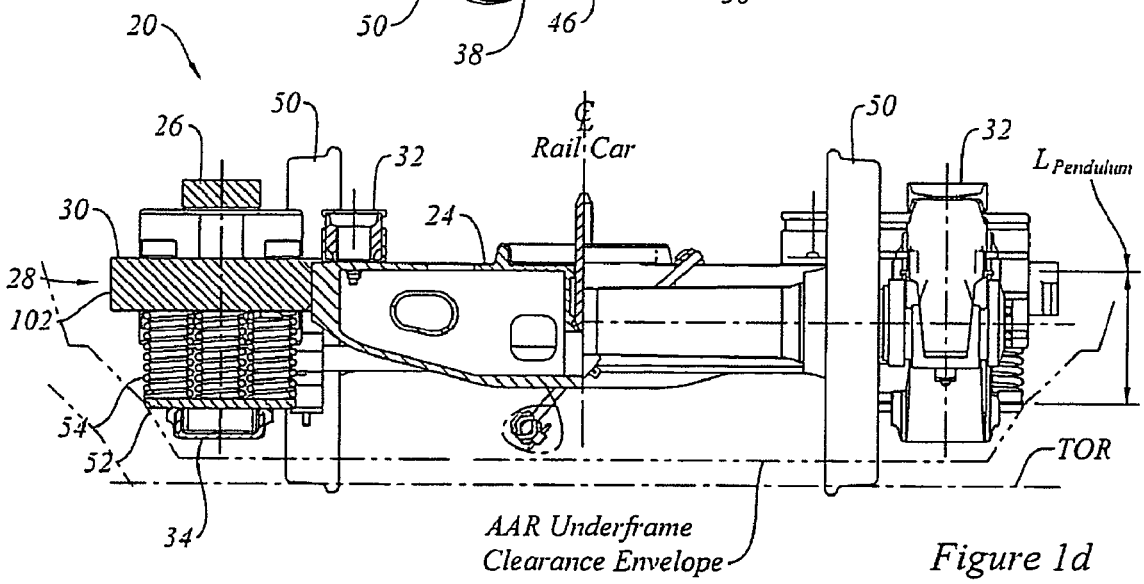
FIG. 1*d* is a split view showing, in one half an end view of the truck of FIG. 1*a*, and in the other half and a section taken level with the truck center.
Figure 1E:
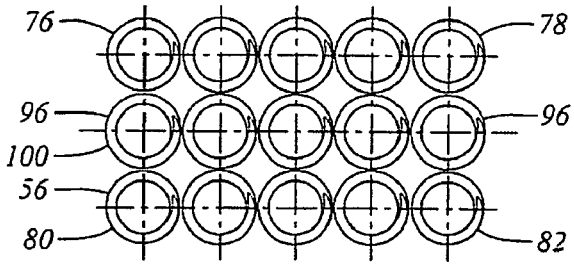
FIG. 1*e* shows a spring layout for the truck of FIG. 1*a;*

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

In terms of general orientation and directional nomenclature, for each of the rail road car trucks described herein, the longitudinal direction is defined as being coincident with the rolling direction of the rail road car, or rail road car unit, when located on tangent (that is, straight) track. In the case of a rail road car having a center sill, the longitudinal direction is parallel to the center sill, and parallel to the side sills, if any. Unless otherwise noted, vertical, or upward and downward, are terms that use top of rail, TOR, as a datum. The term lateral, or laterally outboard, refers to a distance or orientation relative to the longitudinal centerline of the railroad car, or car unit. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis.

This description relates to rail car trucks and truck components. Several AAR standard truck sizes are listed at page 711 in the 1997 *Car & Locomotive Cyclopedia*. As indicated, for a single unit rail car having two trucks, a "40 Ton" truck rating corresponds to a maximum gross car weight on rail (GWR) of 142,000 lbs. Similarly, "50 Ton" corresponds to 177,000 lbs., "70 Ton" corresponds to 220,000 lbs., "100 Ton" corresponds to 263,000 lbs., and "125 Ton" corresponds to 315,000 lbs. In each case the load limit per truck is then half the maximum gross car weight on rail. Two other types of truck are the "110 Ton" truck for railcars having a 286,000 lbs. GWR and the "70 Ton Special" low profile truck sometimes used for auto rack cars. Given that the rail road car trucks described herein tend to have both longitudinal and transverse axes of symmetry, a description of one half of an assembly may generally also be intended to describe the other half as well, allowing for differences between right hand and left hand parts.

This application refers to friction dampers for rail road car trucks, and multiple friction damper systems. There are several types of damper arrangements, as shown at pp. 715-716 of the 1997 *Car and Locomotive Cyclopedia*, those pages being incorporated herein by reference. Double damper arrangements are shown and described in co-pending U.S. patent application Ser. No. 10/210,797 entitled "Rail Road Freight Car With Damped Suspension", published as US patent application Publication No. US 2003/0041772 A1, on Mar. 6, 2003, and also incorporated herein by reference. Each of the arrangements of dampers shown at pp. 715 to 716 of the 1997 *Car and Locomotive Cyclopedia* can be modified according to the principles of the aforesaid co-pending application for "Rail Road Freight Car With Damped Suspension" to employ a four cornered, double damper arrangement of inner and outer dampers.

In dealing with friction dampers, there is discussion of damper wedges. Several variations of damper wedges are discussed herewithin. In terms of general nomenclature, the wedges tend to be mounted within an angled "bolster pocket" formed in an end of the truck bolster. In cross-section, each wedge may then have a generally triangular shape, one side of the triangle being, or having, a bearing face, a second side which might be termed the bottom, or base, forming a spring seat, and the third side being a sloped side or hypotenuse between the other two sides. The first side may tend to have a substantially planar bearing face for vertical sliding engagement against one of the sideframe columns. The second face may not be a face, as such, but rather may have the form of a socket for receiving the upper end of one of the springs of a spring group. Although the third face, or hypotenuse, may appear to be generally planar, it may tend to have a slight crown, having a radius of curvature of perhaps 60". The crown may extend along and across the slope. The end faces of the wedges may be generally flat, and may be provided with a coating, surface treatment, shim, or low friction pad to give a smooth sliding engagement with the sides of the bolster pocket, or with the adjacent side of another independently slidable damper wedge, as may be.

The bearing face of the damper may tend to be planar, and may tend to be in planar contact with the mating surface of the sideframe column wear plate. During railcar operation, the sideframe may tend to rotate, or pivot, through a small range of angular deflection about the end of the truck bolster in the manner of a walking beam to yield wheel load equalisation. The slight crown on the slope face of the damper may tend to accommodate this pivoting motion by allowing the damper to rock somewhat relative to the generally inclined face of the bolster pocket while the planar bearing face remains in planar contact with the wear plate of the sideframe column. Although the slope face may have a slight crown, for the purposes of this description it will be described as the slope face or as the hypotenuse, and will be considered to be a substantially flat face as a general approximation.

In the terminology herein, wedges have a primary angle $\alpha$, namely the included angle between (a) the sloped damper pocket face mounted to the truck bolster, and (b) the side frame column face, as seen looking from the end of the bolster toward the truck center. This is the included angle described above. In some embodiments, a secondary angle may be defined in the plane of angle α, namely a plane perpendicular to the vertical longitudinal plane of the (undeflected) side frame, tilted from the vertical at the primary angle. That is, this plane is parallel to the (undeflected) long axis of the truck bolster, and taken as if sighting along the back side (hypotenuse) of the damper.

The secondary angle β is defined as the lateral rake angle seen when looking at the damper parallel to the plane of angle α. As the suspension works in response to track perturbations, the wedge forces acting on the secondary angle will tend to urge the damper either inboard or outboard according to the angle chosen. Inasmuch as the tapered region of the wedge may be quite thin in terms of vertical through-thickness, it may be desirable to step the sliding face of the wedge (and the co-operating face of the bolster seat) into two or more portions. This may be particularly so if the primary angle of the wedge is large.

General Description of Truck Features

FIGS. 1*a* to 1*e* and 1*f* to 1*i* provide examples of trucks 20 and 22 embodying an aspect of the invention. Trucks 20 and 22 of FIGS. 1*a* and 1*f* may have the same, or generally similar, features and similar construction, although they may differ in pendulum length, spring stiffness, wheelbase, window width and height, and damping arrangement. That is, truck 20 of FIG. 1*a* may tend to have a longer wheelbase (from 73 inches to 86 inches, possibly between 80-84 inches for truck 20, as opposed to a wheelbase of 63-73 inches for truck 22), may tend to have a main spring group having a softer vertical spring rate, and a four cornered damper group that may have different primary and secondary angles on the damper wedges. While either truck may be suitable for a variety of general purpose uses, truck 20 may be optimized for use in rail road cars for carrying relatively low density, high value lading, such as automobiles or consumer products, for example, whereas truck 22 may be optimized for carrying denser semi-finished industrial goods, such as might be carried in rail road freight cars for transporting rolls of paper, for example. The various features of the two truck types may be interchanged, and are intended to be illustrative of a wide range of truck types in which the present invention may be employed. Notwithstanding possible differences in size, generally similar features are given the same part numbers. Trucks 20 and 22 are symmetrical about both their longitudinal and transverse centreline axes. In each case, where reference is made to a sideframe, it will be understood that the truck has first and second sideframes, first and second spring groups, and so on.

Trucks 20 and 22 each have a truck bolster, identified as 24, and sideframes, identified as 26. Each sideframe 26 has a generally rectangular window 28 that accommodates one of the ends 30 of the bolster 24. The upper boundary of window 28 is defined by the sideframe arch, or compression member identified as top chord member 32, and the bottom of window 28 is defined by a tension member identified as bottom chord 34. The fore and aft vertical sides of window 28 are defined by sideframe columns 36.

The ends of the tension member sweep up to meet the compression member. At each of the swept-up ends of sideframe 26 there are sideframe pedestal fittings, or pedestal seats 38. Each fitting 38 accommodates an upper fitting, which may be a rocker or a seat, as described and discussed below. This upper fitting, whichever it may be, is indicated generically as 40. Fitting 40 engages a mating fitting 42 of the upper surface of a bearing adapter 44. Bearing adapter 44 engages a bearing 46 mounted on one of the ends of one of the axles 48 of the truck adjacent one of the wheels 50. A fitting 40 is located in each of the fore and aft pedestal fittings 38, the fittings 40 being longitudinally aligned such that the sideframe can swing transversely relative to the rolling direction of the truck.

The relationship of the mating fittings 40 and 42 is described at greater length below. The relationship of these fittings determines part of the overall relationship between an end of one of the axles of one of the wheelsets and the sideframe pedestal. That is, in determining the overall response, the degrees of freedom of the mounting of the axle end in the sideframe pedestal involve a dynamic interface across an assembly of parts, such as may be termed a wheelset to sideframe interface assembly, that may include the bearing, the bearing adapter, an elastomeric pad, if used, a rocker if used, and the pedestal seat mounted in the roof of the sideframe pedestal. Several different embodiments of this wheelset to sideframe interface assembly are described below. To the extent that the bearing has a single degree of freedom, namely rotation of the shaft about the lateral axis, analysis of the assembly can be focused on the bearing to pedestal seat interface assembly, or on the bearing adapter to pedestal seat interface assembly. For the purposes of this description, items 40 and 42 are intended generically to represent the combination of features of a bearing adapter and pedestal seat assembly defining the interface between the roof of the sideframe pedestal and the bearing adapter, and the six degrees of freedom of motion at that interface, namely vertical, longitudinal and transverse translation (i.e., translation in the z, x, and y directions) and pitching, rolling, and yawing (i.e., rotational motion about the y, x, and z axes respectively) in response to dynamic inputs. In general, this interface is nearly infinitely stiff in vertical translation.

Continuing with the general description of the trucks, the bottom chord or tension member of sideframe 26 may have a basket plate, or lower spring seat 52 rigidly mounted to bottom chord 34, to give a rigid orientation relative to window 28, and to sideframe 26 in general. Although trucks 20 and 22 are free of unsprung lateral cross-bracing, whether in the nature of a transom or lateral rods, in the event that truck 20 or truck 22 is taken to represent a "swing motion" truck with a transom or other cross bracing, the lower rocker platform of spring seat 52 may be mounted on a rocker, to permit lateral rocking relative to sideframe 26. Spring seat 52 may have retainers for engaging the springs 54 of a spring set, or spring group, 56, whether internal bosses, or a peripheral lip for discouraging the escape of the bottom ends of the springs. The spring group, or spring set 56, is captured between the distal end 30 of bolster 24 and spring seat 52, being placed under compression by the weight of the rail car body and lading that bears upon bolster 24 from above.

Bolster 24 has double, inboard and outboard, bolster pockets 60, 62 on each face of the bolster at the outboard end (i.e., for a total of 8 bolster pockets per bolster, 4 at each end). Bolster pockets 60, 62 accommodate a pair of first and second, laterally inboard and laterally outboard friction damper wedges 64, 66 and 68, 70, respectively. Each bolster pocket 60, 62 has an inclined face, or damper seat 72, that mates with a similarly inclined hypotenuse face 74 of the damper wedge, 64, 66, 68 and 70. Wedges 64, 66 each sit over a first, inboard corner spring 76, 78, and wedges 68, 70 each sit over a second, outboard corner spring 80, 82. Angled faces 74 of wedges 64, 66 and 68, 70 ride against the angled face of seat 72.

A middle end spring 96 bears on the underside of a land 98 located intermediate bolster pockets 60 and 62. The top ends of the central row of springs, 100, seat under the main central portion 102 of the end of bolster 24. In this four corner arrangement, each damper is individually sprung by one or another of the springs in the spring group. The static compression of the springs under the weight of the car body and lading tends to act as a spring loading to bias the damper to act along the slope of the bolster pocket to force the friction surface against the sideframe. Friction damping is provided by damping wedges 64, 66 and 68, 70 (that seat in mating bolster pockets 60, 62 that have inclined damper seats 72 when the vertical sliding faces 90 of the friction damper wedges 64, 66 and 68, 70 then ride up and down on friction wear plates 92 mounted to the inwardly facing surfaces of sideframe columns 36. In this way the kinetic energy of the motion is, in some measure, converted through friction to heat. This friction may tend to damp out the motion of the bolster relative to the sideframes.

When a lateral perturbation is passed to wheels 50 by the rails, rigid axles 48 may tend to cause both sideframes 26 to deflect in the same direction. The reaction of sideframes 26 is to swing, like pendula, on the upper rockers. The weight of the pendulum and the reactive force arising from the twisting of the springs may then tend to urge the sideframes back to their initial position. The tendency to oscillate harmonically due to the track perturbation may tend to be damped out by the friction of the dampers on the wear plates 92.

Figure 1C:
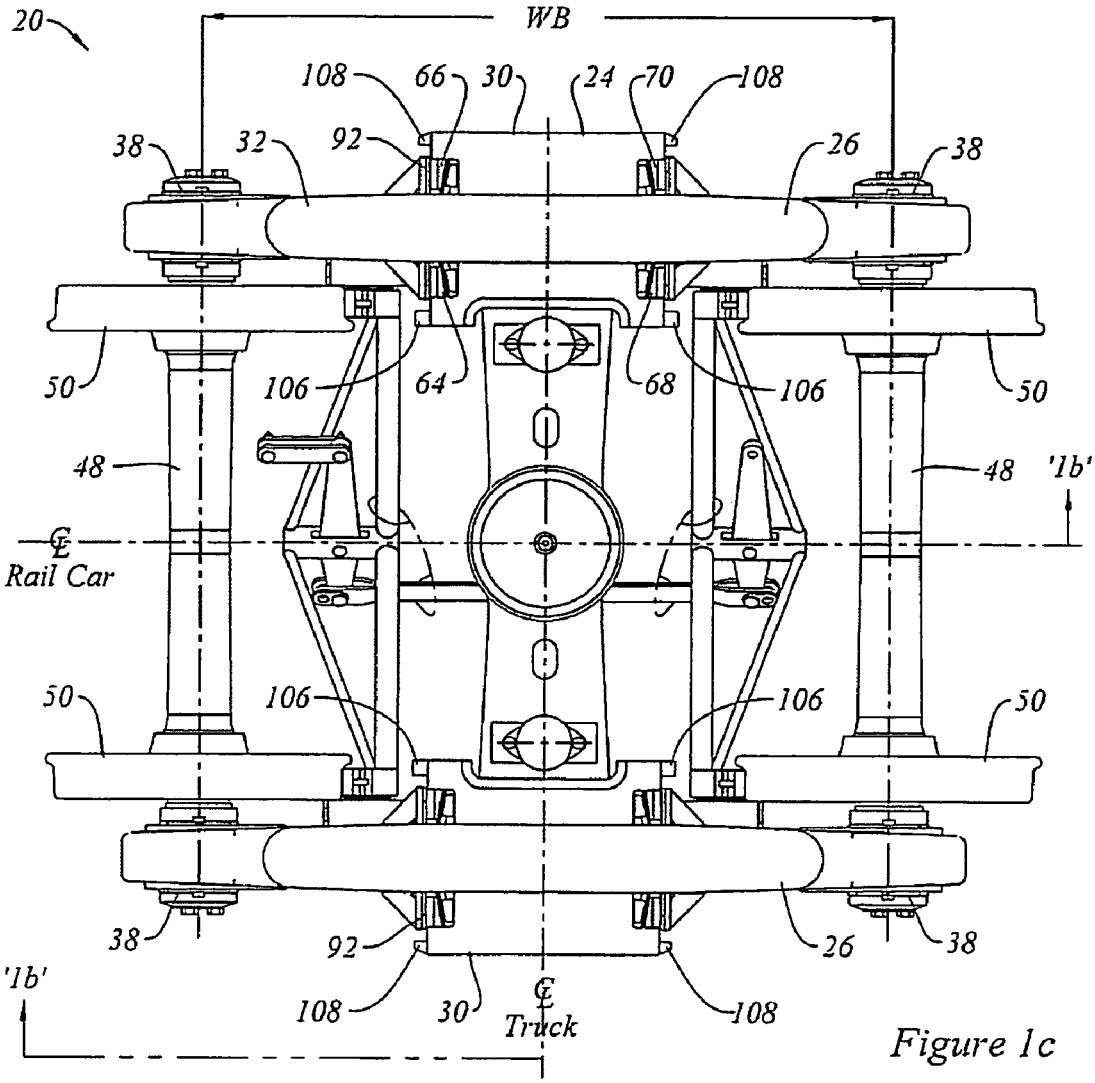
FIG. 1*c* shows a top view of the railroad car truck of FIG. 1*a;*
Figure 1B:
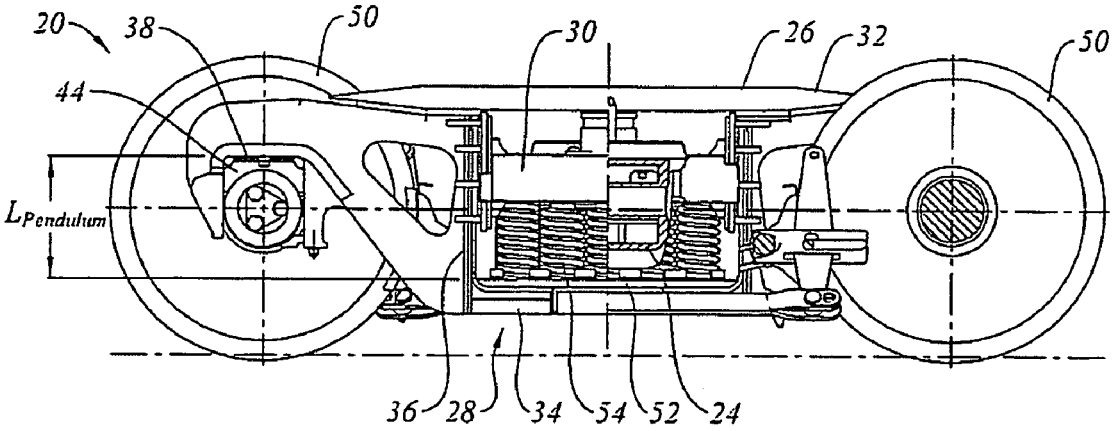
FIG. 1*b* shows a side view of the railroad car truck of FIG. 1*a;*
Figure 1F:
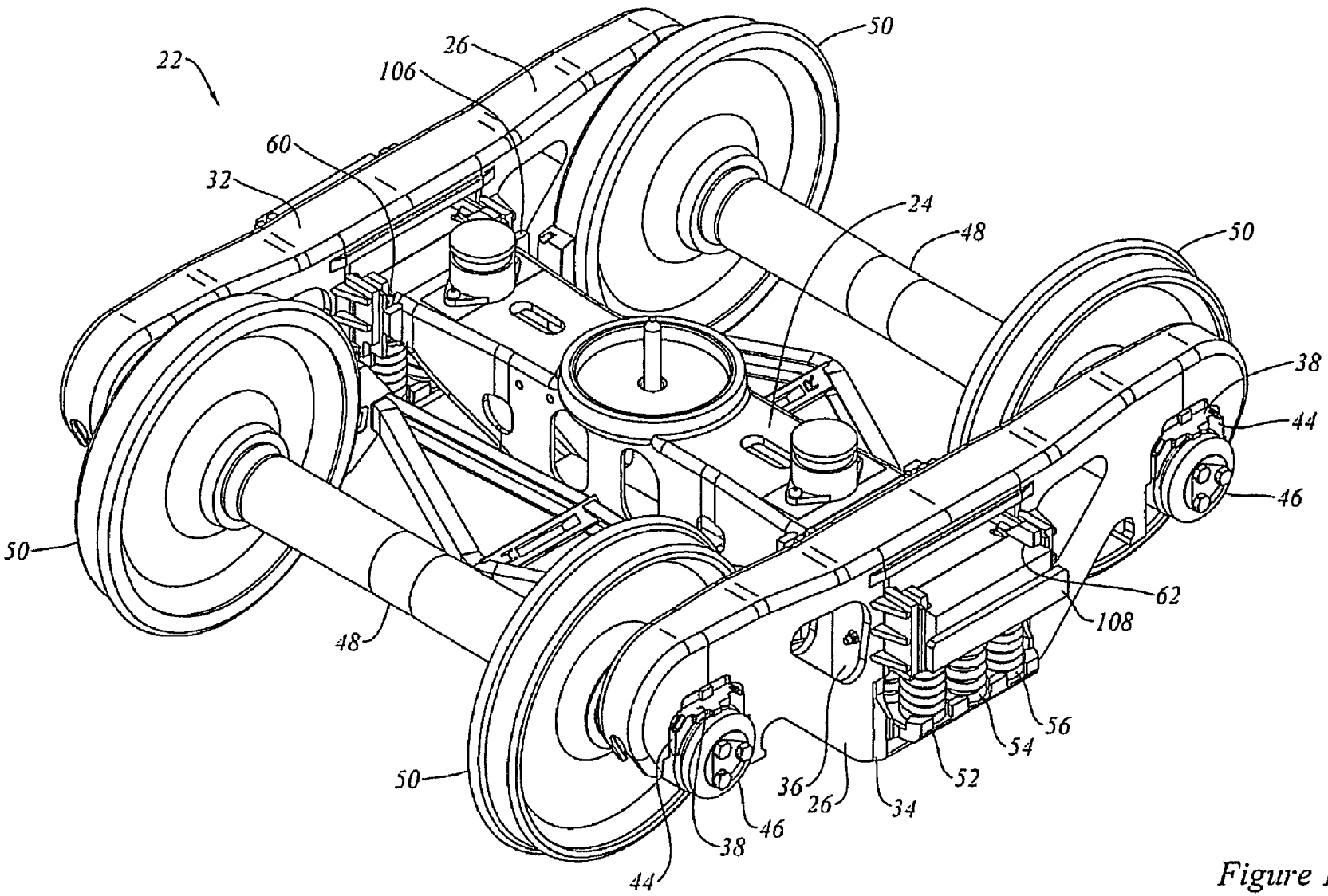
FIG. 1*f* shows an isometric view of an alternate embodiment of railroad car truck to that of FIG. 1*a;*
Figure 1G:
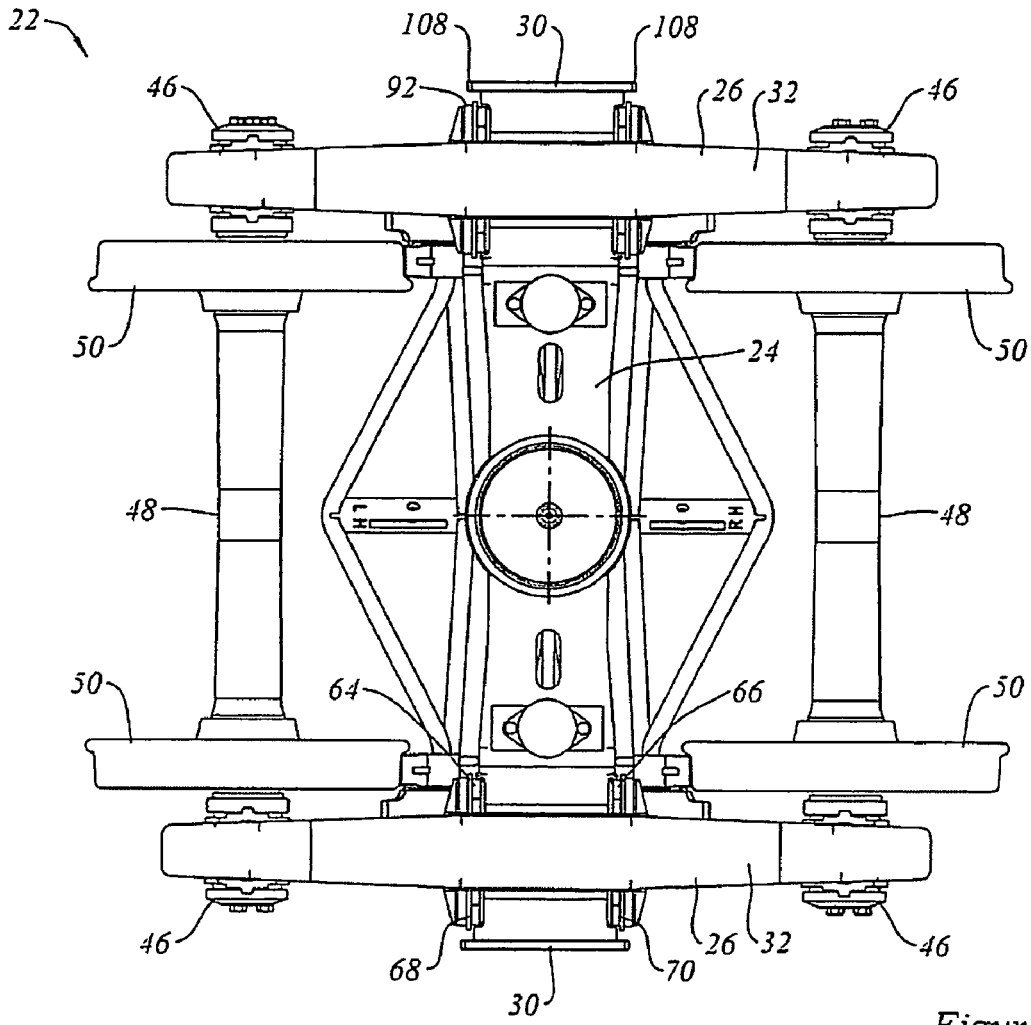
FIG. 1*g* shows a top view of the railroad car truck of FIG. 1*f;*
Figure 1H:
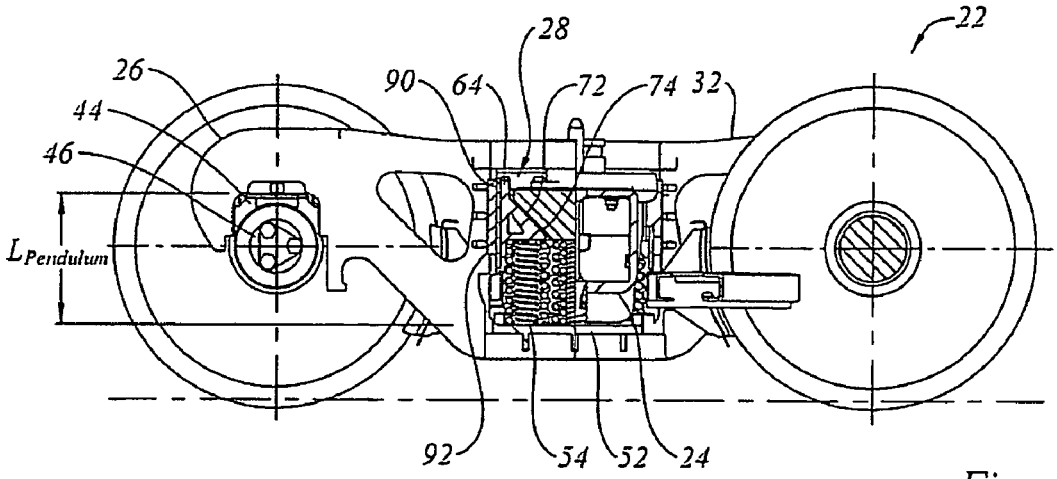
FIG. 1*h* shows a side view of the railroad car truck of FIG. 1*f;*
Figure 1I:
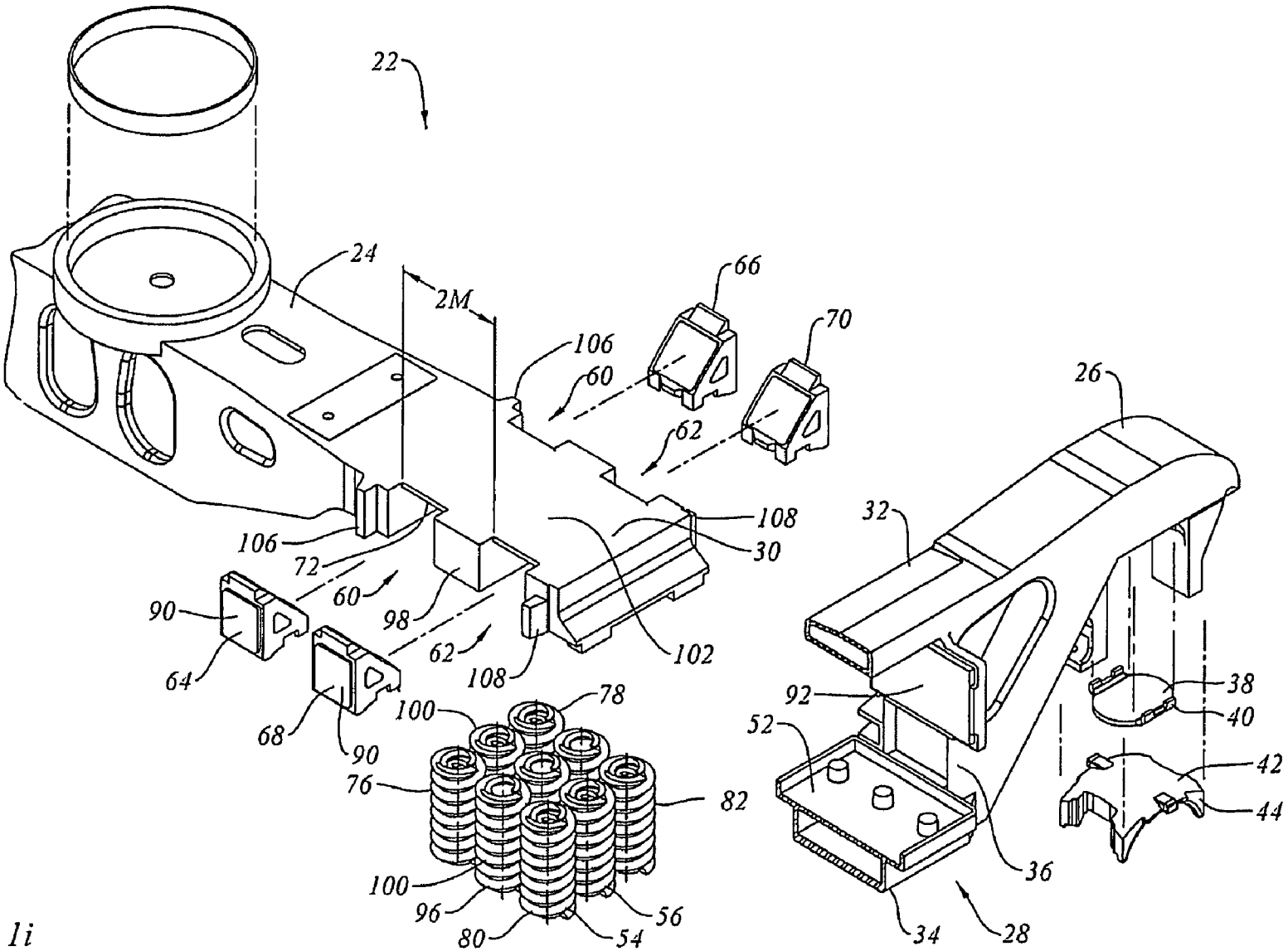
FIG. 1*i* shows an exploded view of a portion of a truck similar to that of FIG. 1*f;*
Figure 1J:
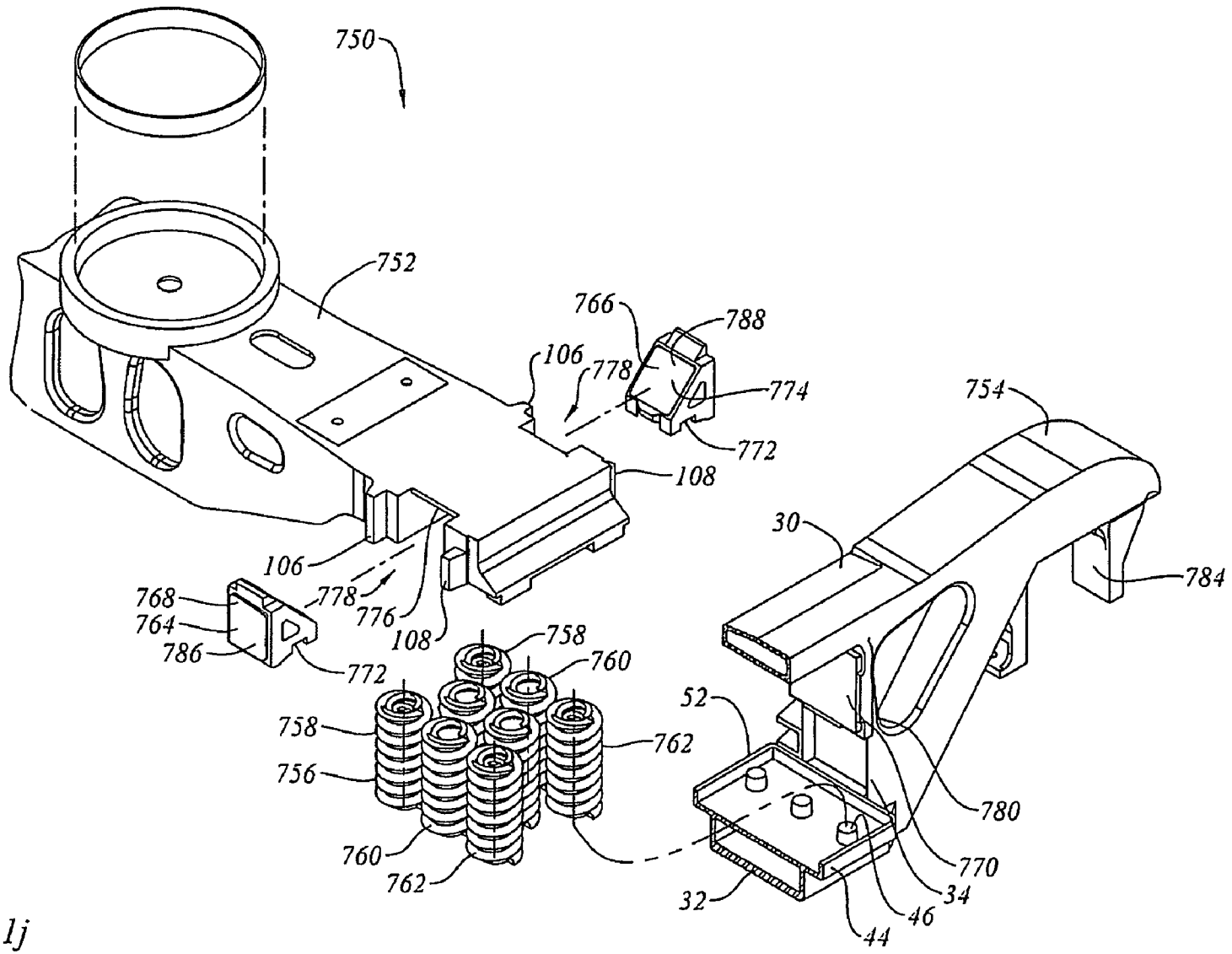
FIG. 1*j* is an exploded, sectioned view of an example of an alternate three piece truck to that of FIG. 1*a*, having dampers mounted along the spring group centerlines.

As compared to a bolster with single dampers as shown in FIG. 1*j*, for example, the use of spaced apart pairs of dampers 64, 68 may tend to give a larger moment arm, as indicated by dimension "2M" in FIG. 1*i*, for resisting parallelogram deformation of truck 20, 22 more generally. Use of doubled dampers this way may yield a greater restorative "squaring" force to return the truck to a square orientation than for a single damper alone. That is, in parallelogram deformation, or lozenging, the differential compression of one diagonal pair of springs (e.g., inboard spring 76 and outboard spring 82 may be more pronouncedly compressed) relative to the other diagonal pair of springs (e.g., inboard spring 78 and outboard spring 80 may be less pronouncedly compressed than springs 76 and 80) tends to yield a restorative moment couple acting on the sideframe wear plates. This moment couple tends to rotate the sideframe in a direction to square the truck, (that is, in a position in which the bolster is perpendicular, or "square", to the sideframes). As such, the dampers co-operate in acting as biased members working between the bolster and the side frames to resist parallelogram, or lozenging, deformation of the side frame relative to the truck bolster.

Figure 14A:
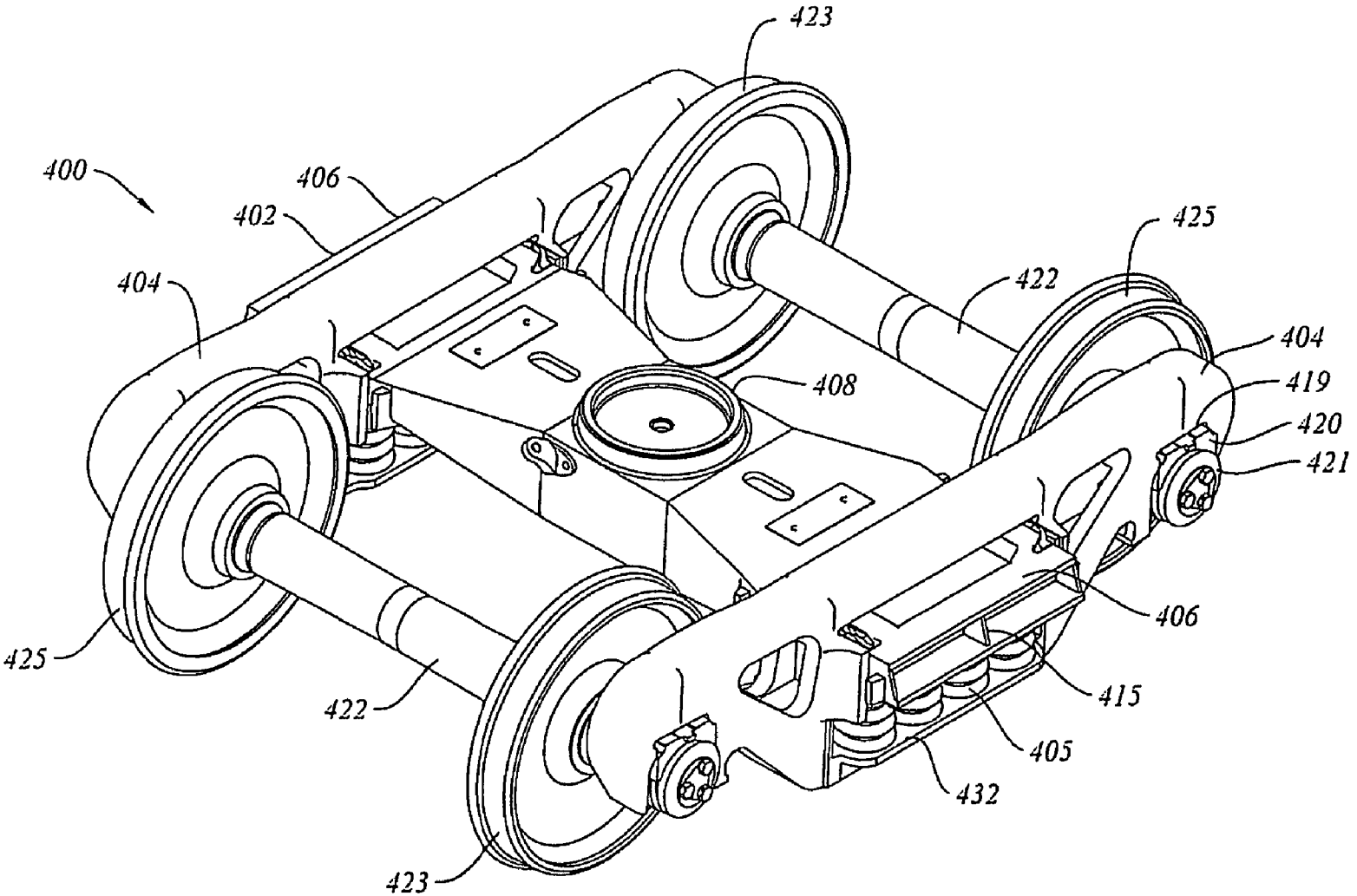
FIG. 14*a* shows an isometric view of an alternate three piece truck to that of FIG. 1*a;*

The foregoing explanation has been given in the context of trucks 20 and 22, each of which has a spring group that has three rows facing the sideframe columns. The restorative moment couple of a four-cornered damper layout can also be explained in the context of a truck having a 2 row spring group arrangement facing the dampers, as in truck 400 of FIGS. 14*a* to 14*e*. For the purposes of conceptual visualisation, the normal force on the friction face of any of the dampers can be taken as a pressure field whose effect can be approximated by a point load acting at the centroid of the pressure field and whose magnitude is equal to the integrated value of the pressure field over its area. The center of this distributed force, acting on the inboard friction face of wedge 440 against column 428 can be thought of as a point load offset transversely relative to the diagonally outboard friction face of wedge 443 against column 430 by a distance that is notionally twice dimension 'L' shown in the conceptual sketch of FIG. 1*k*. In the example of FIG. 14*a*, this distance, 2L, is about one full diameter of the large spring coils in the spring set. The restoring moment in such a case would be, conceptually, $M_R=[(F_1+F_3)-(F_2+F_4)]L$. As indicated by the formulae on the conceptual sketch of FIG. 1*k*, the difference between the inboard and outboard forces on each side of the bolster is proportional to the angle of deflection $\epsilon$ of the truck bolster relative to the side frame, and since the normal forces due to static deflection $x_0$ may tend to cancel out, $M_R=4k_x \text{Tan}(\epsilon)\text{Tan}(\theta)L$, where $\theta$ is the primary angle of the damper (generally illustrated as alpha herein), and $k_c$ is the vertical spring constant of the coil upon which the damper sits and is biased.

In the various arrangements of spring groups 2×4, 3×3, 3:2:3 or 3×5 group, dampers may be mounted over each of four corner positions. The portion of spring force acting under the damper wedges may be in the 25-50% range for springs of equal stiffness. If not of equal stiffness, the portion of spring force acting under the dampers may be in the range of perhaps 20% to 35%. The coil groups can be of unequal stiffness if inner coils are used in some springs and not in others, or if springs of differing spring constant are used.

In the view of the present inventors, it may be that an enhanced tendency to encourage squareness at the bolster to sideframe interface (i.e., through the use of four cornered damper groups) may tend to reduce reliance on squareness at the pedestal to wheelset axle interface. This, in turn, may tend to provide an opportunity to employ a torsionally compliant (about the vertical axis) axle to pedestal interface assembly, and to permit a measure of self steering.

Bearing plate 92 (FIG. 1*a*) is significantly wider than the through thickness of the sideframes more generally, as measured, for example, at the pedestals, and may tend to be wider than has been conventionally common. This additional width corresponds to the additional overall damper span width measured fully across the damper pairs, plus lateral travel as noted above, typically allowing 1½ (+/−) inches of lateral travel of the bolster relative to the sideframe to either side of the undeflected central position. That is, rather than having the width of one coil, plus allowance for travel, plate 92 has the width of three coils, plus allowance to accommodate 1½ (+/−) inches of travel to either side for a total, double amplitude travel of 3" (+/−). Bolster 24 has inboard and outboard gibs 106, 108 respectively, that bound the lateral motion of bolster 24 relative to sideframe columns 36. This motion allowance may advantageously be in the range of +/−1⅛ to 1¾ in., and may be in the range of 1 3/16 to 1 9/16 in., and can be set, for example, at 1½ in. or 1¼ in. of lateral travel to either side of a neutral, or centered, position when the sideframe is undeflected.

The lower ends of the springs of the entire spring group, identified generally as 58, seat in lower spring seat 52. Lower spring seat 52 may be laid out as a tray with an upturned rectangular peripheral lip. Although truck 20 employs a spring group in a 5×3 arrangement, and truck 22 employs a spring group in a 3×3 arrangement, this is intended to be generic, and to represent a range of variations. They may represent a 2×4 arrangement, a 3:2:3 arrangement, and may include a hydraulic snubber, or such other arrangement of springs may be appropriate for the given service for the railcar for which the truck is intended.

Further, in typical friction damper wedges, the enclosed angle of the wedge tends to be somewhat less than 35 degrees measured from the vertical face to the sloped face against the bolster. As the wedge angle decreases toward 30 degrees, the tendency of the wedge to jam in place may tend to increase. Conventionally the wedge is driven by a single spring in a large group. The portion of the vertical spring force acting on the damper wedges can be less than 15% of the group total.

Figure 14B:
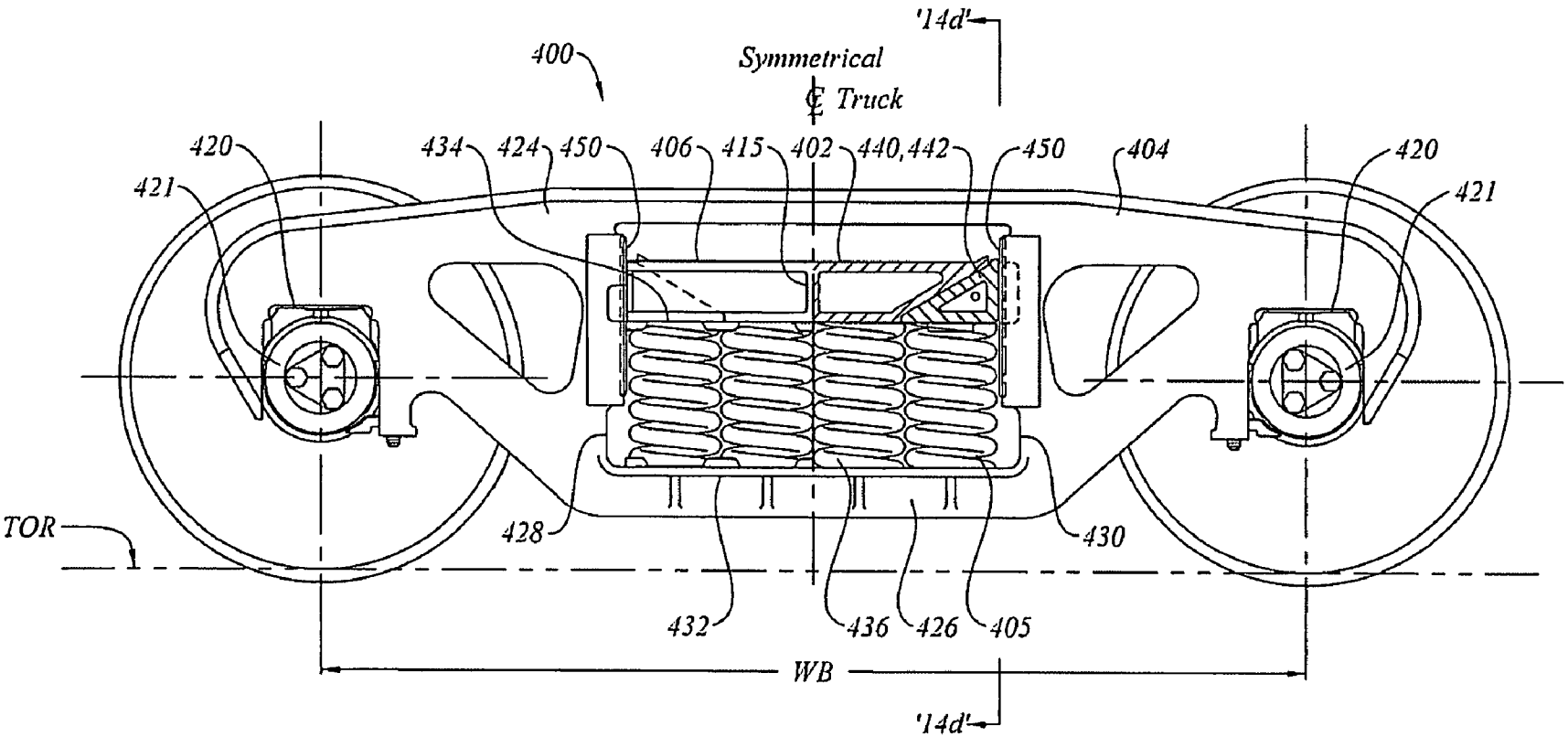
FIG. 14*b* shows a side view of the three piece truck of FIG. 14*a;*

Damper wedges 64, 66 and 68, 70 may sit over the coil positions of 4/9 of a 3 rows×3 columns spring group, which may account for 15% to 35% of the overall spring rate of the group. In the embodiment of FIG. 14*b*, it may be 50% of the group total (i.e., 4 of 8 equal springs). There are three related variables that are subject to optimization, namely (a) the choice, and layout of the various springs, (i.e., general arrangement of rows and columns), (b) the use (or not) of outer, inner, and inner-inner coils, use of side coils, whether outer and inner, and use of snubbers to determine not only the overall spring stiffness, but also the proportion of that stiffness to be carried under the dampers; and (c) the primary angle of the wedges. There are many possible damper styles and arrangements. In general, for the same proportion of vertical damping, where a higher proportion of the total spring stiffness is mounted under the dampers, the corresponding wedges may tend to have a larger included angle (i.e., between the wedge hypotenuse and the vertical face for engaging the friction wear plates on the sideframe columns 36). The use of more springs, or more precisely, a greater portion of the overall spring stiffness, under the dampers, may permit the enclosed angle of wedges 440, 442 to be over 35 degrees. The included angle may range from around 30-35 degrees to perhaps as much as 60-65 degrees, with a more moderate range being in the range of 35-45 degrees, or thereabout. The specific angle may tend to be a function of the specific spring stiffnesses and spring combinations actually employed.

One way to encourage an increase in the hunting threshold may be to employ a truck having a longer wheelbase, or one whose length is proportionately great relative to its width. For example, at present two axle truck wheelbases may generally range from about 5'-3" to 6'-0". However, the standard North American track gauge is 4'-8½", giving a wheelbase to track width ratio possibly as small as 1.12. At 6'-0" the ratio is roughly 1.27. It may be preferable to employ a wheelbase having a longer aspect ratio relative to the track gauge.

In the case of truck 20, the size of the spring group may yield an opening between the vertical columns of sideframe more than 27½ inches wide. Truck 20 may have a greater wheelbase length, indicated as WB (FIG. 1*c*). WB may be greater than 73 inches, or, taken as a ratio to the track gauge width, and may also be greater than 1.30 times the track gauge width. It may be greater than 80 inches, or more than 1.4 times the gauge width, and in one embodiment is greater than 1.5 times the track gauge width, being as great, or greater than, about 86 inches.

Rocker Description

The present inventors have noted that the rocking interface surface of the bearing adapter might have a crown, or a concave curvature, like a swing motion truck, by which a rolling contact on the rocker permits lateral swinging of the side frame. The present inventors have also noted, as shown and described herein, that the bearing adapter to pedestal seat interface might also have a fore-and-aft curvature, whether a crown or a depression, and that, if used as described by the inventors hereinbelow, this crown or depression might tend to present a more or less linear resistance to deflection in the longitudinal direction, much as a spring or elastomeric pad might do. The present inventors also note that it may be advantageous for the rockers to be self centering.

For surfaces in rolling contact on a compound curved surface (i.e., having curvatures in two directions) as shown and described by the present inventors hereinbelow, the vertical stiffness may again be approximated as infinite; the longitudinal stiffness in translation at the point of contact can also be taken as infinite, the assumption being that the surfaces do not slip; the lateral stiffness in translation at the point of contact can be taken as infinite, again, provided the surfaces do not slip. The rotational stiffness about the vertical axis may be taken as zero or approximately zero. By contrast, the angular stiffnesses about the longitudinal and transverse axes are non-trivial. The lateral angular stiffnesses may tend to determine the equivalent pendulum stiffnesses for the sideframe more generally.

Where a complex, two dimensional, curvature is used as suggested herein, the torsional stiffness across the bearing adapter crown to pedestal seat roof interface may be taken as being zero, as noted above. Another observation of the present inventors is that it is desirable for the rockers to remain in rolling (i.e., static) contact, as opposed to breaking free and sliding, with resultant undesirable kinematic friction.

Where a truck already has an elastomeric bearing adapter pad, a fore-and-aft rocker may also be used to obtain as additional measure of self steering without unduly softening the lateral response of the bearing adapter to pedestal seat interface. Alternatively, depending on the properties and performance of the elastomeric pad, it may be desirable to employ a laterally swinging rocker as well as an elastomeric pad, such that a measure of self steering may be achieved with a side frame that rocks in the manner of a swing motion truck.

The stiffness of a pendulum is directly proportional to the weight on the pendulum. Similarly, the drag on a rail car wheel, and the wear to the underlying track structure is proportional to the weight borne by the wheel. For this reason, the desirability of self steering may be greatest for a fully laden car, and a pendulum may tend to maintain a general proportionality between the amount of drag and the stiffness of the self-steering mechanism.

Truck performance may vary with the friction characteristics of the bearing surfaces of the dampers used in the truck suspension. Conventional dampers have tended to employ dampers in which the dynamic and static coefficients of friction may have been significantly different, yielding a stick-slip phenomenon that may not have been entirely advantageous. In the view of the present inventors it may be advantageous to combine the feature of a self-steering capability with dampers that have a reduced tendency to stick-slip operation.

Furthermore, the present inventors have noted that while bearing adapters may be formed of relatively low cost materials, such as cast iron, where a rocker is used as proposed herein, it may be desirable to use an insert of a different material for the rocker. The inventors also propose that it may be desirable to employ a member that may tend to center the rocker on installation, and that may tend to perform an auxiliary centering function to tend to urge the rocker to operate from a desired minimum energy position.

Now considering the interface between the sideframe pedestal and the bearing adapter, the geometry and operation of an embodiment of bearing adapter and pedestal seat assembly is first illustrated in the series of views of FIGS. 2*a*-2*g*. Bearing adapter 44 has a lower portion 112 that is formed to accommodate, and seat upon, bearing 46, that is itself mounted on the end of a shaft, namely an end of axle 48. Bearing adapter 44 has an upper portion 114 that has a centrally located, upwardly protruding fitting in the nature of a male bearing adapter interface portion 116. A mating fitting, in the nature of a female rocker seat interface portion 118 is rigidly mounted within the roof 120 of the sideframe pedestal. To that end, laterally extending lugs 122 are mounted centrally with respect to pedestal roof 120. The upper fitting 40, whichever type it may be, has a body that is a plate having, along its longitudinally extending, lateral margins a set of upwardly extending lugs or ears, or tangs 124 separated by a notch, that bracket, and tightly engage lugs 122, thereby locating upper fitting 40 in position, with the back of the plate 126 of fitting 40 abutting the flat, load transfer face of roof 120. In this instance, upper fitting 40 is a pedestal seat fitting with a hollowed out female bearing surface, namely portion 118.

Figure 2A:
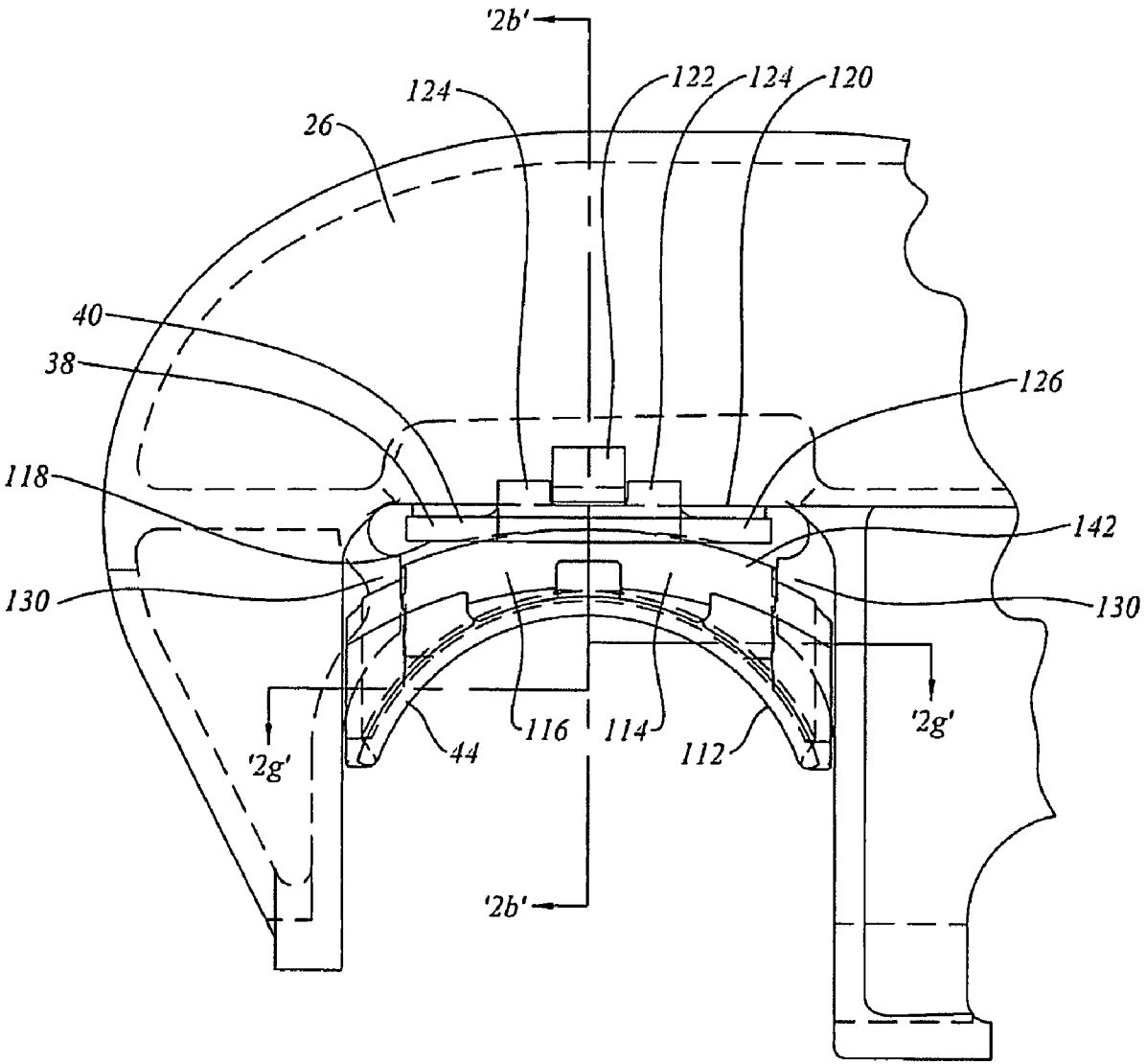
FIG. 2*a* is an enlarged detail of a side view of a truck such as the truck of FIGS. 1*b*, 1*g*, 1*i* or 1*j* taken at the sideframe pedestal to bearing adapter interface.
Figure 2C:
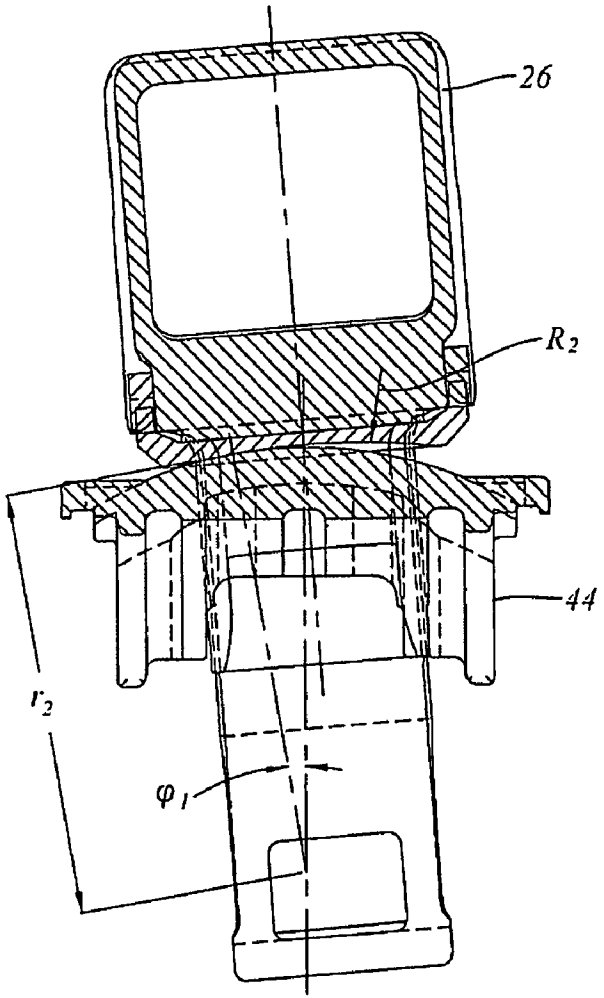
FIG. 2*c* shows the cross-section of FIG. 2*a* in a laterally deflected condition.
Figure 2B:
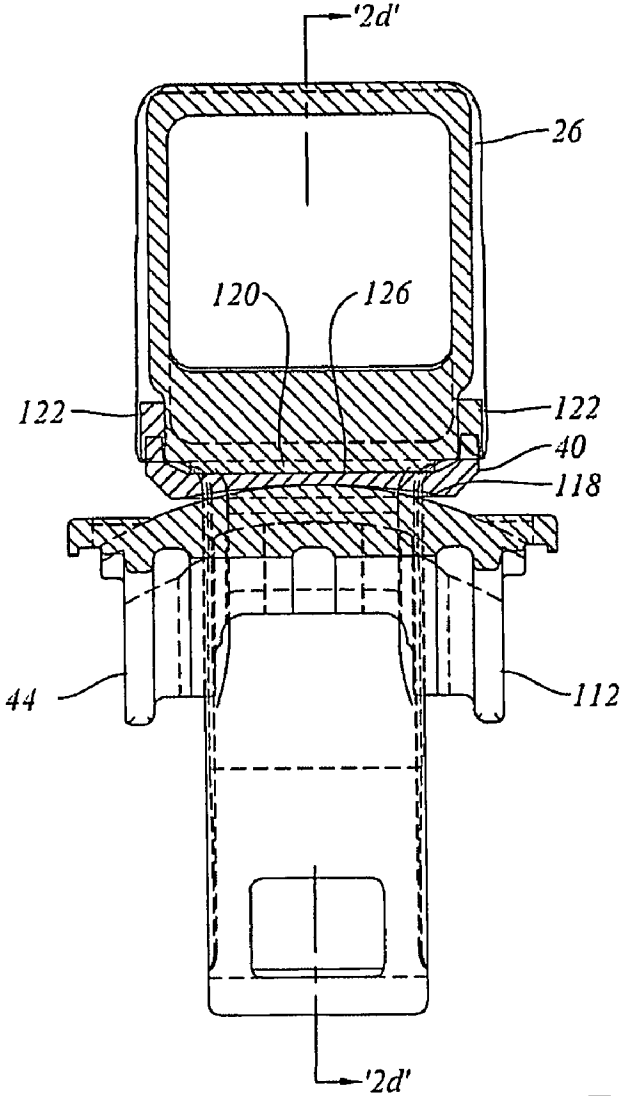
FIG. 2*b* shows a lateral cross-section through the sideframe pedestal to bearing adapter interface of FIG. 2*a*, taken at the wheelset axle centreline.
Figure 2D:
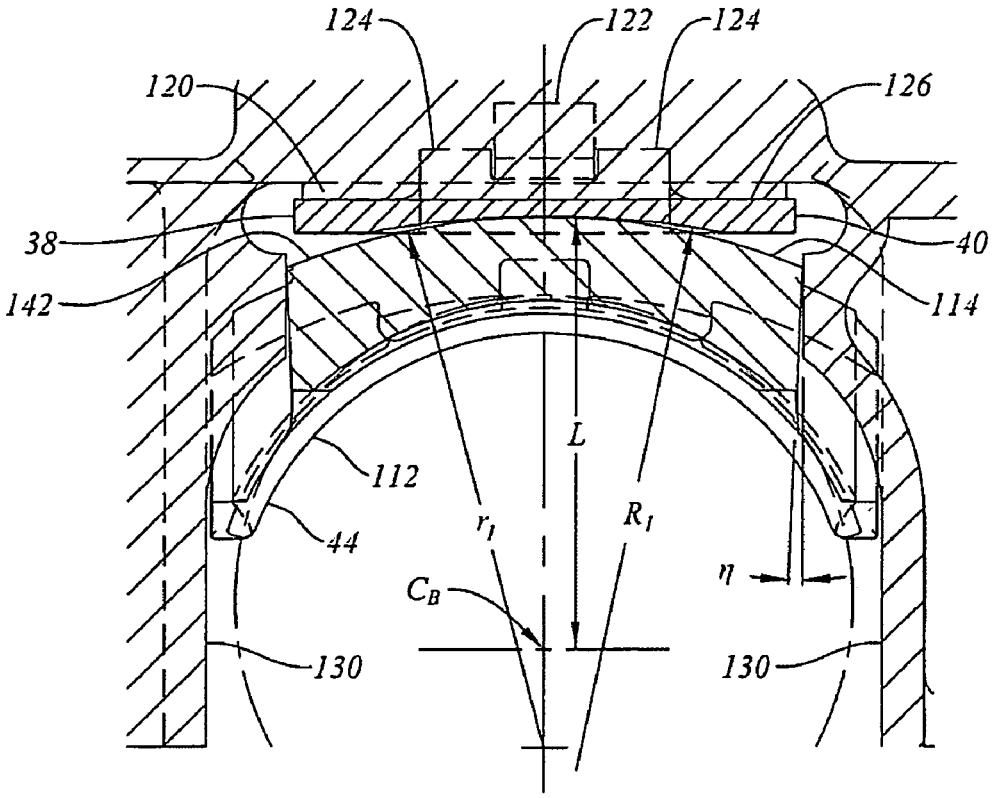
FIG. 2*d* is a longitudinal section of the pedestal seat to bearing adapter interface of FIG. 2*a*, on the longitudinal plane of symmetry of the bearing adapter.
Figure 2E:
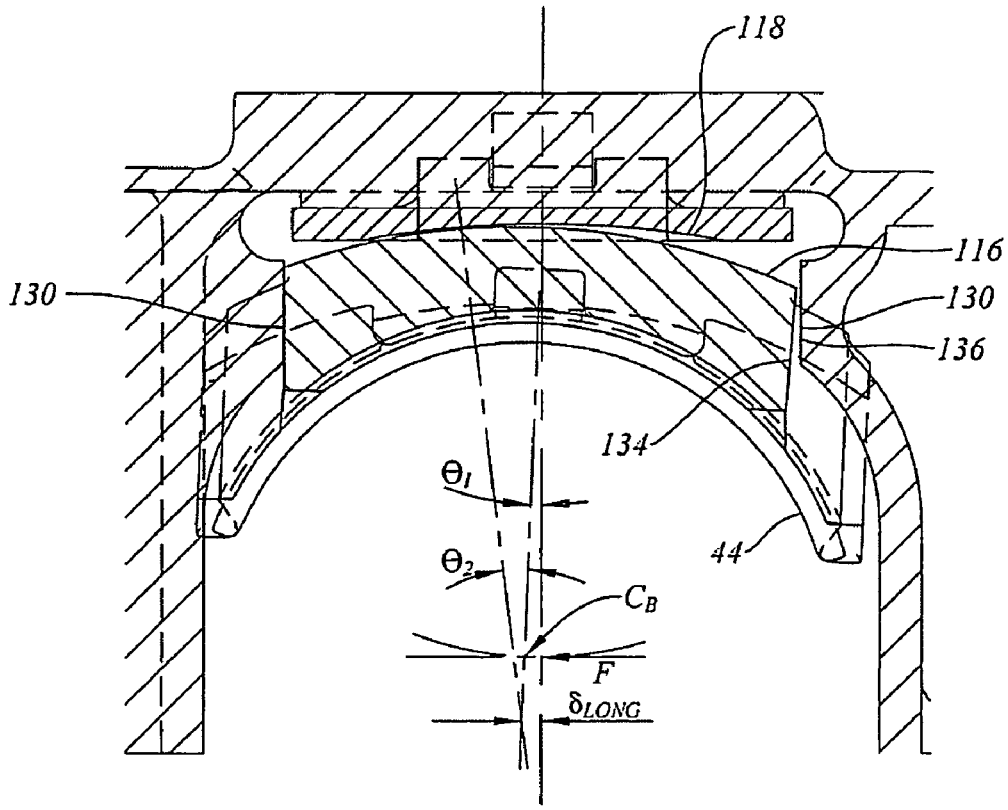
FIG. 2*e* shows the longitudinal section of FIG. 2*d* as longitudinally deflected.
Figure 2F:
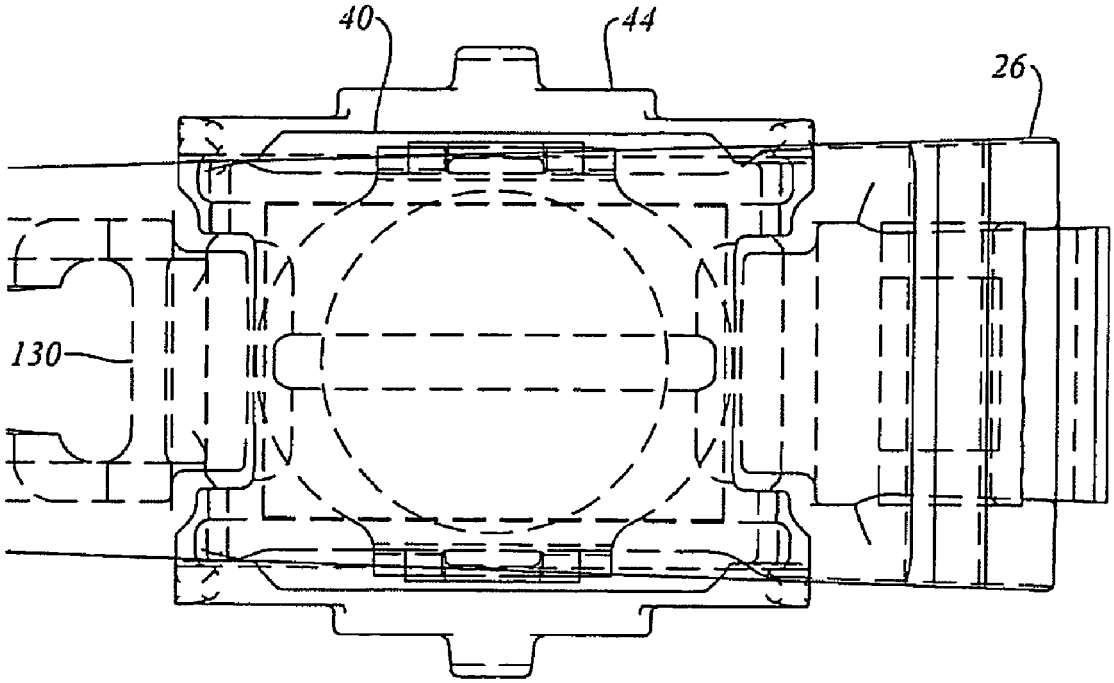
FIG. 2*f* shows a top view of the detail of FIG. 2*a;*
Figure 2G:
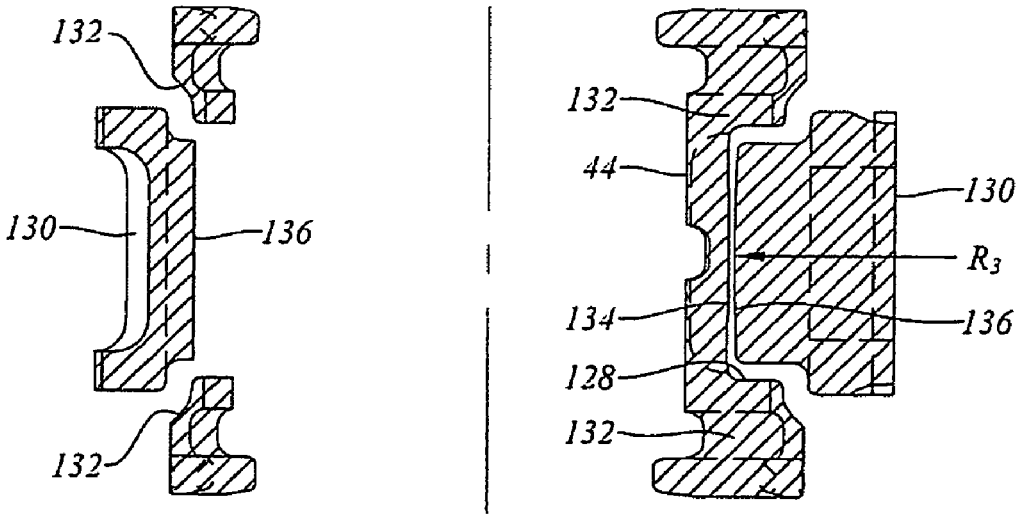
FIG. 2*g* shows a staggered section of the bearing adapter of FIG. 2*a*, on section lines '2*g*-2*g*' of FIG. 2*a;*

As shown in FIG. 2*g*, when the sideframes are lowered over the wheel sets, the end reliefs, or channels 128 lying between corner abutments 132 seat between the respective side frame pedestal jaws 130. With the sideframes in place, bearing adapter 44 is thus captured in position with the male and female portions (116 and 118) of the adapter interface in mating engagement.

Male portion 116 (FIG. 2*d*) has been formed to have a generally upwardly facing surface 142 that has both a first curvature $r_1$ to permit rocking in the longitudinal direction, and a second curvature $r_2$ (FIG. 2*c*) to permit rocking (i.e. swing motion of the sideframe) in the transverse direction. Similarly, in the general case, female portion 118 has a surface having a first radius of curvature $R_1$ in the longitudinal direction, and a second radius of curvature $R_2$ in the transverse direction. The engagement of $r_1$ with $R_1$ tends to permit a rocking motion in the longitudinal direction when the wheel set exhibits a tendency to drag, with rocking displacement being generally linearly proportionate to the drag since wheel drag may be proportional to weight on the wheel. That is to say, the resistance to angular deflection is proportional to weight rather than being a fixed spring constant. This may tend to yield passive self-steering in both the light car and fully laden conditions. This relationship is shown in FIGS. 2*d* and 2*e*. FIG. 2*d* shows the centered, or at rest, non-deflected position of the longitudinal rocking elements. FIG. 2*e* shows the rocking elements at their condition of maximum longitudinal deflection. FIG. 2*d* represents a local, minimum potential energy condition for the system. FIG. 2*e* represents a system in which the potential energy has been increased by virtue of the work done by drag force F acting longitudinally in the horizontal plane through the center of the axle and bearing, $C_B$. The present inventors have applied the following approximation for this longitudinal rocking motion:

$$F/\delta_{long}=k_{long}=(W/L)[[(1/L)/(1/r_1-1/R_1)]-1]$$

Where:

- $k_{long}$ is the longitudinal constant of proportionality between longitudinal force and longitudinal deflection for the rocker.
- F is a unit of longitudinal force, namely of drag on the wheel.
- $\delta_{long}$ is a unit of longitudinal deflection of the centreline of the axle.
- W is the weight on the pendulum.
- L is the distance from the centreline of the axle to the apex of male portion 116.
- $R_1$ is the longitudinal radius of curvature of the female hollow in the pedestal seat 38.
- $r_1$ is the longitudinal radius of curvature of the crown of the male portion 116 on the bearing adapter.

It will be noted that $R_1$ is greater than $r_1$ in this relationship, and (1/L) is greater than $[(1/r_1)-(1/R_1)]$.

The limit of travel in the longitudinal direction is reached when the end face 134 of bearing adapter 44 extending between corner abutments 132, comes into contact with one or other of the travel limiting abutment faces 136 of jaws 130. In the general case, the deflection can be characterized either by the angular displacement of the centreline of the axle as $\theta_1$, or by the angular displacement of the contact point of the rocker on radius $r_1$, indicated as $\theta_2$. End face 134 of bearing adapter 44 is planar, and is relieved, or inclined, at an angle η from the vertical. As shown in FIG. 2*g*, abutment face 136 may have a round, cylindrical arc, with the major axis of the cylinder extending vertically. A typical maximum radius $R_3$ for this surface is 34 inches. When bearing adapter 44 is fully deflected through angle η, end face 134 is intended to meet abutment face 136 in line contact. When this occurs, further rocking motion of the male surface against the female surface is inhibited. Thus jaws 130 constrain the arcuate deflection of bearing adapter 44 to a limited range. A typical range for η might be about 3 degrees of arc. A typical maximum value of $\delta_{long}$ may be about +/−3/16" to either side of the vertical, at rest, center line.

Similarly, as shown in FIGS. 2*b* and 2*c*, in the transverse direction, the engagement of $r_2$ with $R_2$ may tend to permit lateral rocking motion, in the manner of a swing motion truck. FIG. 2*b* shows a centered, at rest, minimum potential energy position of the lateral rocking system. FIG. 2*c* shows the same system in a laterally deflected condition. In this instance $\delta_2$ is roughly $(L_{pendulum}-r_2)\text{Sin}\,\phi$, where, for small angles Sin φ is approximately equal to φ. The present inventors have applied the following approximation for this condition, for small angular deflections:

$$k_{pendulum}=(F_2/\delta_2)=(W/L_{pend.})[[(1/L_{pend.})/((1/R_{Rocker})-(1/R_{Seat}))]+1]$$

where:

- $k_{pendulum}$=the lateral stiffness of the pendulum
- $F_2$=the force per unit of lateral deflection applied at the bottom spring seat
- $\delta_2$=a unit of lateral deflection
- W=the weight borne by the pendulum
- $L_{pend.}$=the length of the pendulum, being the distance from the contact surface of the bearing adapter to the bottom of the pendulum at the spring seat
- $R_{Rocker}=r_2$=the lateral radius of curvature of the rocker surface
- $R_{Seat}=R_2$=the lateral radius of curvature of the rocker seat Where $R_{Seat}$ and $R_{Rocker}$ are of similar magnitude, and are not unduly small relative to L, the pendulum may tend to have a relatively large lateral deflection constant. It will be noted that where $R_{Seat}$ is large as compared to L or $R_{Rocker}$, or both, and can be approximated as infinite (i.e., a flat surface), this formula simplifies to:

$$k_{pendulum}=(F_{lateral}/\delta_{lateral})=(W/L_{pendulum})[(R_{curvature}/L_{pendulum})+1]$$

where:

- $k_{pendulum}$=the lateral stiffness of the pendulum
- $F_{lateral}$=the force per unit of lateral deflection
- $\delta_{lateral}$=a unit of lateral deflection
- W=the weight borne by the pendulum
- $L_{pendulum}$=the length of the pendulum, being the vertical distance from the contact surface of the bearing adapter to the bottom spring seat
- $R_{curvature}$=the radius of curvature of the rocker surface Following from this, if the pendulum stiffness is taken in series with the lateral spring stiffness, then the resultant overall lateral stiffness can be obtained. Using this number in the denominator, and the design weight in the numerator yields a length, effectively equivalent to a pendulum length if the entire lateral stiffness came from an equivalent pendulum according to $L_{eq}=W/k_{lateral\ total}$ When a lateral force is applied at the centerplate of the truck bolster, a reaction force is, ultimately, provided at the meeting of the wheels with the rail. The lateral force is transmitted from the bolster into the main spring groups, and then into a lateral force in the spring seats to deflect the bottom of the pendulum. The reaction is carried to the bearing adapter, and hence into the top of the pendulum. The pendulum will then deflect until the weight on the pendulum, multiplied by the moment arm of the deflected pendulum is sufficient to balance the moment of the lateral moment couple acting on the pendulum.

It may be noted that this bearing adapter to pedestal seat interface assembly is biased by gravity acting on the pendulum toward a central, or "at rest" position, where there is a local minimum of the potential energy in the system. The fully deflected position shown in FIG. 2*c* may correspond to a deflection from vertical of the order of rather less than 10 degrees (and preferably less than 5 degrees) to either side of center, the actual maximum being determined by the spacing of gibs 106 and 108 relative to plate 104. Although in the general case $R_1$ and $R_2$ may be different such that the female surface is a section of the outside of a torus, it may be convenient, and desirable, for $R_1$ and $R_2$ to be the same, i.e., so that the bearing surface of the female fitting is formed as a portion of a spherical surface, having neither a major nor a minor axis, but merely being formed on a spherical radius. $R_1$ and $R_2$ give a self-centering tendency. That tendency may be quite gentle.

Further, and again in the general condition, the smallest of $R_1$ and $R_2$ may be equal to or larger than the largest of $r_1$ and $r_2$. If so, then the contact point may have little, if any, ability to transmit torsion acting about an axis normal to the point of contact, so the lateral and longitudinal rocking motions may tend to be torsionally de-coupled, and hence it may be said that relative to this degree of freedom (rotation about the vertical, or substantially vertical axis) the interface is torsionally compliant. For small angular deflections, the torsional stiffness about the normal axis at the contact point, this condition may sometimes be satisfied even where the smaller of the female radii is substantially less than the largest male radius.

Although it is possible for $r_1$ and $r_2$ to be the same, such that the crowned surface of the bearing adapter (or the pedestal seat, if the relationship is inverted) is a portion of a spherical surface, in the general case $r_1$ and $r_2$ may be different, with $r_1$ perhaps tending to be larger, possibly significantly larger, than $r_2$. In the event that $r_1$ and $r_2$, are the same, then $R_1$ and $R_2$ need not be. In the general case, whether or not $r_1$ and $r_2$ are equal, then $R_1$ and $R_2$ may be the same or different. Where $r_1$ and $r_2$ are different, the male fitting engagement surface may be a section of the surface of a torus. It may also be noted that, provided the system may tend to return to a local minimum energy state (i.e., that is self-restorative in normal operation) in the limit either or both of $R_1$ and $R_2$ may be infinitely large such that either a cylindrical section is formed or, when both are infinitely large, a planar surface may be formed. In the further alternative, it may be that $r_1=r_2$, and $R_1=R_2$.

Constant radii of curvature have been discussed thus far. While it may be practical to make mating male and female engagement surfaces with circular arcs and constant radii of curvature, alternate arcs may also be considered. For example, the surfaces may be elliptic, or may be parabolic. The surfaces may have a smaller radius of curvature in a central portion to give a generally softer lateral response for low amplitude perturbations (and possibly relatively high frequency), with a larger radius of curvature at greater lateral angular deflection to provide a stiffer response as the magnitude of deflection increases. Alternatively, in the longitudinal direction, there may be a central portion with a large radius of curvature to yield a relatively stiff response until the moment couple tending to cause passive self steering builds up, and then a smaller radius of curvature to ease self steering once a certain threshold has been reached. The arrangement of FIG. 2*a* can be inverted, such that the female engagement fitting portion may be part of bearing adapter 44, and the male fitting may be mounted to the pedestal roof 120.

The embodiment of bearing adapter to pedestal seat interface described above and shown in FIGS. 2*a*-2*g*, may tend to have very high stiffness in vertical translation, longitudinal translation, and transverse translation, to the extent that non-slip, rolling contact is maintained. To the extent that there is point contact between the compound curvature surface of the male portion and the female portion, and the smallest radius of curvature of the female portion is larger than the largest radius of curvature of the male portion, the torsional resistance to relative rotation about the vertical, or z axis may tend to be minimal, if not zero, (i.e., it is highly torsionally compliant) and, for the purposes of approximation, torsional resistance may be taken as being zero. There may tend to be little or no torsional moment passed through the bearing adapter interface. Rotation about the lateral and longitudinal axes of rotation, namely the x and y axes, is non-trivial, and may correspond to the equations provided above.

The rocker surfaces herein may tend to be formed of a relatively hard material, which may be a metal or metal alloy material, such as a steel. Such materials may have elastic deformation at the location of rocking contact in a manner analogous to that of journal or ball bearings. Nonetheless, the rockers may be taken as approximating the ideal rolling point or line contact (as may be) of infinitely stiff members. This is to be distinguished from materials in which deflection of an elastomeric element be it a pad, or block, of whatever shape, may be intended to determine a characteristic of the dynamic or static response of the element.

In one embodiment the lateral rocking constant for a light car may be in the range of about 48,000 to 130,000 in-lbs per radian of angular deflection of the side frame pendulum, or, 260,000 to 700,000 in-lbs per radian for a fully laded car, or more generically, about 0.95 to 2.6 in-lbs per radian per pound of weight borne by the pendulum. Alternatively, for a light (i.e., empty) car the stiffness of the pendulum may be in the range 3,200 to 15,000 lbs per inch, and 22,000 to 61,000 lbs per inch for a fully laden 110 ton truck, or, more generically, in the range of 0.06 to 0.160 lbs per inch of lateral deflection per pound weight borne by the pendulum, as measured at the bottom spring seat.

In one embodiment $R_1=R_2=15$ inches, $r_1=8\frac{5}{8}$ inches and $r_2=5"$. In another embodiment, $R_1=R_2=15$ inches, and $r_1=10"$ and $r_2=8\frac{5}{8}"$ (+/−). In another embodiment $r_1=8\frac{5}{8}$, $r_2=5"$, $R_1=R_2=12"$ in still another embodiment $r_1=12\frac{1}{2}"$, $r_2=8\frac{5}{8}$ and $R_1=R_2=15"$. The radius of curvature of the male longitudinal rocker, $r_1$, may be less than 60 inches, and may lie in the range of 5 to 40 inches, and may lie in the range of 8 to 20 inches, and may be about 15 inches. $R_1$ may be less than 100 inches, and may be in the range of 10 to 60 inches, or in the narrower range of 12 to 40 inches, and may be in the range of $\frac{1}{10}$ to 4 times the size of $r_1$. The radius of curvature of the male lateral rocker, $r_2$, may be less than about 25 or 30 in., being half, or less than half, of the 60 inch crown radius of bearing adapters of trucks that might not generally be considered to be "swing motion" trucks, and may lie in the range of about 5 to 20 inches. $r_2$ may lie in the range of about 8 to 16 inches, and may be about 10 inches. Where a spherical male rocker is used on a spherical female cap, the male radius may be in the range of 8-10 in., and may be about 9 in.; the female radius may be in the range of 11-13 in., and may be about 12 in. Where a torus, or elliptical surface is employed, in one embodiment the lateral male radius may be about 7 in., the longitudinal male radius may be about 10 inches, the lateral female radius may be about 12 in. and the longitudinal female radius may be about 15 in. Where a flat female rocker surface is used, and a male spherical surface is used, the male radius of curvature may be in the range of about 20 to about 50 in., and may lie in the narrower range of 30 to 40 in. Many combinations are possible, depending on loading, intended use, and rocker materials.

Where line contact rocking motion is used, $r_2$ may perhaps be somewhat smaller than otherwise, perhaps in the range of 3 to 10 inches, and perhaps being about 5 inches. $R_2$ may be less than 60 inches, and may be less than about 25 or 30 inches, then being less than half the 60 inch crown radius noted above. Alternatively, $R_2$ may lie in the range of 6 to 40 inches, and may lie in the range of 5 to 15 inches in the case of rolling line contact. $R_2$ may be between 1½ to 4 times as large as $r_2$. In one embodiment $R_2$ may be roughly twice as large as $r_2$, (+/−20%).

FIGS. 3*a*-3*g*

FIGS. 3*a* to 3*g* show and alternate bearing adapter 144 and pedestal seat 146 pair. Bearing adapter 144 is substantially the same as bearing adapter 44, except insofar as bearing adapter 44 has a fully curved top surface 142, whereas bearing adapter 144 has an upper surface that has a flat central portion 148 between somewhat elevated side portions 150. The male bearing surface portion 152 is located centrally on flat central portion 148, and extends upwardly therefrom. As with bearing adapter 44, bearing adapter 144 has first and second radii $r_1$ and $r_2$, formed in the longitudinal and transverse directions respectively, such that the upwardly protruding surface so formed is a toroidal surface. Pedestal seat 146 is substantially similar to pedestal seat fitting 38. Pedestal seat 146 has a body having an upper surface 154 that seats in planar abutment against the downwardly facing surface of pedestal roof 120, and upwardly extending tangs 124 that engage lugs 122 as before.

Figure 3A:
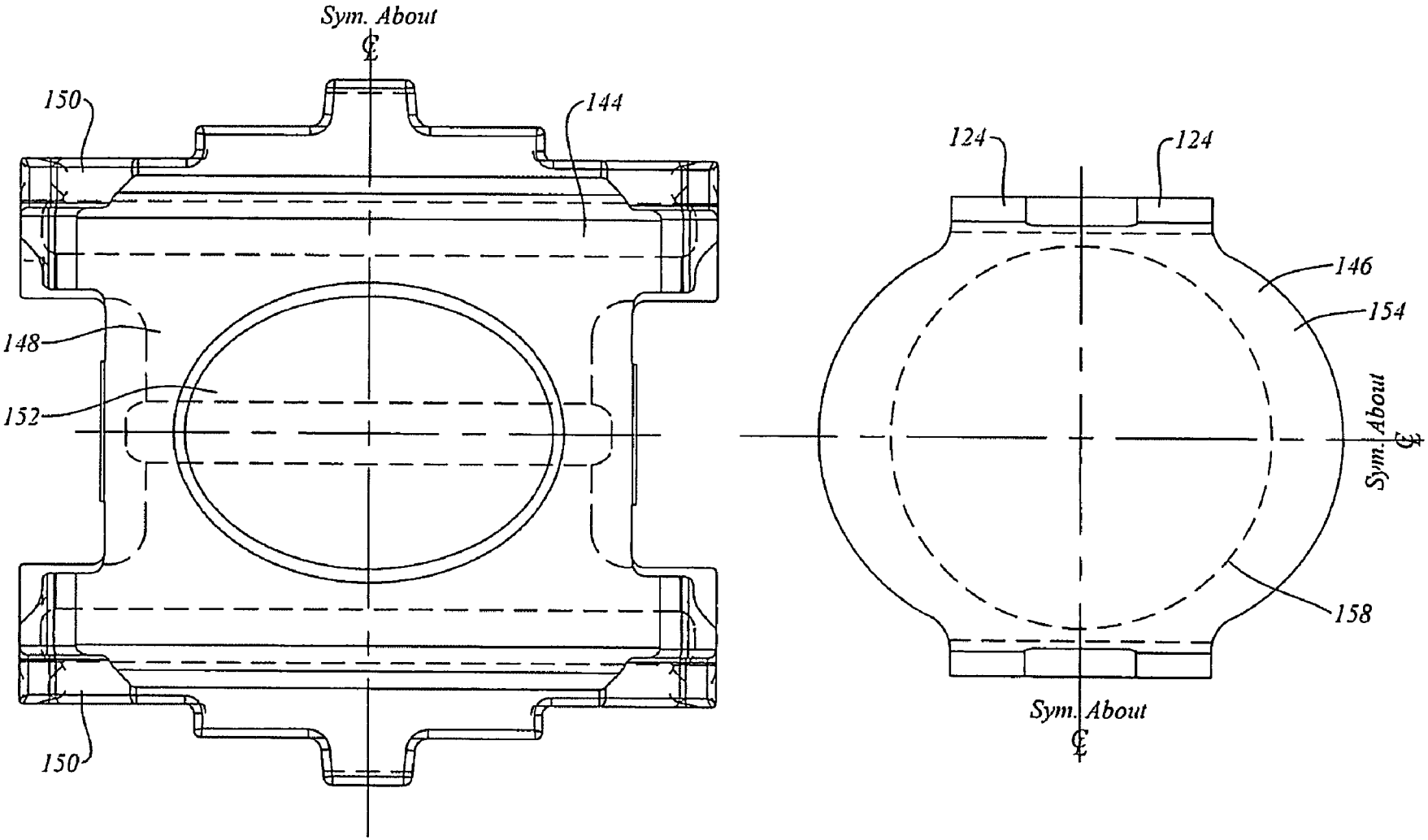
FIG. 3*a* shows a top view of an embodiment of bearing adapter and pedestal seat such as could be used in a side frame pedestal similar to that of FIG. 2*a*, with the seat inverted to reveal a female depression formed therein for engagement with the bearing adapter.
Figure 3B:
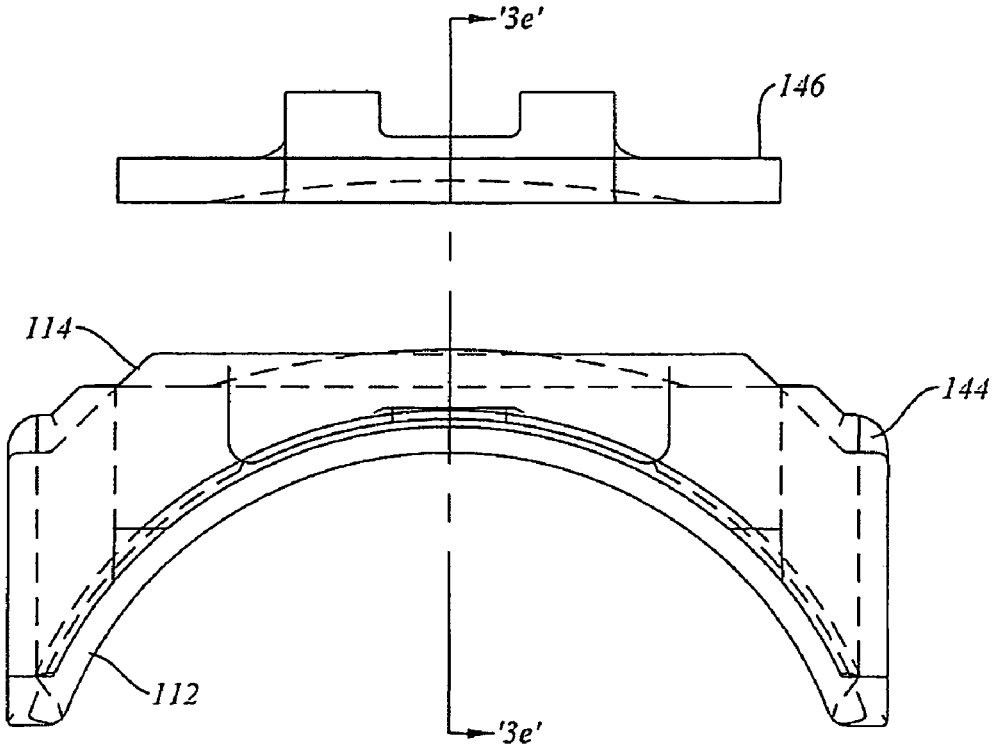
FIG. 3*b* shows a side view of the bearing adapter and seat of FIG. 3*a;*
Figure 3C:
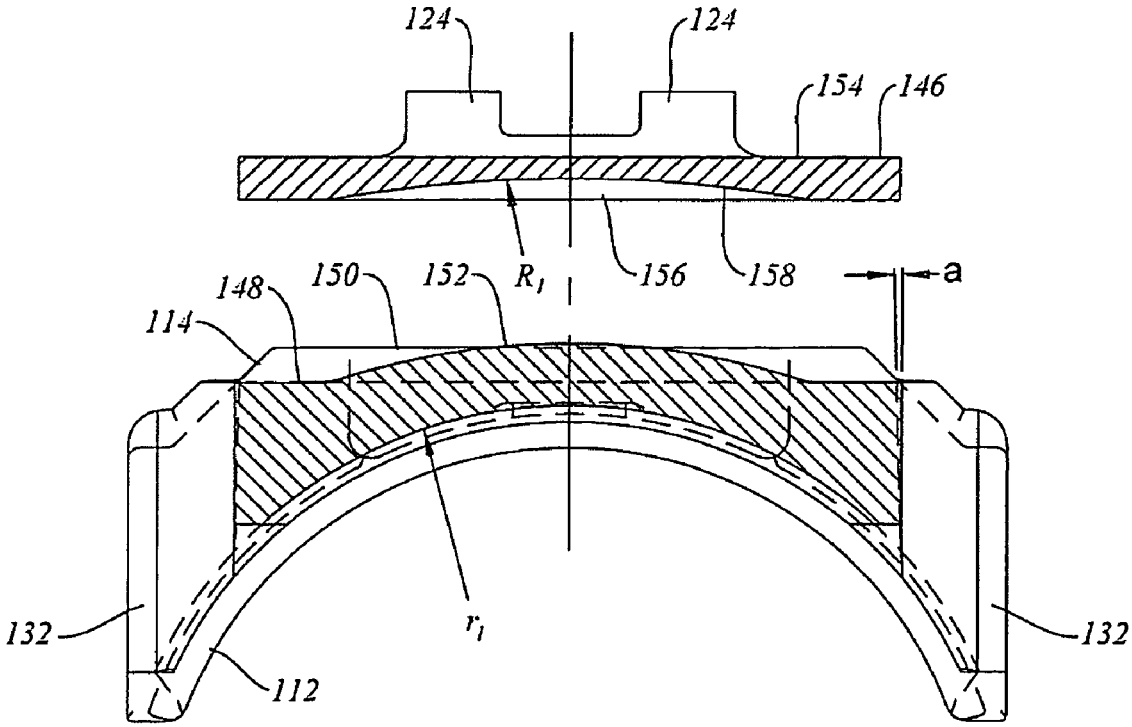
FIG. 3*c* shows a longitudinal section of the bearing adapter of FIG. 3*a* taken on section '3*c*-3*c*' of FIG. 3*d;*
Figure 3D:
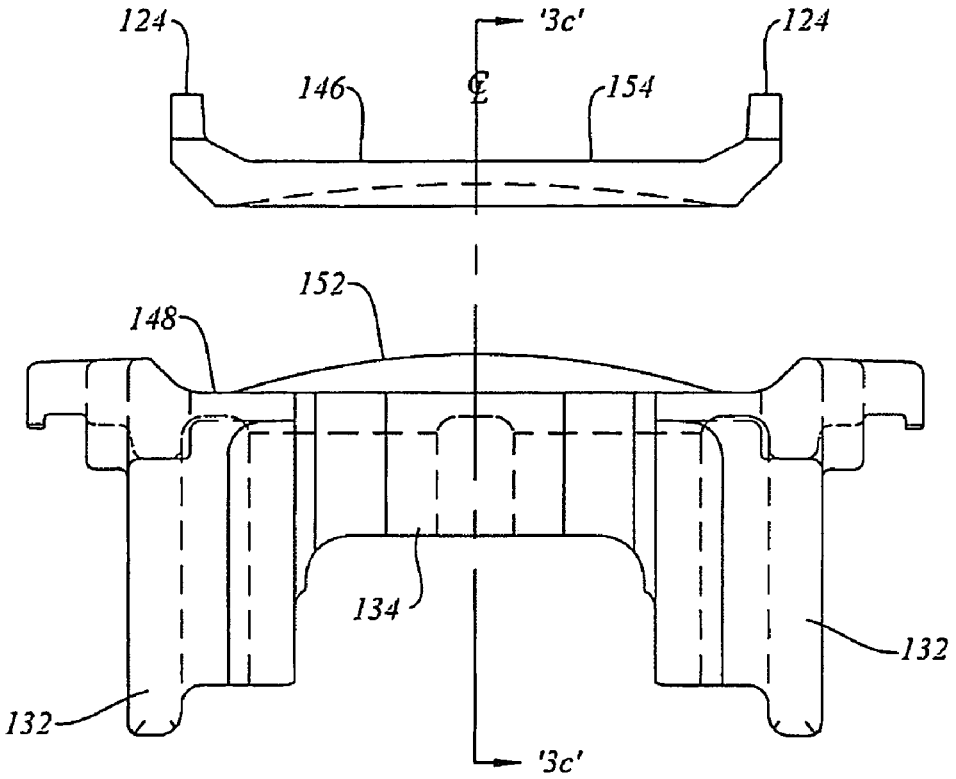
FIG. 3*d* shows an end view of the bearing adapter and pedestal seat of FIG. 3*a;*
Figure 3E:
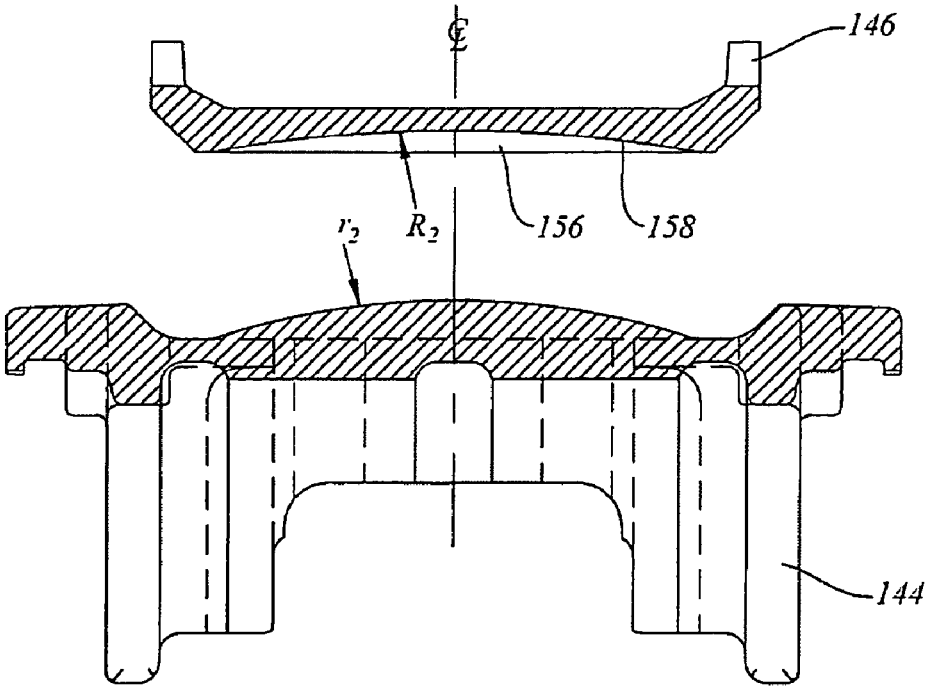
FIG. 3*e* shows a transverse section of the bearing adapter of FIG. 3*a*, taken on the wheelset axle centreline.

While in the general sense, the female engagement fitting portion, namely the hollow depression 156 formed in the lower face of seat 146, is formed on longitudinal and lateral radii $R_1$ and $R_2$, as above, when these two radii are equal a spherical surface 158 is formed, giving the circular plan view of FIG. 3*a*.

Figure 3F:
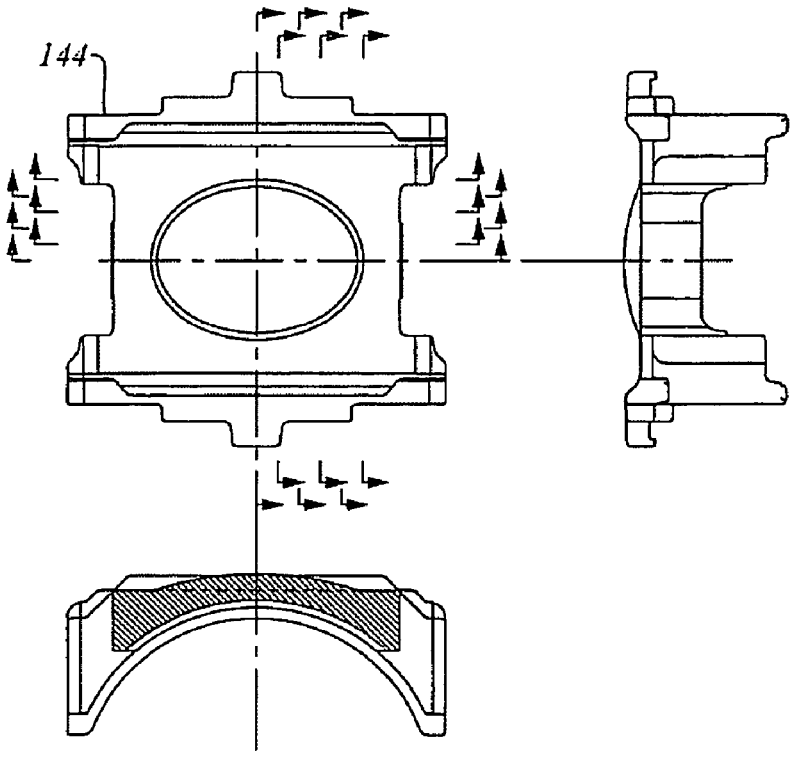
FIG. 3*f* shows a progression of longitudinal sectional profiles for the bearing adapter and seat of FIG. 3*a;*
Figure 3F:
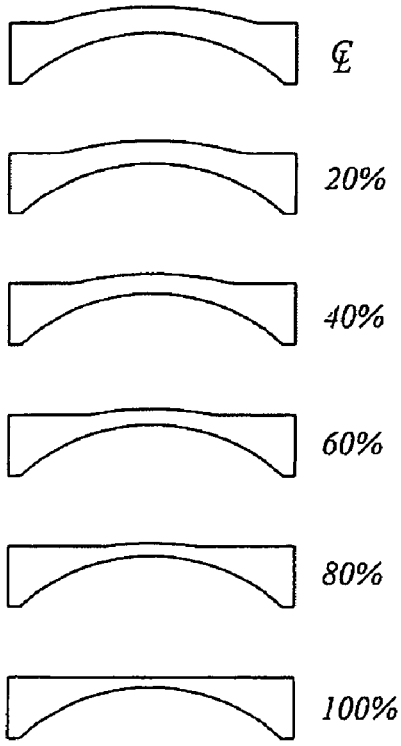
Figure 3G:
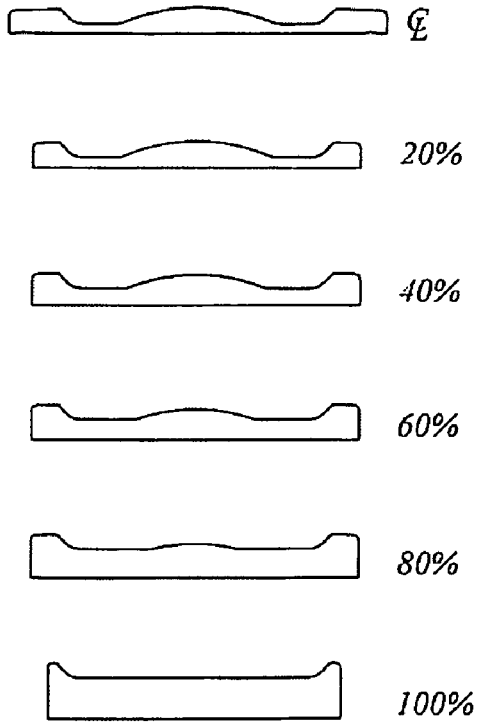
FIG. 3*g* shows a progression of lateral sectional profiles for the bearing adapter and seat of FIG. 3*a;*

As the profiles of both the male and female surfaces are compound curves (i.e., with curvatures in both the x and y directions) FIGS. 3*f* and 3*g*, show a series of profiles in each of the longitudinal and transverse directions, at spaced intervals as indicated in the top view accompanying FIG. 3*f*. These profiles are taken at the centreline, 20%, 40%, 60%, 80%, and 100% of the distance from the centreline to the edge of the curved portion of the bearing adapter or seat, as may be.

Figure 3H:
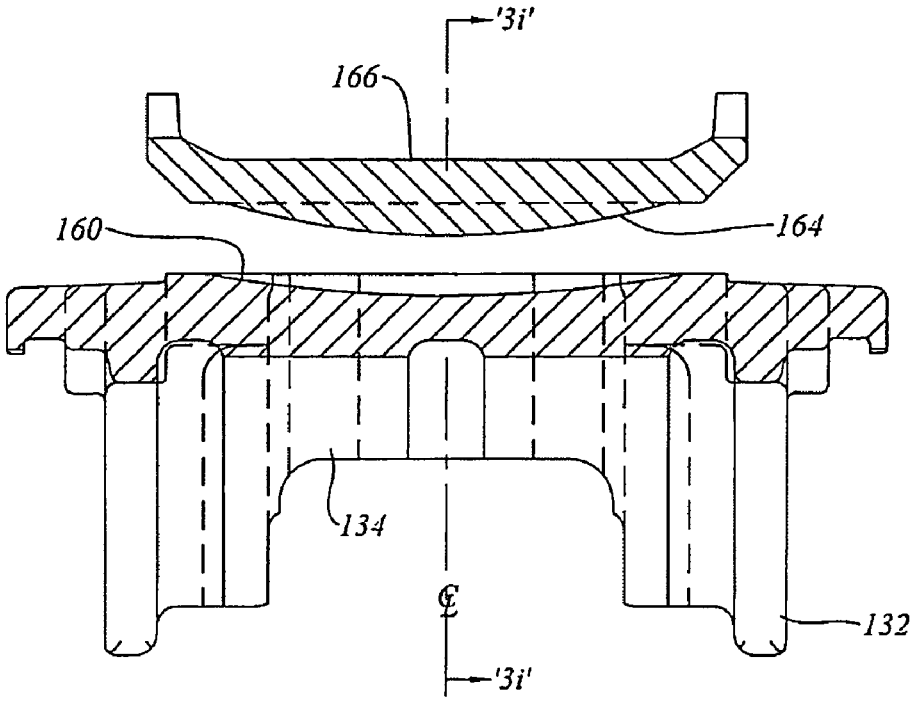
FIG. 3*h* is a section in the transverse plane of symmetry of a bearing adapter and pedestal seat pair like that of FIG. 3*e*, with inverted rocker and seat portions.
Figure 3I:
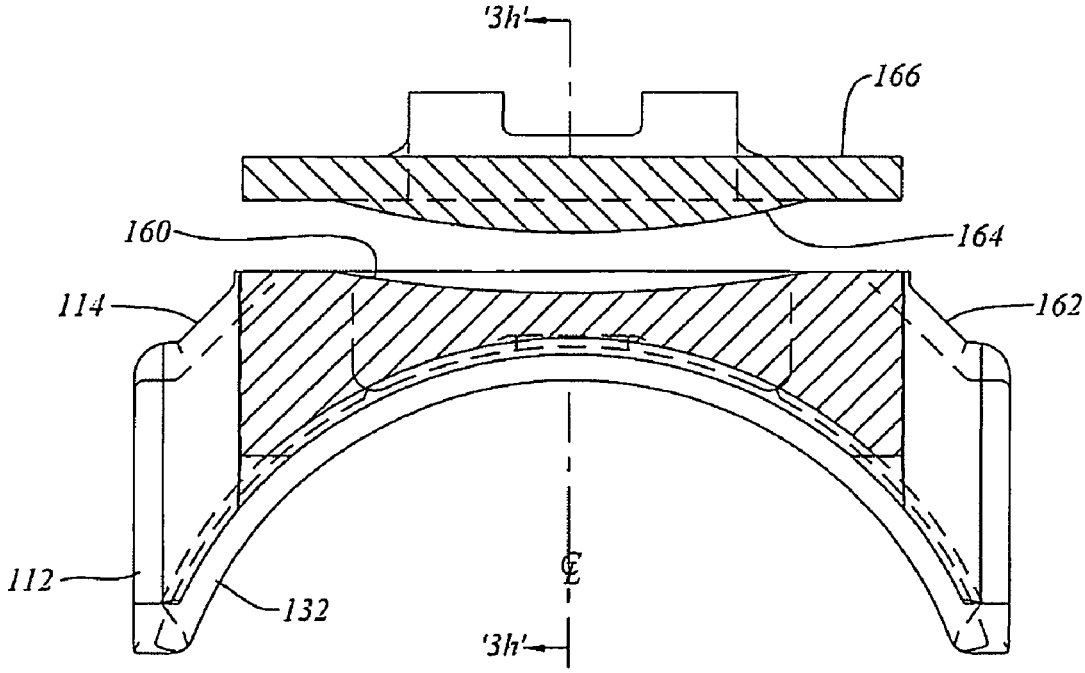
FIG. 3*i* shows a cross-section on the longitudinal plane of symmetry of the bearing adapter and pedestal seat pair of FIG. 3*h;*
Figure 4A:
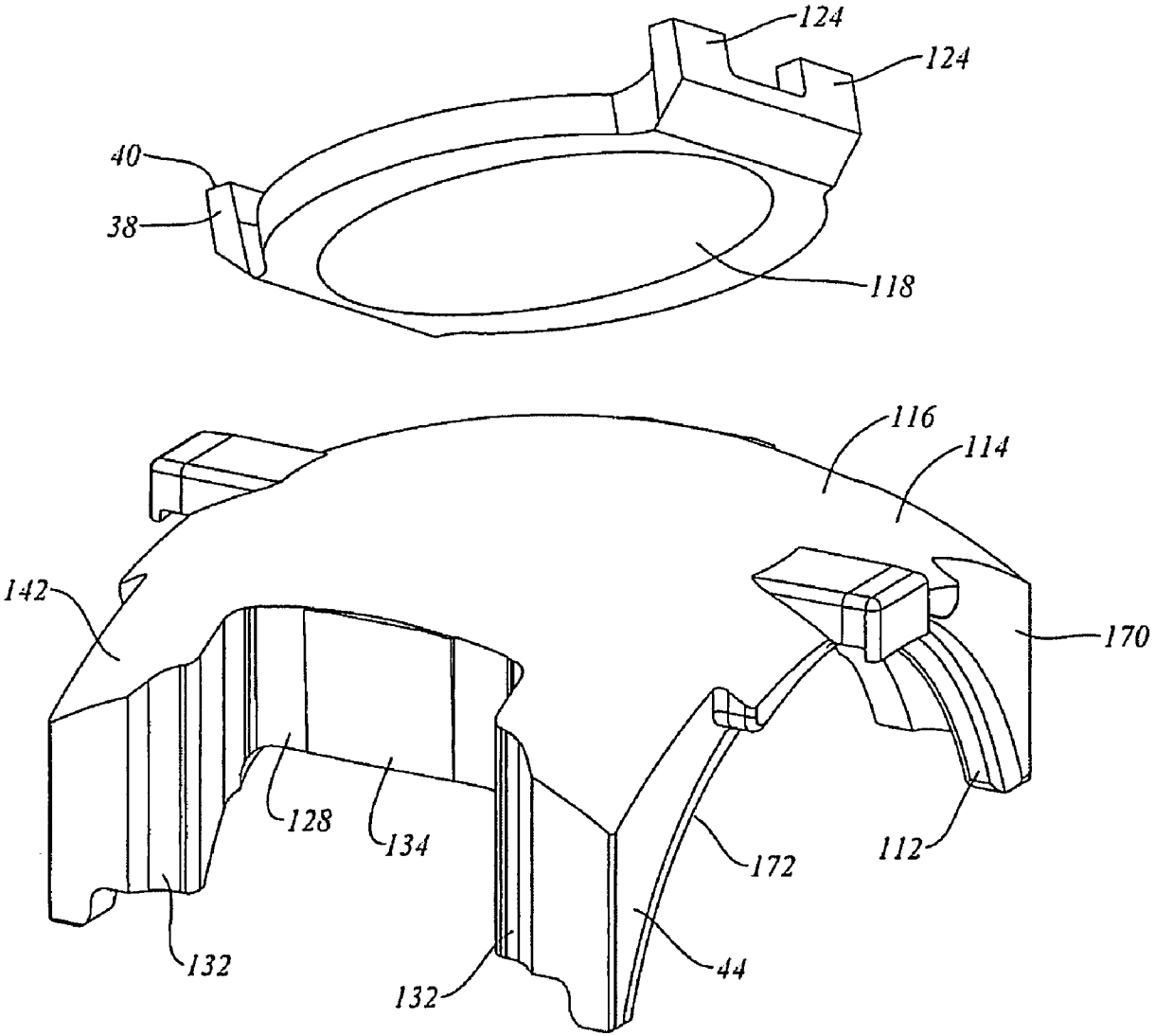
FIG. 4*a* shows an isometric view of an alternate embodiment of bearing adapter and pedestal seat to that of FIG. 3*a* having a fully curved upper surface.
Figure 4B:
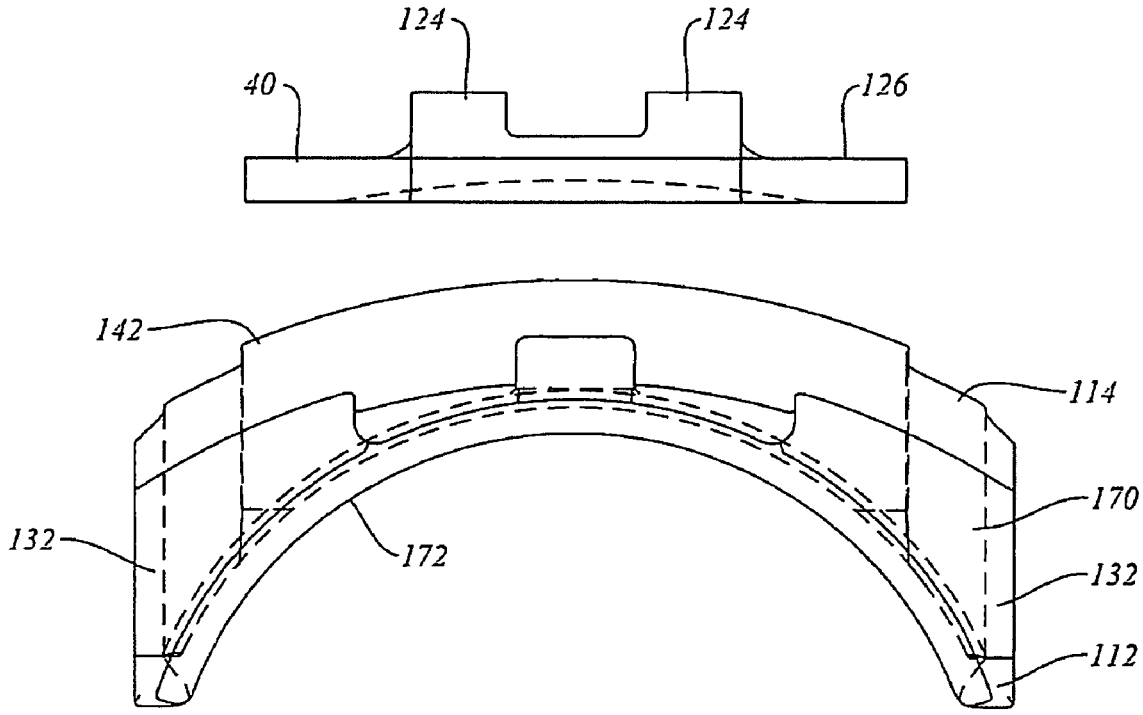
FIG. 4*b* shows a side view of the bearing adapter and seat of FIG. 4*a;*
Figure 4D:
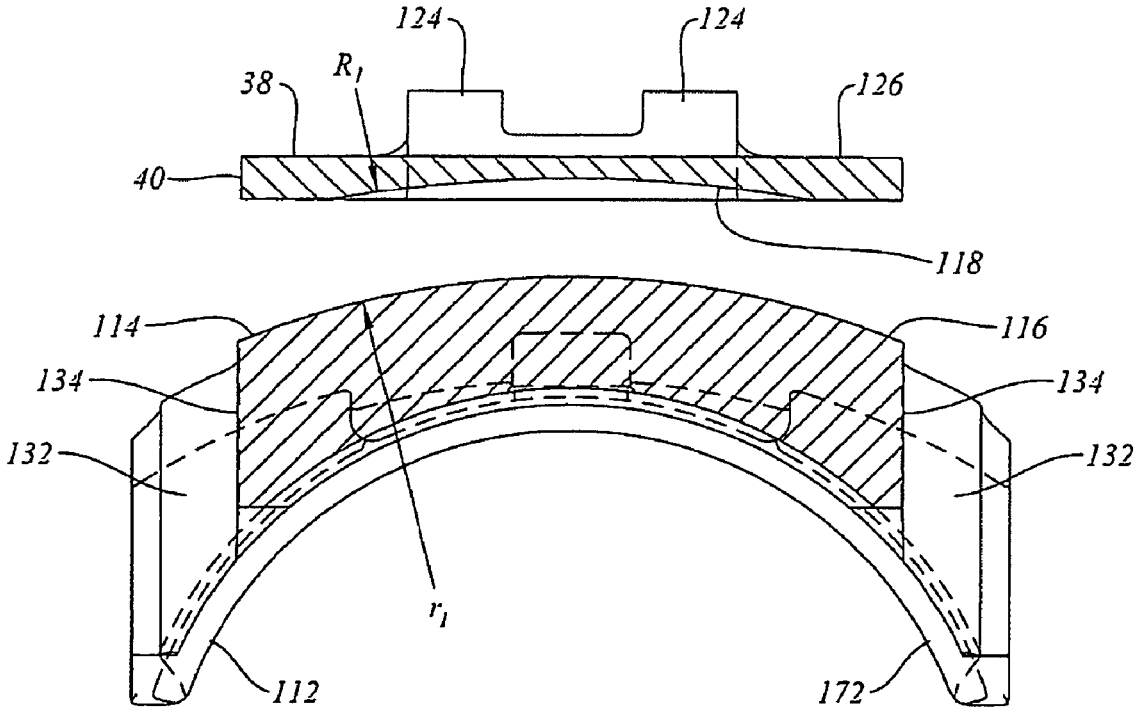
FIG. 4*d* shows a cross-section of the bearing adapter and pedestal seat of FIG. 4*a* taken on the longitudinal plane of symmetry.
Figure 4C:
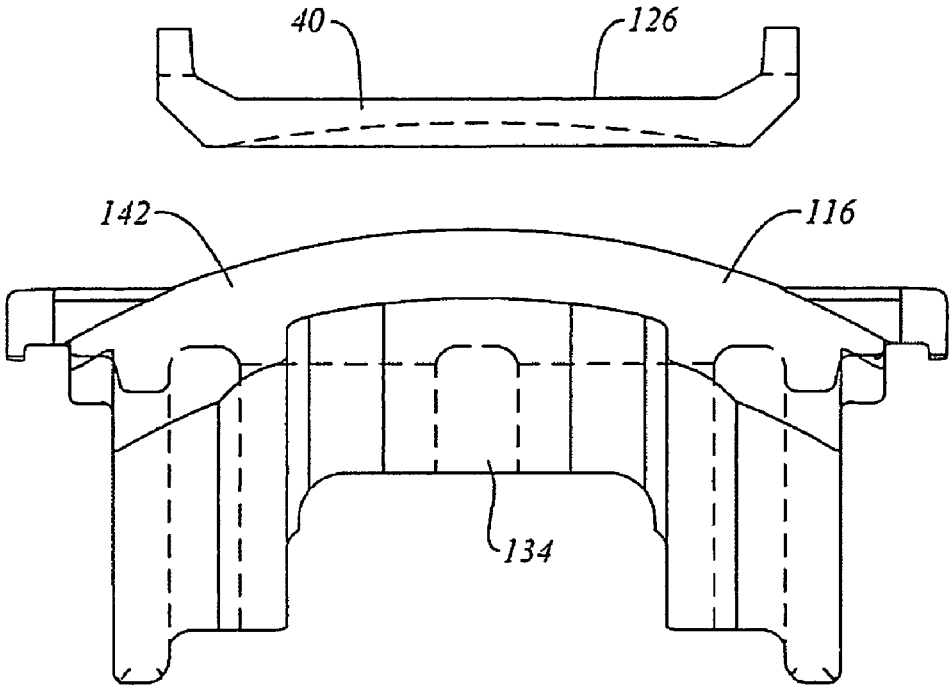
FIG. 4*c* shows an end view of the bearing adapter and seat of FIG. 4*a;*
Figure 4E:
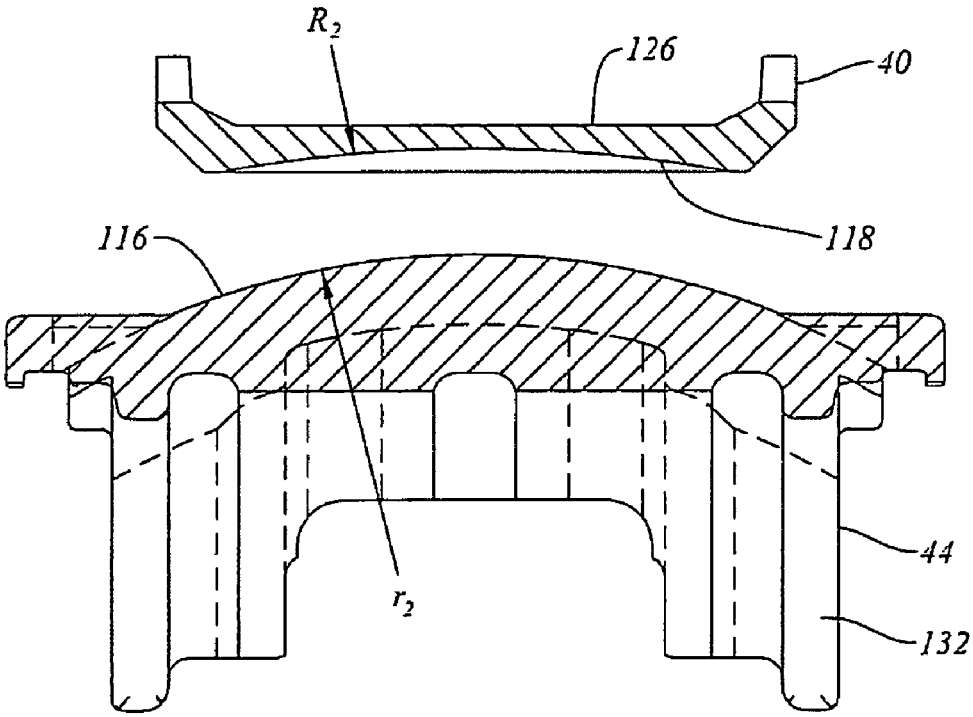
FIG. 4*e* shows a cross-section of the bearing adapter and pedestal seat of FIG. 4*a* taken on the transverse plane of symmetry.

FIGS. 3*h* and 3*i* serve to illustrate that the male and female surfaces may be inverted, such that the female engagement surface 160 is formed on bearing adapter 162, and the male engagement surface 164 of seat 166. It is a matter of terminology which part is actually the "seat", and which is the "rocker". Sometimes the seat may be assumed to be the part that has the larger radius, and which is usually thought of as being the stationary reference, while the rocker is taken to be the part with the smaller radius, that "rocks" on the stationary seat. However, this is not always so. At root, the relationship is of mating parts, whether male or female, and there is relative motion between the parts, or fittings, whether the fittings are called a "seat" or a "rocker". The fittings mate at a force transfer interface. The force transfer interface moves as the parts that co-operate to define the rocking interface rock on each other, whichever part may be, nominally, the male part or the female part. One of the mating parts or surfaces, is part of the bearing adapter, and another is part of the pedestal. There may be only two mating surfaces, or, as noted below in the context of the example of FIGS. 7*a*-7*d*, there may be more than two mating surfaces in the overall assembly defining the dynamic interface between the bearing adapter and the pedestal fitting, or pedestal seat, however it may be called.

FIGS. 4*a*-4*e*

FIGS. 4*a*-4*e* show enlarged views of bearing adapter 44 and pedestal seat fitting 38. As can be seen, the compound curve, upwardly facing surface 142 runs fully to terminate at the end faces 134, and the side faces 170 of bearing adapter 44. The side faces show the circularly downwardly arched lower walls margins 172 of side faces 170 that seat about bearings 46. In all other respects, for the purposes of this description, bearing adapter 44 can be taken as being the same as bearing adapter 144.

Figure 5A:
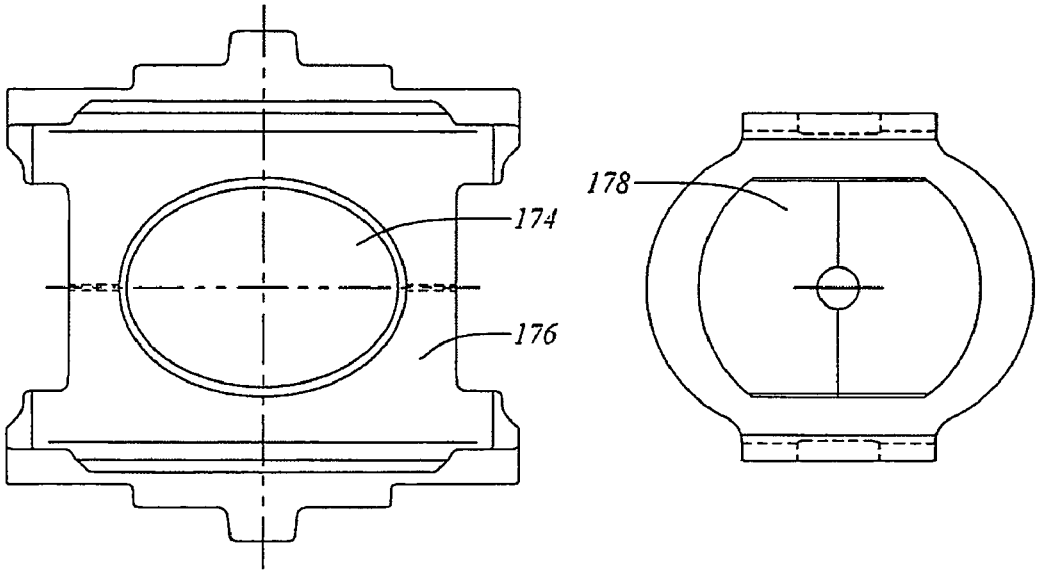
FIG. 5*a* shows a top view of an alternate bearing adapter and an inverted view of an alternate female pedestal seat to that of FIG. 3*a;*
Figure 5B:
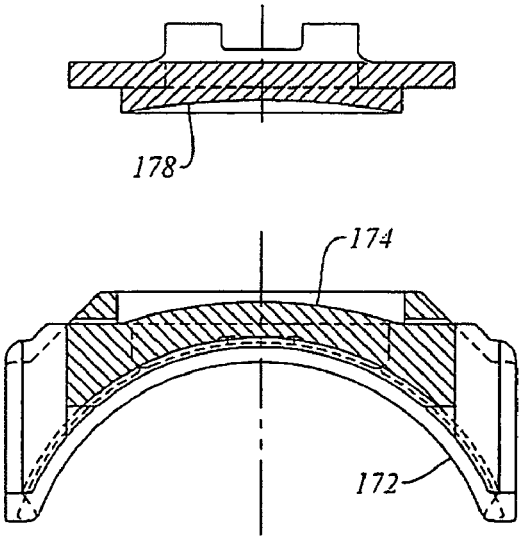
FIG. 5*b* shows a longitudinal section of the bearing adapter of FIG. 5*a;*
Figure 5C:
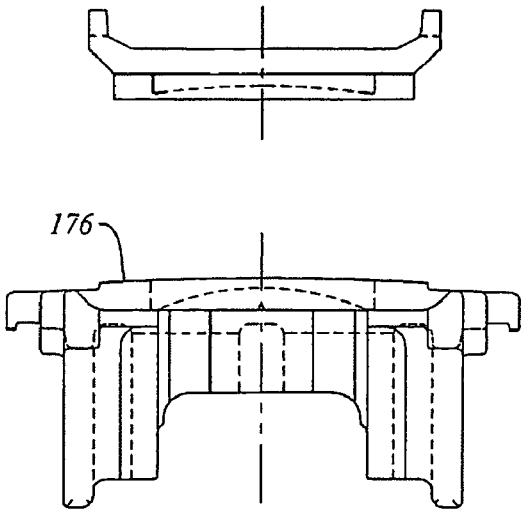
FIG. 5*c* shows an end view of the bearing adapter and seat of FIG. 5*a;*

FIGS. 5*a*-5*c*

FIGS. 5*a*-5*c*, show a conceptually similar bearing adapter and pedestal seat combination to that of FIGS. 3*a* to 3*g*, but rather than having the interface portions standing proud of the remainder of the bearing adapter, the male portion 174 is sunken into the top of the bearing adapter, and the surrounding surface 176 is raised up. The mating female portion 178 while retaining its hollowed out shape, stands proud of the surrounding structure of the seat to provide a corresponding mating surface. The longitudinally extending phantom lines indicate drain ports to discourage the collection of water.

FIGS. 6*a*-6*e*

It may not be necessary for both female radii $R_1$ and $R_2$ to be on the same fitting, or for both male radii $r_1$ and $r_2$ to be on the same fitting. This is illustrated by the saddle shaped fittings of FIGS. 6*a* to 6*e*. In these illustrations, a bearing adapter 180 is of substantially the same construction as bearing adapters 44 and 144, except insofar as bearing adapter 180 has an upper surface 192 that has a male fitting in the nature of a longitudinally extending crown 182 with a laterally extending axis of rotation, for which the radius of curvature is $r_1$, and a female fitting in the nature of a longitudinally extending trough 184 having a lateral radius of curvature $R_2$. Similarly, pedestal fitting 186 mounted in roof 120 has a generally downwardly facing surface 194 that has a transversely extending trough 188 having a longitudinally oriented radius of curvature $R_1$, for engagement with $r_1$ of crown 182, and a longitudinally running, downwardly protruding crown 190 having a transverse radius of curvature $r_2$ for engagement with $R_2$ of trough 184. A progression of sectional profiles of these inter-relating curvatures at the 0%, 20%, 40%, 60%, 80% and 100% x and y locations is provided in FIGS. 6*d* and 6*e*. In this embodiment, the smallest of $R_1$ and $R_2$ may again be equal to or larger than the largest of $r_1$ and $r_2$.

As noted in the context of FIG. 3*a*, in one sense the saddle shaped upper surface 192 of bearing adapter 180 is both a seat and a rocker, being a seat in one direction, and a rocker in the other, as is the pedestal seat fitting. As noted above, the essence is that there are two small radii, and two large (or possibly even infinite) radii, and the surfaces form a mating pair that engage in rolling point contact in both the lateral and longitudinal directions, with a central local minimum potential energy position to which the assembly is biased to return.

Figure 6A:
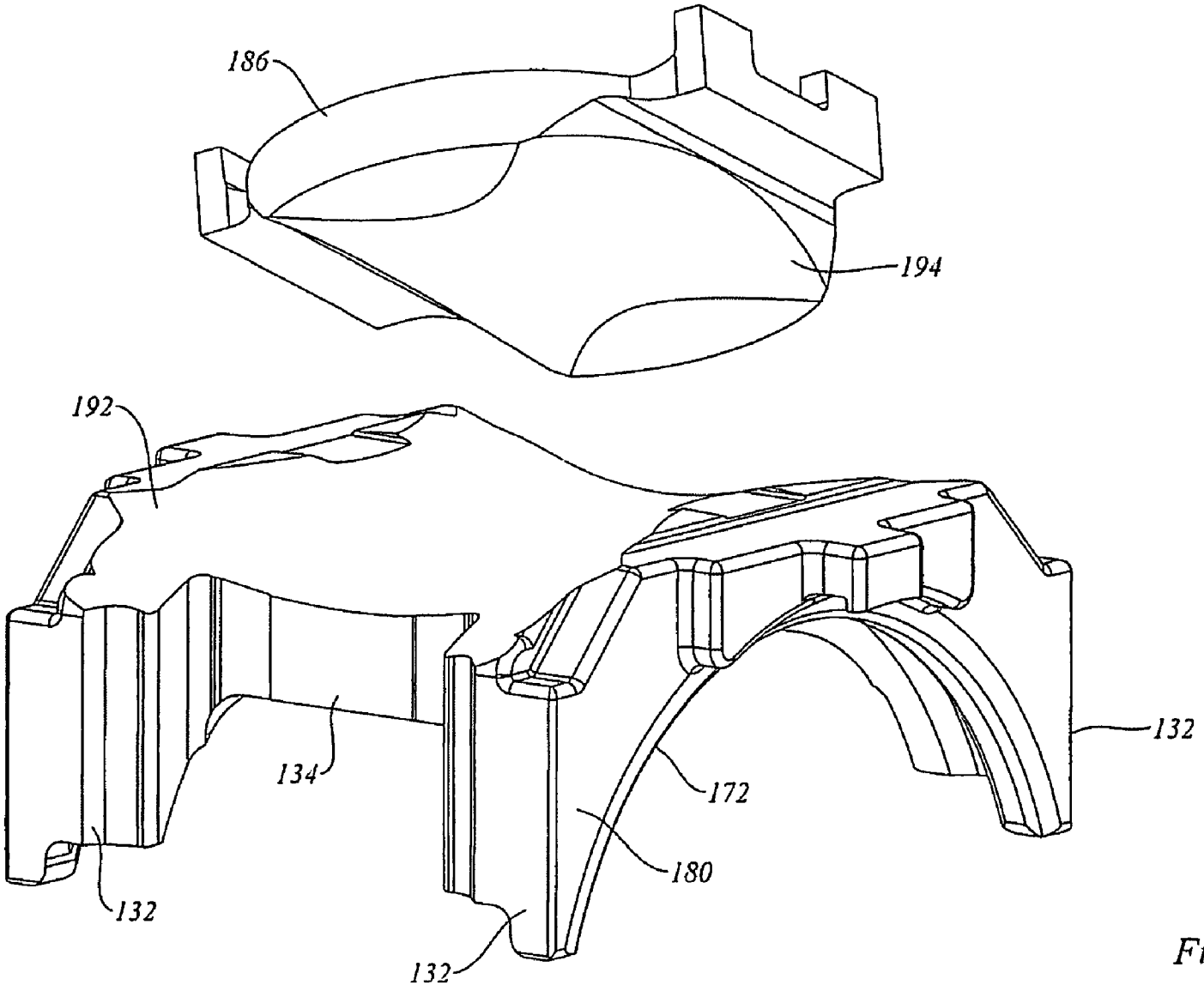
FIG. 6*a* shows an isometric view of a further embodiment of bearing adapter and seat combination to that of FIG. 3*a*, in which the bearing adapter and pedestal seat have saddle shaped engagement interfaces.
Figure 6B:
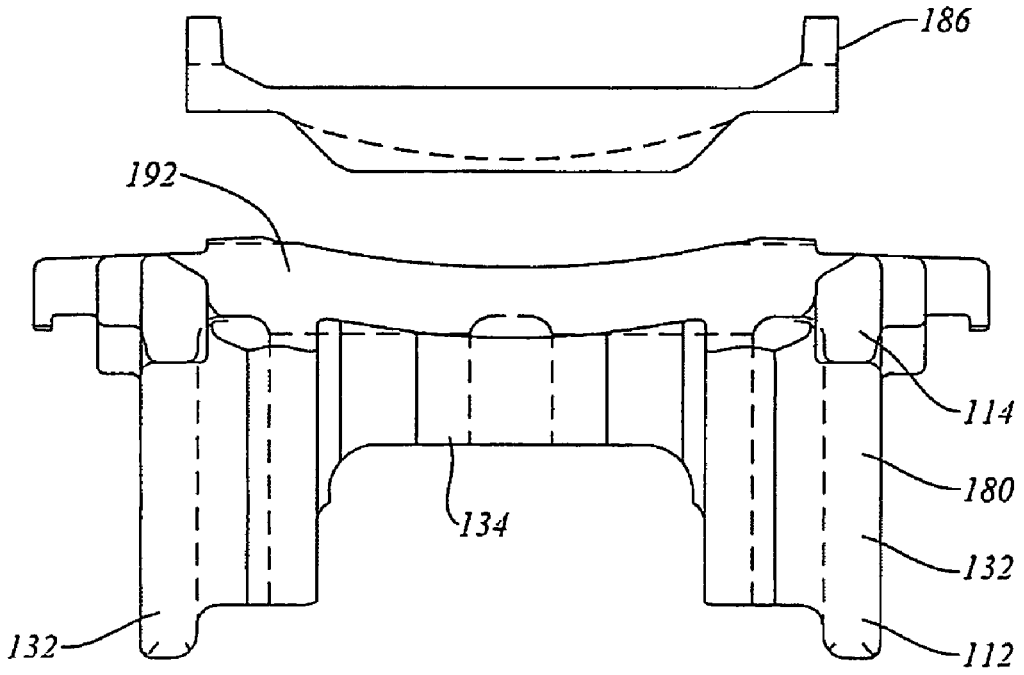
FIG. 6*b* shows an end view of the bearing adapter and pedestal seat of FIG. 6*a;*
Figure 6D:
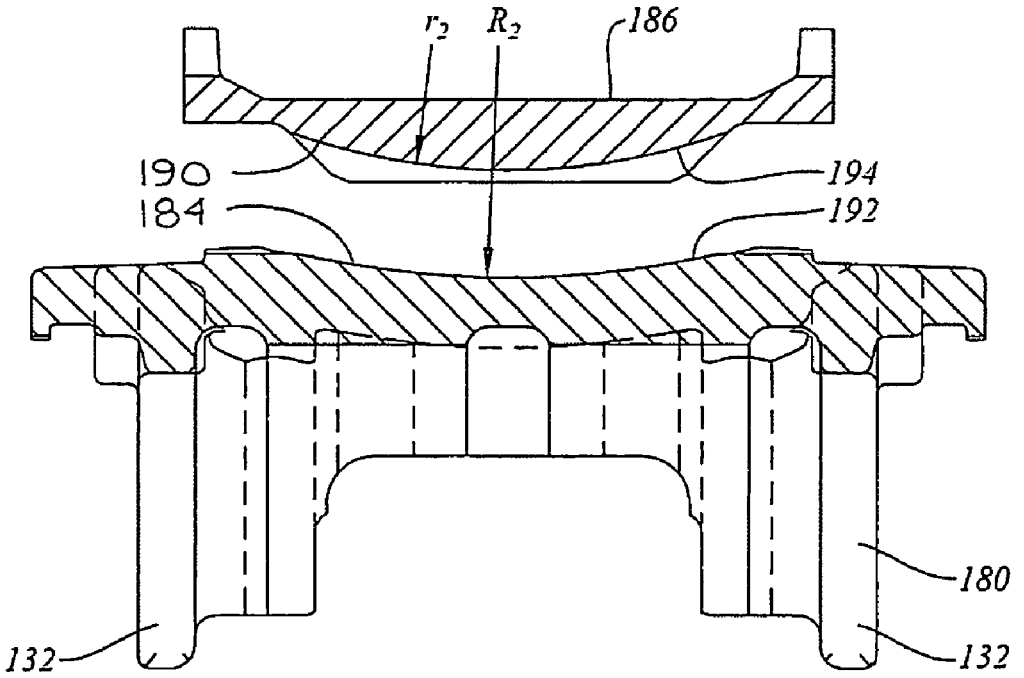
FIG. 6*d* is a lateral section of the adapter and pedestal seat of FIG. 6*a;*
Figure 6C:
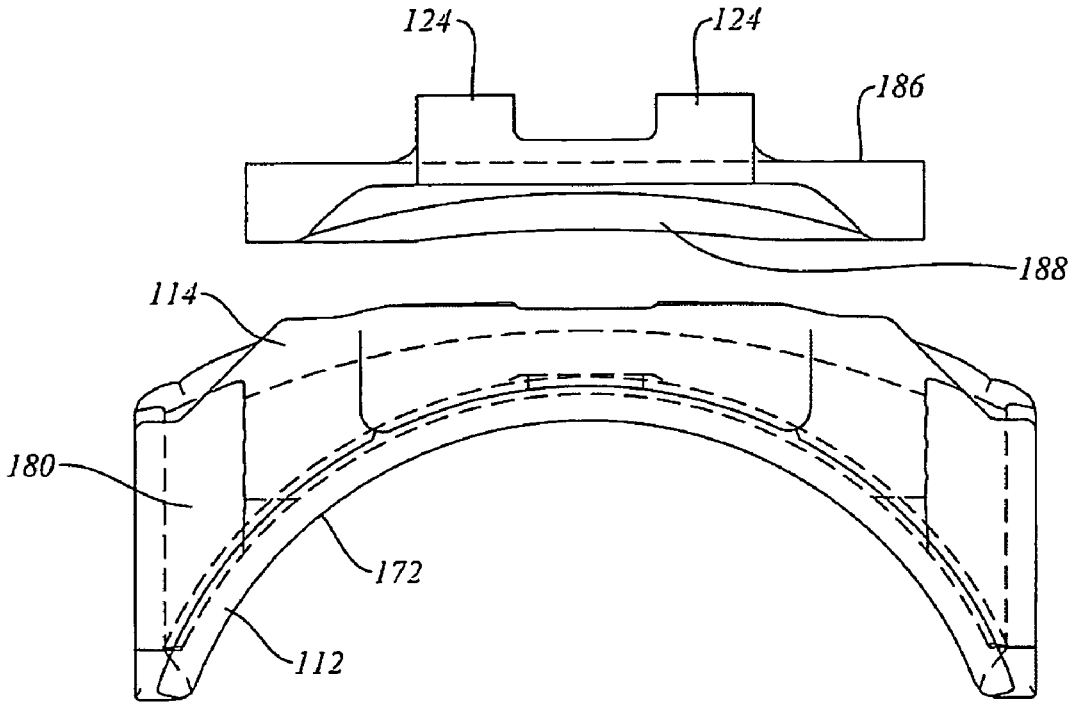
FIG. 6*c* shows a side view of the bearing adapter and pedestal seat of FIG. 6*a;*
Figure 6E:
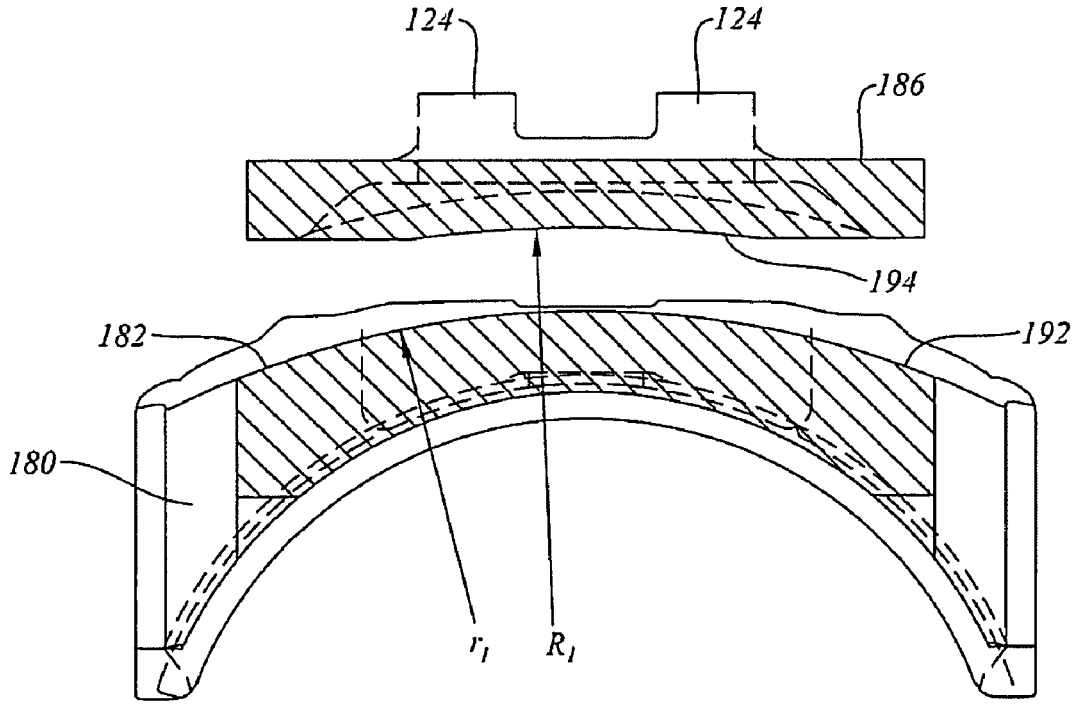
FIG. 6*e* is a longitudinal section of the adapter and pedestal seat of FIG. 6*a;*
Figure 6F:
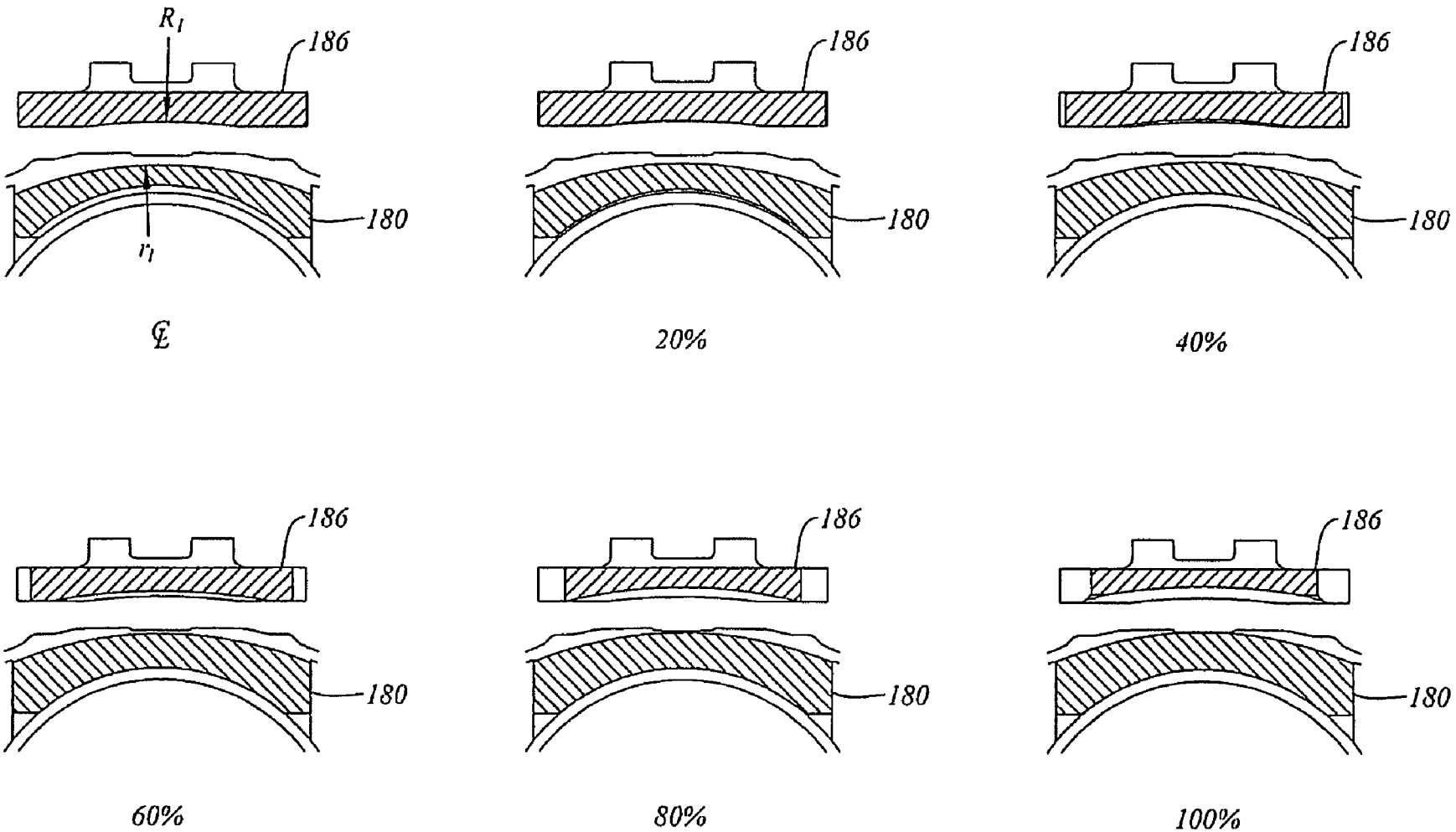
FIG. 6*f* shows progressive longitudinal profiles for the bearing adapter and pedestal seat of FIG. 6*a;*
Figure 6G:
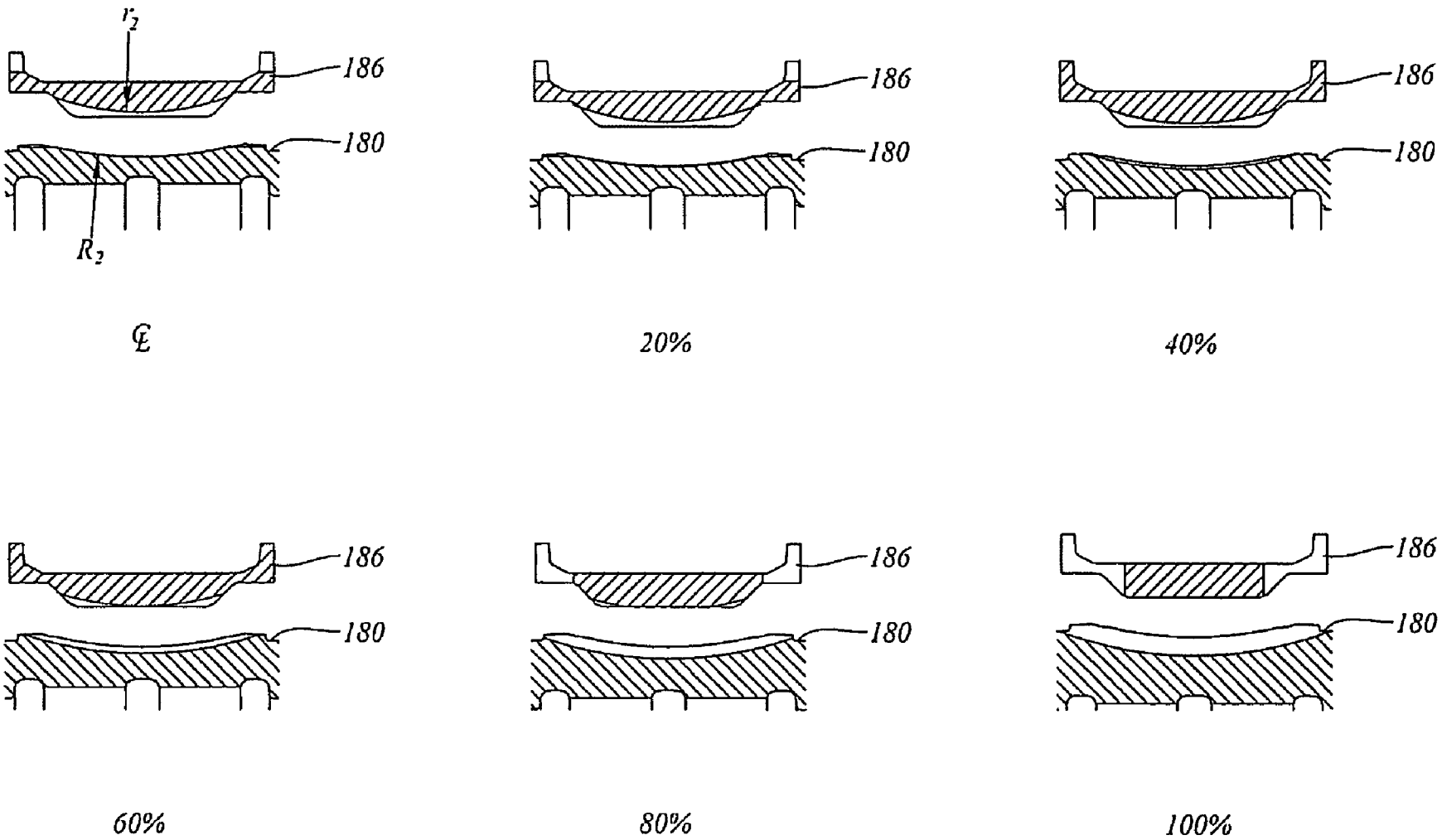
FIG. 6*g* shows progressive transverse profiles for the bearing adapter and pedestal seat of FIG. 6*f;*
Figure 6H:
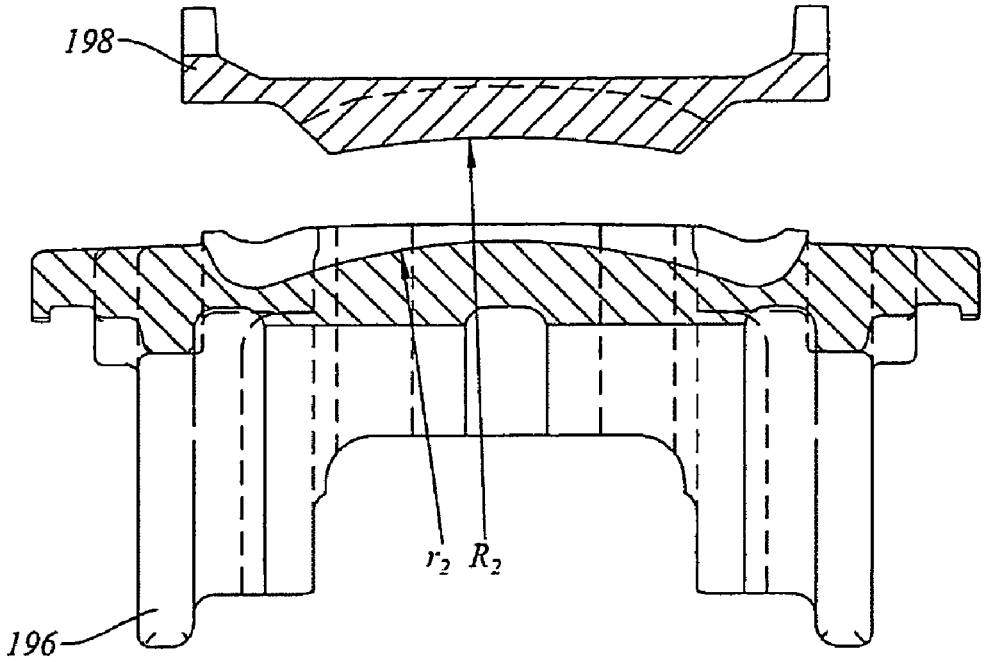
FIG. 6*h* shows a transverse cross section of a bearing adapter and pedestal seat pair having an inverted interface to that of FIG. 6*a;*
Figure 6I:
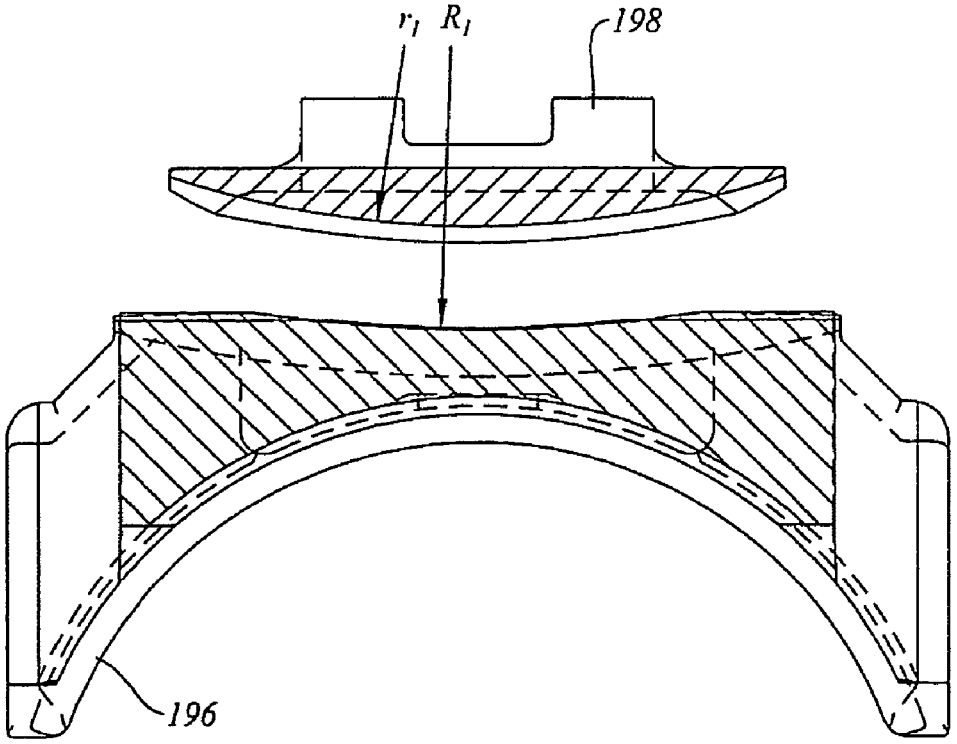
FIG. 6*i* shows a longitudinal cross section for the bearing adapter and pedestal seat pair of FIG. 6*h;*
Figure 7A:
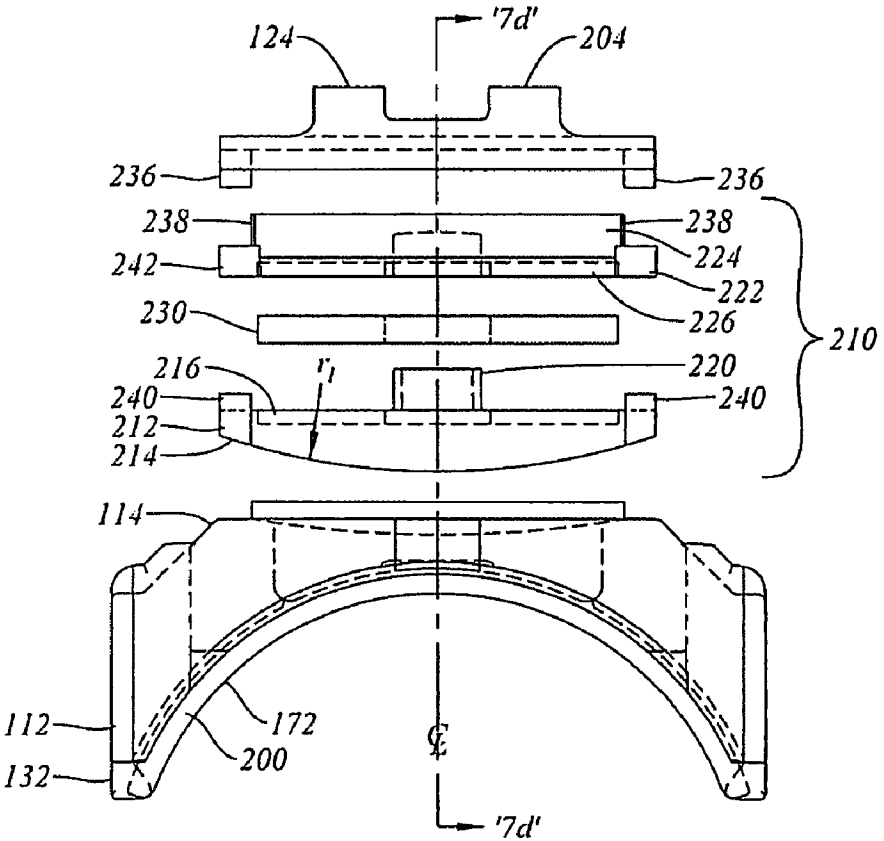
FIG. 7*a* shows an exploded side view of a further alternate bearing adapter and seat combination to that of FIG. 3*a*, having a pair of cylindrical rocker elements, and a pivoted connection therebetween.
Figure 7B:
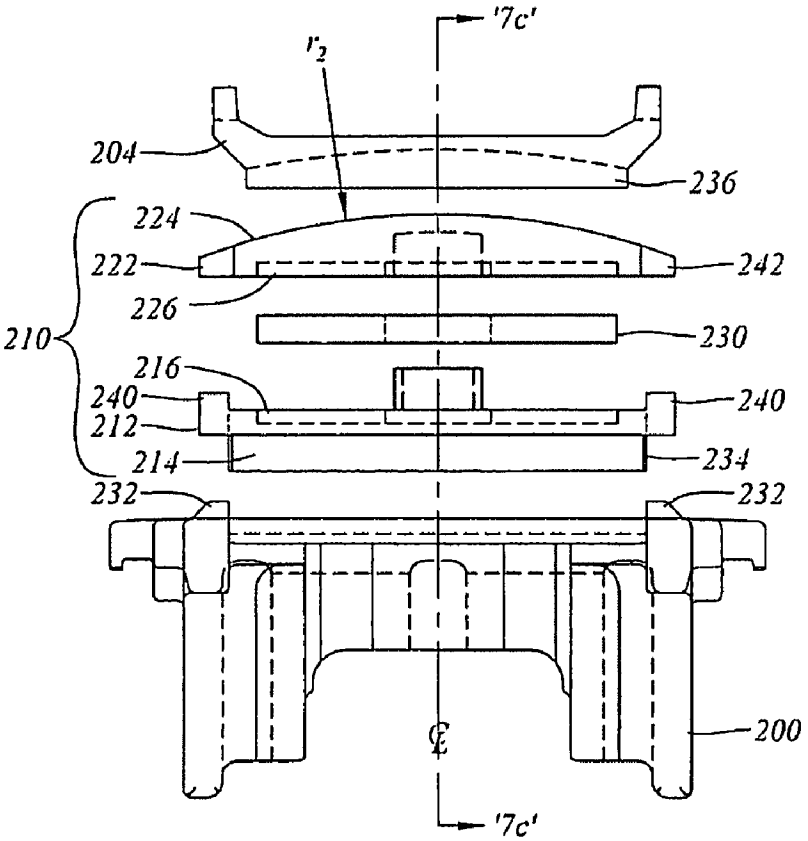
FIG. 7*b* shows an exploded end view of the bearing adapter and seat of FIG. 7*a;*
Figure 7C:
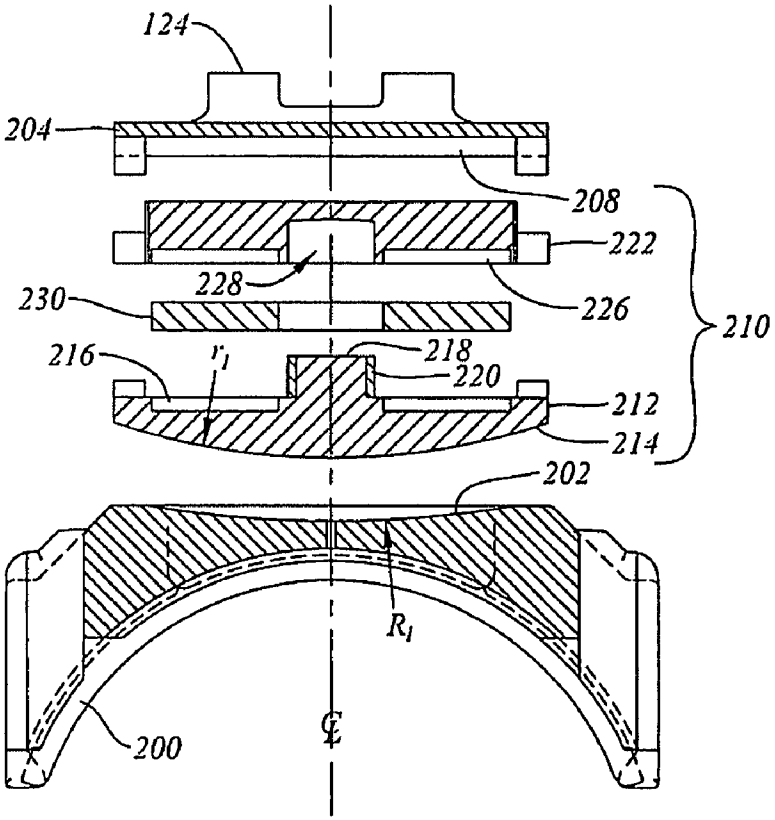
FIG. 7*c* shows a cross-section of the bearing adapter and seat of FIG. 7*a*, as assembled, taken on the longitudinal centreline thereof.
Figure 7D:
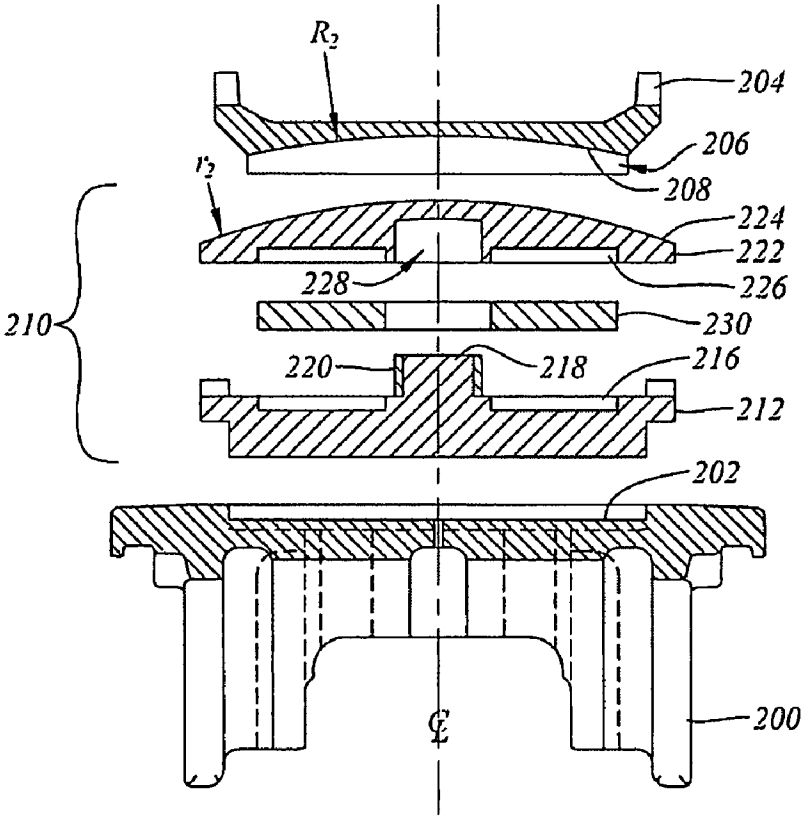
FIG. 7*d* shows a cross-section of the bearing adapter and seat of FIG. 7*a*, as assembled, taken on the transverse centre-line thereof.

It may also be noted, as shown in FIGS. 6*h* and 6*i*, the saddle surfaces can be inverted such that whereas bearing adapter 180 has $r_1$ and $R_2$, bearing adapter 196 has $r_2$ and $R_1$. Similarly, whereas pedestal fitting 186 has $r_2$ and $R_1$, pedestal fitting 198 has $r_1$ and $R_2$. In either case, the smallest of $R_1$ and $R_2$ may be larger than, or equal to, the largest of $r_1$ and $r_2$, and the mating opposed saddle surfaces, over the desired range of motion, may tend to be torsionally uncoupled as noted above in the context of bearing adapters 44 and 144.

FIGS. 7*a*-7*d*

It may be desired that the vertical forces transmitted from the pedestal roof into the bearing adapter be passed through line contact, rather than the bi-directional rolling or rocking point contact as in the assemblies of the embodiments of FIGS. 2*a*-2*g*, 3*a*-3*i*, 4*a*-4*e*, 5*a*-5*c*, and 6*a*-6*g*. In that case, it may be advantageous to employ an embodiment of pedestal seat to bearing adapter interface assembly having line contact rocker interfaces such as represented by the example shown in FIGS. 7*a* to 7*d*. In this instance a bearing adapter 200 has a hollowed out transverse cylindrical upper surface 202, acting as a female engagement fitting portion formed on radius $R_1$. Surface 202 may be a round cylindrical section, or it may be parabolic, or other cylindrical section.

The corresponding pedestal seat fitting 204 may have a longitudinally extending female fitting, or trough, 206 having a cylindrical surface 208 formed on radius $r_1$. Again, fitting 204 is cylindrical, and may be a round cylindrical section although, alternatively, it could be parabolic, elliptic, or some other shape for producing a rocking motion.

Trapped between bearing adapter 200 and pedestal seat fitting 204 is a rocker member 210. Rocker member 210 has a first, or lower portion 212 having a protruding male cylindrical rocker surface 214 formed on a radius $r_1$ for line contact engagement of surface 202 of bearing adapter 200 formed on radius $R_1$, $r_1$ being smaller than $R_1$, and thus permitting longitudinal rocking to obtain passive self steering. As above, the resistance to rocking, and hence to self steering, may tend to be proportional to the weight on the rocker and hence may give proportional self steering when the car is either empty or loaded. Lower portion 212 also has an upper relief 216 that is preferably machined to a high level of flatness. Lower portion 212 also has a centrally located, integrally formed upwardly extending cylindrical stub 218 that stands perpendicularly proud of surface 216. A bushing 220, which may be a press fit bushing, mounts on stub 218.

Rocker member 200 also has an upper portion 222 that has a second protruding male cylindrical rocker surface 224 formed on a radius $r_2$ for line contact engagement with the cylindrical surface 208 of trough 206, formed on radius $R_2$, thus permitting lateral rocking of sideframe 26. Upper portion 222 may have a lower relief 226 for placement in opposition to relief 216. Upper portion 222 has a centrally located blind bore 228 of a size for tight fitting engagement of bushing 220, such that a close tolerance, pivoting connection is obtained that is largely compliant to pivotal motion about the vertical, or z, axis of upper portion 222 with respect to lower portion 212. That is to say, the resistance to torsional motion about the z-axis is very small, and can be taken as zero for the purposes of analysis. To aid in this, bearing 230 may be installed about stub 218 and bushing 220 and is placed between opposed surfaces 206 and 216 to encourage relative rotational motion therebetween.

In this embodiment, stub 218 could be formed in upper portion 222, and bore 218 formed in lower portion 212, or, alternatively, bores 228 could be formed in both upper portion 212 and lower portion 222, and a freely floating stub 218 and bushing 220 could be captured between them. It may be noted that the angular displacement about the z axis of upper portions 222 relative to lower portion 212 may be quite small—of the order of 1 degree of arc, and may tend not to be even that large overly frequently.

Having described the rocking portions of the assembly of FIGS. 7*a*-7*d*, there are a number of additional features that may also be noted. First, bearing adapter 200 may have longitudinally extending raised lateral abutment side walls 232 to discourage lateral migration, or escape of lower portion 212. Lower portion 212 may have non-galling, relatively low co-efficient of friction side wear shim stock members 234 trapped between the end faces of lower portion 212 and side walls 232. Bearing adapter 200 may also have a drain hole formed therein, possibly centrally, or placed at an angle. Similarly, pedestal seat fitting 204 may have laterally extending depending end abutment walls 236 to discourage longitudinal migration, or escape, of upper portion 222. In a like manner to shim stock members 234, non-galling, relatively low co-efficient of friction end wear shim stock members 238 may be mounted between the end faces of upper portion 222 and end abutment walls 236.

In an alternative to the foregoing embodiment, the longitudinal cylindrical trough could be formed on the bearing adapter, and the lateral cylindrical trough could be formed in the pedestal seat, with corresponding changes in the entrapped rocker element. Further, it is not necessary that the male cylindrical portions be part of the entrapped rocker element. Rather, one of those male portions could be on the bearing adapter, and one of those male portions could be on the pedestal seat, with the corresponding female portions being formed on the entrapped rocker element. In the further alternative, the rocker element could include one male element, and one female element, having the male element formed on $r_1$ (or $r_2$) being located on the bearing adapter, and the female element formed on $R_1$ (or $R_2$) being on the underside of the entrapped rocker element, and the male element formed on $r_2$ (or $r_1$) being formed on the upper surface of the entrapped rocker element, and the respective mating female element formed on radius $R_2$ (or $R_1$) being formed on the lower face of the pedestal seat. In the still further alternative, the rocker element could include one male element, and one female element, having the male element formed on $r_1$ (or $r_2$) being located on the pedestal seat, and the female element formed on $R_1$ (or $R_2$) being on the upper surface of the entrapped rocker element, and the male element formed on $r_2$ (or $r_1$) being formed on the lower surface of the entrapped rocker element, and the respective mating female element formed on radius $R_2$ (or $R_1$) being formed on the upper face of the bearing adapter. There are, in this regard, at least eight possible combinations. It is intended that the illustrations of FIGS. 7*a*-7*d* be understood to be generically representative of all of these possible combinations, without requiring further multiplication of drawing views.

In this way the embodiment of FIGS. 7*a*-7*d* may tend to yield line contact at the force transfer interfaces, and yet rock in both the longitudinal and lateral directions, with compliance to torsion about the vertical axis. That is, the bearing adapter to pedestal seat interface assembly may tend to permit rotation about the longitudinal axis to give lateral rocking motion of the side frame; rotation about a transverse axis to give longitudinal rocking motion; and compliance to torsion about the vertical axis. It may tend to discourage lateral translation, and may tend to retain high stiffness in the vertical direction.

Figure 8B:
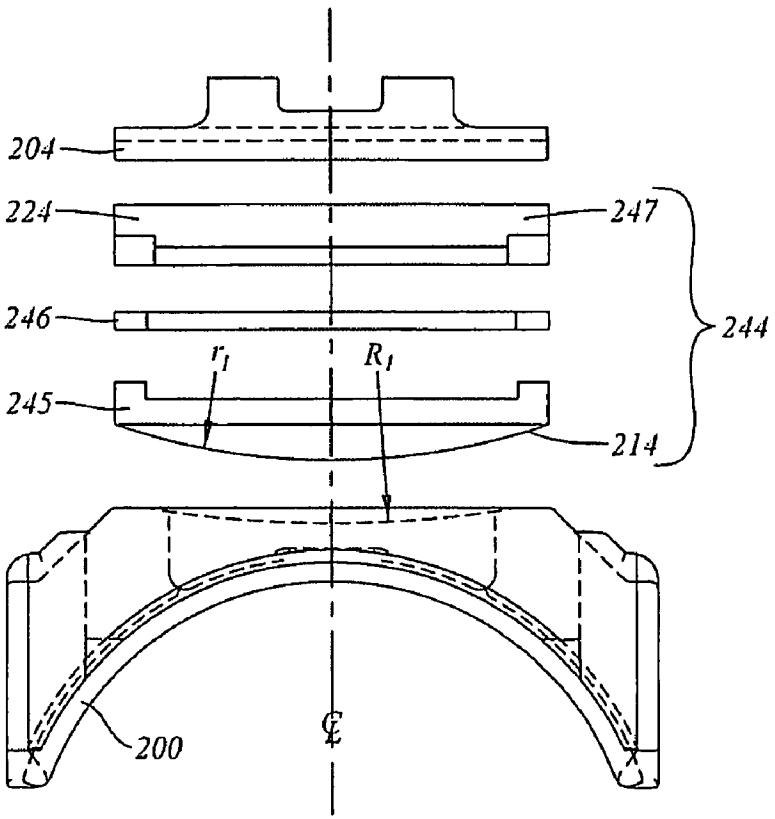
FIG. 8*b* shows an exploded side view of the assembly of FIG. 8*a;*
Figure 8A:
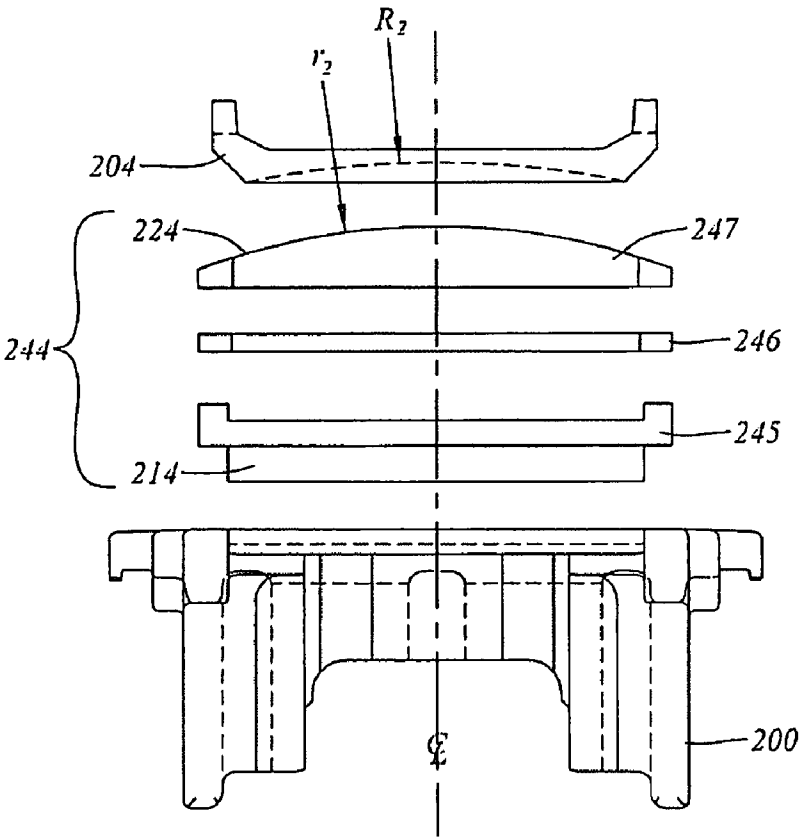
FIG. 8*a* is an exploded end view of an alternate version of bearing adapter and seat assembly to that of FIG. 7*a* having an elastomeric intermediate member.

FIGS. 8*a* and 8*b*

The embodiment of FIGS. 8*a* and 8*b* is substantially similar to the embodiment of FIGS. 7*a* to 7*d*. However, rather than employing a pivot connection such as the bore, stub, bushing and bearing of FIGS. 7*a*-7*d*, a rocker element 244 is captured between bearing adapter 200 and pedestal seat 204. Rocker element 244 has a torsional compliance element made of a resilient material, identified as elastomeric member 246 bonded between the opposed faces of the upper 247 and lower 245 portions of rocker element 244.

Although FIGS. 8*a* and 8*b* show the laterally extending trough in bearing adapter 200, and the longitudinal trough in pedestal seat 204, it will be understood that the same commentary made concerning the possible alternate variations and combinations of the features of the example of FIGS. 7*a* to 7*d* also applies to the example of FIGS. 8*a* and 8*b*.

In general, while the torsional element may be between the two cylindrical elements in a manner tending torsionally to decouple them, it may be that the elastomeric pad need not necessarily be installed between the two cylindrical members. For example, the rocker element 244 could be solid, and an elastomeric element could also be installed beneath the top surface of bearing adapter 200, or above the pedestal seat element, such that a torsionally compliant element is placed in series with the two rockers. This may tend to provide a degree of angular compliance in the connection.

The same general commentary may be made with regard to the pivotal connection suggested above in connection with the example of FIGS. 7*a* to 7*d*. That is, the top of the bearing adapter could be pivotally mounted to the body of the bearing adapter more generally, or the pedestal seat could be pivotally mounted to the pedestal roof, such that, again, a torsionally compliant element would be place in series with the two rockers. However, as noted above, the torsionally compliant element may be between the two rockers, such that they may tend to be torsionally de-coupled from each other.

In general, with regard to the embodiments of FIGS. 7*a*-7*d*, and 8*a*-8*b*, provided that the radii employed yield a physically appropriate combination tending toward a local stable minimum energy state, the male portion of the bearing adapter to pedestal seat interface (with the smaller radius of curvature) may be on either the bearing adapter or on the pedestal seat, and the mating female portion (with the larger radius of curvature) may be on the other part, whichever it may be. In that light, although a particular depiction may show a male portion on a bearing adapter, and a female fitting on the pedestal seat, these features may, in general, be reversed, without requiring a multiplicity of drawings to show all possible permutations.

In general, provided that the radii employed yield a physically appropriate combination tending toward a local stable minimum energy state, the male portion of the bearing adapter to pedestal seat interface (with the smaller radius of curvature) may be on either the bearing adapter or on the pedestal seat, and the mating female portion (with the larger radius of curvature) may be on the other part, whichever it may be. In that light, although a particular depiction may show a male portion on a bearing adapter, and a female fitting on the pedestal seat, it is understood that these features can, in general, be reversed, without requiring a multiplicity of drawings to show all possible permutations.

Figure 9A:
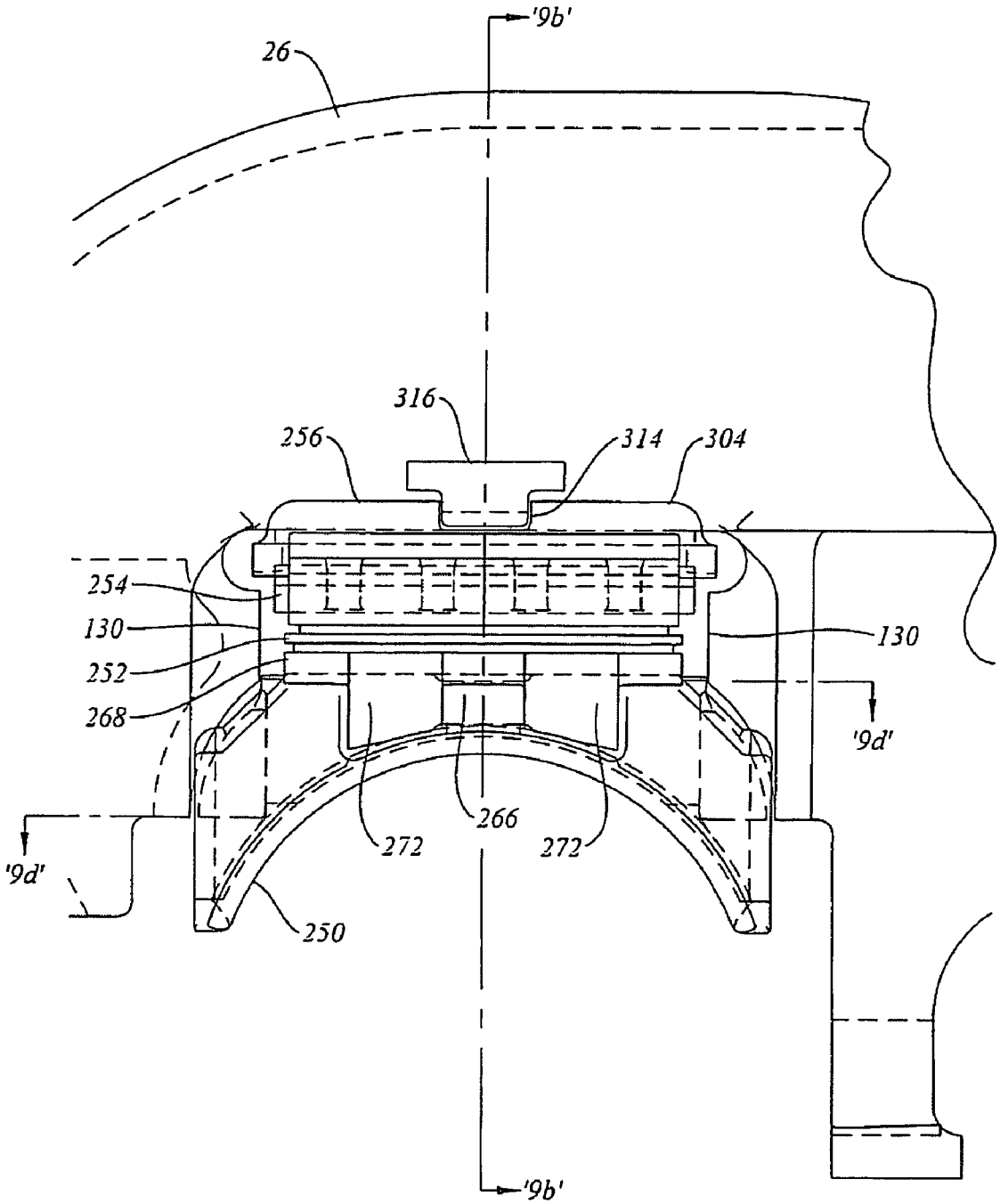
FIG. 9*a* is a side view of alternate assembly to that of FIG. 3*a* or 6*a*, employing an elastomeric shear pad and a laterally swinging rocker.
Figure 9B:
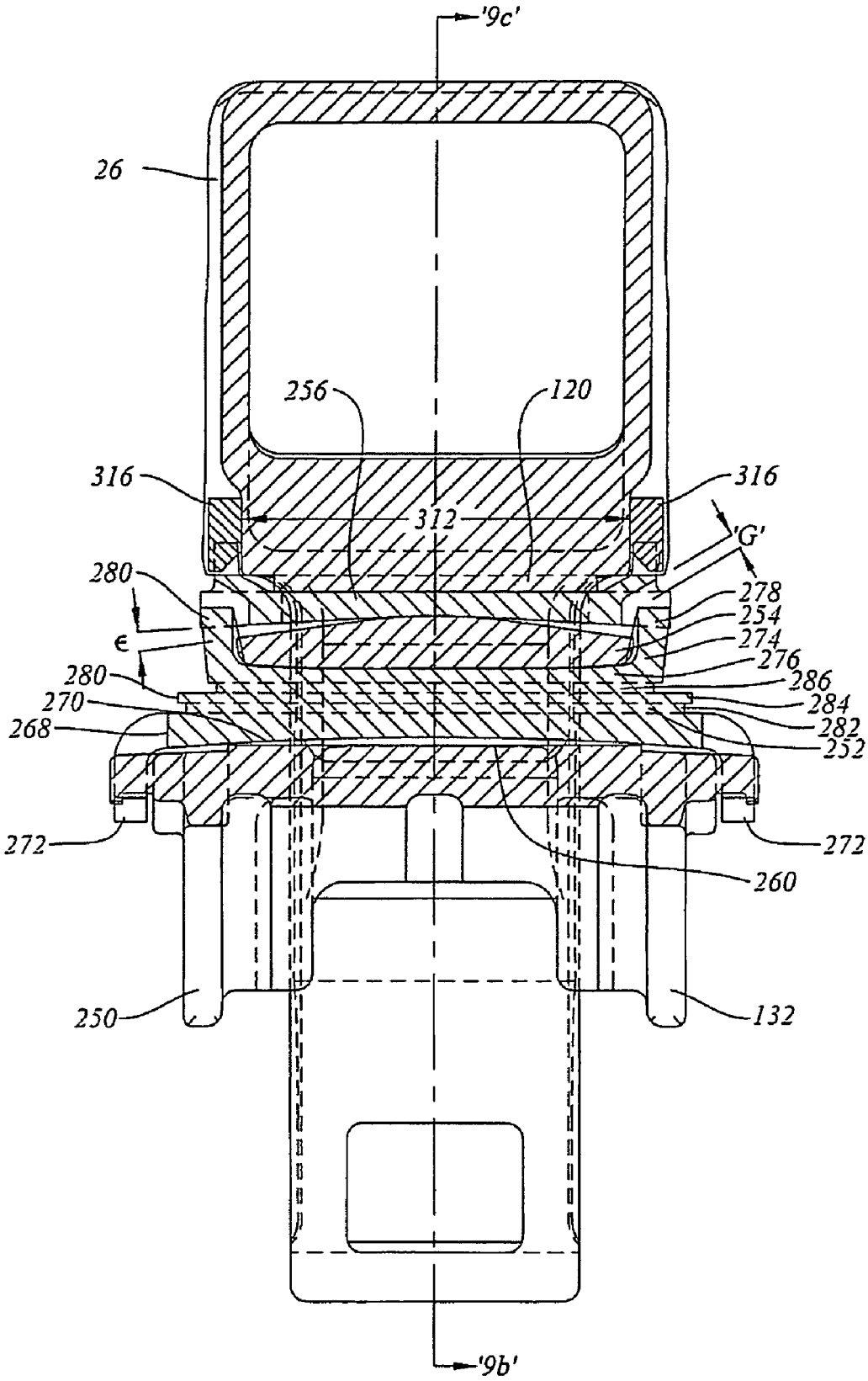
FIG. 9*b* shows a transverse cross-section of the assembly of FIG. 9*a*, taken on the axle center line thereof.
Figure 9C:
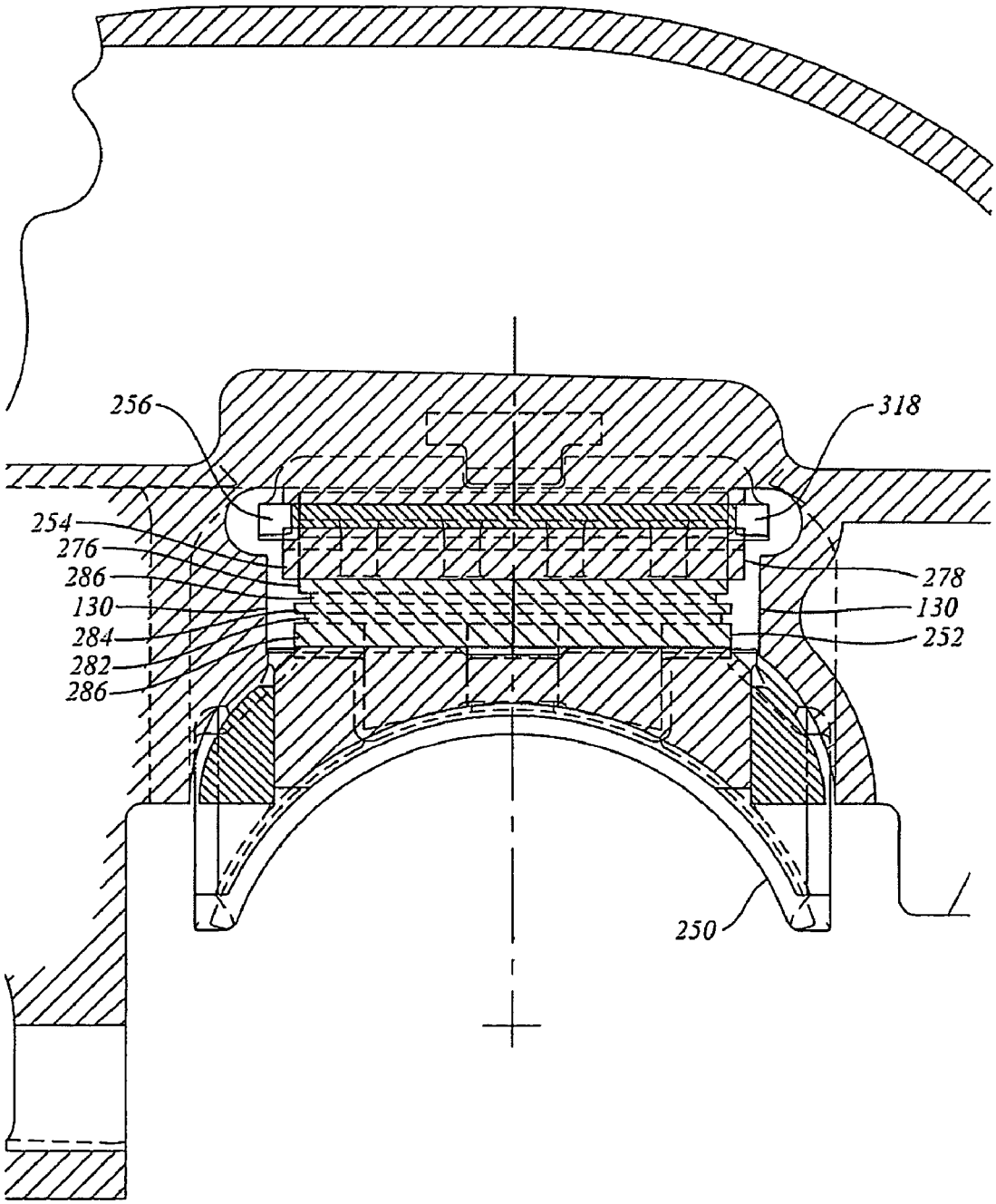
FIG. 9*c* shows a cross section of the assembly of FIG. 9*a* taken on the longitudinal plane of symmetry of the bearing adapter.
Figure 9D:
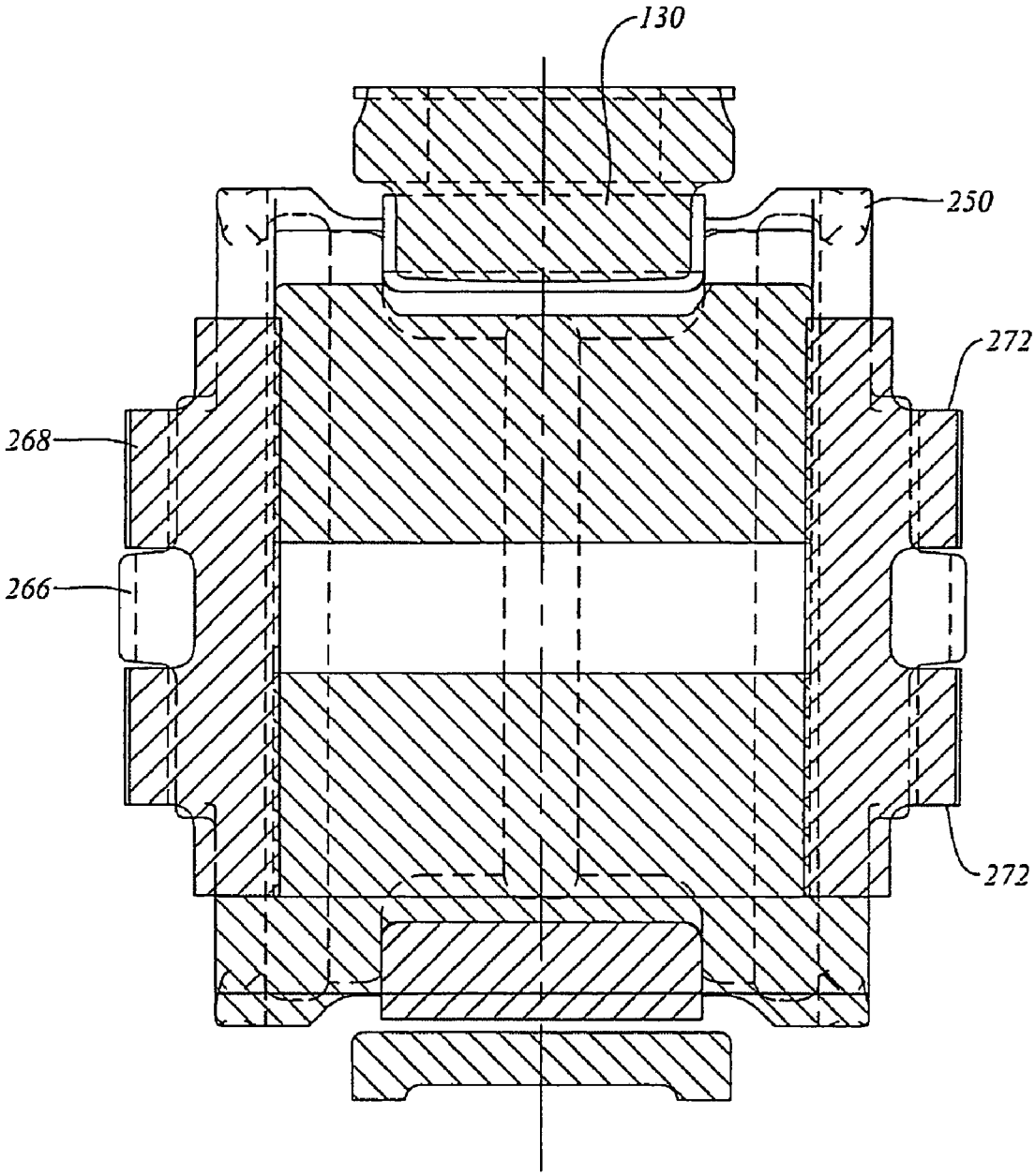
FIG. 9*d* shows a sectional view of the alternate assembly of FIG. 9*a*, as viewed from above, taken on the staggered section indicated as '9*d*-9*d'*.

FIGS. 9*a* to 9*c*

FIGS. 9*a* to 9*c* show the combination of a bearing adapter 250 with an elastomeric bearing adapter pad 252 and a rocker 254 and pedestal seat 256 to permit lateral rocking of the sideframe.

Figure 10A:
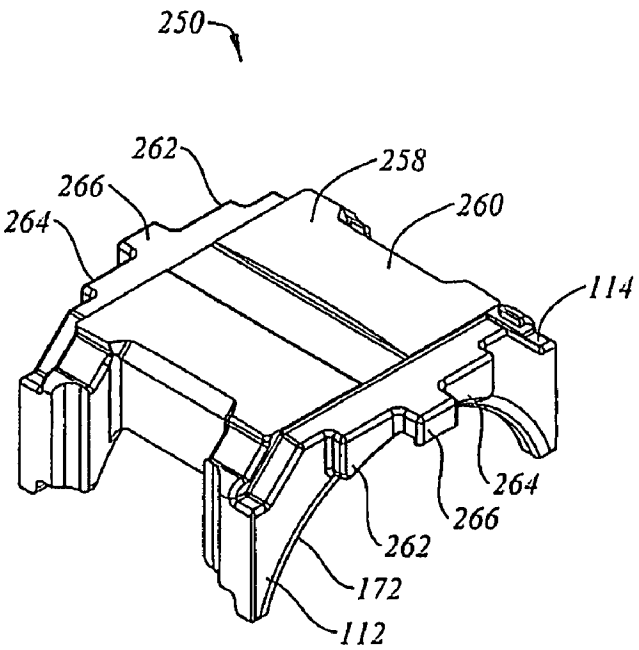
FIG. 10*a* is a view of a bearing adapter for use in the assembly of FIG. 9*a;*
Figure 10B:
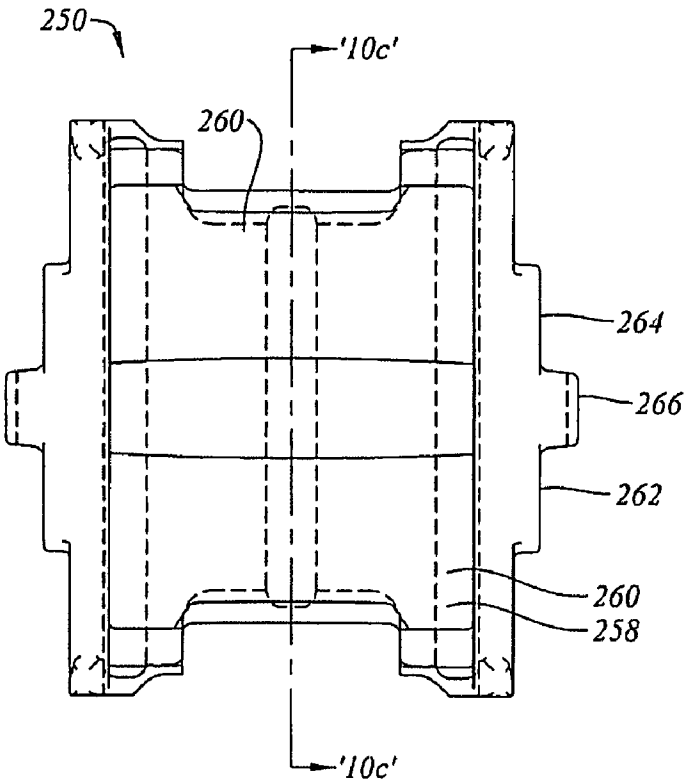
FIG. 10*b* shows a top view of the bearing adapter of FIG. 10*a;*
Figure 10C:
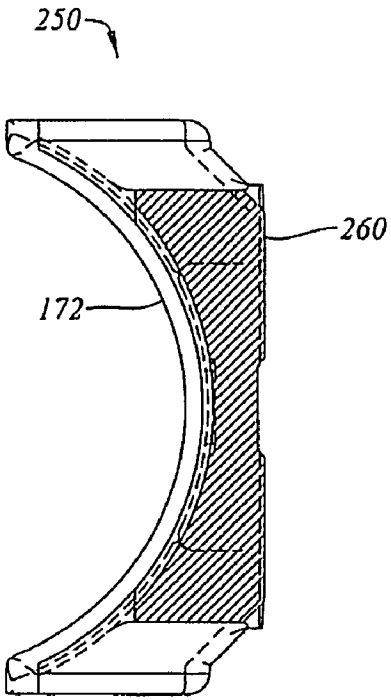
FIG. 10*c* shows a longitudinal cross-section of the bearing adapter of FIG. 10*a;*

Bearing adapter 250 may be a commercially available part. Bearing adapter 250, shown in three additional views in FIGS. 10*a*-10*c* is substantially similar to bearing adapter 44 (or 144) to the extent of its geometric features for engaging a bearing, but differs therefrom in having a more or less conventional upper surface. Upper surface 258 may be flat, or may have a large (roughly 60") radius crown 260, such as might have been used for engaging a planar pedestal seat surface. Crown 260 is split into two fore-and-aft portions, with a laterally extending central flat portion between them. Abreast of the central flat portion, bearing adapter 250 has a pair of laterally proud, outwardly facing lateral lands, 262 and 264, and, amidst those lands, lateral lugs 266 that extend further still proud beyond lands 262 and 264.

Bearing adapter pad 252 may be a commercially available assembly such as may be manufactured by Lord Corporation of Erie Pa., or such as may be identified as Standard Car Truck Part Number SCT 5578. Bearing adapter pad 252 has a bearing adapter engagement member in the nature of a lower plate 268 whose bottom surface 270 is relieved to seat over crown 260 in non-rocking engagement. Lateral and longitudinal translation of bearing adapter pad 252 is inhibited by an array of downwardly bent securement locating lugs, or fingers, or claws, in the nature of indexing members or tangs 272, two per side in pairs located to reach downwardly and bracket lugs 266 in close fitting engagement. The bracketing condition with respect to lugs 266 inhibits longitudinal motion between bearing adapter pad 252 and bearing adapter 250. The laterally inside faces of tangs 272 closely oppose the laterally outwardly facing surfaces of lands 262 and 264, tending thereby to inhibit lateral relative motion of bearing adapter pad 252 relative to bearing adapter 250. Given that, typically, ⅛ of the weight of the rail road car body and lading may be passed through plate 268, its vertical, lateral, and longitudinal position relative to bearing adapter 250 can be taken as fixed.

Bearing adapter pad 252 also has an upper plate, 274, that, in the case of a retro-fit installation of rocker 254 and seat 256, may have been used as a pedestal seat engagement member. In any case, upper plate 274 has the general shape of a longitudinally extending channel member, with a central, or back, portion, 276 and upwardly extending left and right hand leg portions 278, 280 adjoining the lateral margins of back portion 276. Leg portions 278 may have a size and shape such as might have been suitable for mounting directly to the sideframe pedestal.

Between lower plate 268 and upper plate 274, bearing adapter pad 252 has a bonded resilient sandwich 280 that may include a first resilient layer, indicated as lower elastomeric layer 282 mounted directly to the upper surface of lower plate 268, an intermediate stiffener shear plate 284 bonded or molded to the upper surface of layer 282, and an upper resilient layer, indicated as upper elastomeric layer 286 bonded atop plate 284. The upper surface of layer 286 may be bonded or molded to the lower surface of upper plate 274. Given that the resilient layers may be quite thin as compared to their length and breadth, the resultant sandwich may tend to have comparatively high vertical stiffness, comparatively high resistance to torsion about the longitudinal (x) and lateral (y) axes, comparatively low resistance to torsion about the vertical (z) axis (given the small angular displacements in any case), and non-trivial, roughly equal resistance to shear in the x or y directions that may be in the range of 20,000 to 40,000 lbs per inch, or more narrowly, about 30,000 lbs per inch for small deflections. Bearing adapter pad 252 may tend to permit a measure of self steering to be obtained when the elastomeric elements are subjected to longitudinal shear forces.

Rocker 254 (seen in additional views 11*e*, 11*f* and 11*g*) has a body of substantially constant cross-section, having a lower surface 290 formed to sit in substantially flat, non-rocking engagement upon the upper surface of plate 274 of bearing adapter pad 252, and an upper surface 292 formed to define a male rocker surface. Upper surface 292 may have a continuously radius central portion 294 lying between adjacent tangential portions 296 lying at a constant slope angle. In one embodiment, the central portion may describe 4-6 degrees of arc to either side of a central position, and may, in one embodiment have about 4½ to 5 degrees. In the terminology used above, this radius is "$r_2$", the male radius of a lateral rocker for permitting lateral swinging motion of side frame 26. Where a bearing adapter with a crown radius is mounted under the resilient bearing adapter pad, the radius of rocker 254 is less than the radius of the crown, perhaps less than half the crown radius, and possibly being less than ⅓ of the crown radius. It may be formed on a radius of between 5 and 20 inches, or, more narrowly, on a radius of between 8 and 15 inches. Surface 292 could also be formed on a parabolic profile, an elliptic or hyperbolic profile, or some other profile to yield lateral rocking.

Pedestal seat 256 (seen in FIGS. 11*a* to 11*d*) has a body having a major portion 300 that is substantially rectangular in plan view. When viewed from one end in the longitudinal direction, pedestal seat 256 has a generally channel shaped cross-section, in which major portion 300 forms the back 302 and two longitudinally running legs 304, 306 extend upwardly and laterally outwardly from the lateral margins of major portion 300. Legs 304 and 306 have an inner, or proximal portion 308 that extends upwardly and outwardly at an angle from the lateral margins of main portion 300, and an outer, or distal portion, or toe 310 that extends from the end of proximal portion 308 in a substantially vertical direction. The breadth between the opposed fingers of the channel section (i.e., between opposed toes 310) corresponds to the width of the sideframe pedestal roof 312, as shown in the cross-section of FIG. 9*b*, with which legs 304 and 306 sit in close fitting, bracketing engagement. Legs 304 and 306 have longitudinally centrally located cut-outs, reliefs, rebates, or indexing features, identified as notches 314. Notches 314 seat in close fitting engagement about T-shaped lugs 316 (FIG. 9*b*) that are welded to the sideframe on either side of the pedestal roof This engagement establishes the lateral and longitudinal position of pedestal seat 256 with respect to sideframe 26.

Pedestal seat 256 also has four laterally projecting corner lugs, or abutment fittings 318, whose longitudinally inwardly facing surfaces oppose the laterally extending end-face surfaces of the upturned legs 278 of upper plate 274 of bearing adapter pad 252. That is, the corner abutment fittings 318 on either lateral side of pedestal seat 256 bracket the ends of the upturned legs 278 of adapter pad 252 in close fitting engagement. This relationship fixes the longitudinal position of pedestal seat 256 relative to the upper plate of bearing adapter pad 252.

Figure 11E:
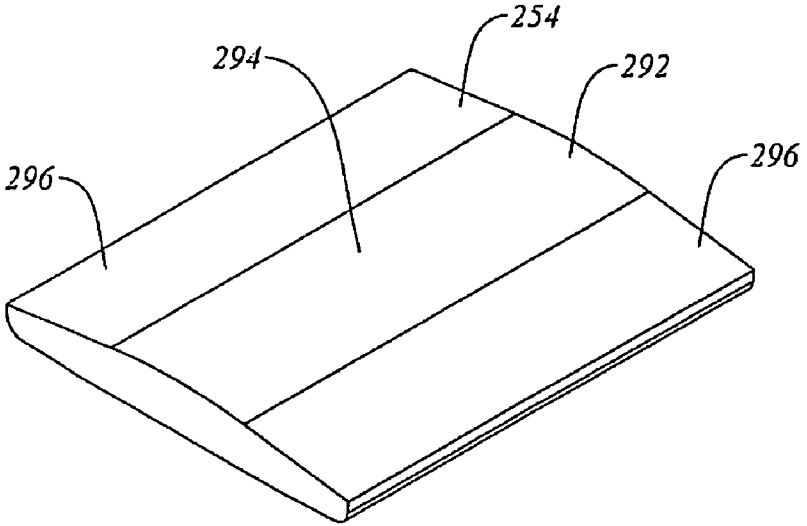
FIG. 11*e* shows an isometric view of a rocker for the pad adapter of FIG. 11*a;*
Figure 11F:
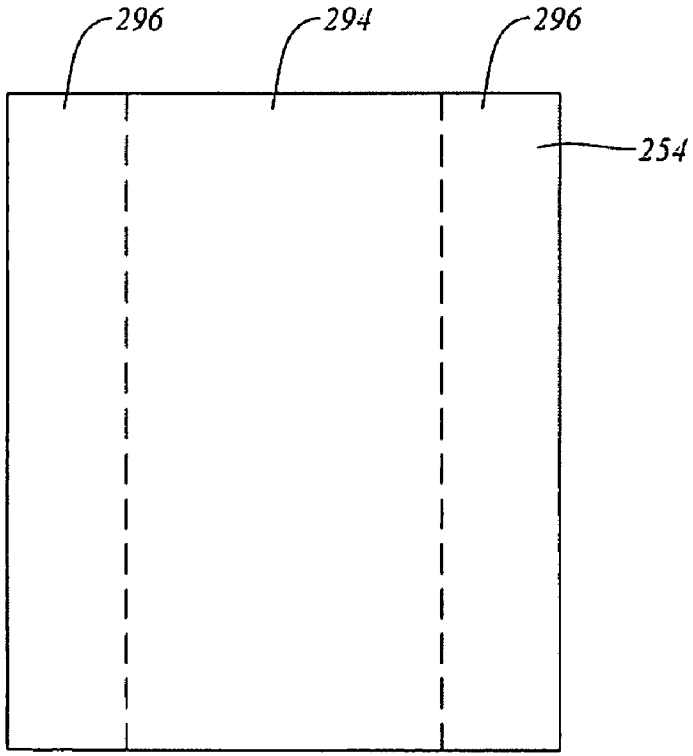
FIG. 11*f* shows a top view of the rocker of FIG. 11*a;*
Figure 11G:
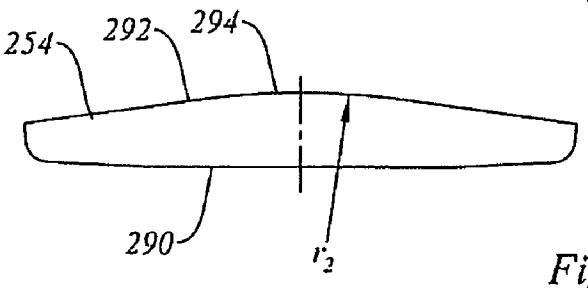
FIG. 11*g* shows an end view of the rocker of FIG. 11*a;*

Major portion 300 of pedestal seat 256 has a downwardly facing surface 300 that is hollowed out to form a depression defining a female rocking engagement surface 302. This surface is formed on a female radius (identified as $R_2$ in concordance with terminology used herein above) that is quite substantially larger than the radius of central portion 294 (FIG. 11*f*) of rocker 254, such that rocker 254 and pedestal seat 256 meet in rolling line contact engagement and permit sideframe 26 to swing laterally in a lateral rocking relationship on rocker 254. The arcuate profile of female rocking engagement surface 302 may be such as to encourage lateral self centering of rocker 254, and may have a radius of curvature that varies from a central region to adjacent regions, which may be tangential planar regions. Where pedestal seat 256 and rocker 254 are provided by way of retro-fit installation above an adapter having a crown radius, the radius of curvature of the pedestal seat may tend to be less than or equal to the crown radius. The central radius of curvature $R_2$ of surface 302, or the radius of curvature generally if constant, may be in the range of 6 to 60 inches, is preferably greater than 10 inches and less than 40 inches. It may be between 11/10 to 4 times as large as the rocker radius of curvature $r_2$. As noted elsewhere, the pedestal seat need not have the female rocker surface, and the rocker need not have the male rocker surface, but rather, these surfaces could be reversed, so that the male surface is on the pedestal seat, and the female surface is on the rocker. Particularly in the context of a retro-fit installation, there may be relatively little clearance between the upturned legs 278 of upper plate 274 and legs 304, 306 of pedestal seat 256. This distance is shown in FIG. 9*b* as gap 'G', which is preferably sufficient allowance for rocking motion between the parts that rocking motion is bounded by the spacing of the truck bolster gibs 106, 108.

By providing the combination of a lateral rocker and a shear pad, the resultant assembly may provide an anisotropic response at the bearing adapter to pedestal seat assembly interface, with a generally increased softness in the lateral direction, while permitting a measure of self steering. The example of FIG. 9*a* may be provided as an original installation, or may be provided as a retrofit installation. In the case of a retrofit installation, rocker 254 and pedestal seat 256 may be installed between an existing elastomeric pad and an existing pedestal seat, or may be installed in addition to a replacement elastomeric pad of lesser through-thickness, such that the overall height of the bearing adapter to pedestal seat interface may remain roughly the same as it was before the retrofit.

Figure 9F:
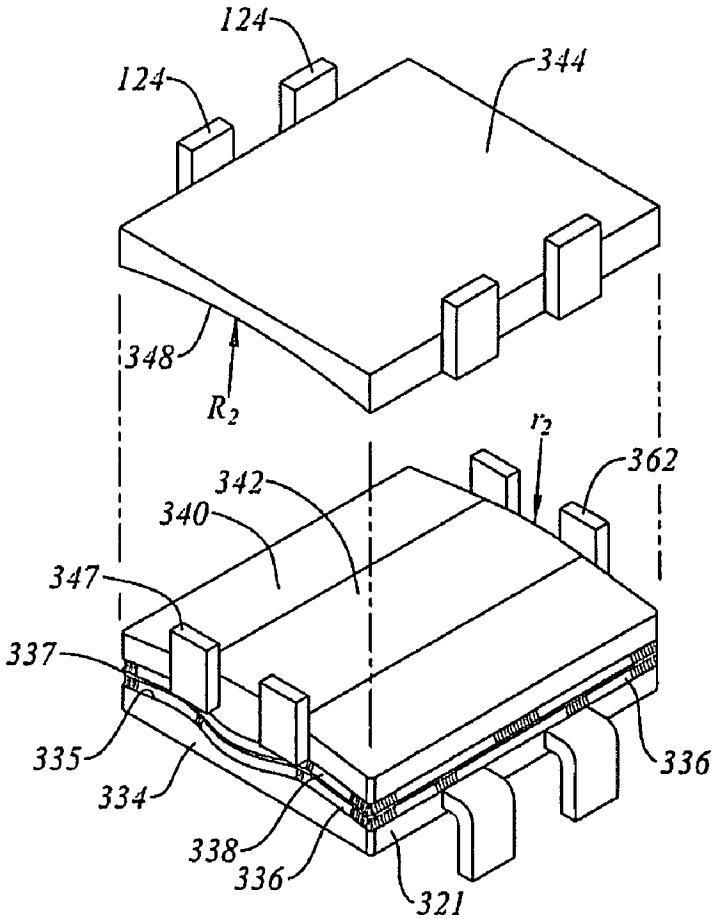
FIG. 9*f* shows a perspective view of an alternate pad combination to that of FIG. 9*e;*
Figure 9E:
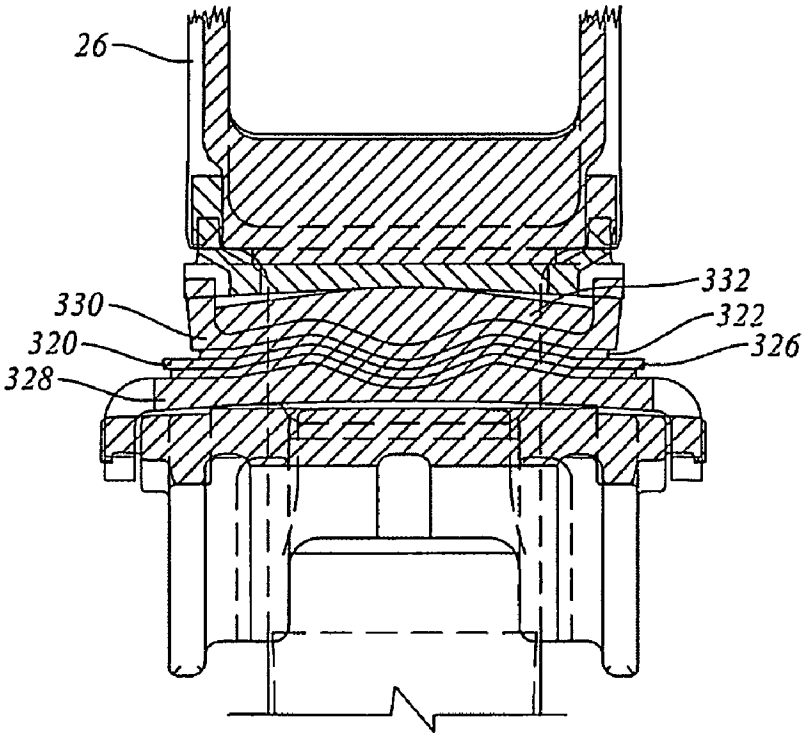
FIG. 9*e* shows an end view of an alternate rocker combination employing an elastomeric pad.

FIGS. 9*e* and 9*f* represent alternate embodiments of combinations of elastomeric pads and rockers. While the embodiment of FIG. 9*a* showed an elastomeric sandwich that had roughly equivalent response to shear in the lateral and longitudinal directions, this need not be the general case. For example, in the embodiments of FIGS. 9*e* and 9*f*, elastomeric bearing adapter pad assemblies 320 and 331 have respective resilient elastomeric laminates sandwiches, indicated generally as 322 and 323 in which the stiffeners 326, 327 have longitudinally extending corrugations, or waves. In the longitudinal direction, the sandwich may tend to react in nearly pure shear, as before in the example of FIG. 9*a*. However, deflection in the lateral direction now requires not only a shear component, but also a component normal to the elastomeric elements, in compressive or tensile stress, rather than, and in addition to, shear. This may tend to give a stiffer lateral response, and hence an anisotropic response. An anisotropic shear pad arrangement of this nature might have been used in the embodiment of FIG. 9*a*, and a planar arrangement, as in the embodiment of FIG. 9*a* could be used in either of the embodiments of FIG. 9*e*, and 9*f*. Considering FIG. 9*e*, both base plate 328 and upper plate 330 has a wavy contour corresponding to the wavy contour of sandwich 322 generally. Rocker 332 has a lower surface of corresponding profile. Otherwise, this embodiment is substantially the same as the embodiment of FIG. 9*a*.

Considering FIG. 9*f*, an elastomeric bearing adapter pad assembly 321 has a base plate 334 having a lower surface for seating in non-rocking relationship on a bearing adapter, in the same manner as bearing adapter pad assembly 252 sits upon bearing adapter 250. The upper surface 335 of base plate 334 has a corrugated or wavy contour, the corrugations running lengthwise, as discussed above. An elastomeric laminate of a first resilient layer 336, an internal stiffener plate 337, and a second resilient layer 338 are located between base plate 334 and a correspondingly wavy undersurface of upper plate 340. Rather than being a flat plate upon which a further rocker plate is mounted, upper plate 340 has an upper surface 342 having an integrally formed rocker contour corresponding to that of the upper surface of rocker 254. Pedestal seat 344 then mounts directly to, and in lateral rocking relationship with upper plate 340, without need for a separate rocker part. The combination of bearing adapter pad 321 and pedestal seat 342 may have interconnecting abutments 347 to prevent longitudinal migration of rocker surface 342 relative to the contoured downwardly facing surface 348 of pedestal seat 344.

FIG. 12*a*

Figure 12A:
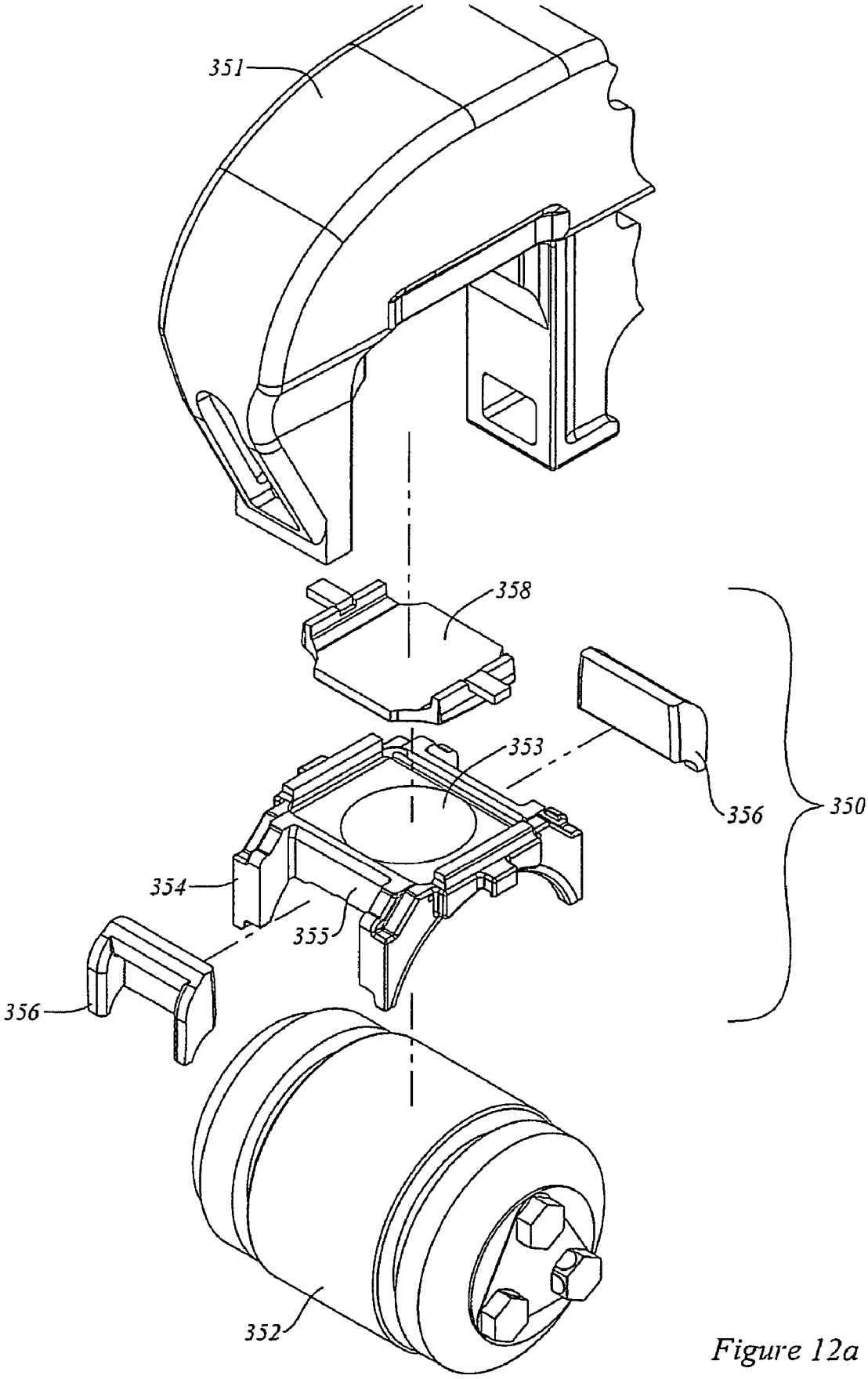
FIG. 12*a* shows an exploded isometric view of the assembly of FIG. 12*a;*

FIG. 12*a* shows an alternate embodiment of wheelset to sideframe interface assembly, indicated most generally as 350. In this example it may be understood that the pedestal region of sideframe 351, as shown in FIG. 12*a*, is substantially similar to those shown in the previous examples, and may be taken as being the same except insofar as may be noted. Similarly, bearing 352 may be taken as representing the location of the end of a wheelset more generally, with the wheelset to sideframe interface assembly including those items, members or elements that are mounted between bearing 352 and sideframe 351. Bearing adapter 354 may be generally similar to bearing adapter 44 or 144 in terms of its lower structure for seating on bearing 352. As with the bodies of the other bearing adapters described herein, the body of bearing adapter 354 may be a casting or a forging, or a machined part, and may be made of a material that may be a relatively low cost material, such as cast iron or steel, and may be made in generally the same manner as bearing adapters have been made heretofore. Bearing adapter 354 may have a bi-directional rocker 353 employing a compound curvature of first and second radii of curvature according to one or another of the possible combinations of male and female radii of curvature discussed above. Bearing adapter 354 may differ from those described above in that the central body portion 355 of the adapter has been trimmed to be shorter longitudinally, and the inside spacing between the corner abutment portions has been widened somewhat, to accommodate the installation of an auxiliary centering device, or centering member, or centrally biased restoring member in the nature of, for example, elastomeric bumper pads, such as those identified as resilient pads, 356. Pads 356 may be considered a form of restorative centering element, and may also be termed "snubbers". A pedestal seat fitting having a mating rocking surface for permitting lateral and longitudinal rocking, is identified as 358. As with the other pedestal seat fittings shown and described herein, fitting 358 may be made of a hard metal material, which made be a grade of steel. The mating engagement of the rocking surfaces may, again, tend to be torsionally compliant as noted above.

FIG. 12*b*

Figure 12B:
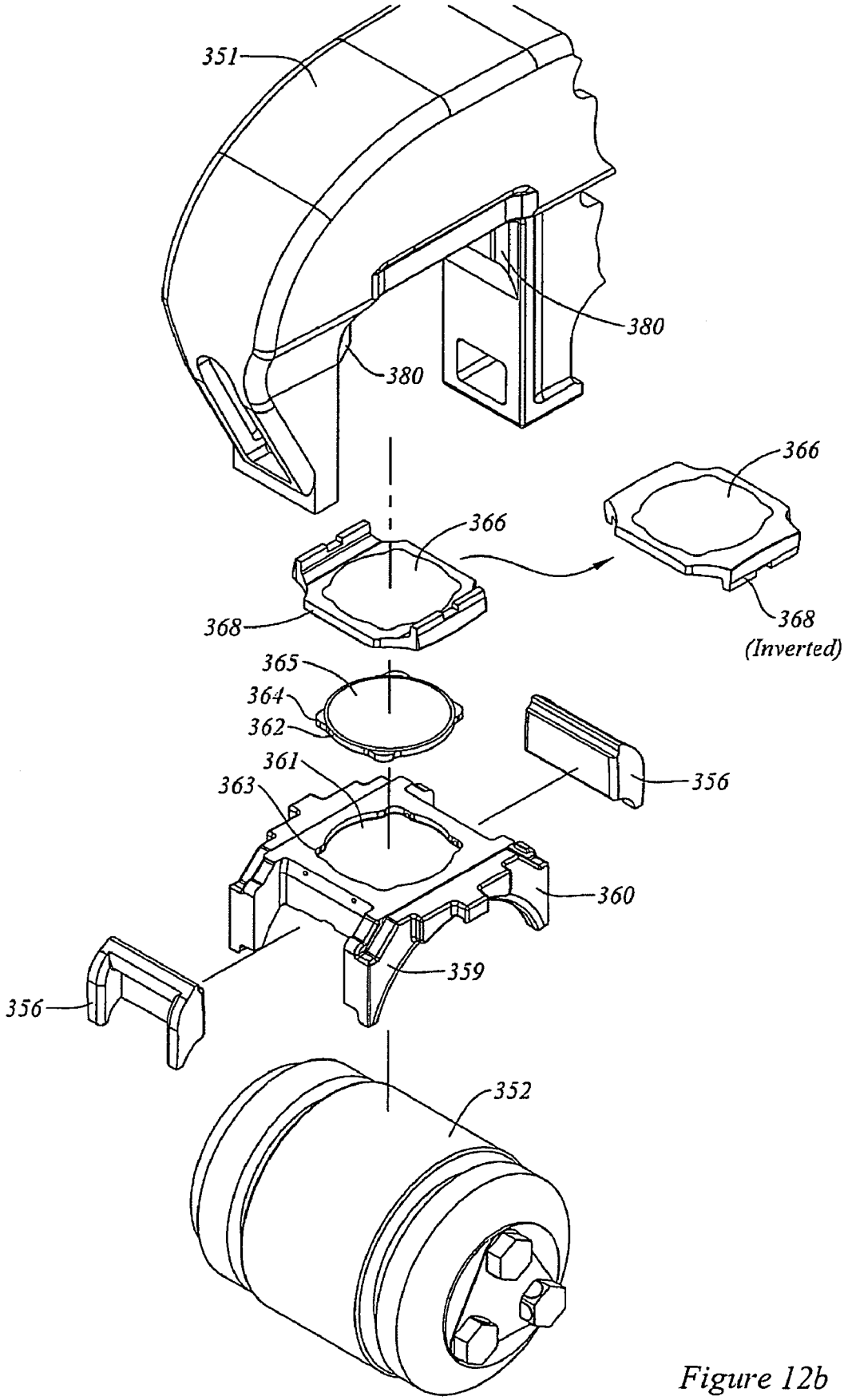
FIG. 12*b* shows an alternate embodiment of bearing adapter to pedestal seat interface to that of FIG. 12*a;*

In FIG. 12*b*, a bearing adapter 360 is substantially similar to bearing adapter 354, but differs in having a central recess, or socket, or accommodation, indicated generally as 361 for receiving an insert identified as a first, or lower, rocker member 362. As with bearing adapter 354, the main, or central portion of the body 359 of bearing adapter 360 may be of shorter longitudinal extent than might otherwise be the case, being truncated or relieved to accommodate resilient members 356.

Accommodation 361 may have a plan view form whose periphery may include one or more keying, or indexing, features or fittings, of which cusps 363 may be representative. Cusps 363 may receive mating keying, or indexing, features or fittings, of which lobes 364 may be taken as representative examples. Cusps 363 and lobes 364 may be such as may fix the angular orientation of the lower, or first, rocker member 362 such that the appropriate radii of curvature may be presented in each of the lateral and longitudinal directions. For example cusps 363 may be spaced unequally about the periphery of accommodation 361 (with lobes 364 being correspondingly spaced about the periphery of the insert member 362) in a specific spacing arrangement to prevent installation in an incorrect orientation, (such as 90 degrees out of phase). For example, one cusp may be spaced 80 degrees of arc about the periphery from one neighbouring cusp, and 100 degrees of arc from another neighbouring cusp, and so on to form a rectangular pattern. Many variations are possible.

While body 359 of bearing adapter 360 may be made of cast iron or steel, the insert, namely first rocker member 362, may be made of a different material. That different material may present a hardened metal rocker surface such as may have been manufactured by a different process. For example, the insert, member 362, may be made of a tool steel, or of a steel such as may be used in the manufacture of ball bearings. Furthermore, upper surface 365 of insert member 362, which includes that portion that is in rocking engagement with the mating pedestal seat 368, may be machined or otherwise formed to a high degree of smoothness, akin to a ball bearing surface, and may be heat treated, to give a finished bearing part.

Figure 12C:
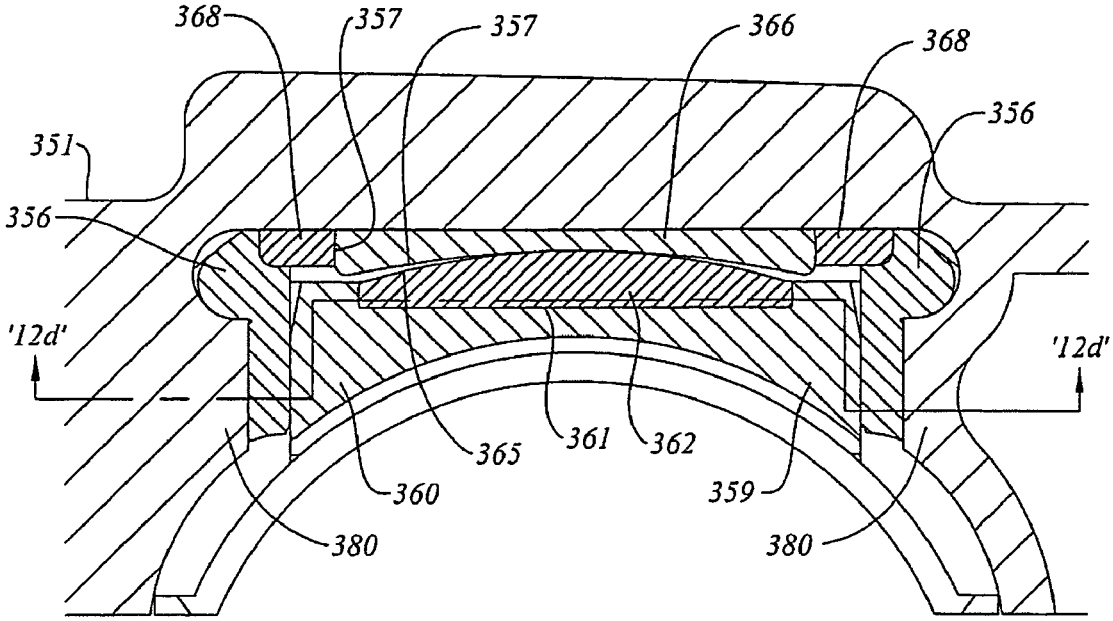
FIG. 12*c* shows a sectional view of the assembly of FIG. 12*b*; taken on a longitudinal-vertical plane of symmetry thereof.
Figure 12D:
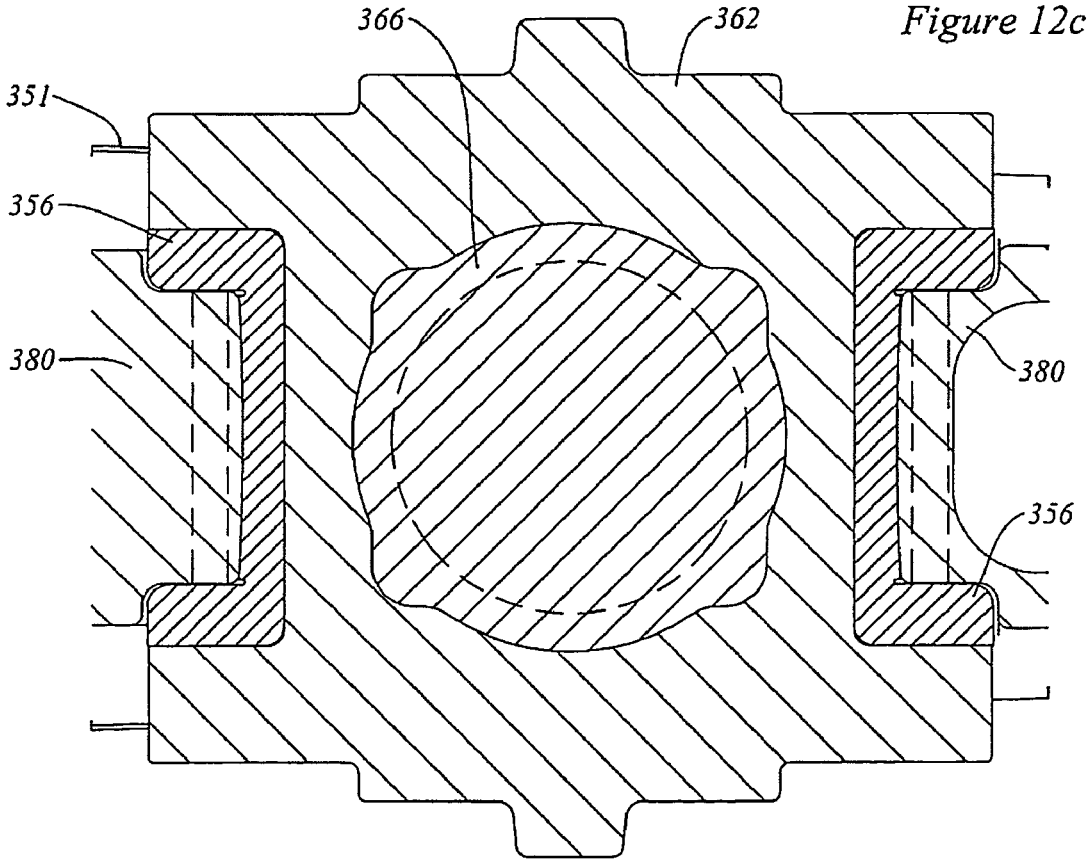
FIG. 12*d* shows a stepped sectional view of a detail of the assembly of FIG. 12*b* taken on 12*d*-12*d'* of FIG. 12*c;*

Similarly, pedestal seat 368 may be made of a hardened material, such as a tool steel or a steel from which bearings are made, formed to a high level of smoothness, and heat treated as may be appropriate, having a surface formed to mate with surface 365 of rocker member 362. Alternatively, pedestal seat 368 may have an accommodation 367 and indicated as an upper or second rocker member 366 analogous to insert 362 and accommodation 361, with keying or indexing such as may tend to cause the parts to seat in the correct orientation. Insert member 366 may be formed of a hard material in a manner similar to insert member 362. and has a downward facing rocking surface 357, which may be machined or otherwise formed to a high degree of smoothness, akin to a ball or roller bearing surface, and may be heat treated, to give a finished bearing part surface for mating, rocking engagement with surface 365. Where rocker member 362 has both male radii, and the female radii of curvature are both infinite, such that the female surface is planar, a wear member having a planar surface such as spring clip 369 may be mounted in a sprung interference fit in the pedestal roof in lieu of pedestal seat 368. In one embodiment, spring clip 369 may be a clip on "Dyna-Clip"™ pedestal roof wear plate such as made by TransDyne Inc. Such a clip 369 is shown an isometric view in FIG. 12*f*. Clip 369 is shown, as installed, in a quartered section isometric view in FIG. 12*g* in a position for rocking engagement with a bearing adapter 349. While bearing adapter 349 does not show an insert, a bearing adapter such as bearing adapter 360 with an insert 364 may be employed.

FIG. 12*e*

Figure 12E:
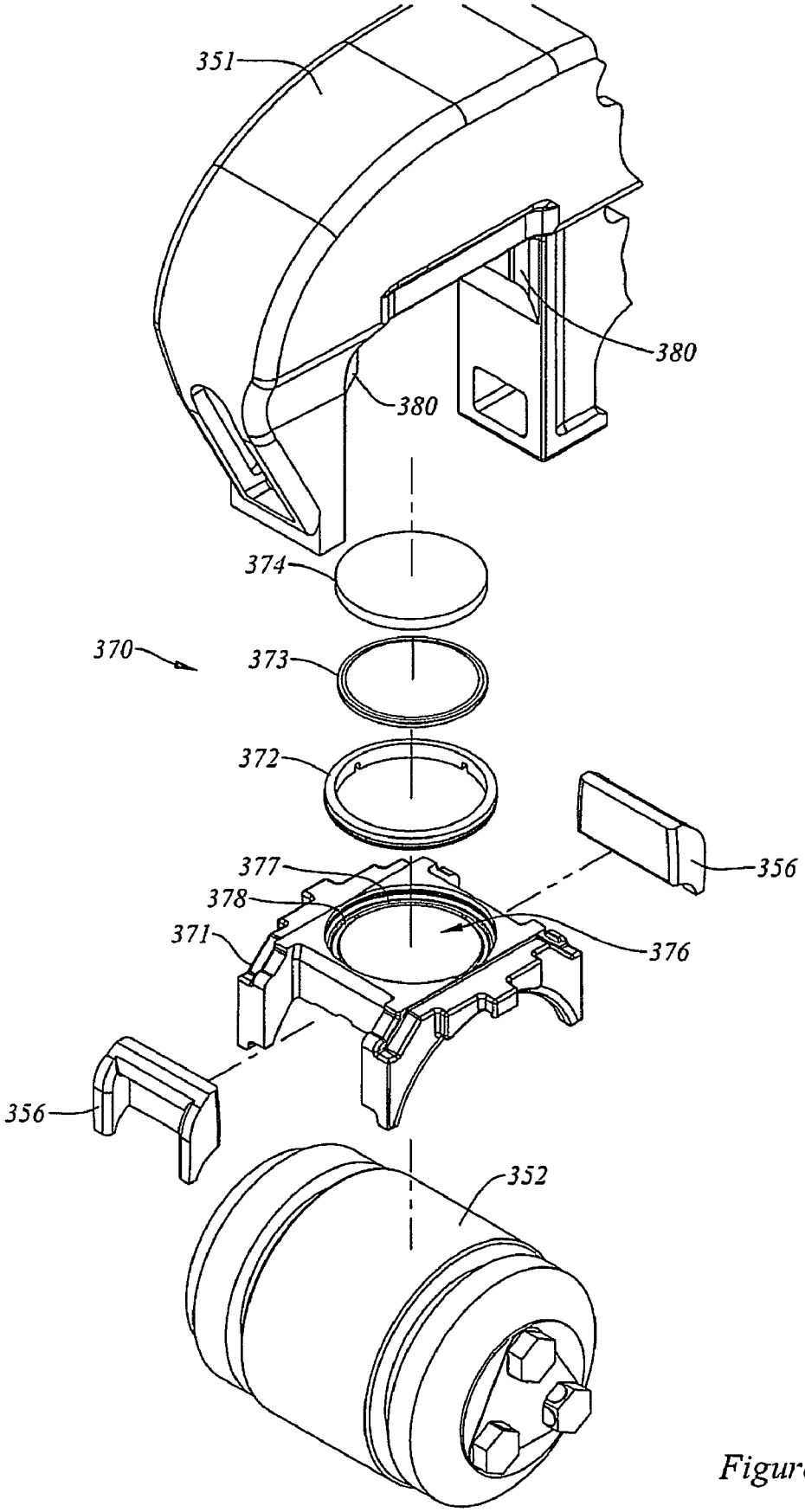
FIG. 12*e* shows an exploded view of another alternative embodiment of bearing adapter to pedestal seat interface to that of FIG. 12*a;*
Figure 12F:
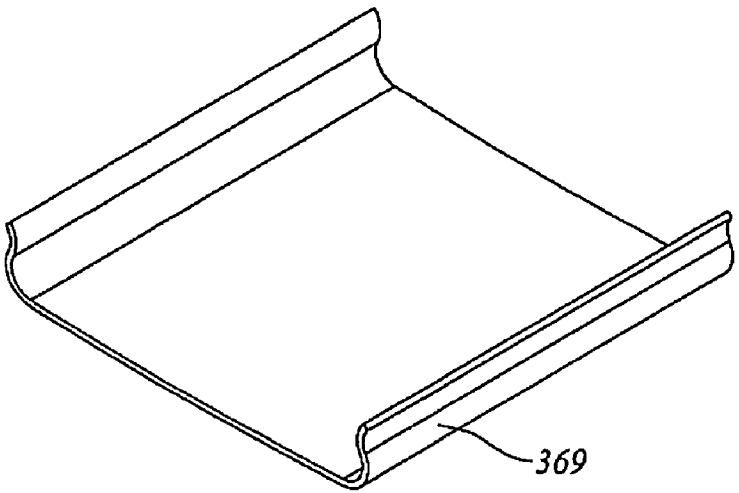
FIG. 12*f* shows an alternate style of wear plate for use in some embodiments of the bearing adapter to pedestal seat interface of, for example, FIG. 12*c;*
Figure 12G:
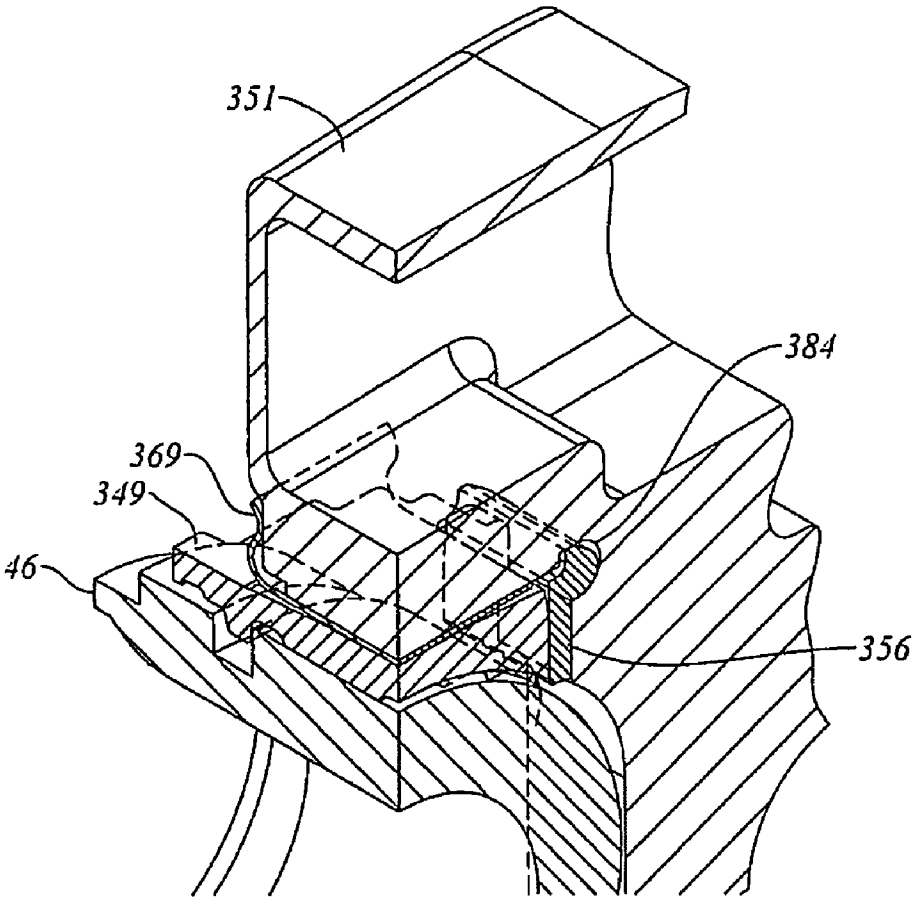
FIG. 12*g* shows a quartered isometric section the wear plate of FIG. 12*f* as installed.
Figure 13D:
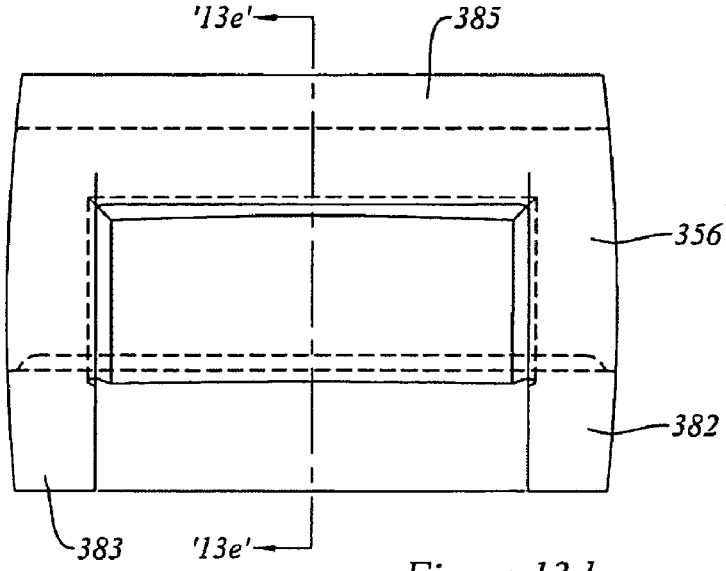
FIG. 13*d* is a front view of the retainer pad of FIG. 13*a;*
Figure 13E:
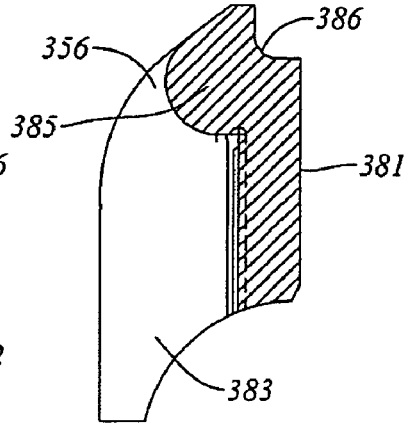
FIG. 13*e* is a section on '13*e*-13*e*' of FIG. 13*d* of the retainer pad of FIG. 13*a;*
Figure 13C:
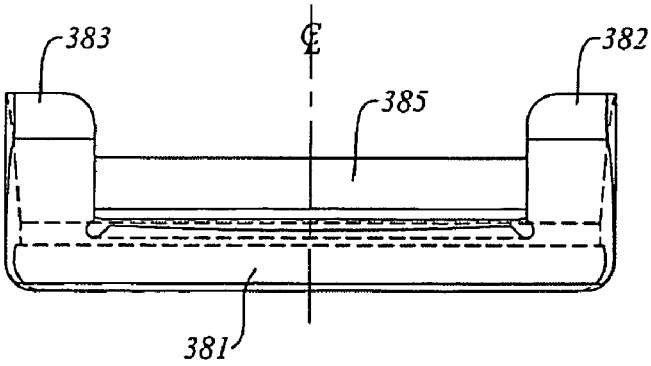
FIG. 13*c* is a bottom view of the retainer pad of FIG. 13*a;*
Figure 13B:
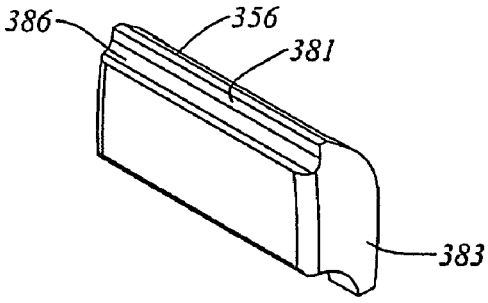
FIG. 13*b* is an isometric view from above and behind the retainer pad of FIG. 13*a;*
Figure 13A:
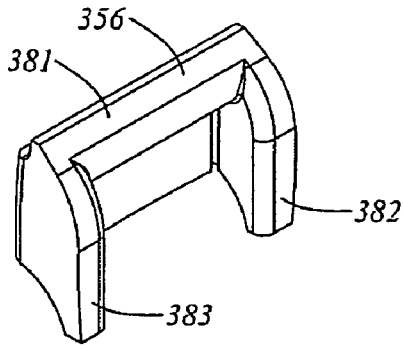
FIG. 13*a* shows an isometric view of a retainer pad of the assembly of FIG. 12*a*, taken from above, and in front of one corner.

FIG. 12*e* shows an alternate embodiment of wheelset to sideframe interface assembly, indicated most generally as 370. Assembly 370 may include such elements as a bearing adapter 371, a pair of resilient members 356, a rocking assembly that may include a boot, resilient ring or retainer, 372, a first rocker member 373, and a second rocker member 374. A pedestal seat may be provided to mount in the roof of the pedestal as described above, or second rocker member 374 may mount directly in the pedestal roof.

Bearing adapter 371 is generally similar to bearing adapter 44, 144 or 354 in terms of its lower structure for seating on bearing 352. The body of bearing adapter 371 may be a casting or a forging, or a machined part, and may be made of a material that may be a relatively low cost material, such as cast iron or steel. Bearing adapter 371 may be provided with a central recess, or socket, or accommodation, indicated generally as 376, for receiving rocker member 372 and rocker member 373, and resilient ring 372. The ends of the main portion of the body of bearing adapter 371 may be of relatively short extent to accommodate resilient members 356.

Accommodation 376 may have the form of a circular opening, that may have a radially inwardly extending flange 377, whose upwardly facing surface 378 defines a circumferential land upon which to seat first rocker member 372. Flange 377 may also include drain holes 378, such as may be 4 holes formed on 90 degree centers, for example. Rocker member 372 has a spherical engagement surface.

First rocker member 372 may include a thickened central portion, and a thinner radially distant peripheral portion, having a lower radial edge, or margin, or land, for seating upon, and for transferring vertical loads into, flange 377. In an alternate embodiment a non-galling, relatively soft annular gasket, or shim, whether made of a suitable brass, bronze, copper, or other material may be employed on flange 377 under the land. First rocker member 372 may be made of a different material from the material from which the body of bearing adapter 356 is made more generally. That is to say, rocker member 372 may be made of a hard, or hardened material, such as a tool steel or a steel such as might be used in a bearing, that may be finished to a generally higher level of precision, and to a finer degree of surface roughness than the body of bearing adapter 356 more generally. Such a material may be suitable for rolling contact operation under high contact pressures.

Second rocker member 373 may be a disc of circular shape (when viewed in plan view) or other suitable shape for seating in pedestal seat 375, or, in the event that a pedestal seat member is not used, then formed directly to mate with the pedestal roof. First rocker member 373 may have an upper, or rocker surface 374, having a profile such as may give bi-directional lateral and longitudinal rocking motion when used in conjunction with the mating second, or upper rocker member, 373. Second rocker member 373 may be made of a different material from the material from which the body of bearing adapter 371, or the pedestal seat, is made more generally. Second rocker member 373 may be made of a hard, or hardened material, such as a tool steel or a steel such as might be used in a bearing, that may be finished to a generally higher level of precision, and to a finer degree of surface roughness than the body of bearing adapter 371 more generally. Such a material may be suitable for rolling contact operation under high contact pressures, particularly as when operated in conjunction with first rocker member 372. It may be noted that where an insert of dissimilar material is used, that material may tend to be rather more costly than the cast iron or relatively mild steel from which bearing adapters may otherwise tend to be made. Further still, an insert of this nature may possibly be removed and replaced, either on the basis of a scheduled rotation, or as the need may arise.

Resilient member 372 may be made of a composite or polymeric material, such as a polyurethane. Resilient member 372 may also have apertures, or reliefs 373 such as may be placed in a position for co-operation with corresponding to drain holes 378. The wall height of resilient member 372 may be such as to engage the periphery of sufficiently tall that first rocker member 372. Further, a portion of the radially outwardly facing peripheral edge of the second, upper, rocking member 374, may also lie within, or may be partially overlapped by, and may possibly slightly stretchingly engage, the upper margin of resilient member 372 in a close, or interference, fit manner, such that a seal may tend to be formed to exclude dirt or moisture. In this way the assembly may tend to form a closed unit. In that regard, such space as may be formed between the first and second rockers 373, 374 may be packed with a lubricant, such as a lithium or other suitable grease.

It may be desirable for the rocking assembly at the wheelset to sideframe interface to tend to maintain itself in a centered condition. As noted, the torsionally de-coupled bi-directional rocker arrangements disclosed herein may tend to have rocking stiffnesses that are proportional to the weight placed upon the rocker. When the rocker is unloaded, in whole or in part, it may be desirable for the rocker to be urged to a self centered position without regard to the actual weight on the rocker surfaces. The interface assembly may include resilient members 356 that may seat between the longitudinal ends of bearing adapter 371 (and pedestal seat 352) and the pedestal jaw thrust blocks 380.

FIGS. 12*c* and 12*d* are provided to illustrate the spatial relationship of the sandwich formed by (a) the bearing adapter, such as, for example, bearing adapter 354; (b) the centering member, such as, for example, resilient members 356; and (c) the pedestal jaw thrust blocks, 380. Ancillary details such as, for example, drain holes or phantom lines to show hidden features have been omitted from FIGS. 12*c* and 12*d* for clarity.

FIGS. 13*a*-13*e*

As shown in FIGS. 13*a*-13*e*, resilient members 356 may have the general shape of a channel, having a central, or back, or transverse, or web portion 381, and a pair of left and right hand, flanking wing portions 382, 383. Wing portions 382 and 383 may tend to have downwardly and outwardly tending extremities that may tend to have an arcuate lower edge such as may seat over the bearing casing. The inside width of wing portions 382 and 383 may be such as to seat snugly about the sides of thrust blocks 380. A transversely extending lobate portion 385, running along the upper margin of web portion 381, may seat in a radiused rebate 384 between the upper margin of thrust blocks 380 and the end of pedestal seat 354. The inner lateral edge 386 of lobate portion 385 may tend to be chamfered, or relieved, to accommodate, and to seat next to, the end of pedestal seat 354.

Where a longitudinal rocking surface is used, and the truck is experiencing reduced wheel load, (such as may approach wheel lift), or where the car is operating in the light car condition, it may be helpful to employ an auxiliary restorative centering element that may include a biasing element tending to move the bearing adapter to a longitudinally centered position relative to the pedestal roof, and whose restorative tendency may be independent of the gravitational force experienced at the wheel. That is, when the bearing adapter is under less than full load, or is unloaded, it may be desirable to maintain a bias to a central position. Resilient members 356 described above may operate to urge such centering.

When resilient member 356 is in place, bearing adapter 354 may tend to be located relative to jaws 380. As installed, the snubber (member 356) may seat about the pedestal jaw thrust lug in a slight interference fit, and may seat next to the bearing adapter end wall and between the bearing adapter corner abutments in a slight interference fit. The snubber may be sandwiched between, and may establish the spaced relative position of, the thrust lug and the bearing adapter and may provide an initial central positioning of the mating rocker elements as well as providing a restorative bias. Although bearing adapter 354 may still rock relative to the sideframe, such rocking may tend to deform (typically, locally compress) a portion of member 356, and, being elastic, member 354 may tend to urge bearing adapter 354 back to a central position, whether there is much weight on the rocking elements or not. Resilient member 354 may have a restorative force-deflection characteristic in the longitudinal direction that is substantially less stiff than the force deflection characteristic of the fully loaded longitudinal rocker (perhaps one to two orders of magnitude less), such that, in a fully loaded car condition, member 354 may tend not significantly to alter the rocking behaviour. In one embodiment member 354 may be made of a polyurethane having a Young's modulus of some 6,500 p.s.i. In another embodiment the Young's modulus may be about 13,000 p.s.i. The placement of resilient members 356 may tend to center the rocking elements during installation. In one embodiment, the force to deflect one of the snubbers may be less than 20% of the force to deflect the rocker a corresponding amount under the light car (i.e., unloaded) condition, and may, for small deflections, have an equivalent force/deflection curve slope that may be less than 10% of the force deflection characteristic of the longitudinal rocker.

FIGS. 14*a* to 14*e*

Figure 14C:
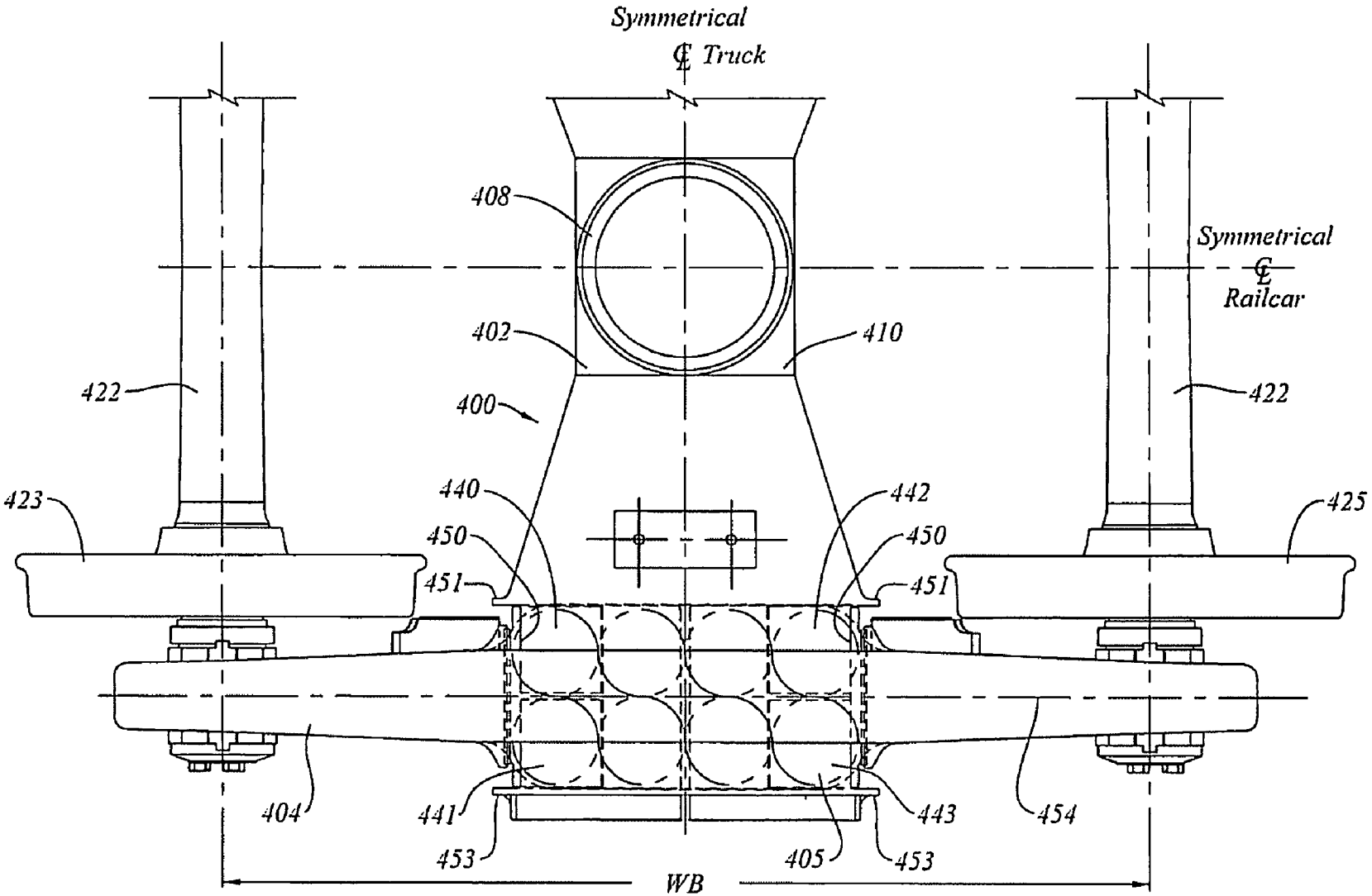
FIG. 14*c* shows a top view of half of the three piece truck of FIG. 14*b;*
Figure 14D:
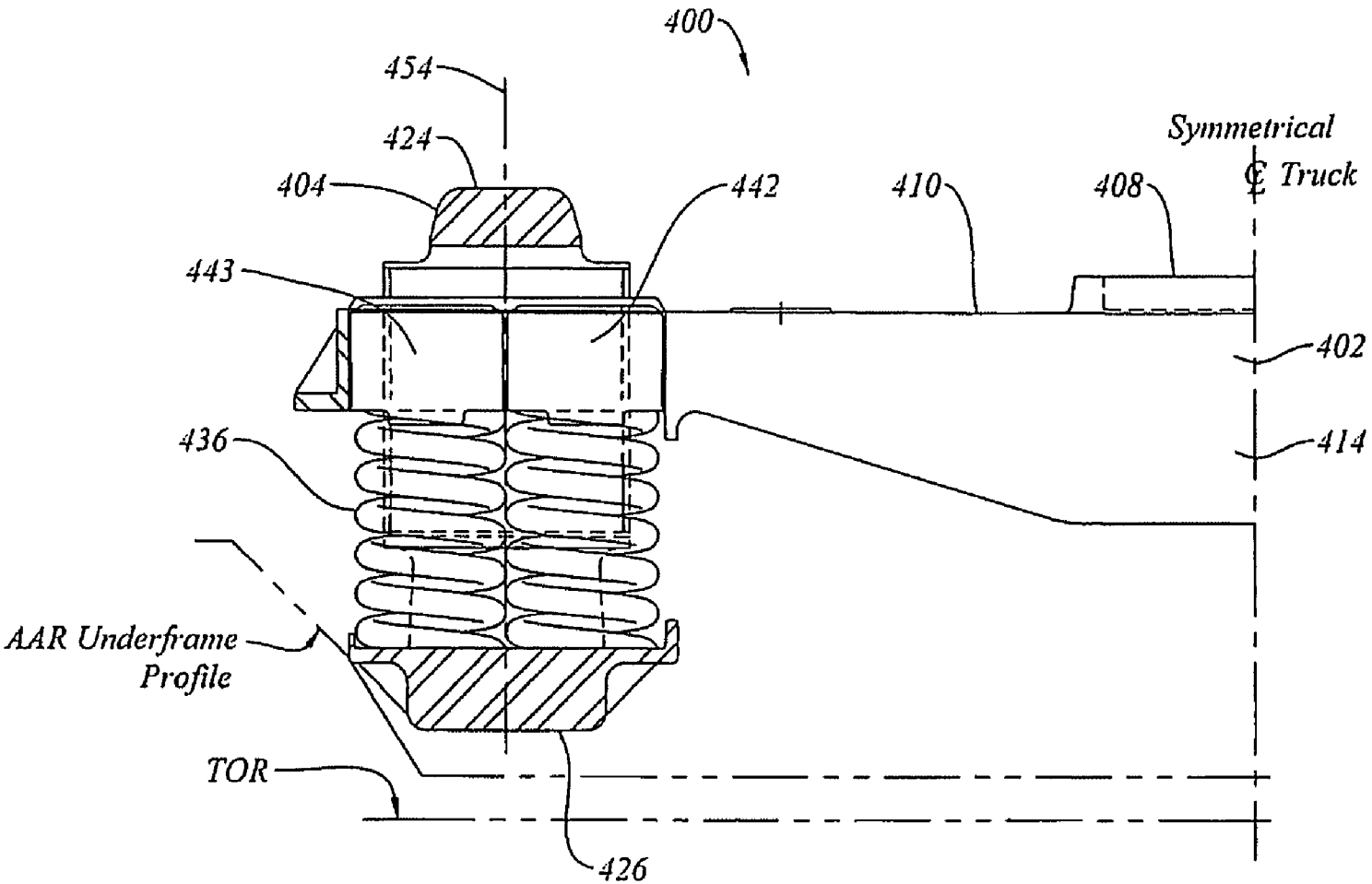
FIG. 14*d* shows a partial section of the truck of FIG. 14*b* taken on '14*d*-14*d'*.

FIGS. 14*a* to 14*e* relate to a three piece truck 400. Truck 400 has three major elements, those elements being a truck bolster 402, that is symmetrical about the truck longitudinal centreline, and a pair of first and second side frames, indicated as 404. Only one side frame is shown in FIG. 14*c* given the symmetry of truck 400. Three piece truck 400 has a resilient suspension (a primary suspension) provided by a spring groups 405 trapped between each of the distal (i.e., transversely outboard) ends of truck bolster 402 and side frames 404.

Truck bolster 402 is a rigid, fabricated beam having a first end for engaging one side frame assembly and a second end for engaging the other side frame assembly (both ends being indicated as 406). A center plate or center bowl 408 is located at the truck center. An upper flange 410 extends between the two ends 404, being narrow at a central waist and flaring to a wider transversely outboard termination at ends 404. Truck bolster 402 also has a lower flange 412 and two fabricated webs 414 extending between upper flange 410 and lower flange 412 to form an irregular, closed section box beam. Additional webs 415 are mounted between the distal portions of flanges 410 and 412 where bolster 402 engages one of the spring groups 405. The transversely distal region of truck bolster 402 also has friction damper seats 416, 418 for accommodating friction damper wedges.

Side frame 404 may be a casting having pedestal fittings 419 into which bearing adapters 420, bearings 421, and a pair of axles 422 mount. Each of axles 422 has a pair of first and second wheels 423, 425 mounted to it in a spaced apart position corresponding to the width of the track gauge of the track upon which the rail car is to operate. Side frame 404 also has a compression member, or upper beam member 424, a tension member, or lower beam member 426, and vertical side columns 428 and 430, each lying to one side of a vertical transverse plane bisecting truck 400 at the longitudinal station of the truck center. A generally rectangular opening is defined by the co-operation of the upper and lower beam members 424, 426 and vertical columns 428, 430, into which the distal end of truck bolster 402 can be introduced. The distal end of truck bolster 402 can then move up and down relative to the side frame within this opening. Lower beam member 426 has a bottom or lower spring seat 432 upon which spring group 405 can seat. Similarly, an upper spring seat 434 is provided by the underside of the distal portion of bolster 402 engages the upper end of spring group 405. As such, vertical movement of truck bolster 402 will tend to increase or decrease the compression of the springs in spring group 405.

In the embodiment of FIG. 14*a*, spring group 405 has two rows of springs 436, a transversely inboard row and a transversely outboard row. In one embodiment each row may have four large (8 inch +/−) diameter coil springs giving vertical bounce spring rate constant, k, for group 405 of less than 10,000 lbs./inch. In one embodiment this spring rate constant may be in the range of 6000 to 10,000 lbs./in., and may be in the range of 7000 to 9500 lbs./in, giving an overall vertical bounce spring rate for the truck of double these values, perhaps in the range of 14,000 to 18,500 lbs./in for the truck. The spring array may include nested coils of outer springs, inner springs, and inner-inner springs depending on the overall spring rate desired for the group, and the apportionment of that stiffness. The number of springs, the number of inner and outer coils, and the spring rate of the various springs can be varied. The spring rates of the coils of the spring group add to give the spring rate constant of the group, typically being suited for the loading for which the truck is designed.

Each side frame assembly also has four friction damper wedges arranged in first and second pairs of transversely inboard and transversely outboard wedges 440, 441, 442 and 443 that engage the sockets, or seats 416, 418 in a four-cornered arrangement. The corner springs in spring group 405 bear upon a friction damper wedge 440, 441, 442 or 443. Each of vertical columns 428, 430 has a friction wear plate 450 having transversely inboard and transversely outboard regions against which the friction faces of wedges 440, 441, 442 and 443 can bear, respectively. Bolster gibs 451 and 453 lie inboard and outboard of wear plate 450 respectively. Gibs 451 and 453 act to limit the lateral travel of bolster 402 relative to side frame 404. The deadweight compression of the springs under the dampers will tend to yield a reaction force working on the bottom face of the wedge, trying to drive the wedge upward along the inclined face of the seat in the bolster, thus urging, or biasing, the friction face against the opposing portion of the friction face of the side frame column. In one embodiment, the springs chosen may have an undeflected length of 15 inches, and a dead weight deflection of about 3 inches.

Figure 1K:
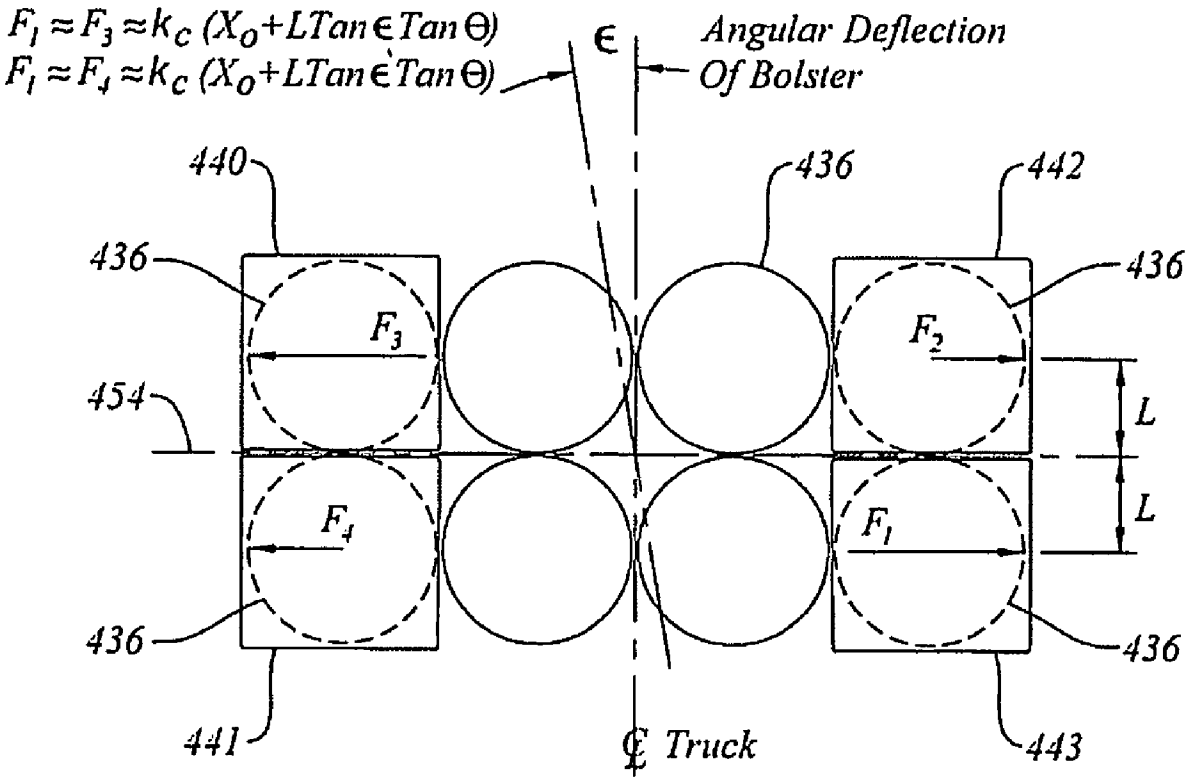
FIG. 1*k* shows a force schematic for four cornered damper arrangements generally, such as, for example, in the trucks of FIGS. 1*a*, 1*f*, 1*i* and FIG. 14*a;*

As seen in the top view of FIG. 14*c*, and in the schematic sketch of FIG. 1*k* the side-by-side friction dampers have a relatively wide averaged moment arm L to resist angular deflection of the side frame relative to the truck bolster in the parallelogram mode. This moment arm is significantly greater than the effective moment arm of a single wedge located on the spring group (and side frame) centre line. Further, the use of independent springs under each of the wedges means that whichever wedge is jammed in tightly, there is always a dedicated spring under that specific wedge to resist the deflection. In contrast to older designs, the overall damping face width is greater because it is sized to be driven by relatively larger diameter (e.g., 8 in +/−) springs, as compared to the smaller diameter of, for example, AAR B 432 out or B 331 side springs, or smaller. Further, in having two elements side-by-side the effective width of the damper is doubled, and the effective moment arm over which the diagonally opposite dampers work to resist parallelogram deformation of the truck in hunting and curving greater than it would have been for a single damper.

Figure 14E:
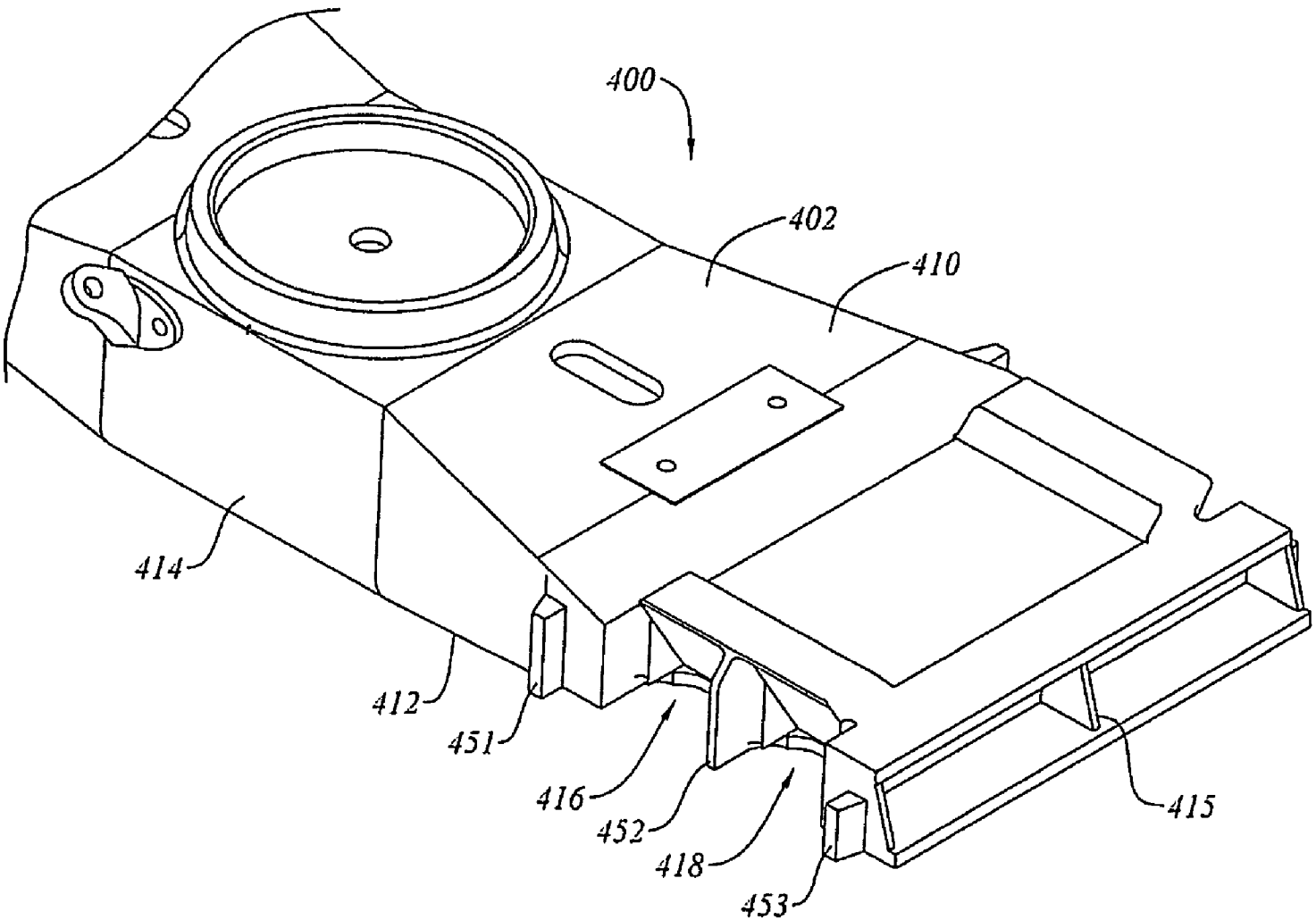
FIG. 14*e* shows a partial isometric view of the truck bolster of the three piece truck of FIG. 14*a* showing friction damper seats.

In the illustration of FIG. 14*e*, the damper seats are shown as being segregated by a partition 452. If a longitudinal vertical plane is drawn through truck 400 through the center of partition 452, it can be seen that the inboard dampers lie to one side of plane 454, and the outboard dampers lie to the outboard side of the plane. In hunting then, the normal force from the damper working against the hunting will tend to act in a couple in which the force on the friction bearing surface of the inboard pad will always be fully inboard of the plane on one end, and fully outboard on the other diagonal friction face.

In one embodiment, the size of the spring group embodiment of FIG. 14*b* may yield a side frame window opening having a width between the vertical columns of side frame 404 of roughly 33 inches. This is relatively large compared to existing spring groups, being more than 25% greater in width. Truck 400 may have a correspondingly greater wheelbase length, indicated as WB. WB may be greater than 73 inches, or, taken as a ratio to the track gauge width, may be greater than 1.30 time the track gauge width. It may be greater than 80 inches, or more than 1.4 times the gauge width, and in one embodiment is greater than 1.5 times the track gauge width, being as great, or greater than, about 84 inches. Similarly, the side frame window may be wider than tall. The measurement across the wear plate faces of the side frame columns may be greater than 24", possibly in the ratio of greater than 8:7 of width to height, and possibly in the range of 28" or 32" or more, giving ratios of greater than 4:3 and greater than 3:2. The spring seat may have lengthened dimensions to correspond to the width of the side frame window, and a transverse width of 15½-17" or more.

Figure 15A:
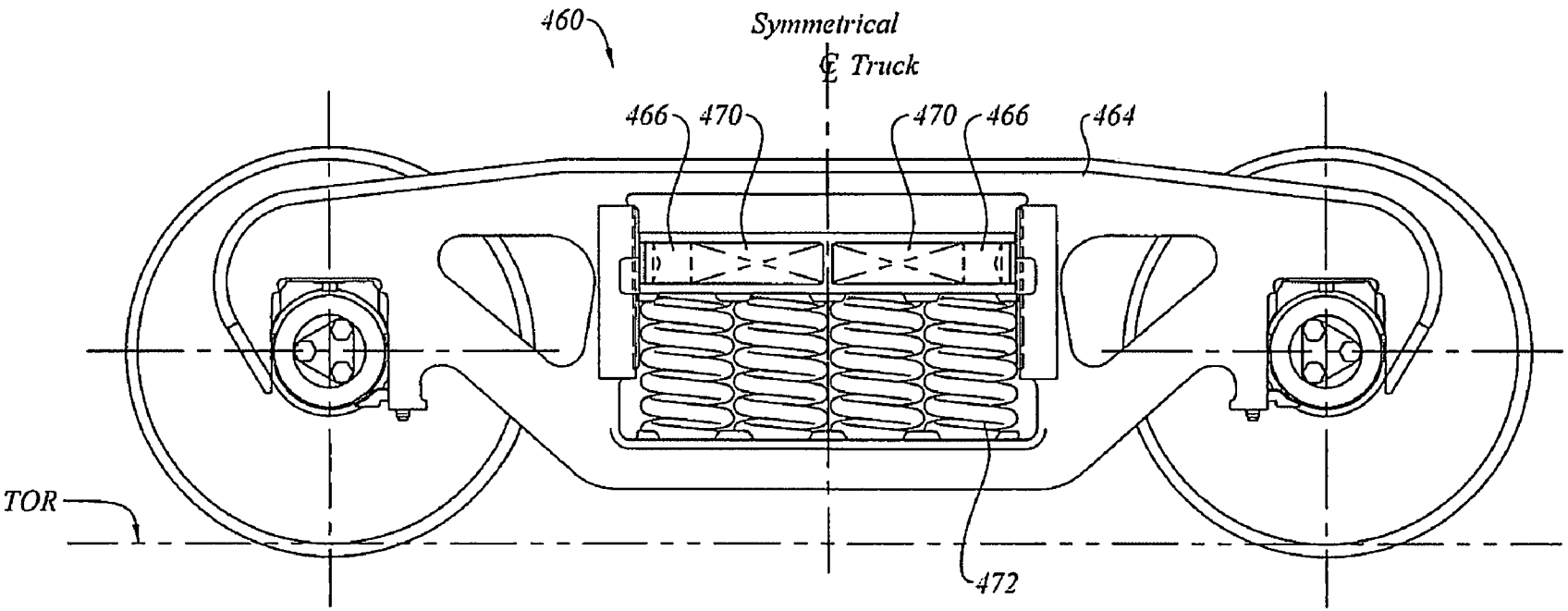
FIG. 15*a* shows a side view of an alternate three piece truck to that of FIG. 14*a;*
Figure 15B:
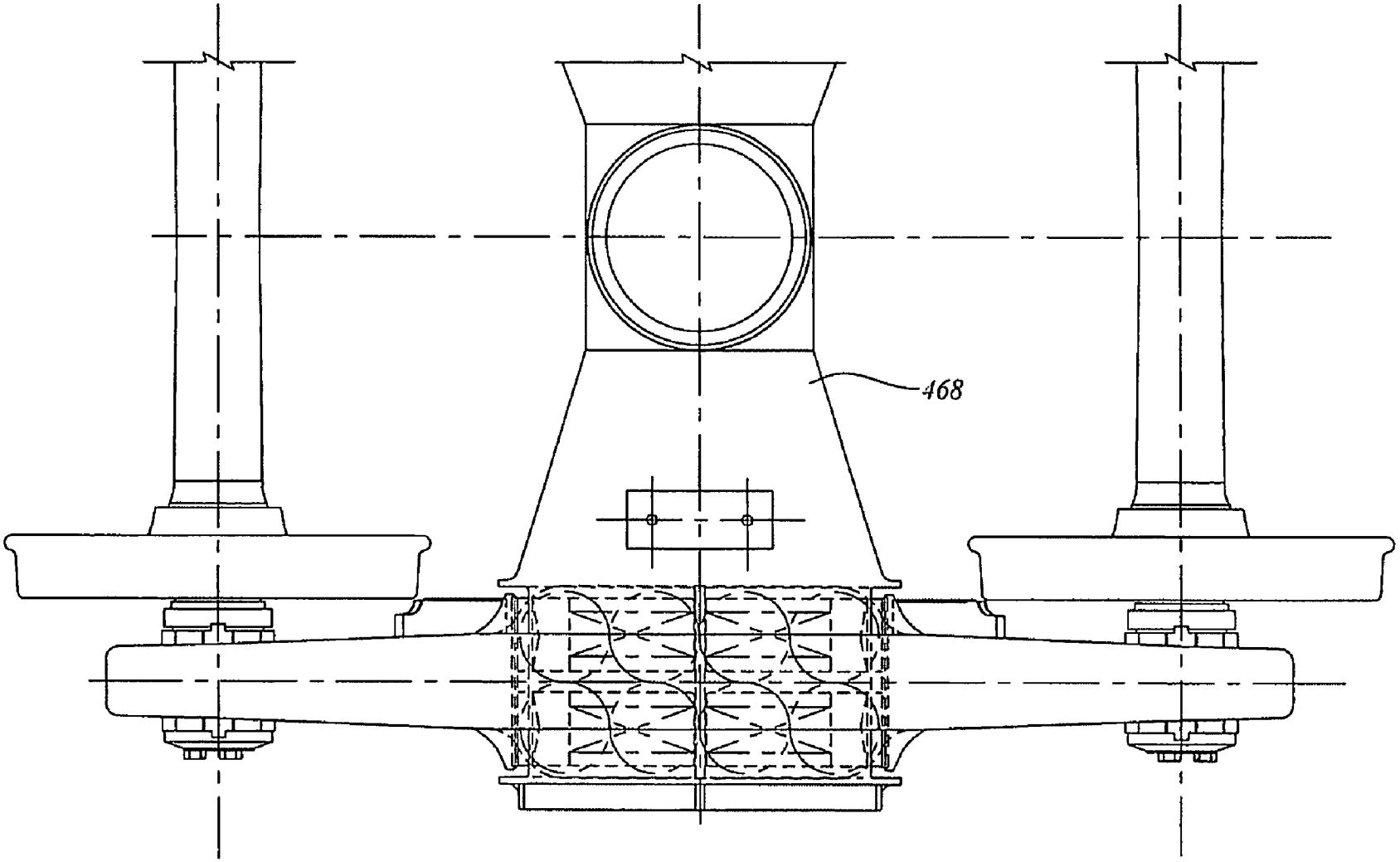
FIG. 15*b* shows a top view of half of the three piece truck of FIG. 15*a*.
Figure 15C:
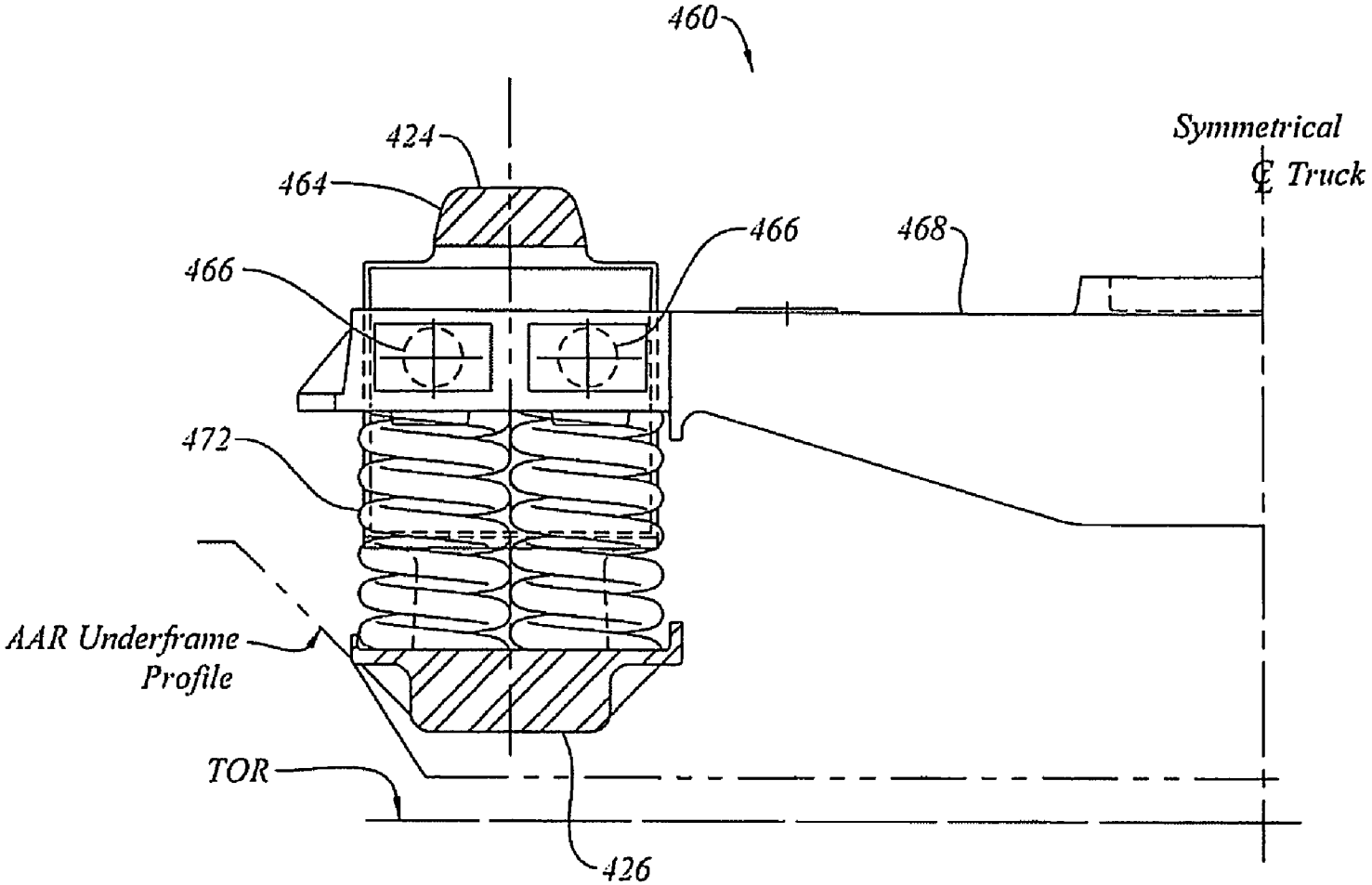
FIG. 15*c* shows a partial section of the truck of FIG. 15*a* taken on '15*c*-15*c'*.

FIGS. 15*a*, 15*b* and 15*c*

In FIGS. 15*a*, 15*b* and 15*c*, there is an alternate embodiment of three piece truck, identified as 460. Truck 460 employs constant force inboard and outboard, fore and aft pairs of friction dampers 466 mounted in the distal ends of truck bolster 468. In this arrangement, springs 470 are mounted horizontally in pockets in the distal ends of truck bolster 468 and urge, or bias, each of the friction dampers 466 against the corresponding friction surfaces of the vertical columns of the side frames. The spring force on friction damper wedges 440, 441, 442 and 443 varies as a function of the vertical displacement of truck bolster 402, since they are driven by the vertical springs of spring group 405. By contrast, the deflection of springs 470 does not depend on vertical compression of the main spring group 472, but rather is a function of an initial pre-load.

Figures 16A, 16B:
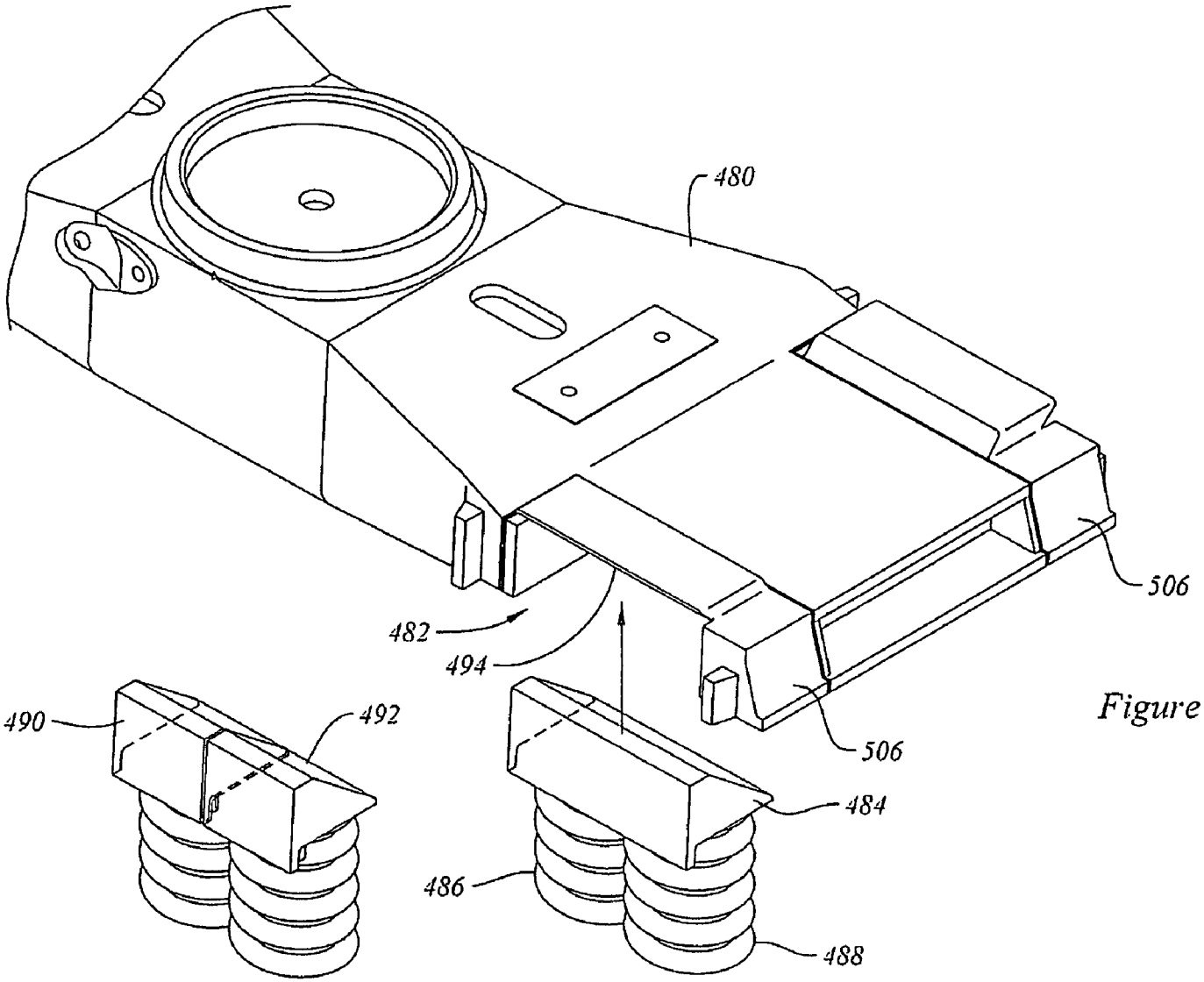
FIG. 16*a* shows an alternate version of the bolster of FIG. 14*e*, with a double sized damper pocket for seating a large single wedge having a welded insert.
FIG. 16*b* shows an alternate dual wedge for a truck bolster like that of FIG. 16*a;*

FIGS. 16*a* and 16*b*

FIGS. 16*a* and 16*b* show a partial isometric view of a truck bolster 480 that is generally similar to truck bolster 402 of FIG. 14*a*, except insofar as bolster pocket 482 does not have a central partition like web 452, but rather has a continuous bay extending across the width of the underlying spring group, such as spring group 436. A single wide damper wedge is indicated as 484. Damper 484 is of a width to be supported by, and to be acted upon, by two springs 486, 488 of the underlying spring group. In the event that bolster 400 may tend to deflect to a non-perpendicular orientation relative to the associated side frame, as in the parallelogramming phenomenon, one side of wedge 484 may tend to be squeezed more tightly than the other, giving wedge 484 a tendency to twist in the pocket about an axis of rotation perpendicular to the angled face (i.e., the hypotenuse face) of the wedge. This twisting tendency may also tend to cause differential compression in springs 486, 488, yielding a restoring moment both to the twisting of wedge 484 and to the non-square displacement of truck bolster 480 relative to the truck side frame. As there may tend to be a similar moment generated at the opposite spring pair at the opposite side column of the side frame, this may tend to enhance the self-squaring tendency of the truck more generally.

Also included in FIG. 16*b* is an alternate pair of damper wedges 490, 492. This dual wedge configuration can similarly seat in bolster pocket 482, and, in this case, each wedge 490, 492 sits over a separate spring. Wedges 490, 492 are vertically slidable relative to each other along the primary angle of the face of bolster pocket 482. When the truck moves to an out of square condition, differential displacement of wedges 490, 492 may tend to result in differential compression of their associated springs, e.g., 484, 488 resulting in a restoring moment as above.

The sliding motion described above may tend to cause wear on the moving surfaces, namely (a) the side frame columns, and (b) the angled surfaces of the bolster pockets. To alleviate, or ameliorate, this situation, consumable wear plates 494 can be mounted in bolster pocket 482 (with appropriate dimensional adjustments) as in FIG. 16*a*. Wear plates 494 can be smooth steel plates, possibly of a hardened, wear resistant alloy, or may be made from a non-metallic, or partially non-metallic, relatively low friction wear resistant surface. Other plates for engaging the friction surfaces of the dampers may be mounted to the side frame columns, and indicated by item 496 in FIG. 15*d*.

For the purposes of the example of FIG. 14*a*, it has been assumed that the spring group is two coils wide, and that the pocket is, correspondingly, also two coils wide. The spring group could be more than two coils wide. The bolster pocket is assumed to have the same width as the spring group, but could be less wide. In the embodiments of FIGS. 1*a*, 1*f*, 14*a*, and 16*a*, for example, the dampers are in four cornered arrangements that are symmetrical both about the center axis of the truck bolster and about a longitudinal vertical plane of the side frame.

Figure 17A:
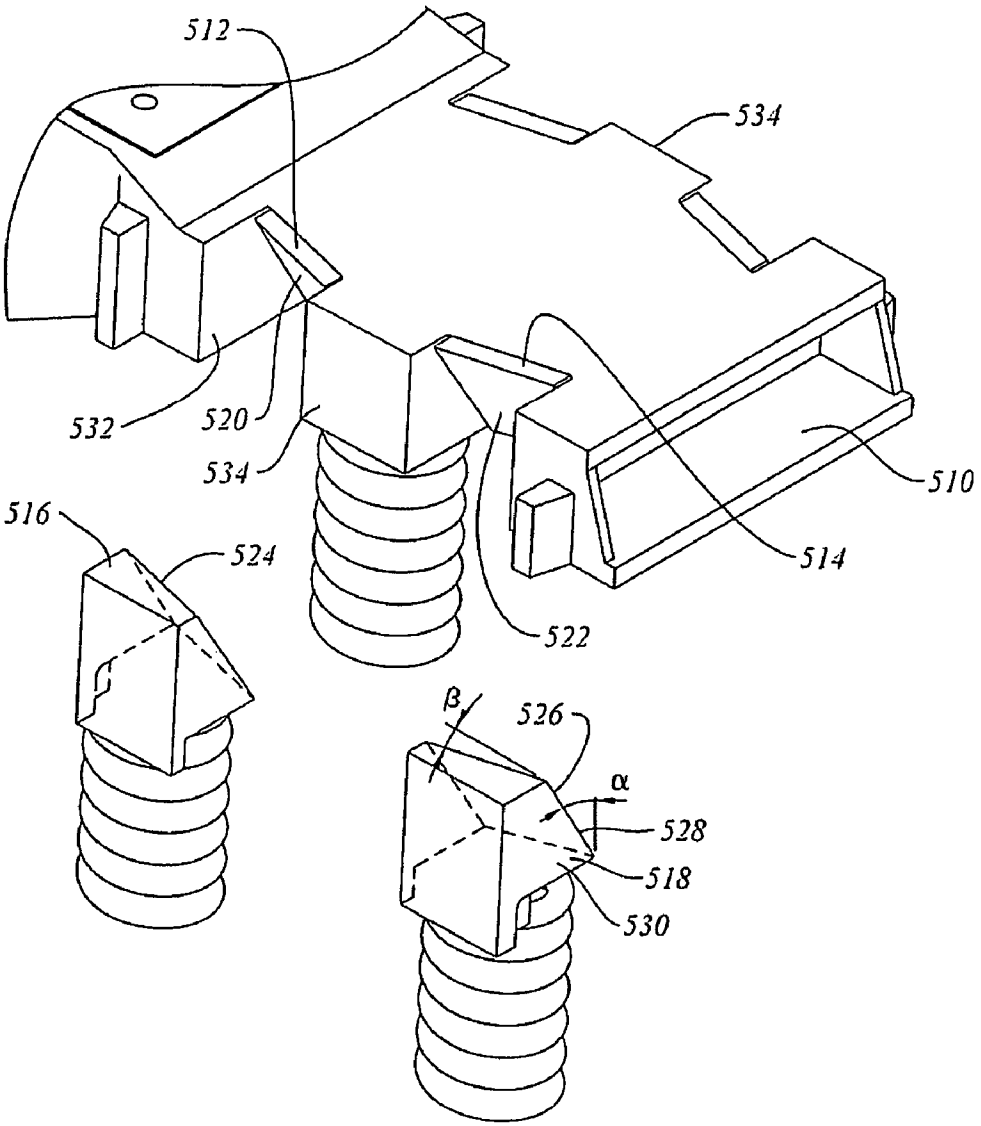
FIG. 17*a* shows an alternate bolster, similar to that of FIG. 14*a*, with a pair of spaced apart bolster pockets, and inserts with primary and secondary wedge angles.

Thus far only primary wedge angles have been discussed. FIG. 17*a* shows an isometric view of an end portion of a truck bolster 510, generally similar to bolster 402. As with all of the truck bolsters shown and discussed herein, bolster 510 is symmetrical about the central longitudinal vertical plane of the bolster (i.e., cross-wise relative to the truck generally) and symmetrical about the vertical mid-span section of the bolster (i.e., the longitudinal plane of symmetry of the truck generally, coinciding with the rail car longitudinal center line). Bolster 510 has a pair of spaced apart bolster pockets 512, 514 for receiving damper wedges 516, 518. Pocket 512 is laterally inboard of pocket 514 relative to the side frame of the truck more generally. Wear plate inserts 520, 522 are mounted in pockets 512, 514 along the angled wedge face.

As can be seen, wedges 516, 518 have a primary angle, $\alpha$ as measured between vertical sliding face 524, (or 526, as may be) and the angled vertex 528 of outboard face 530. For the embodiments discussed herein, primary angle $\alpha$ may tend to lie in the range of 35-55 degrees, possibly about 40-50 degrees. This same angle $\alpha$ is matched by the facing surface of the bolster pocket, be it 512 or 514.

A secondary angle $\beta$ gives the inboard, (or outboard), rake of the sloped surface of wedge 516 (or 518). The true rake angle can be seen by sighting along plane of the sloped face and measuring the angle between the sloped face and the planar outboard face 530. The rake angle is the complement of the angle so measured. The rake angle may tend to be greater than 5 degrees, may lie in the range of 5 to 20 degrees, and is preferably about 10 to 15 degrees. A modest rake angle may be desirable.

When the truck suspension works in response to track perturbations, the damper wedges may tend to work in their pockets. The rake angles yield a component of force tending to bias the outboard face 530 of outboard wedge 518 outboard against the opposing outboard face of bolster pocket 514. Similarly, the inboard face of wedge 516 may tend to be biased toward the inboard planar face of inboard bolster pocket 512. These inboard and outboard faces of the bolster pockets may be lined with a low friction surface pad, indicated generally as 532. The left hand and right hand biases of the wedges may tend to keep them apart to yield the full moment arm distance intended, and, by keeping them against the planar facing walls, may tend to discourage twisting of the dampers in the respective pockets.

Bolster 510 includes a middle land 534 between pockets 512, 514, against which another spring 536 may work. Middle land 534 is such as might be found in a spring group that is three (or more) coils wide. However, whether two, three, or more coils wide, and whether employing a central land or no central land, bolster pockets can have both primary and secondary angles as illustrated in the example embodiment of FIG. 18*c*, with or without wear inserts.

Where a central land, e.g., land 534, separates two damper pockets, the opposing side frame column wear plates need not be monolithic. That is, two wear plate regions could be provided, one opposite each of the inboard and outboard dampers, presenting planar surfaces against which the dampers can bear. The normal vectors of those regions may be parallel, the surfaces may be co-planar and perpendicular to the long axis of the side frame, and may present a clear, un-interrupted surface to the friction faces of the dampers.

Figure 17B:
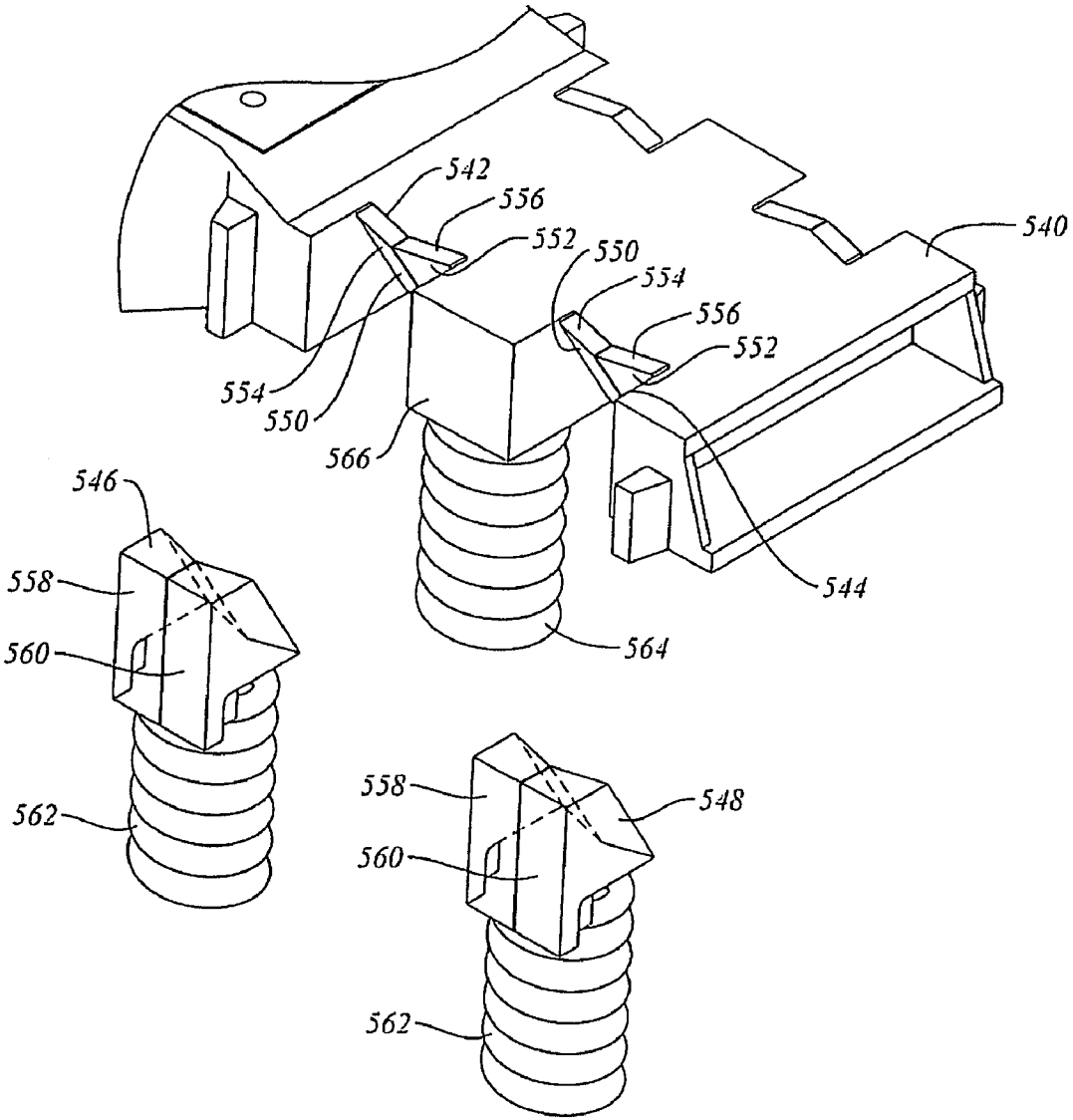
FIG. 17*b* shows an alternate bolster, similar to that of FIG. 17*a*, and split wedges.

FIG. 17*b* shows a bolster 540 that is similar to bolster 510 except insofar as bolster pockets 542, 544 each accommodate a pair of split wedges 546, 548. Pockets 542, 544 each have a pair of bearing surfaces 550, 552 that are inclined at both a primary angle α and a secondary angle β, the secondary angles of surfaces 550 and 552 being of opposite hand to yield the damper separating forces discussed above. Surfaces 550 and 552 are also provided with linings in the nature of relatively low friction wear plates 554, 556. Each of pockets 542 and 544 accommodates a pair of split wedges 558, 560. Each pair of split wedges seats over a single spring 562. Another spring 564 bears against central land 566.

Figure 18A:
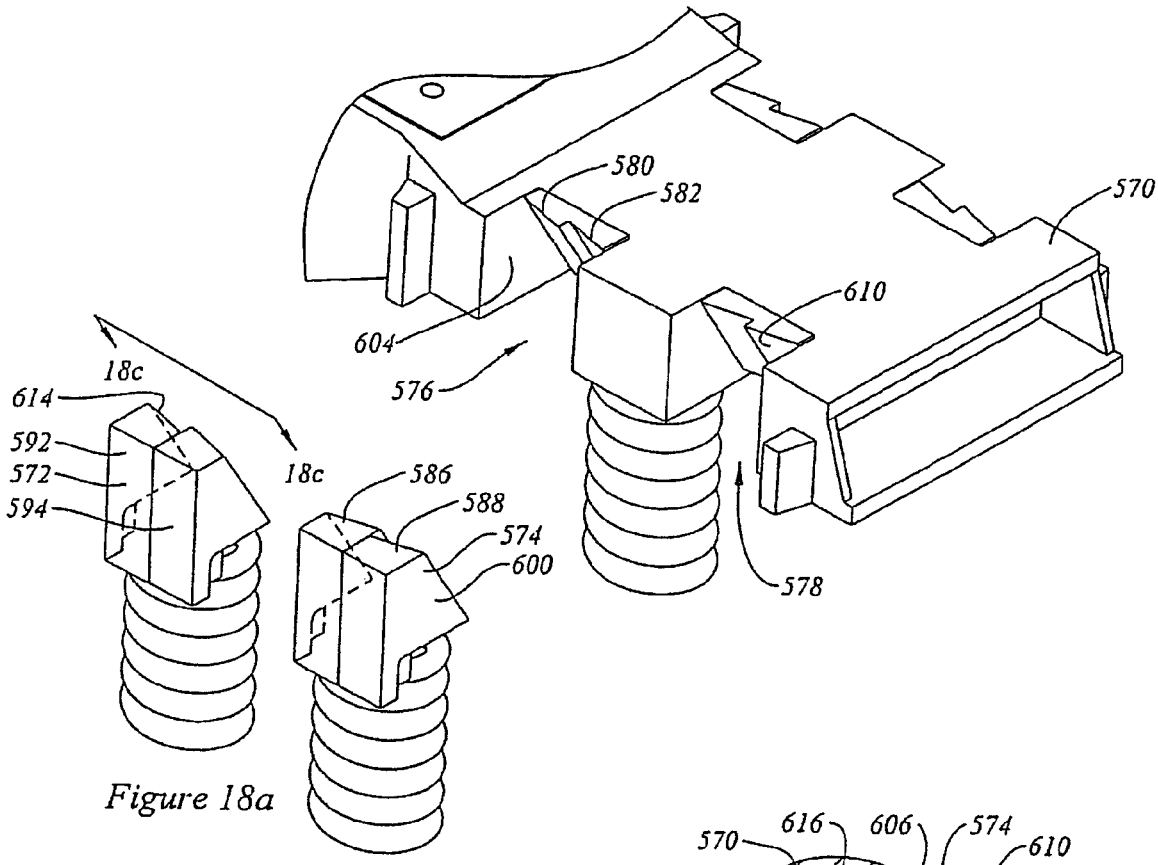
FIG. 18*a* shows a bolster similar to that of FIG. 14*a*, having a wedge pocket having primary and secondary angles and a split wedge arrangement for use therewith.

The example of FIG. 18*a* shows a combination of a bolster 570 and biased split wedges 572, 574. Bolster 570 is the same as bolster 540 except insofar as bolster pockets 576, 578 are stepped pockets in which the steps, e.g., items 580, 582, have the same primary angle α, and the same secondary angle β, and are both biased in the same direction, unlike the symmetrical faces of the split wedges in FIG. 8*d*, which are left and right handed. Thus the outboard pair of split wedges 584 has a first member 586 and a second member 588 each having primary angle α and secondary angle β, and are of the same hand such that in use both the first and second members will tend to be biased in the outboard direction (i.e. toward the distal end of bolster 570). Similarly, the inboard pair of split wedges has a first member 592 and a second member 594 each having primary angle α, and secondary angle β, except that the sense of secondary angle β is in the opposite direction such that members 592 and 594 will both tend in use to be driven in the inboard direction (i.e., toward the truck center).

Figure 18C:
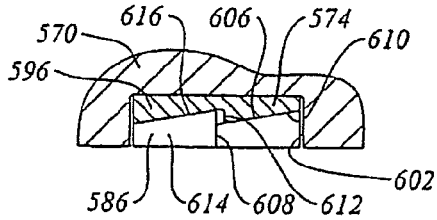
FIG. 18*c* is a view looking along a plane on the primary angle of the split wedge of FIG. 18*a* relative to the bolster pocket.

As shown in the partial sectional view of FIG. 18*c*, a replaceable monolithic stepped wear insert 596 is welded in the bolster pocket 580 (or 582 if opposite hand, as the case may be). Insert 596 has the same primary and secondary angles α and β as the split wedges it is to accommodate, namely 586, 588 (or, opposite hand, 592, 594). When installed, and working, the more outboard of the wedges, 588 (or, opposite hand, the more inboard of the wedges 592) has a vertical and longitudinally planar outboard face 600 that bears against a similarly planar outboard face 602 (or, opposite hand, inboard face 604) These faces are preferably prepared in a manner that yields a relatively low friction sliding interface between them. In that regard, a low friction pad may be mounted to either surface, preferably the outboard surface of pocket 580. The sloped face 606 of member 588 bears against the opposing outboard land 610 of insert 596. The overall width of outboard member 588 is greater than that of outboard land 610, such that the inboard planar face of member 588 acts as an abutment face to fend inboard member 586 off of the surface of the step 612 in insert 596. In similar manner inboard, wedge member 586 has a hypotenuse face 614 that bears against the inboard land portion 616 of insert 596. The total width of bolster pocket 580 is greater than the combined width of wedge members, such that a gap is provided between the inboard (non-contacting) face of member 586 and the inboard planar face of pocket 580. The same relationship, but of opposite hand, exists between pocket 582 and members 592, 594. A low friction pad, or surfacing, may be used at the interface of members 586, 588 (or 592, 594) to facilitate sliding motion of the one relative to the other.

Figure 18B:
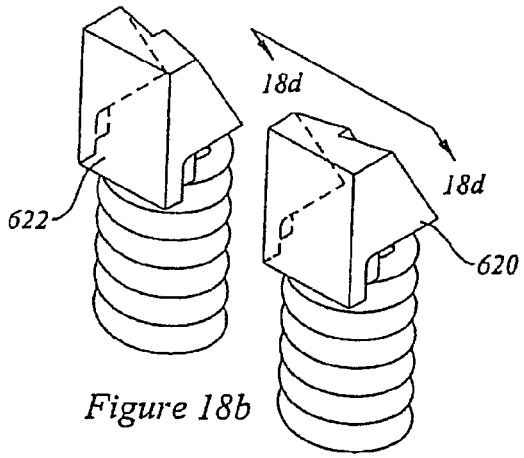
FIG. 18*b* shows an alternate stepped single wedge for the bolster of FIG. 18*a;*
Figure 18D:
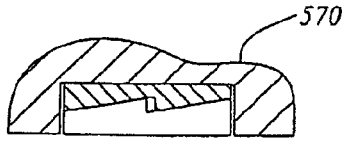
FIG. 18*d* is a view looking along a plane on the primary angle of the stepped wedge of FIG. 18*b* relative to the bolster pocket.

In this arrangement, working of the wedges, i.e., members 586, 588 against the face of insert 596 may tend to cause both members to move in one direction, namely to their most outboard position. Similarly, members 592 and 594 may tend to work to their most inboard positions. This may tend to maintain the wedge members in an untwisted orientation, and may also tend to maintain the moment arm of the restoring moment at its largest value. In the arrangement of FIGS. 18*b* and 18*d*, a single, stepped wedge 620 is used in place of the pair of split wedges e.g., members 586, 588. A corresponding wedge of opposite hand is used in the other bolster pocket.

Figures 19A, 19B, 19C, 19D:
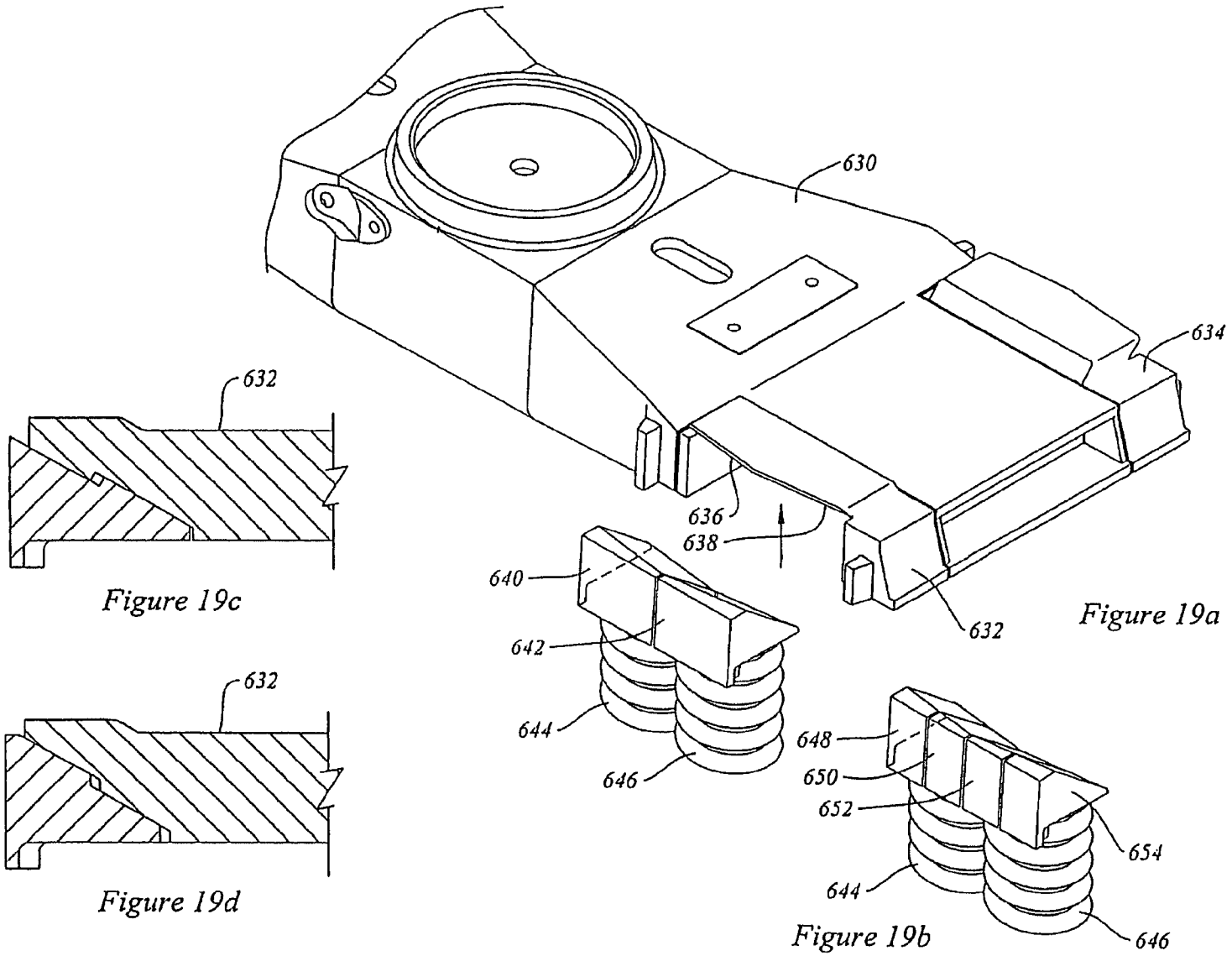
FIG. 19*a* shows an alternate bolster and wedge arrangement to that of FIG. 17*b*, having secondary wedge angles.
FIG. 19*b* shows an alternate, split wedge arrangement for the bolster of FIG. 19*a;*
FIG. 19*c* is a section of a stepped damper for use with a bolster as in FIG. 19*a;*
FIG. 19*d* shows an alternate stepped damper to that of FIG. 19*c;*

In the embodiment of FIG. 19*a*, a truck bolster 630 has welded bolster pocket inserts 632 and 634 of opposite hands welded into accommodations in its distal end. In this instance, each bolster pocket has an inboard portion 636 and an outboard portion 638. Inboard and outboard portions 636 and 638 share the same primary angle α, but have secondary angles β that are of opposite hand. Respective inboard and outboard wedges are indicated as 640 and 642, and each seats over a vertically oriented spring 644, 646. In this case bolster 630 is similar to bolster 480 of FIG. 16*a*, to the extent that the bolster pocket is continuous—there is no land separating the inner and outer portions of the bolster pocket. Bolster 630 is also similar to bolster 510 of FIG. 17*a*, except that the bolster pockets of opposite hand are merged without an intervening land. In the further alternative of FIG. 19*b*, split wedge pairs 648, 650 (inboard) and 652, 654 (outboard) are employed in place of the single inboard and outboard wedges 640 and 642. In some instances the primary angle of the wedge may be steep enough that the thickness of section over the spring might not be overly great. In such a circumstance the wedge may be stepped in cross section to yield the desired thickness of section as show in the details of FIGS. 19*c* and 19*d*.

Figure 20A:
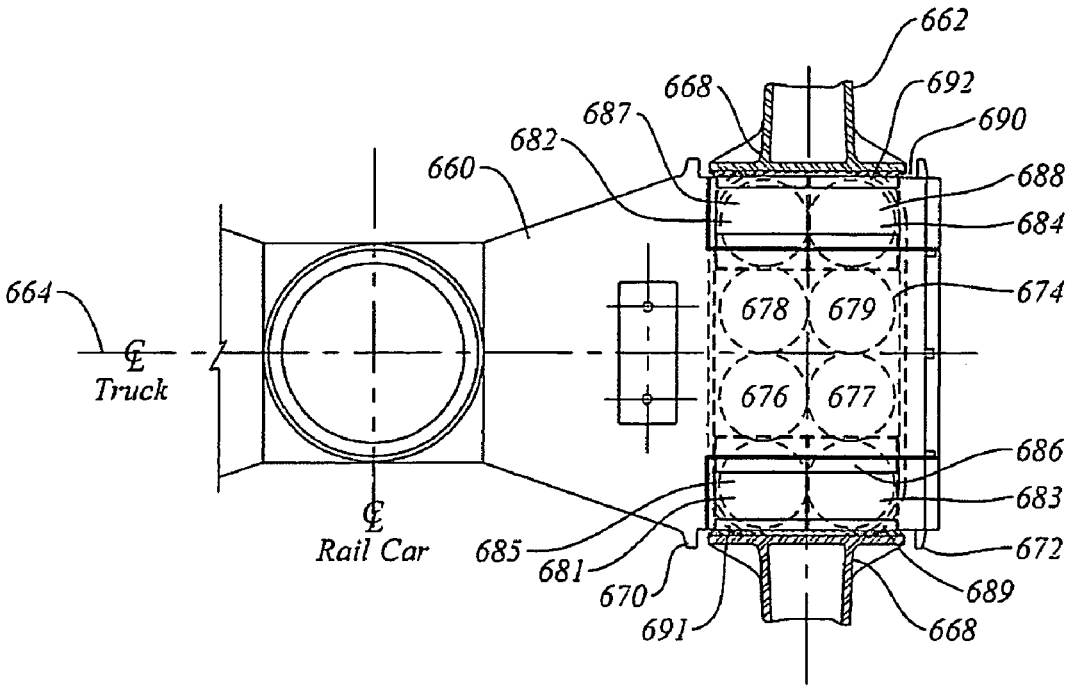
FIG. 20*a* is a section of FIG. 14*b* showing a replaceable side frame wear plate.
Figure 20B:
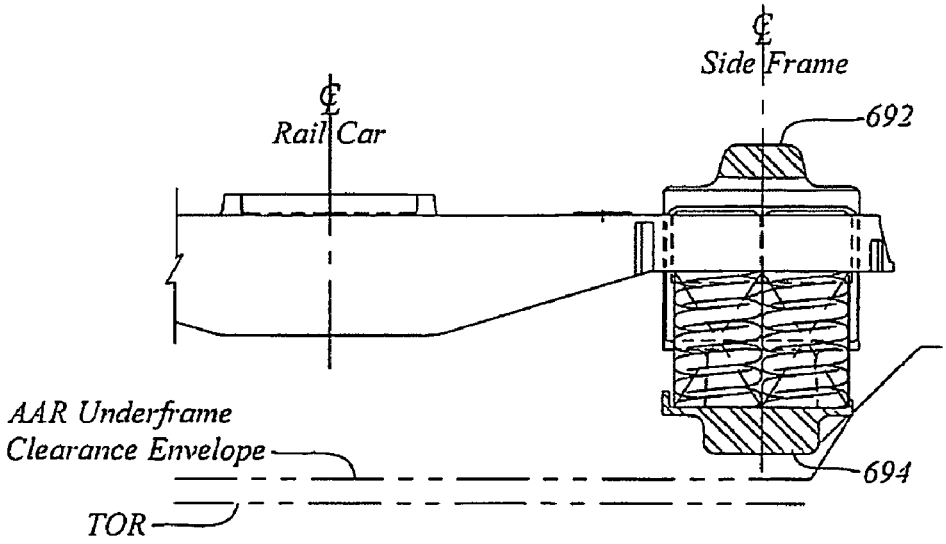
FIG. 20*b* is a sectional view of the side frame of FIG. 20*a* with the near end of the side frame sectioned, and the nearer wear plate removed to show the location of the wear plate of FIG. 20*a;*

FIG. 20*a* shows the placement of a low friction bearing pad for bolster 660 of FIG. 16*a*. Such a pad can be used at the interface between the friction damper wedges of any of the embodiments discussed herein. In FIG. 20*a*, the truck bolster is identified as item 660 and the side frame is identified as item 662. Side frame 662 is symmetrical about the truck centerline, indicated as 664. Side frame 662 has side frame columns 668 that locate between the inner and outer gibs 670, 672 of truck bolster 660. The spring group is indicated generally as 674, and has eight relatively large diameter springs arranged in two rows, being an inboard row and an outboard row. Each row has four springs in it. The four central springs 676, 677, 678, 679 seat directly under the bolster end. The end springs of each row, 681, 682, 683, 684 seat under respective friction damper wedges 685, 686, 687, 688. Wear plates 689, 690 are mounted to the wide, facing flanges 691, 692 of the side frame columns, 668. As shown in FIG. 20*b*, plates 689, 690 are mounted centrally relative to the side frames, beneath the juncture of the side frame arch 692 with the side frame columns. The lower longitudinal member of the side frame, bearing the spring seat, is indicated as 694.

Figure 20C:
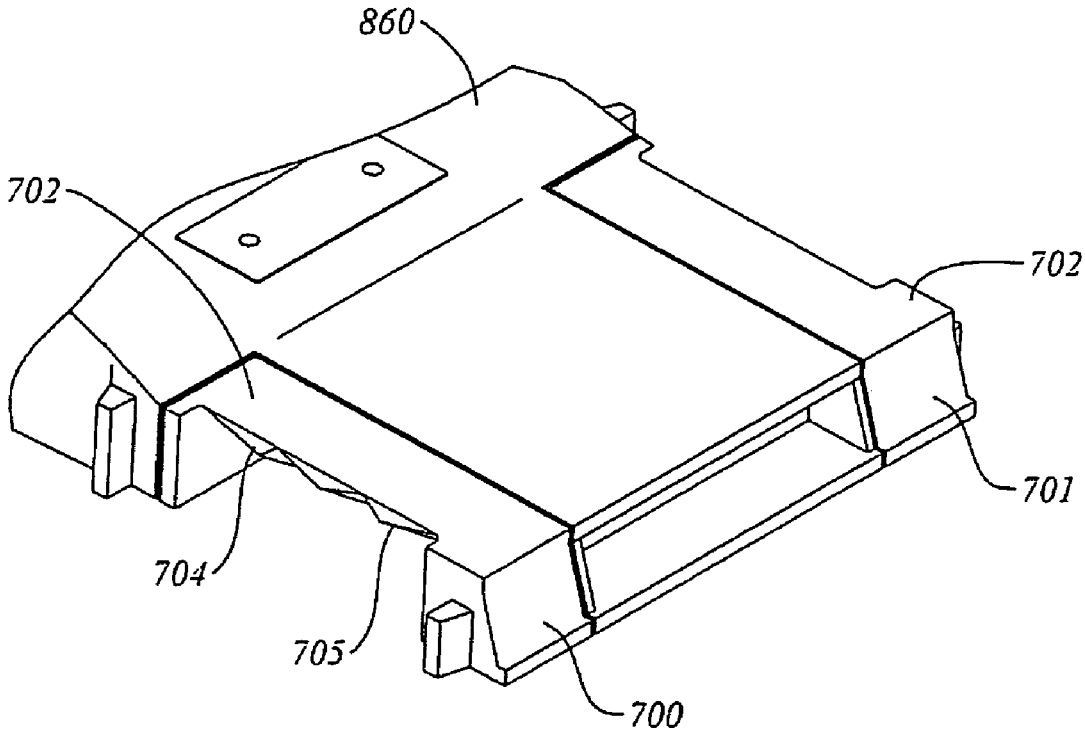
FIG. 20*c* shows a compound bolster pocket for the bolster of FIG. 20*a;*
Figure 20D:
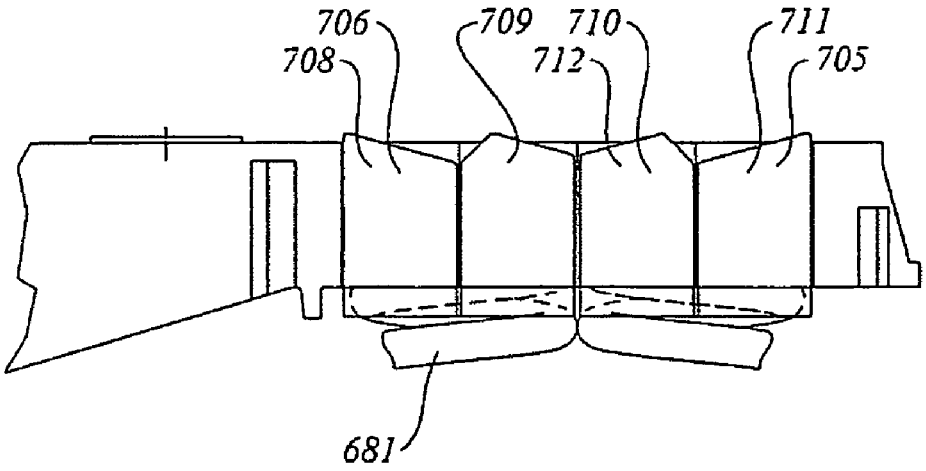
FIG. 20*d* is a side view detail of the bolster pocket of FIG. 20*c*, as installed.
Figure 20F:
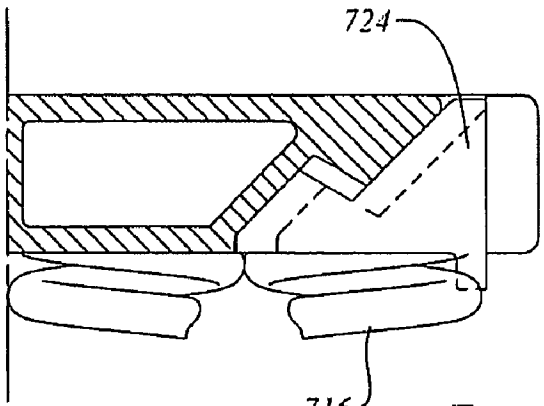
FIG. 20*f* shows an alternate, stepped steeper angle profile for the primary angle of the wedge of the bolster pocket of FIG. 20*d;*
Figure 20G:
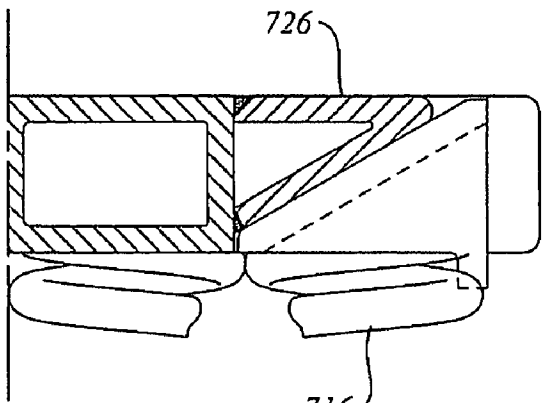
FIG. 20*g* shows a welded insert having a profile for mating engagement with the corresponding face of the bolster pocket of FIG. 20*d;*
Figure 20E:
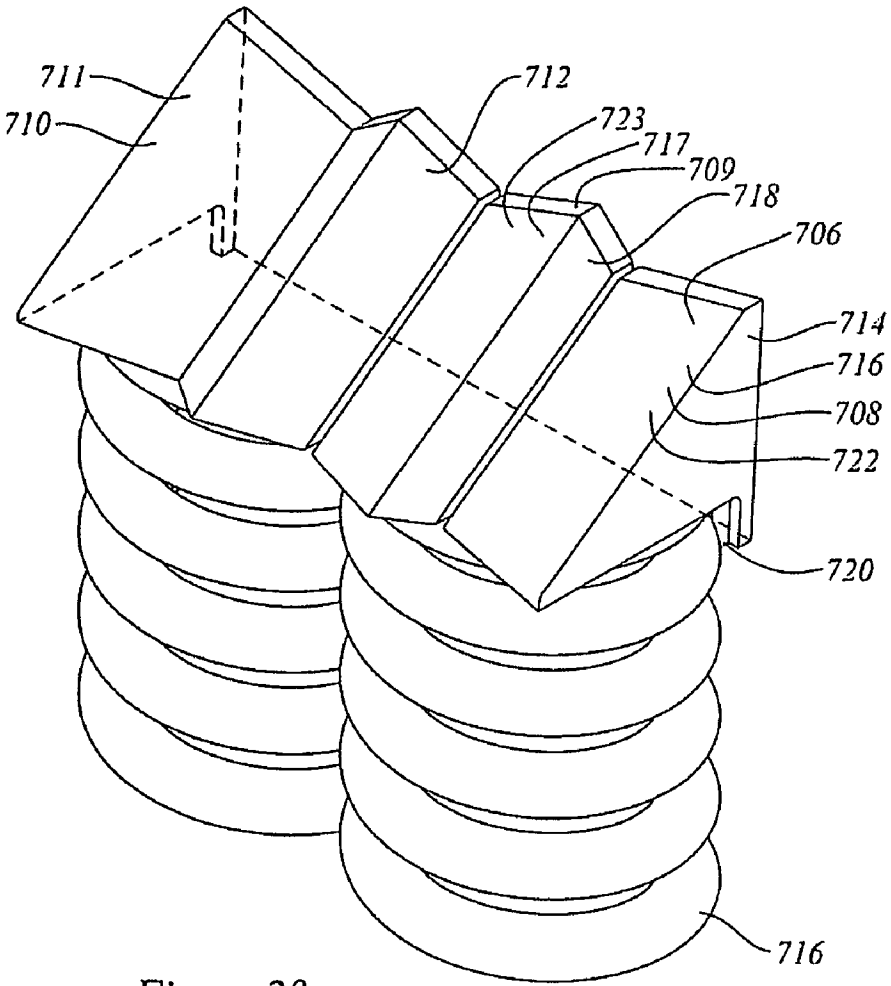
FIG. 20*e* shows an isometric detail of a split wedge version and a single wedge version of wedges for use in the compound bolster pocket of FIG. 20*c;*

Referring now to FIGS. 20*c* and 20*e*, bolster 660 has a pair of left and right hand, welded-in bolster pocket assemblies 700, 701, each having a cast steel, replaceable, welded-in wedge pocket insert 702. Insert 702 has an inboard-biased portion 704, and an outboard-biased portion 705. Inboard end spring 682 (or 681) bears against an inboard-biased split wedge pair 706 having members 708, 709, and outboard end spring 684 (or 683) bears against an outboard-biased split wedge pair 710 having members 711, 712. As suggested by the names, the outboard-biased wedges will tend to seat in an outboard position as the suspension works, and the inboard-biased wedges will tend to seat in an inboard position.

Each insert portion 704, 705 is split into a first part and a second part for engaging, respectively, the first and second members of a commonly biased split wedge pair. Considering pair 706, inboard leading member 708 has an inboard planar face 714, that, in use, is intended slidingly to contact the opposed vertically planar face of the bolster pocket. Leading member 708 has a bearing face 716 having primary angle $\alpha$ and secondary angle $\beta$. Trailing member 709 has a bearing face 717 also having primary angle $\alpha$ and secondary angle $\beta$, and, in addition, has a transition, or step, face 718 that has a primary angle $\alpha$ and a tertiary angle $\phi$, where tertiary angle $\phi$ is a rake angle tending to oppose the direction of bias of secondary angle $\beta$.

Insert 702 has a corresponding array of bearing surfaces having a primary angle $\alpha$, and a secondary angle $\beta$, with transition surfaces having tertiary angle $\phi$ for mating engagement with the corresponding surfaces of the inboard and outboard split wedge members. As can be seen, a section taken through the bearing surface resembles a chevron with two unequal wings in which the face of the secondary angle $\beta$ is relatively broad and shallow and the face associated with tertiary angle $\phi$ is relatively narrow and steep.

In FIG. 20*e*, the sloped portions of split wedge members 711, 712 extend only partially far enough to overlie a coil spring 716. In consequence, wedge members 711 and 712 each have a base portion 717, 718 having a fore-and-aft dimension greater than the diameter of spring 716, and a width greater than half the diameter of spring 716. Each of base portions 717, 718 has a downwardly proud, roughly semi-circular boss 720 for seating in the top of the coil of spring 716. The upwardly angled portion 722, 723 of each wedge member 711, 712 extends upwardly of base portion 717, 718 to engage the matingly angled portions of insert 702.

In a further alternate embodiment, the split wedges may be replaced with stepped wedges 724 of similar compound profile, as shown in FIG. 20*f*. In the event that the primary wedge angle $\alpha$ is relatively steep (i.e., greater than about 45 degrees when measured from the horizontal, or less than about 45 degrees when measured from the vertical). FIG. 20*g* shows a welded in insert 726 having a profile for mating engagement with the corresponding wedge faces.

Figure 15D:
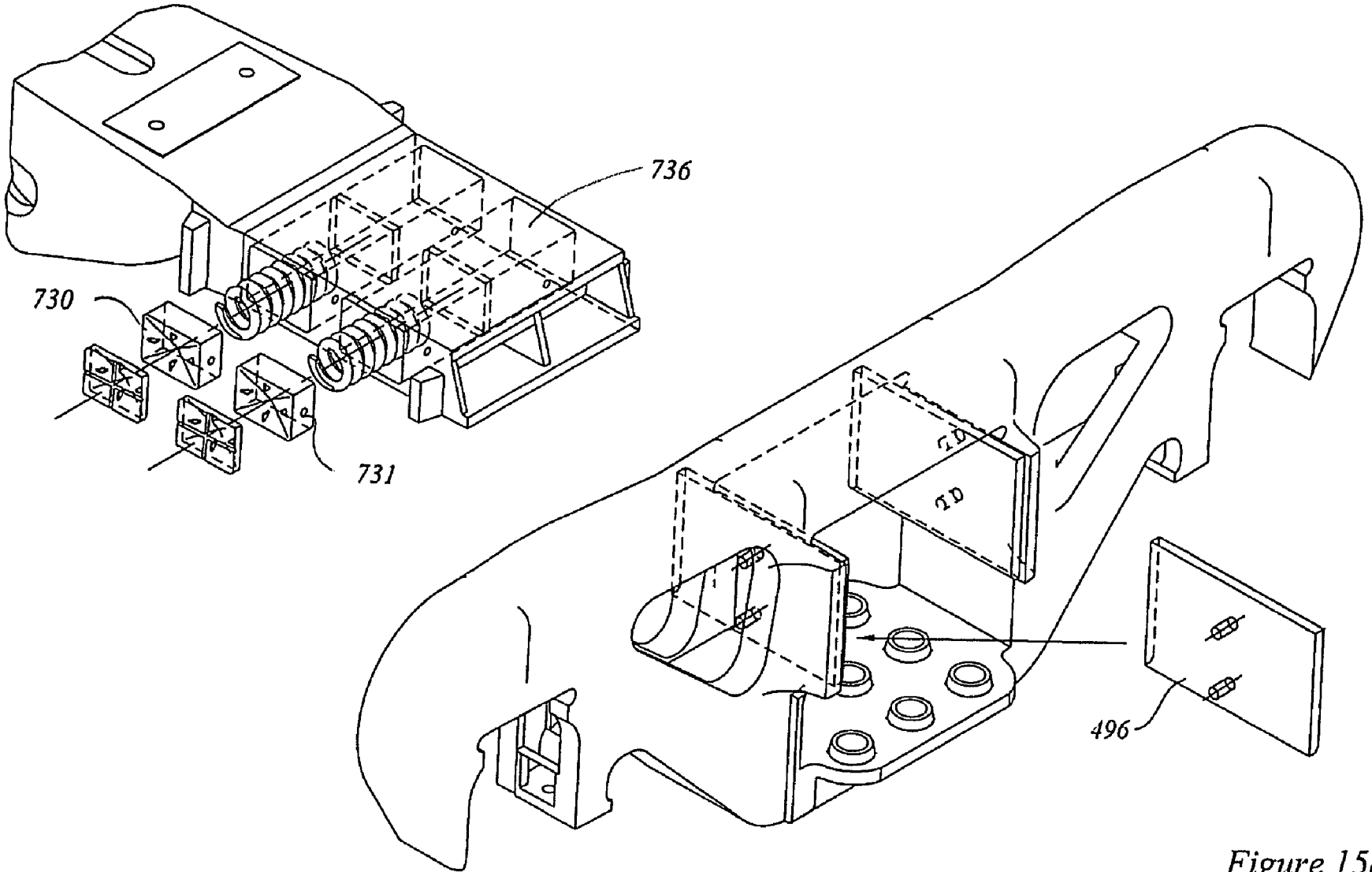
FIG. 15*d* shows an exploded isometric view of the bolster and side frame assembly of FIG. 15*a*, in which horizontally acting springs drive constant force dampers.
Figure 15E:
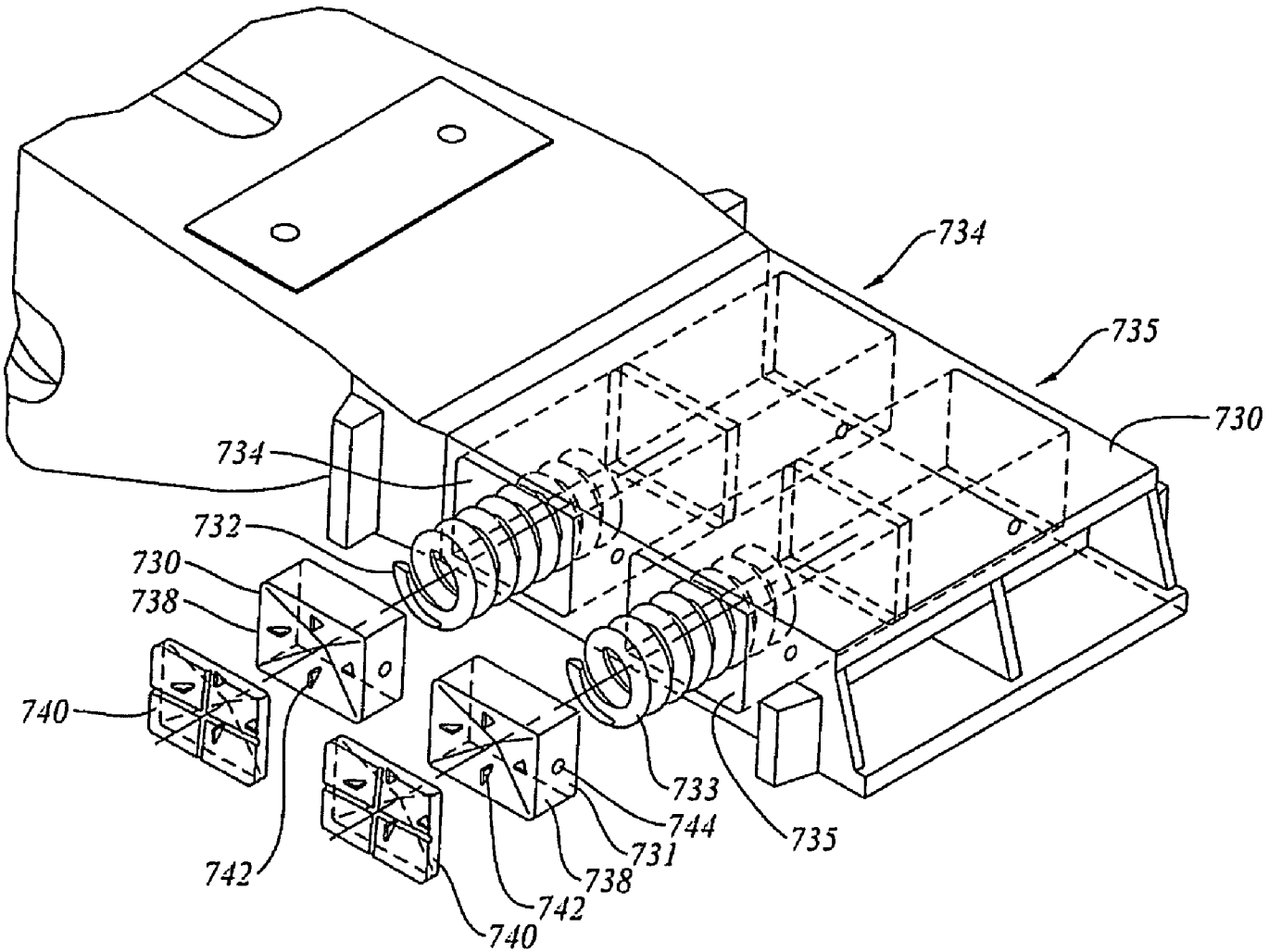
FIG. 15*e* shows an enlarged view of the side-by-side double damper arrangement of FIG. 15*d;*

FIGS. 15*d* and 15*e* show a bolster, side frame and damper arrangement having dampers 730, 731 independently sprung on horizontally acting springs 732, 733 housed in side-by-side pockets 734, 735 in the distal end of bolster 736. While only two dampers are shown, a pair of such dampers faces toward each of the opposed side frame columns. Dampers 730, 731 each include a block 738 and a consumable wear member 740, the block and wear member having male and female indexing features 742 to maintain their relative position. Such an arrangement may permit the damper force to be independent of the spring compression in the main spring group. A removable grub screw fitting 744 is provided in the spring housing to permit the spring to be pre-loaded and held in place during installation.

FIG. 1*j* shows an example of a three piece railroad car truck, shown generally as 750. Truck 750 has a truck bolster 752, and a pair of sideframes 754. The spring groups of truck 750 are indicated as 756. Spring groups 756 are spring groups having three springs 758 (inboard corner), 760 (center) and 762 (outboard corner) most closely adjacent to the sideframe columns 754. A motion calming, kinematic energy dissipating element, in the nature of a friction damper 764, 766 is mounted over each of central springs 760.

Friction damper 764, 766 has a substantially planar friction face 768 mounted in facing, planar opposition to, and for engagement with, a side frame wear member in the nature of a wear plate 770 mounted to sideframe column 754. The base of damper 764, 766 defines a spring seat, or socket 772 into which the upper end of central spring 760 seats. Damper 764, 766 has a third face, being an inclined slope or hypotenuse face 774 for mating engagement with a sloped face 776 inside sloped bolster pocket 778. Compression of spring 760 under an end of the truck bolster may tend to load damper 764 or 766, as may be, such that friction face 768 is biased against the opposing bearing face of the sideframe wear column, such as 780.

Truck 750 also has wheelsets whose bearings are mounted in the pedestal 784 at either ends of the side frames 754. Each of these pedestals may accommodate one or another of the sideframe to bearing adapter interface assemblies described above in the context of FIGS. 2*a*-12*f* and may thereby have a measure of self steering.

In this embodiment, face 768 of friction damper 764, 766 may have a bearing surface having a co-efficient of static friction, $:_s$, and a co-efficient of dynamic or kinetic friction, $:_k$. that may tend to exhibit little or no "stick-slip" behaviour when operating against the wear surface of wear plate 770. In one embodiment, the coefficients of friction are within 10% of each other. In another embodiment the coefficients of friction are substantially equal and may be substantially free of stick-slip behaviour. In one embodiment, when dry, the coefficients of friction may be in the range of 0.10 to 0.45, may be in the narrower range of 0.15 to 0.35, and may be about 0.30. Friction damper 764, 766 may have a friction face coating, or bonded pad 786 having these friction properties, and corresponding to those inserts or pads described in the context of FIGS. 21*a*-21*c*, and FIGS. 22*a*-22*h*. Bonded pad 786 may be a polymeric pad or coating. A low friction, or controlled friction pad or coating 788 may also be employed on the sloped surface of the damper. In one embodiment that coating or pad 788 may have coefficients of static and dynamic friction that are within 20%, or, more narrowly, 10% of each other. In another embodiment, the coefficients of static and dynamic friction are substantially equal. The co-efficient of dynamic friction may be in the range of 0.10 to 0.30, and may be about 0.20.

Friction Surfaces

It may be desirable for rail road car trucks to exhibit relatively low curving resistance. One AAR standard suggests a curving resistance of 0.4 lbs/(degree-ton) where the "degree" is the number of degrees of angular arc in a 100 ft section of track. It may also be desirable for a railroad car truck to possess a disinclination to exhibit "wheel lift" in operation. Wheel lift may occur, for example, on a curve where there is super cross-elevation, and, at some point along the super-elevated curve the outside rail has one or more downward perturbations that may cause the car to rock while going through the curve. One AAR standard for this is that, during a particular wheel lift test, the weight on any wheel in the truck ought not to fall below 10% of the static wheel load.

In the view of the present inventors, wheel lift may tend to occur more easily where the dampers exhibit a "stick-slip" operation that may tend to be associated with use of dampers having distinctly different coefficients of static and dynamic friction. In that light, dampers may be employed whose friction faces have linings, such as may be akin to brake or clutch linings that may tend not to exhibit the stick-slip phenomenon, or to exhibit it only mildly. Such a prepared bearing surface may also be formed of a cast alloy of a suitable, non-galling composition, or from a sintered powder metal composition. That is, the bearing surface may be formed of a composition having known coefficients of static and dynamic friction. These coefficients of friction may be within 10% of each other. In one embodiment the coefficients of static and dynamic friction may be approximately equal.

The bodies of the damper wedges themselves may be made from a relatively common material, such as a mild steel or cast iron. The wedges may then be given wear face members in the nature of shoes, wear inserts or other wear members, which may be intended to be consumable items. Such an arrangement is shown in FIG. 21 or 22*a*-22*f*.

Figure 21A:
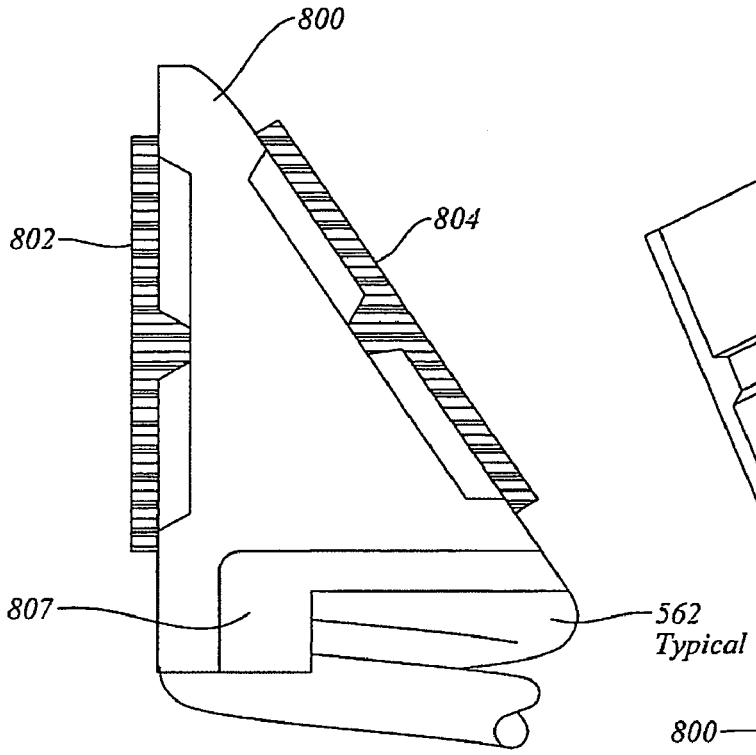
FIG. 21*a* is a cross-section of an alternate damper such as may be used, for example, in the bolster of the trucks of FIGS. 1*a*, 1*f*, 1*i*, 1*j* and 14*a;*

In FIG. 21*a*, a damper wedge is shown generically as 800. The replaceable, friction modification consumable wear members are indicated as 802, 804. The wedges and wear members have mating male and female mechanical interlink features, such as the cross-shaped relief 803 formed in the primary angled and vertical faces of wedge 800 for mating with the corresponding raised cross shaped features 805 of wear members 802, 804. Sliding wear member 802 may be made of a material having specified friction properties, and may be obtained from a supplier of such materials as, for example, brake and clutch linings and the like, such as Railway Friction Products, above. The materials may include materials that are referred to as being non-metallic, low friction materials, and may include UHMW polymers.

Figure 21C:
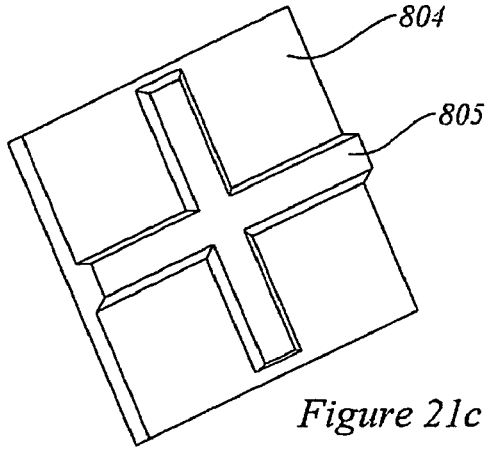
FIG. 21*c* is a reverse view of a friction modifying pad of the damper of FIG. 21*a;*
Figure 21B:
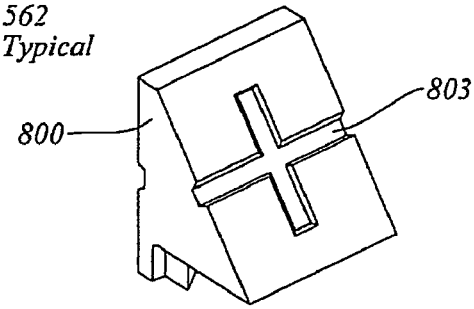
FIG. 21*b* shows an isometric view of the damper of FIG. 21*a* with friction modifying pads removed.

Although FIGS. 21*a* and 21*c* show consumable inserts in the nature of a wear plates, namely wear member 802, 804 the entire bolster pocket may be made as a replaceable part, as in FIG. 16*a*. This bolster pocket may be a high precision casting, or may include a sintered powder metal assembly having suitable physical properties. The part so formed may then be welded into place in the end of the bolster, as at 506 indicated in FIG. 16*a*.

The underside of the wedges described herein, wedge 800 being typical in this regard, has a seat, or socket 807, for engaging the top end of the spring coil, whichever spring it may be, spring 562 being shown as typically representative. Socket 807 serves to discourage the top end of the spring from wandering away from the intended generally central position under the wedge. A bottom seat, or boss for discouraging lateral wandering of the bottom end of the spring is shown in FIG. 14*a* as item 808.

It may be noted that wedge 800 has a primary angle, but does not have a secondary rake angle. In that regard, wedge 800 may be used as damper 764, 766 of truck 750 of FIG. 1*j*, for example, and may provide friction damping with little or no "stick-slip" behaviour, but rather friction damping for which the coefficients of static and dynamic friction are equal, or only differ by a small (less than about 20%, perhaps less than 10%) difference. Wedge 800 may be used in truck 750 in conjunction with a bi-directional bearing adapter of any of the embodiments described herein. Wedge 800 may also be used in a four cornered damper arrangement, as in truck 20 or 22, for example, where wedges may be employed that do not use secondary angles.

Referring to FIGS. 22*a*-22*e*, a damper 810 is shown such as may be used in truck 20, truck 22, or any of the other double damper trucks described herein, and may be mounted to engage an appropriately formed, mating bolster pocket. Damper 810 is similar to damper 800, but may include both primary and secondary angles. It may be noted that damper 810 may, arbitrarily, be termed a right handed damper wedge, and that FIGS. 22*a*-22*e* are intended to be generic such that it may be understood also to represent the left handed, mirror image of a mating damper with which damper 810 would form a matched pair.

Wedge 810 has a body 812 that may be made by casting or by another suitable process. Body 812 may be made of steel or cast iron, and may be substantially hollow. Body 812 has a first, substantially planar platen portion 814 having a first face for placement in a generally vertical orientation in opposition to a sideframe bearing surface, for example, a wear plate mounted on a sideframe column. Platen portion 814 may have a rebate, or relief, or depression formed therein to receive a bearing member, indicated as member 816. Member 816 may be a material having specific friction properties when used in conjunction with the sideframe column wear plate material. For example, member 816 may be formed of a brake lining material, and the column wear plate may be formed from a high hardness steel.

Body 812 may also include a base portion 818 that may extend rearwardly from and generally perpendicularly to, platen portion 814. Base portion 818 may have a relief 820 formed therein in a manner to form, roughly, the negative impression of an end of a spring coil, such as may receive a top end of a coil of a spring of a spring group, such as spring 562. Base portion 818 may join platen portion 814 at an intermediate height, such that a lower portion 821 of platen portion 814 may depend downwardly therebeyond in the manner of a skirt. That skirt portion may include a corner, or wrap around portion 822 formed to seat around a portion of the spring.

Body 812 may also include a diagonal member in the nature of a sloped member 824. Sloped member 824 may have a first, or lower end extending from the distal end of base 818 and running upwardly and forwardly toward a junction with platen portion 814. An upper region 826 of platen portion 814 may extend upwardly beyond that point of junction, such that damper wedge 810 may have a footprint having a vertical extent somewhat greater than the vertical extent of sloped member 824. Sloped member 824 may also have a socket or seat in the nature of a relief or rebate 828 formed therein for receiving a sliding face member 830 for engagement with the bolster pocket wear plate of the bolster pocket into which wedge 810 may seat. As may be seen sloped member 824 (and face member 830) are inclined at a primary angle $\alpha$, and a secondary angle $\beta$. Sliding face member 830 may be an element of chosen, possibly relatively low, friction properties (when engaged with the bolster pocket wear plate), such as may include desired values of coefficients of static and dynamic friction. In one embodiment the coefficients of static and dynamic friction may be substantially equal, may be about 0.2 (+/−20%, or, more narrowly +/−10%), and may be substantially free of stick-slip behaviour.

Figure 22H:
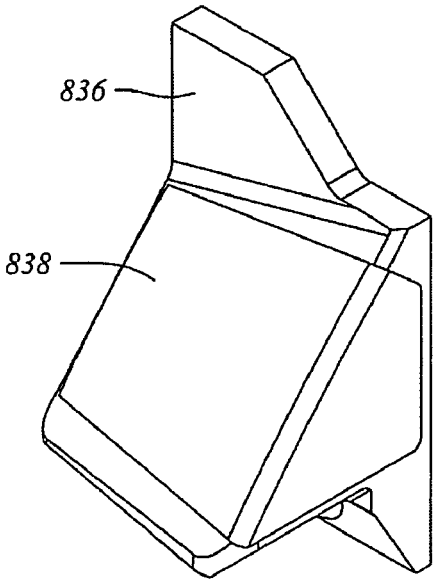
FIG. 22*h* shows an isometric view of a further alternate damper to that of FIG. 22*a*, having a "wrap-around" friction modifying pad.
Figure 22G:
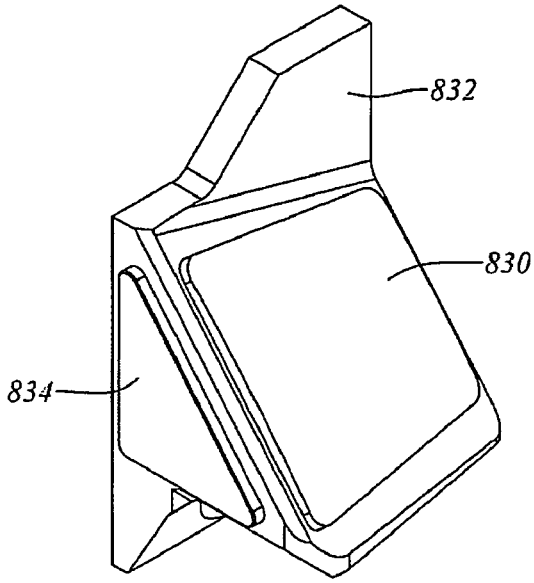
FIG. 22*g* shows an isometric view of an alternate damper to that of FIG. 22*a* having a friction modifying side face pad.
Figure 22A:
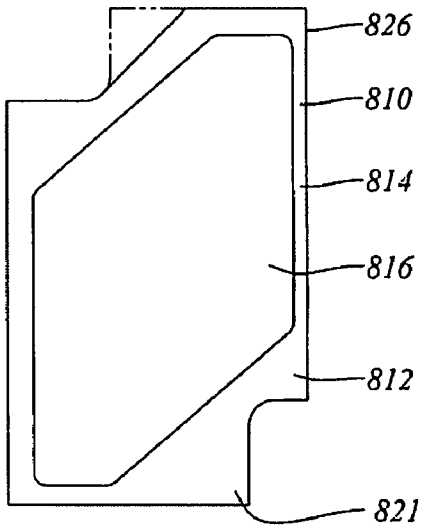
FIG. 22*a* is a front view of a friction damper for a truck such as that of FIG. 1*a;*
Figure 22F:
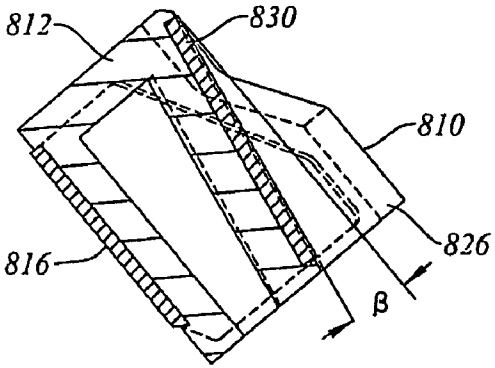
FIG. 22*f* shows a cross-section of the damper of FIG. 22*a* taken on section '22*f*-22*f*' of FIG. 22*e;*
Figure 22B:
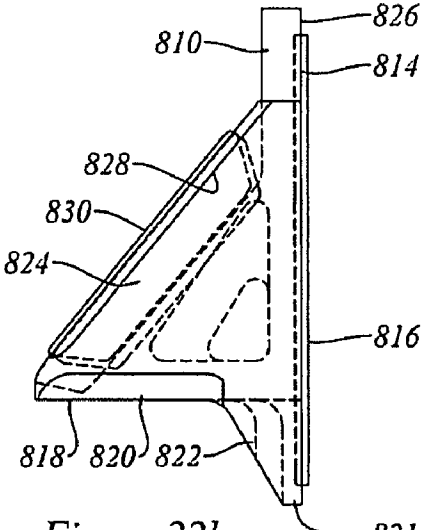
FIG. 22*b* shows a side view of the damper of FIG. 22*a;*
Figure 22E:
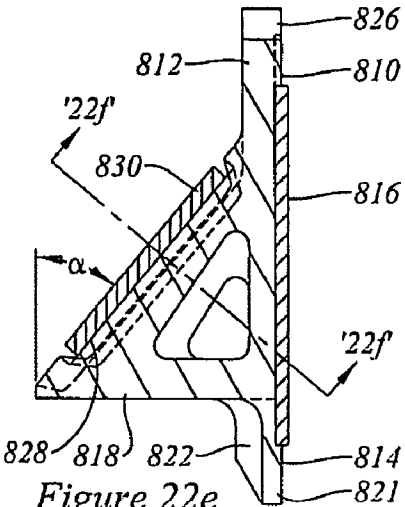
FIG. 22*e* shows a cross-sectional view on the centerline of the damper of FIG. 22*a* taken on section '22*e*-22*e*' of FIG. 22*c;*
Figure 22C:
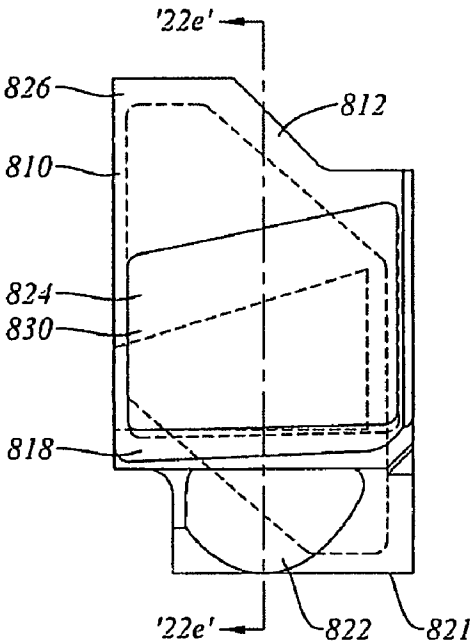
FIG. 22*c* shows a rear view of the damper of FIG. 22*b;*
Figure 22D:
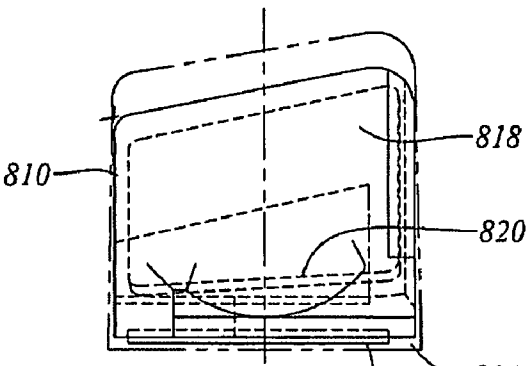
FIG. 22*d* shows a top view of the damper of FIG. 22*a;*

In the alternative embodiment of FIG. 22*g*, a damper wedge 832 is similar to damper wedge 810, but, in addition to pads or inserts for providing modified or controlled friction properties on the friction face for engaging the sideframe column and on the face for engaging the slope of the bolster pocket, damper wedge 832 may have pads or inserts such as pad 834 on the side faces of the wedge for engaging the side faces of the bolster pockets. In this regard, it may be desirable for pad 834 to have low coefficients of friction, and to tend to be free of stick slip behaviour. The friction materials may be cast or bonded in place, and may include mechanical interlocking features, such as shown in FIG. 21*a*, or bosses, grooves, splines, or the like such as may be used for the same purpose. Similarly, in the alternative embodiment of FIG. 22*h*, a damper wedge 836 is provided in which the slope face insert or pad, and the side wall insert or pad form a continuous, or monolithic, element, indicated as 838. The material of the pad or insert may, again, be cast in place, and may include mechanical interlock features. The materials may be the same as used in the Barber "Twin Guard" split wedge covering materials, and may be formed in the same manner.

The present inventors consider the use of a controlled friction interface between the slope face and the inclined face of the bolster pocket, in which the combination of wear plate and friction member may tend to yield coefficients of friction of known properties to be advantageous. It may be desirable for those coefficients to be the same, or nearly the same, and for the combination chosen to have little or no tendency to exhibit stick-slip behaviour, or a reduced stick-slip tendency as compared to cast iron on steel. Further, the use of brake linings, or inserts of cast materials having known friction properties may tend to permit the properties to be controlled within a narrower, more predictable and more repeatable range such as may yield a reasonable level of consistency in operation.

In the various truck embodiments, there is a friction damping interface between the dampers, of whatever embodiment, and the mating opposed sideframe, of whatever embodiment. It may be that either the sideframe column or the damper may have a bearing surface, either of which may be intended to be consumable, or replaceable, or both. That is, the sideframe column may have a sideframe column wear plate that may be bolted in position, and then welded in place. Such wear plates may be of a particular material chosen for its wear properties. The material may have a certain level of hardness; it may yield desired coefficients of static and dynamic friction when combined with a mating material of a damper friction face. If the wear plate is worn or broken, it may be removed and replaced. Similarly, the friction face of a mating damper may be consumable, as in the nature of a brake shoe or brake lining, the damper being removable and replaceable once the friction face is worn away. The damper friction face may be of a specifically chosen material to yield desired wear and friction co-efficient properties. Although the sideframe column is customarily the portion provided with a wear plate, the "wear plate" could be on the face of the damper, and the friction material, such as may be a brake lining or a material analogous thereto, may be mounted on the sideframe column.

In each of the damper to sideframe column arrangements shown and described, the bearing face of the motion calming, friction damping element may be treated to yield a desired co-efficient of static friction, and a desired co-efficient of dynamic friction. This treatment may include, whether by way of an insert or otherwise, a pad, a coating, or the use of a brake shoe or brake lining, such as may be obtained from a supplier of such equipment as clutch and brake linings and the like. One such supplier is Railway Friction Products. Such a brake shoe or lining may have a polymer based, or composite matrix loaded with a mixture of metal or other particles or materials such as may yield a specified friction performance. That friction surface may, when employed in combination with the opposed bearing surface, have a co-efficient of static friction, $:_s$, and a co-efficient of dynamic or kinetic friction, $:_k$. The coefficients may vary with environmental conditions. For the purposes of this description, the friction co-efficients will be taken as being considered on a dry day condition at 70 F. In one embodiment, those coefficients of friction may be within 20%, or, more narrowly, within 10% of each other. In another embodiment the coefficients of friction are substantially equal. In one embodiment, when dry, the co-efficients of friction may be in the range of 0.15 to 0.45, may be in the narrower range of 0.20 to 0.35, and, in one embodiment, may be about 0.30. In one embodiment that coating, or pad, may, when employed in combination with the opposed bearing surface of the sideframe column, result in coefficients of static and dynamic friction at the friction interface that are within 10% of each other. In another embodiment, the coefficients of static and dynamic friction are substantially equal.

Where damper wedges are employed, a generally low friction, or controlled friction pad or coating may also be employed on the sloped surface of the damper that engages the wear plate (if such is employed) of the bolster pocket where there may be a partially sliding, partially rocking dynamic interaction. The coating, or pad, or lining, may be a polymeric element, or an element having a polymeric of composite matrix loaded with suitable friction materials. It may be obtained from a brake or clutch lining manufacturer, or the like. One such firm that may be able to provide such friction materials is Railway Friction Products of 13601 Laurinburg Maxton Ai, Maxton N.C. In one embodiment, the material may be the same as, or similar to, the material employed by the Standard Car Truck Company in the "Barber Twin Guard"™ damper wedge with polymer covers. In one embodiment the material may be that a coating, or pad, may, when employed in combination with the opposed bearing surface of the sideframe column, result in coefficients of static and dynamic friction at the friction interface that are within 10% of each other. In another embodiment, the coefficients may be substantially equal. In another embodiment, the coefficients of static and dynamic friction are substantially equal. The co-efficient of dynamic friction may be in the range of 0.15 to 0.30, and in one embodiment may be about 0.20.

A damper may be provided with a friction specific treatment, whether by coating, pad or lining, on both the friction face and the slope face. In such case the coefficients of friction on the slope face need not be the same, although they may be. In one embodiment it may be that the coefficients of static and dynamic friction on the friction face may be about 0.3, and may be about equal to each other, while the coefficients of static and dynamic friction on the slope face may be about 0.2, and may be about equal to each other. In either case, whether on the vertical bearing face against the sideframe column, or on the sloped face in the bolster pocket, the present inventors consider it to be advantageous to avoid surface pairings that may tend to lead to galling, and tend to consider it advantageous to avoid stick-slip behaviour.

Furthermore, the various embodiments described herein may employ self-steering apparatus in combination with dampers that may tend to exhibit little or no stick-slip. They may employ a "Pennsy Adapter Plus", sometimes referred to simply as a "Pennsy" pad, or other elastomeric pad arrangement for providing self-steering. Alternatively, they may employ a bi-directional rocking apparatus, which may include a rocker having a bearing surface formed on a compound curve of which several examples have been illustrated and described herein.

Further still, the various embodiments described herein may employ a four cornered damper wedge arrangement, with bearing surfaces of a non-stick-slip nature, in combination with a self steering apparatus, and in particular a bi-directional rocking self-steering apparatus, such as a compound curved rocker.

Combinations and Permutations

The present description recites many examples of dampers and bearing adapter arrangements. Not all of the features need be present at one time, and various optional combinations can be made. As such, the features of the embodiments of several of the various figures may be mixed and matched, without departing from the spirit or scope of the invention. For the purpose of avoiding redundant description, it will be understood that the various damper configurations can be used with spring groups of a 2×4, 3×3, 3:2:3, 3×5 or other arrangement. Similarly, several variations of bearing to pedestal seat adapter interface arrangements have been described and illustrated. There are a large number of possible combinations and permutations of damper arrangements and bearing adapter arrangements. In that light, it may be understood that the various features can be combined, without further multiplication of drawings and description.

In the various embodiments of trucks herein, the gibs may be shown mounted to the bolster inboard and outboard of the wear plates on the side frame columns. In the embodiments shown herein, the clearance between the gibs and the side plates is desirably sufficient to permit a motion allowance of at least ¾" of lateral travel of the truck bolster relative to the wheels to either side of neutral, advantageously permits greater than 1 inch of travel to either side of neutral, and may permit travel in the range of about 1 or 1⅛" to about 1⅝ or 1 9/16" inches to either side of neutral.

The inventors presently favour embodiments having a combination of a bi-directional compound curvature rocker surface, a four cornered damper arrangement in which the dampers are provided with friction linings that may tend to exhibit little or no stick-slip behaviour, and may have a slope face with a relatively low friction bearing surface. However, there are many possible combinations and permutations of the features of the examples shown herein. In general it is thought that a self draining geometry may be preferable over one in which a hollow is formed and for which a drain hole may be required.

In each of the trucks shown and described herein, the overall ride quality may depend on the inter-relation of the spring group layout and physical properties, or the damper layout and properties, or both, in combination with the dynamic properties of the bearing adapter to pedestal seat interface assembly. It may be advantageous for the lateral stiffness of the sideframe acting as a pendulum to be less than the lateral stiffness of the spring group in shear. In rail road cars having 110 ton trucks, one embodiment may employ trucks having vertical spring group stiffnesses in the range of 16,000 lbs/inch to 36,000 lbs/inch in combination with an embodiment of bi-directional bearing adapter to pedestal seat interface assemblies as shown and described herein. In another embodiment, the vertical stiffness of the spring group may be less than 12,000 lbs./in per spring group, with a horizontal shear stiffness of less than 6000 lbs./in.

In either case, the sideframe pendulum may have a vertical length measured (when undeflected) from the rolling contact interface at the upper rocker seat to the bottom spring seat of between 12 and 20 inches, perhaps between 14 and 18 inches. The equivalent length $L_{eq}$, may be in the range of 8 to 20 inches, depending on truck size and rocker geometry. Although truck 20 or 22 may be a 70 ton special, a 70 ton, 100 ton, 110 ton, or 125 ton truck, truck 20 or 22 may be a truck size having 33 inch diameter, or 36 or 38 inch diameter wheels.

In the trucks described herein, for their fully laden design condition which may be determined either according to the AAR limit for 70, 100, 110 or 125 ton trucks, or, where a lower intended lading is chosen, then in proportion to the vertical sprung load yielding 2 inches of vertical spring deflection in the spring groups, the equivalent lateral stiffness of the sideframe, being the ratio of force to lateral deflection, measured at the bottom spring seat, may be less than the horizontal shear stiffness of the springs. The equivalent lateral stiffness of the sideframe $k_{sideframe}$ may be less than 6000 lbs./in. and may be between about 3500 and 5500 lbs./in., and perhaps in the range of 3700-4100 lbs./in. For example, in one embodiment a 2×4 spring group has 8 inch diameter springs having a total vertical stiffness of 9600 lbs./in. per spring group and a corresponding lateral shear stiffness $k_{spring\ shear}$ of 4800 lbs./in. The sideframe has a rigidly mounted lower spring seat. It may be used in a truck with 36 inch wheels. In another embodiment, a 3×5 group of 5½ inch diameter springs is used, also having a vertical stiffness of about 9600 lbs./in., in a truck with 36 inch wheels. It is may be that the vertical spring stiffness per spring group lies in the range of less than 30,000 lbs./in., that it may be in the range of less than 20,000 lbs./in and that it may perhaps be in the range of 4,000 to 12000 lbs./in, and may be about 6000 to 10,000 lbs./in. The twisting of the springs may have a stiffness in the range of 750 to 1200 lbs./in. and a vertical shear stiffness in the range of 3500 to 5500 lbs./in. with an overall sideframe stiffness in the range of 2000 to 3500 lbs./in.

In the embodiments of trucks having a fixed bottom spring seat, the truck may have a portion of stiffness, attributable to unequal compression of the springs equivalent to 600 to 1200 lbs./in. of lateral deflection, when the lateral deflection is measured at the bottom of the spring seat on the sideframe. This value may be less than 1000 lbs./in., and may be less than 900 lbs./in. The portion of restoring force attributable to unequal compression of the springs may tend to be greater for a light car as opposed to a fully laden car.

The double damper arrangements shown above can also be varied to include any of the four types of damper installation indicated at page 715 in the 1997 *Car and Locomotive Cyclopedia*, whose information is incorporated herein by reference, with appropriate structural changes for doubled dampers, with each damper being sprung on an individual spring. That is, while inclined surface bolster pockets and inclined wedges seated on the main springs have been shown and described, the friction blocks could be in a horizontal, spring biased installation in a pocket in the bolster itself, and seated on independent springs rather than the main springs. Alternatively, it is possible to mount friction wedges in the sideframes, in either an upward orientation or a downward orientation.

The embodiments of trucks shown and described herein may vary in their suitability for different types of service. Truck performance can vary significantly based on the loading expected, the wheelbase, spring stiffnesses, spring layout, pendulum geometry, damper layout and damper geometry.

Various embodiments of the invention have been described in detail. Since changes in and or additions to the above-described best mode may be made without departing from the nature, spirit or scope of the invention, the invention is not to be limited to those details but only by the appended claims.

We claim:

1. A self-steering railroad car truck having a truck bolster mounted transversely between sideframes, said sideframes having sideframe pedestals mounted upon wheelsets, there being a self-steering apparatus between said sideframes and said wheelsets, said truck bolster having ends, each of said ends of said truck bolster being resiliently mounted to a respective one of said sideframes, said truck having a set of dampers mounted between each said bolster end and its respective sideframe, each set of dampers including at least a first damper and a second damper, the first damper being mounted transversely inboard of the second damper, each damper having a bearing surface mounted to work slidingly against a mating surface at a friction interface in a sliding, substantially stick-slip free relationship when said bolster moves relative to said sideframes, said first damper and said second damper being urged against the mating surface by a first biasing device and a second biasing device respectively, the first biasing device being offset sideways from the second biasing device, said bearing surface of each said damper having a dynamic co-efficient of friction and a static co-efficient of friction when working against said mating surface and said static and dynamic co-efficients of friction of said first damper lie in the range of 0.1 to 0.4.

2. The truck of claim 1 wherein said dynamic and static co-efficients of friction of said first damper have respective magnitudes within 10% of each other.

3. The truck of claim 1 wherein said static and dynamic co-efficients of friction of said first damper are substantially equal.

4. The truck of claim 1 wherein said first damper has an oblique face for seating in a damper pocket of said truck bolster of said truck, when said first damper is installed in said damper pocket said bearing surface is a substantially vertical face, and said respective mating surface is a surface of a mating sideframe column.

5. The truck of claim 1 wherein said static and dynamic co-efficients of friction of said first damper lie in the range 0.2 to 0.35.

6. The truck of claim 1 wherein said static and dynamic co-efficients of friction of said first damper are about 0.27 to 0.33.

7. The truck of claim 1 wherein each of said first and second sets of dampers includes four friction dampers, two thereof being inboard dampers, two thereof being outboard dampers, and all four thereof being independently biased.

8. The truck of claim 5 wherein said static and dynamic co-efficients of friction of said first damper are substantially equal.

9. The truck of claim 1 wherein said dampers each include a friction element mounted thereto, and said bearing surface is a surface of said friction element.

10. The truck of claim 9 wherein said friction element is a composite surface element that includes a polymeric material.

11. The truck of claim 1 wherein said self-steering apparatus includes a rocker.

12. The truck of claim 1 wherein said self-steering apparatus has a force-deflection characteristic varying as a function of vertical load.

13. The truck of claim 1 wherein, in operation, bearing surfaces of said first and second dampers face toward a sideframe column of one of said sideframes and said respective bearing surfaces of said first and second dampers have normal vectors that are substantially parallel.

14. The truck of claim 1 wherein said sideframes have a long axis, said sideframes have sideframe columns, said mating surface is mounted to one of said sideframe columns, and said mating surface is substantially perpendicular to said long axis of said sideframes.

15. The truck of claim 1 wherein said bolster is permitted a range of lateral travel of at least ¾" to either side of neutral relative to said sideframes.

16. The truck of claim 1 wherein said sideframes have a long axis, in operation said bearing surfaces of said first and second dampers both face toward one sideframe column of one of said sideframes, said respective bearing surfaces of said first and second dampers have normal vectors that are substantially parallel to each other and to said long axis, and said bolster is permitted at least ¾" of lateral travel to either side of neutral relative to said sideframes.

17. A self-steering railroad car truck having:

a truck bolster mounted transversely between sideframes, said sideframes having sideframe pedestals mounted upon wheelsets, there being a self-steering apparatus between said sideframes and said wheelsets;

said truck bolster having ends, each of said ends of said truck bolster being resiliently mounted to a respective one of said sideframes;

said truck having a set of dampers mounted between each said bolster end and its respective sideframe, each set of dampers including at least a first damper and a second damper, the first damper being mounted transversely inboard of the second damper;

each damper having a bearing surface mounted to work slidingly against a mating surface at a friction interface in a sliding, substantially stick-slip free relationship when said bolster moves relative to said sideframes, said first damper and said second damper being urged against the mating surface by a first biasing device and a second biasing device respectively, the first biasing device being offset sideways from the second biasing device, said bearing surface of each said damper having a dynamic co-efficient of friction and a static co-efficient of friction when working against said mating surface; and said truck has a bearing adapter to sideframe pedestal interface that includes said self-steering apparatus, and said self-steering apparatus includes a rocker that rocks both lengthwise and sideways, said rocker being operable to permit lateral rocking of said sideframes and to permit self-steering of said truck.

18. The truck of claim 1 wherein said bearing surface is fabricated from a material having a polymeric component.

19. The truck of claim 1 wherein said bolster includes a damper pocket defining a seat for accommodating said first damper; said first damper has an oblique face for seating in said damper pocket of said truck bolster, one of said sideframes has a sideframe column, said sideframe column including said mating wear surface; and said bearing surface is a substantially vertical face for bearing against said sideframe column mating wear surface.

20. The truck of claim 19 wherein said oblique face has a surface treatment for encouraging sliding of said oblique face relative to said damper pocket.

21. The truck of claim 19 wherein said oblique face has a static coefficient of friction and a dynamic co-efficient of friction, and said co-efficients of static and dynamic friction of said oblique face are substantially equal.

22. The truck of claim 19 wherein said oblique face and said bearing surface both have sliding surface elements, and both of said sliding surface elements are made from materials having a polymeric component.

23. The truck of claim 19 wherein said oblique face has a primary angle relative to said bearing surface, and a crosswise secondary angle.

24. The truck of claim 17 wherein said dynamic and static co-efficients of friction of said first damper have respective magnitudes within 10% of each other.

25. The truck of claim 17 wherein said static and dynamic co-efficients of friction of said first damper are substantially equal.

26. The truck of claim 17 wherein said static and dynamic co-efficients of friction of said first damper lie in the range 0.2 to 0.35.

27. The truck of claim 17 wherein said bearing surface is fabricated from a material having a polymeric component.

28. The truck of claim 17 wherein said self-steering apparatus having a force-deflection characteristic varying as a function of vertical load.

29. The truck of claim 17 wherein said bolster includes a damper pocket defining a seat for accommodating said first damper; said first damper has an oblique face for seating in said damper pocket of said truck bolster, said sideframes have sideframe columns, said mating surface is a surface of one of said sideframe columns; and said bearing surface is a substantially vertical face for bearing against said sideframe column mating surface.

30. The truck of claim 29 wherein said oblique face has a surface treatment for encouraging sliding of said oblique face relative to said damper pocket.

31. The truck of claim 29 wherein said oblique face has a static coefficient of friction and a dynamic co-efficient of friction, and said static and dynamic co-efficients of friction of said oblique face are substantially equal.

32. The truck of claim 29 wherein said oblique face and said bearing surface both have sliding surface elements, and both of said sliding surface elements are made from materials having a polymeric component.

33. The truck of claim 29 wherein said oblique face has a primary angle relative to said bearing surface, and a crosswise secondary angle.

34. The truck of claim 29 wherein each of said sets of dampers includes four friction dampers, two thereof being inboard dampers, two thereof being outboard dampers, and all four thereof being independently biased.

35. The truck of claim 17 wherein, in operation, bearing surfaces of said first and second dampers face toward a sideframe column of one of said sideframes and said respective bearing surfaces of said first and second dampers have normal vectors that are substantially parallel.

36. The truck of claim 17 wherein said sideframes each have a long axis, said sideframes have sideframe columns, said mating surface is mounted one of said sideframe columns, and said mating surface is substantially perpendicular to said long axis of said sideframes.

37. The truck of claim 17 wherein said bolster is permitted a range of lateral travel of at least ¾" to either side of neutral relative to said sideframes.

38. The truck of claim 17 wherein said sideframes have a long axis, in operation said bearing surfaces of said first and second dampers face toward a sideframe column of one of said sideframes, said respective bearing surfaces of said first and second dampers have normal vectors that are substantially parallel to each other and to said long axis of said truck, and said bolster is permitted at least ¾" of lateral travel to either side of neutral relative to said sideframes.

39. A self-steering railroad car truck having:

a truck bolster mounted transversely between a pair of first and second sideframes, each of said sideframes having a sideframe window bounded by respective first and second sideframe columns;

said truck bolster having first and second ends, each of said first and second ends of said truck bolster being resiliently mounted in the sideframe window of a respective one of said sideframes, said first and second sideframes are able to yaw relative to said bolster;

said first and second sideframes each having first and second sideframe pedestals;

said first and second sideframe pedestals being mounted upon respective first and second wheelsets, a self-steering apparatus mounted between said sideframe pedestals and said wheelsets;

a first set of friction dampers mounted between said first end of said bolster and said sideframe columns of said first sideframe;

a second set of friction dampers being mounted between said second end of said bolster and said sideframe columns of said second sideframe;

said first set of friction dampers including at least a first friction damper and a second friction damper;

said first and second friction dampers each having a bearing surface mounted to work slidingly against a mating surface when said bolster moves relative to said sideframe columns of said first sideframe;

said first friction damper and said second friction damper being independently urged against the respective mating surface by a first biasing device and a second biasing device respectively, said first biasing device being offset sideways from the second biasing device;

said first friction damper being mounted transversely inboard of said second friction damper whereby yawing motion of said first sideframe relative to said bolster generates a restorative moment couple between said first friction damper and said second friction damper, that moment couple acting to restore said bolster to a squared position relative to said first sideframe;

said bearing surface having a dynamic co-efficient of friction when working against said mating surface;

said bearing surface having a static co-efficient of friction when working against said mating surface;

said bearing surface and said mating surface defining a substantially stick-slip free friction interface therebetween; and said dynamic and static co-efficients of friction of said first friction damper both lie in the range of 0.2 to 0.35.

40. The self-steering railroad car truck of claim 39 wherein said dynamic co-efficient of friction of said bearing surface of said first friction damper against said respective mating surface is substantially the same as said static so-efficient of friction of said bearing surface of said first friction damper against said respective mating surface.

41. The self-steering railroad car truck of claim 39 wherein said dynamic co-efficient of friction of said bearing surface of said first friction damper against said respective mating surface and said static co-efficient of friction of said bearing surface of said first friction damper against said respective mating surface have respective magnitudes within 10% of each other.

42. The self-steering railroad car truck of claim 39 wherein said first and second friction dampers each include a friction element mounted thereto, said bearing surface is a surface of said friction element, and said friction element is a composite surface element that includes a polymeric material.

43. The self-steering railroad car truck of claim 39 wherein said truck bolster has a damper pocket defining a seat in which to accommodate said first friction damper; said first friction damper has an oblique face for seating in said damper pocket of said truck bolster, when said first friction damper is installed in said damper pocket said bearing surface is a substantially vertical face, and said respective mating surface is a surface of a mating one of said sideframe columns.

44. The self-steering railroad car truck of claim 39 wherein said self-steering apparatus includes a rocker.

45. The self-steering railroad car truck of claim 39 wherein said self-steering apparatus has a force-deflection characteristic varying as a function of vertical load.

46. The self-steering railroad car truck of claim 39 wherein each of said first and second sets of friction dampers includes four friction dampers, two thereof being inboard dampers, two thereof being outboard dampers, and all four thereof being independently biased.

47. The truck of claim 39 wherein, in operation, bearing surfaces of said first and second dampers face toward a sideframe column of one of said sideframes and said respective bearing surfaces of said first and second dampers have normal vectors that are substantially parallel.

48. The truck of claim 39 wherein said sideframes have a long axis, said sideframes have sideframe columns, said mating surface is mounted to one of said sideframe columns, and said mating surface is substantially perpendicular to said long axis of said sideframes.

49. The truck of claim 39 wherein said bolster is permitted a range of lateral travel of at least ¾" to either side of neutral relative to said sideframes.

50. The truck of claim 39 wherein said sideframes each have a long axis, in operation said bearing surfaces of said first and second friction dampers both face toward one sideframe column of one of said sideframes, said respective bearing surfaces of said first and second friction dampers have normal vectors that are substantially parallel to each other and to said long axis, and said bolster is permitted at least ¾" of lateral travel to either side of neutral relative to said sideframes.

51. A railroad car truck having a truck bolster mounted transversely between sideframes, said truck bolster having ends, each of said ends of said truck bolster being resiliently mounted to a respective one of said sideframes, said truck having a set of dampers mounted between each said bolster end and its respective sideframe, each set of dampers including at least a first damper and a second damper, the first damper being mounted transversely inboard of the second damper, each damper having a bearing surface mounted to work slidingly against a mating surface at a friction interface in a sliding, substantially stick-slip free relationship when said bolster moves relative to said sideframes, said first damper and said second damper being urged against the mating surface by a first biasing device and a second biasing device respectively, the first biasing device being offset sideways from the second biasing device, said bearing surface of each said damper having a dynamic co-efficient of friction and a static co-efficient of friction when working against said mating surface; said truck includes a bearing adapter to sideframe pedestal interface that includes a self-steering apparatus; and said self-steering apparatus includes a rocker.

52. The truck of claim 51 wherein said dynamic and static co-efficients of friction of said first damper have respective magnitudes within 10% of each other.

53. The truck of claim 51 wherein said static and dynamic co-efficients of friction of said first damper are substantially equal.

54. The truck of claim 51 wherein said static and dynamic co-efficients of friction of said first damper lie in the range 0.2 to 0.35.

55. The truck of claim 51 wherein said bearing surface is fabricated from a material having a polymeric component.

56. The truck of claim 51 wherein said self-steering apparatus having a force-deflection characteristic varying as a function of vertical load.

57. The truck of claim 51 wherein said bolster includes a damper pocket defining a seat for accommodating said first damper; said first damper has an oblique face for seating in said damper pocket of said truck bolster, said sideframes have sideframe columns, said mating surface is a surface of one of said sideframe columns; and said bearing surface is a substantially vertical face for bearing against said sideframe column mating surface.

58. The truck of claim 57 wherein said oblique face has a surface treatment for encouraging sliding of said oblique face relative to said damper pocket.

59. The truck of claim 57 wherein said oblique face has a static coefficient of friction and a dynamic co-efficient of friction, and said static and dynamic co-efficients of friction of said oblique face are substantially equal.

60. The truck of claim 57 wherein said oblique face and said bearing surface both have sliding surface elements, and both of said sliding surface elements are made from materials having a polymeric component.

61. The truck of claim 57 wherein said oblique face has a primary angle relative to said bearing surface, and a crosswise secondary angle.

62. The truck of claim 51 wherein each of said sets of dampers includes four friction dampers, two thereof being inboard dampers, two thereof being outboard dampers, and all four thereof being independently biased.

63. The truck of claim 51 wherein, in operation, bearing surfaces of said first and second dampers face toward a sideframe column of one of said sideframes and said respective bearing surfaces of said first and second dampers have normal vectors that are substantially parallel.

64. The truck of claim 51 wherein said sideframes each have a long axis, said sideframes have sideframe columns, said mating surface is mounted one of said sideframe columns, and said mating surface is substantially perpendicular to said long axis of said sideframes.

65. The truck of claim 51 wherein said bolster is permitted a range of lateral travel of at least ¾" to either side of neutral relative to said sideframes.

66. The truck of claim 51 wherein said sideframes each have a long axis, in operation said bearing surfaces of said first and second dampers both face toward one sideframe column of one of said sideframes, said respective bearing surfaces of said first and second dampers have normal vectors that are substantially parallel to each other and to said long axis, and said bolster is permitted at least ¾" of lateral travel to either side of neutral relative to said sideframes.

* * * * *